US007083908B2

(12) United States Patent
Yamamoto et al.

(10) Patent No.: US 7,083,908 B2
(45) Date of Patent: Aug. 1, 2006

(54) PHOTOTHERMOGRAPHIC MATERIAL

(75) Inventors: Seiichi Yamamoto, Knagawa (JP); Eiichi Okutsu, Kanagawa (JP); Tomoyuki Ohzeki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/412,214

(22) Filed: Apr. 14, 2003

(65) Prior Publication Data

US 2003/0224307 A1 Dec. 4, 2003

(30) Foreign Application Priority Data

| | | |
|---|---|---|
| Apr. 17, 2002 | (JP) | 2002-114743 |
| Aug. 12, 2002 | (JP) | 2002-234786 |
| Aug. 12, 2002 | (JP) | 2002-234787 |
| Sep. 27, 2002 | (JP) | 2002/284293 |
| Nov. 18, 2002 | (JP) | 2002-333718 |
| Nov. 18, 2002 | (JP) | 2002-333719 |

(51) Int. Cl.
*G03C 1/498* (2006.01)
*G03C 1/34* (2006.01)

(52) U.S. Cl. ..... 430/619; 430/264; 430/584; 430/607; 430/611; 430/613

(58) Field of Classification Search ..... 430/619, 430/567, 607, 584, 611, 613, 264
See application file for complete search history.

(56) References Cited

U.S. PATENT DOCUMENTS

| | | | | |
|---|---|---|---|---|
| 4,332,889 | A * | 6/1982 | Siga et al. | 430/583 |
| 5,492,803 | A * | 2/1996 | Landgrebe et al. | 430/619 |
| 5,686,228 | A * | 11/1997 | Murray et al. | 430/350 |
| 5,747,236 | A * | 5/1998 | Farid et al. | 430/583 |
| 5,958,668 | A * | 9/1999 | Matsumoto et al. | 430/619 |
| 5,998,126 | A | 12/1999 | Toya et al. | |
| 6,090,538 | A | 7/2000 | Arai et al. | |
| 6,143,488 | A * | 11/2000 | Uytterhoeven et al. | 430/619 |
| 6,156,491 | A * | 12/2000 | Goto | 430/619 |
| 6,171,767 | B1 * | 1/2001 | Kong et al. | 430/350 |
| 6,174,663 | B1 * | 1/2001 | Kato | 430/619 |
| 6,265,146 | B1 * | 7/2001 | Kashiwagi | 430/584 |
| 6,274,297 | B1 * | 8/2001 | Uytterhoeven et al. | 430/350 |
| 6,413,712 | B1 | 7/2002 | Yoshioka et al. | |
| 6,645,714 | B1 | 11/2003 | Oya et al. | |
| 6,689,554 | B1 * | 2/2004 | Yamada et al. | 430/600 |
| 6,855,488 | B1 * | 2/2005 | Yamada et al. | 430/566 |

FOREIGN PATENT DOCUMENTS

| | | |
|---|---|---|
| EP | 0922995 A1 | 6/1999 |
| JP | 2001-092075 | 4/2001 |

OTHER PUBLICATIONS

U.S. Appl. No. 10/238,611, filed Sep. 11, 2002 entitled "Heat-Developable Photosensitive Material and Heat-Developing Method Using the Same".

* cited by examiner

*Primary Examiner*—Thorl Chea
(74) *Attorney, Agent, or Firm*—Margaret A. Burke; Sheldon J. Moss

(57) ABSTRACT

A photothermographic material including a substrate carrying on one surface thereof an image forming layer containing at least a photosensitive silver halide, a non-photosensitive organic silver salt, a reducing agent for a silver ion, and a binder, wherein the photosensitive silver halide has a silver iodide content of 40 to 100 mol %, and an average particle size of 5 to 80 nm, and the photothermographic material contains a compound of the following general formula (1);

$$Q\text{-}(Y)_n\text{—}C(Z_1)(Z_2)X \qquad \text{General formula (1)}$$

wherein Q represents a heterocycle, Y represents a divalent connecting group, n represents 0 or 1, $Z_1$ and $Z_1$ each represent a halogen atom, and X represents a hydrogen atom or an electron withdrawing group.

11 Claims, No Drawings

PHOTOTHERMOGRAPHIC MATERIAL

BACKGROUND OF THE INVENTION

1. Field of the Invention

The present invention relates to a photothermographic material, particularly to a photothermographic material suitable for medical imaging, industrial photographic imaging, graphic arts and COM.

2. Description of the Related Art

Recently, in the medical imaging field and the graphic arts field, dry photographic process is strongly desired from the standpoints of environmental conservation and space saving. In these fields, digitization has been in progress, and systems are quickly spreading in which image information is taken into a computer and preserved, and when necessary, processed, and output on a photosensitive material by a laser image setter or laser imager at a necessary position using communication, and developed. As the photosensitive material, photosensitive materials which can be recorded by exposure to laser of high intensity of illumination and can form a clear black image having high resolution and sharpness are required. As such digital recording imaging materials, various hard copying systems utilizing pigments and dyes such as inkjet printers, electrophotography and the like are distributed as a general image formation system, however, they are unsatisfactory in image qualities (sharpness, graininess, gradation, tone) determining a diagnosis ability such as in medical imaging, and in recording speed (sensitivity), and have not reached level capable of substituting conventional wet processing silver salt films for medical use.

On the other hand, thermal image formation systems utilizing an organic silver salt are described in U.S. Pat. Nos. 3,152,904, 3,457,075, and D. H. Klosterboer, Thermally Processed Silver Systems (Imaging Processes and Materials, Neblette, 8th edition, Sturge, V. Walworth and A. Shepp, edit, chapter 9, p. 279, 1989).

A photothermographic material is exposed image-wisely, then, heated at high temperature (for example, 80° C. or higher), and gives a black silver image formed by a redox reaction between a silver halide or reducible silver salt (functions as an oxidizer) and a reducing agent. The redox reaction is promoted by the catalytic action of a latent image generated on a silver halide by exposure. As a result, a black silver image is formed on the exposed region. The photothermographic materials are disclosed in a lot of literatures typically including U.S. Pat. No. 2,910,377 and JP-B No. 43-4924.

In the photothermographic materials as described above, polymers having glass transition temperatures in a range lower than the thermal development temperature are used as a binder.

On the other hand, generally used as laser beam are gas lasers ($Ar^+$, He—Ne, He—Cd), YAG laser, dye laser, semiconductor laser and the like. Semiconductor laser and second harmonic generation element and the like can also be used. As mentioned to emitting wavelengt, there are used lasers in wider wavelength range from blue range to infrared range. Of them, infrared semiconductor laser is particularly suitable for designing of a image output system by laser, which is compact and excellent in operability and does not restrict the situation place and used conveniently since economic and stable in light emission is obtained. The photothermographic material is required to have infrared sensitivity for the above-mentioned reason. Various efforts have been conducted for enhancing infrared sensitivity.

However, infrared spectrum sensitization has a problem that it is in general unstable and decomposed during the preservation of the photosensitive material, leading to decrease in sensitivity, and there is an increasing requirement for improvement in preservation stability, together with increased sensitivity.

Recently, blue semiconductor laser has been developed to enable image recording with high precision and consequently, recording density increases and long life and stable output is obtained, therefore, demand for the blue semiconductor laser is expanding and a photothermographic recording material corresponding to this is required.

Since the photothermographic material contains all chemicals necessary for image forming incorporated in the layers, the photothermographic material has a problem of preservability showing "increase in fogging" in which a non-exposed portion is blackened by preservation until use after production of the photothermographic material and a problem of "print out" in which a non-exposed portion is blackened gradually when an image is left under weak light such as room light and the like after photothermographic development.

As a means of improving this print out, incorporation of a halogen precursor compound and of other development termination agents and the like have been suggested, however, in any means, image formation itself is disturbed and sensitivity is lowered, resulting in insufficient effects.

Particularly, in the case of the photothermographic material by an organic solvent application method using polyvinyl butylal as a binder, there is a problem that variation in sensitivity during preservation is larger as compared to that by water application method using a polymer latex. Under such conditions, there is a desired for a technology of increasing sensitivity giving excellent preservation stability particularly when an organic solvent is used as the application solvent.

Thus, the print out and fogging is a very important problem in case of a photothermographic material, and improvement of these problems is always eagerly desired.

An application of silver iodide as a photosensitive silver halide has been tried, however, it has very low sensitivity and practical use thereof has not been take into consideration.

As a means of increasing the sensitivity of a silver iodide photographic emulsion, academic literatures disclose addition of a halogen receptor such as sodium nitrite, pyrogallol, hydroquinone and the like, immersion into an aqueous silver nitrate solution, sulfur sensitization at a pAg of 7.5, and the like.

For example, these are described in P. B. Gilman, Photographic Science and Engineering, 18(5), 475 (1974), W. L. Gardener, Photographic Science and Engineering, 21(6), 325 (1977), T. H. James, Photographic Science and Engineering, 5, 216 (1961), and the like.

However, the sensitization effect of these halogen acceptors is very small and extremely insufficient in a photothermographic material intended by the invention.

In a photothermographic material sensitized to infrared light, sensitivity is tried to be increased by using a heteroaromatic mercapto compound or heteroaromatic disulfide compound as a supersensitizer. When silver iodide is used as a photosensitive silver halide, these compounds have an action of increasing sensitivity, but also have problems that color tone of the image varies and pure black tone is not obtained easily, development is suppressed and a long period development time is necessary for image formation, and the like.

SUMMARY OF THE INVENTION

An object of the present invention is to solve the various problems above mentioned, and to provide a photothermographic material having high sensitivity and excellent preservation stability and excellent in light fastness of images (print out resistance).

1) A first aspect of the invention provides a photothermographic material comprising: a substrate; and an image forming layer disposed on one surface of the substrate, and containing at least a photosensitive silver halide, a non-photosensitive organic silver salt, a reducing agent for a silver ion, and a binder, wherein the photosensitive silver halide has a silver iodide content of 40 to 100 mol %, and an average particle size of 5 to 80 nm, and the photothermographic material contains a compound represented by the following general formula (1);

$$Q\text{-}(Y)_n\text{—}C(Z_1)(Z_2)X \qquad \text{General formula (1)}$$

wherein Q represents a heterocycle, Y represents a divalent connecting group, n represents 0 or 1, $Z_1$ and $Z_1$ each represent a halogen atom, and X represents a hydrogen atom or an electron withdrawing group.

2) A second aspect of the invention provides a photothermographic material comprising: a substrate; and an image forming layer disposed on one surface of the substrate, and containing at least a photosensitive silver halide, a non-photosensitive organic silver salt, a reducing agent for a silver ion, and a binder, wherein the photosensitive silver halide has a silver iodide content of 40 to 100 mol %, and the photothermographic material contains at least one compound selected from the group consisting of compounds represented by the following general formula (T1) and (T2);

General formula (T1)

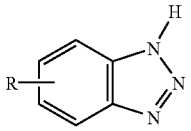

wherein R represents a hydrogen atom, an alkyl group having 1 to 4 carbon atoms, an aryl group, a halogen atom, an amino group, a nitro group, an alkoxycarbonyl group, a substituted or non-substituted carboxyl group or salt thereof, or a sulfonic group or salt thereof, General formula (T2)

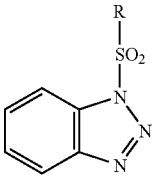

wherein R represents an alkyl or alkenyl group having 20 or less carbon atoms, an aryl, alkaryl, or aralkyl group having 20 or less carbon atoms, an aliphatic or aromatic heterocyclic group containing 6 or less ring atoms, or a carbocyclic group containing 6 or less carbon atoms.

3) A third aspect of the invention provides a photothermographic material comprising: a substrate; and an image forming layer disposed on one surface of the substrate, and containing at least a photosensitive silver halide, a non-photosensitive organic silver salt, a reducing agent for a silver ion, and a binder, wherein the photosensitive silver halide has a silver iodide content of 40 to 100 mol %, and the photothermographic material contains a compound represented by the following general formula (PR);

General formula (PR)

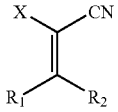

wherein $R_1$ represents a hydroxyl group or a metal salt of a hydroxyl group: $R_2$ represents an alkyl group or an aryl group: and X represents an electron withdrawing group, or $R_2$ and X together form a cycle containing an electron withdrawing group.

DETAILED DESCRIPTION OF THE PRESENT INVENTIONS

The present invention will be described in detail below.

1. Photothermographic Material

The photothermographic material of the invention has an image forming layer having a photosensitive silver halide containing a silver iodide of 40 mol % to 100 mol % and, a non-photosensitive organic silver salt, a reducing agent for a silver ion, and a binder, on at least one surface of a substrate. The image forming layer may be a single layer or may be constituted of a plurality of layers. Further, the image forming layer may carry thereon a surface protective layer, or may carry a back layer, a back protective layer and the like on the opposite surface.

The constitutions and preferable components of these layers will be illustrated in detail below.

1-1. Photosensitive Silver Halide

1) Halogen Composition

It is important that the photosensitive silver halide in the present invention has a silver iodide content of as high as 40 mol % to 100 mol %. Other components are not limited particularly and can be selected from silver chloride and silver bromide and organic silver salts such as silver thiocyanate, silver phosphate and the like, and particularly, silver bromide and silver chloride are preferable. By using such a silver halide having a high silver iodide content, a preferable photothermographic material having excellent image preservability after development treatment, particularly showing remarkably small increase in fogging in irradiation with light can be designed.

Further, it is more preferable that the silver iodide content is 70 mol % to 100 mol %, and it is extremely preferable from the standpoint of image preservability against irradiation with light after treatment particularly when the silver iodide content is 90 mol % to 100 mol %.

The distribution of a halogen composition in a particle may be uniform, or the halogen composition may change in stepweisly or continuously. Further, silver halide particles having a core/shell structure can also be used preferably. Core/shell particles having preferably a 2 to 5-laminar structure, more preferably a 2 to 4-laminar structure, can be used. A high silver iodide core structure having a high silver iodide content in a core portion, or a high silver iodide shell structure having a high silver iodide content in a shell portion, can also be used preferably. Furthermore, there can also be preferably used a technology of localizing silver chloride and silver bromide as an epitaxial part on the surface of a particle.

2) Particle Size

The particle size of silver halide of the high silver iodide used in the invention is particularly important. When the size of a silver halide is large relatively, the application amount of a silver halide necessary for attaining required maximum image density increases and consequently transparency of the film decreases, in general, therefore,.large size of a silver halide is not preferable. The present inventors have found that the silver halide having high silver iodide content of the invention has a specific action that when the greater the application amount thereof is, the larger the development suppressed is and sensitivity lowered is, and it may become unstable against the developing time to obtain uniform image density. It has been found, therefore, that at a certain particle size or more, maximum concentration is not obtained in a given development time, and on the other hand, when the application amount thereof is suppressed to a certain level or less, a sufficient image density is obtained in spite of silver iodide.

Thus, when the high silver iodide is used, it is necessary that the size of a silver halide particle is smaller sufficiently as compared with conventional silver bromide and silver iodide bromide having low iodine content and the application amount of silver iodide is suppressed low, for attaining sufficient maximum optical density. The average particle size of silver halide of high iodide content is preferably 5 nm to 70 nm, more preferably 10 nm to 50 nm. It is particularly preferably 20 nm to 45 nm. The particle size referred to here is observed by an electron microscope, and means the length of ridge of a particle when the particle is a so-called normal crystal in the form of cube or octahedron, and means the average diameter of a converted circle having the same area as the projected area when the particle is not normal crystal, for example, is a spherical particle or rod particle.

3) Application Amount

The application amount of such silver halide particles is 0.1 mol % or more and 15 mol % or less, preferably 0.5 mol % or more and 12 mol % or less per mol of silver of a non-photosensitive organic silver last described later. It is more preferably 1 mol % or more and 9 mol % or less, particularly preferably 1 mol % or more and 7 mol % or less. For preventing remarkable development suppression by the silver halide having high iodide content found by the present inventors, selection of this application amount is extremely important.

4) Particle Formation Method

The method of forming a photosensitive silver halide is well known in the art, and for example, methods described in Research Disclosure No. 170929, June 1978 and U.S. Pat. No. 3,700,458 can be used, and specifically, a method is used in which a photosensitive silver halide is prepared by mixing a silver supplying compound and a halogen supplying compound into a solution of gelatin or other polymers, and then, mixed with an organic silver salt. Further, a method described in JP-A No. 11-119374, paragraph nos. 0217 to 0224 and methods described in JP-A No. 11-352627 and Japanese Patent Application No. 2000-42336 are also preferable.

For example, a so-called halidation method is also preferably used in which a part of an organic silver salt is halogenated with an organic or inorganic halide. As the organic halide used here, any compounds reacting with an organic silver salt to produce a silver halide may be permissible, and there are mentioned N-halogenoimides (N-bromosuccinimide and the like), halogenated quaternary nitrogen compounds (tetrabutylammonium bromide and the like), associated compounds of halogenated quaternary nitrogen salts with halogen molecules (pyridinium perbromide bromide) and the like. As the inorganic halogen compound, any compounds reacting with an organic silver salt to produced a silver halide may be permissible, and there are mentioned halogenated alkali metals or ammonium (sodium chloride, lithium bromide, potassium iodide, ammonium bromide and the like), halogenated alkaline earth metals (calcium bromide, magnesium chloride and the like), halogenated transition metals (ferric chloride, cupric bromide and the like), metal complexes having a halogen ligand (sodium iridiate bromide, ammonium rhodiate chloride and the like), halogen molecules (bromine, chlorine, iodine) and the like. Further, desired organic and inorganic halogenated compounds may also be used together. As the addition amount of a halide in halidation is preferably 1 mmol to 500 mmol, further preferably 10 mmol to 250 mmol in terms of halogen atom per mol of an organic silver salt.

A photosensitive silver halide particle can be de-salted by methods known in the art such as a noodle method, flocculation method and the like, and in the invention, it may not be de-salted.

5) Particle Form

Regarding the form of silver halide particles, listed are cube particles, octahedron particles, tetradecahedron particles, dodecahedron particles, flat plate particles, sphere particles, rod particles, potato particles and the like. Particularly, dodecahedron particles, tetrahedron particles and flat plate particles are preferable.

The silver halide having high silver iodide content of the invention can take a complicated form, and as the preferable form, there are listed, for example, connecting particles as shown in R. L. JENKINS et al., J. of Phot. Sci. Vol. 28 (1980), p 164, FIG. 1. Flat plate particles as shown in FIG. 1 of the same literature can also be preferably used. Particles obtained by rounding corners of silver halide particles can also be preferably used. The surface index (Mirror index) of the outer surface of a photosensitive silver halide particle is not particularly restricted, and it is preferable that the ratio occupied by the [100] surface is rich, because of showing high spectral sensitization efficiency when a spectral sensitizing dye is adsorbed. The ratio is preferably 50% or more, more preferably 65% or more, further preferably 80% or more. The ratio of the [100] surface, Mirror index, can be determined by a method described in T. Tani; J. Imaging Sci., 29, 165 (1985) utilizing adsorption dependency of the [111] surface and [100] surface in adsorption of a sensitizing dye.

6) Heavy Metal

The photosensitive silver halide particle of the invention can contain metals of VIII to X groups in the periodic table of element (showing I to XVIII group) or metal complexes thereof. Rhodium, ruthenium and iridium are preferable as the metals of VIII to X groups in the periodic table of element or the center metal of metal complexes thereof. These metal complexes may be used alone or two or more complexes of the same metal or different metals may be used. The content thereof is preferably in the range from $1\times10^{-9}$ to $1\times10^{-3}$ mol per mol of silver. The heavy metals and metal complexes and methods of adding them are described in JP-A Nos. 7-225449, 11-65021, paragraph nos. 0018 to 0024, 11-119374, paragraph nos. 0227 to 0240.

In the invention, a silver halide particle having a hexacyano metal complex present on the most outer surface of the particle is preferable. As the hexacyano metal complex, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, $[Re(CN)_6]^{3-}$ and the like are listed. In the invention, hexacyano Fe complexes are preferable.

Since the hexacyano metal complex is present in the form of an ion in an aqueous solution, a counter cation is not important, and it is preferable to use alkali metal ions such as a sodium ion, potassium ion, rubidium ion, cesium ion, lithium ion and the like, an ammonium ion, alkyl ammonium ions (for example, tetramethylammonium ion, tetraethylammonium ion, tetrapropylammonium ion, tetra(n-butyl)ammonium ion), which are miscible with water and suitable for a precipitation operation of a silver halide emulsion.

The hexacyano metal complex can be added in admixture with gelatin or a mixed solvent with a suitable organic solvent miscible with water (for example, alcohols, ethers, glycols, ketones, esters, amides and the like), in addition to water.

The addition amount of the hexacyano metal complex is preferably $1\times10^{-5}$ mol or more and $1\times10^{-2}$ mol or less, more preferably $1\times10^{-4}$ mol or more and $1\times10^{-3}$ mol or less per mol of silver.

For allowing a hexacyano metal complex to present on the most outer surface of a silver halide particle, a hexacyano metal complex is added, after completion of addition of an aqueous silver nitrate solution used for particle formation and before completion of charging processes until chemical sensitization processes of conducting calcogen sensitization such as sulfur sensitization, selenium sensitization and tellurium sensitization, or rare metal sensitization such as gold sensitization and the like, during a water washing process, during a dispersion process or at the initiation of the chemical sensitization process. For not allowing a silver halide fine particle to grow, it is preferable to added a hexacyano metal complex quickly after particle formation and before completion of the charging process.

Addition of a hexacyano metal complex may be initiated after addition of 96% by weight of the total amount of silver nitrate added to form particles, and more preferably initiated after addition of 98% by weigh, and particularly preferably after addition of 99% by weight.

If these hexacyano metal complexs are added after addition of an aqueous silver nitrate solution directly before completion of particle formation, they can be adsorbed on the most outer surface of a silver halide particle, and most of them form a poorly soluble salt with a silver ion on the surface of the particle. A silver salt of this hexacyano iron (II) is a salt poorly soluble than AgI, therefore, it can prevent re-dissolution of the particle and is advantageous for production of silver halide fine particles having small particle size.

Further, methods of chemical sensitization and methods of de-salting of silver halide emulsions and metal atoms capable of being contained in the silver halide particle in the invention are described in JP-A Nos. 11-84574, paragraph nos. 0046 to 0050, 11-65021, paragraph nos. 0025 to 0031 and 11-119374, paragraph nos. 0242 to 0250.

7) Gelatin

As the gelatin contained on the photosensitive silver halide emulsion used in the invention, various gelatins can be used. For maintaining an excellent dispersion condition of a photosensitive silver halide emulsion in an organic silver salt-containing application solution, it is preferable to use gelatins having a low molecular weight of 500 to 60000. The gelatins of low molecular weight may be used in particle formation in dispersing after de-salting treatment, and it is preferable to use the gelatin in dispersing after de-salting treatment.

8) Chemical Sensitization

The photosensitive silver halide used in the invention may be not chemically sensitized, however, it is preferable that the photosensitive silver halide is chemically sensitized by at least one method from calcogen sensitization methods, gold sensitization method and reduction sensitization method. As the calcogen sensitization method, a sulfur sensitization method, selenium sensitization method and tellurium sensitization method are listed.

In the sulfur sensitization, an unstable sulfur compound is used, and unstable sulfur compounds described in P. Grafkides, Chimie et Physique, Photographique (published by Pul Momtel, 1987, 5-th edi), Research Disclosure, vol. 307, no. 307105, and the like can be used.

Specifically, known sulfur compounds such as thiosulfates (for example, HYPO), thioureas (for example, diphenylthiourea, triethylthiourea, N-ethyl-N'-(4-methyl-2-thiazolyl)thiourea, carboxymethyltrimethylthiourea), thioamides (for example, thioacetamide), rhodanines (for example, diethyl rhodanine, 5-benzylidene-N-ethyl rhodanine), phosphinesulfides (for example, trimethylphosphinesulfide) thiahydantoins, 4-oxo-oxazolidine-2-thiones, disulfides or polysulfides (for example, dimorpholine disulfide, cystine, renthionine), polythionates, elemental sulfur and the like, and active gelatins and the like can also be used. Particularly, thiosulfates, thioureas and rhodanines are preferable.

In selenium sensitization, an unstable selenium compound is used, and selenium compounds described in JP-B Nos. 43-13489, 44-15748, JP-A Nos. 4-25832, 4-109340, 4-271341, 5-40324, 5-11385, Japanese Patent Application Nos. 4-202415, 4-330495, 4-333030, 5-4203, 5-4204, 5-106977, 5-236538, 5-241642, 5-286916, and the like can be used.

Specifically, colloidal metal selenium, selenoureas (for example, N,N-dimethylselenourea, trifluoromethylcarbonyl-trimethylselenourea, acetyl-trimethylselenourea), selenoamides (for example, selenoamide, N,N-diethylphenylselenoamide), phosphine selenides (for example, triphenylphosphine selenide, pentafluorophenyl-triphenylphosphine selenide), selenophosphates (for example, tri-p-tolylselenophosphate, tri-n-butylselenophosphate), selenoketones (for example, selenobenzophene), isoselenocyanates, selenocarboxylic acids, seleno esters, diacyl selenides and the like may be advantageously used. Further, unstable selenium compounds described in JP-B Nos. 46-4553, 52-34492 and the like, for example, selenious acid, selenocyanates, selenazoles, selenides and the like can also be used. Particularly, phosphineselenides, selenoureas and selenocyanates are preferable.

In tellurium sensitization, an unstable tellurium compound is used, and unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, 7-301880 and the like can be used.

Specifically, phosphine tellurides (for example, butyldiisopropylphosphine telluride, tributylphosphine telluride, tributoxyphosphine telluride, ethoxy-diphenylphosphine telluride), diacyl (di)tellurides (for example, bis(diphenylcarbamoyl) ditelluride, bis(N-phenyl-N-methylcarbamoyl) ditelluride, bis(N-phenyl-N-methylcarbamoyl) telluride, bis(N-phenyl-N-benzylcarbamoyl) telluride, bis(ethoxycarbonyl) telluride, tellurourea (for example, N,N'-dimethylethylenetellurourea, N,N'-diphenylethylenetellurourea), telluroamides, telluro esters and the like may be advantageously used. Particularly, diacyl (di)tellurides and phosphinetellurides are preferable, and particularly, compounds described in JP-A No. 11-65021, paragraph no. 0030, and compounds of the general formulae (II) (III) and (IV) in JP-A No. 5-313284, are more preferable.

Particularly in calcogen sensitization in the invention, selenium sensitization and tellurium sensitization are preferable, and particularly tellurium sensitization is preferable.

In gold sensitization, gold sensitization agents described in P. Grafkides, Chimie et Physique, Photographique (published by Paul Momtel, 1987, vol. 5), Research Disclosure, vol. 307, no. 307195, can be used. Specifically listed are auric chloride, potassium chloro aurate, potassium aurithiocyanate, gold sulfide, gold selenide and the like, and in addition the these compound, gold compounds described in U.S. Pat. Nos. 2,642,361, 5,049,484, 5,049,485, 5,169,751, 5,2524,55, Belgium Patent No. 691857 and the like can also be used. Further, salts of noble metals such as platinum, palladium, iridium and the like other than gold compounds described in P. Grafkides, Chimie et Physique, Photographique (published by Paul Momtel, 1987, vol. 5), Research Disclosure, vol. 307, no. 307195, can be also used.

Though the gold sensitization may be used singly, it is preferable to use the gold sensitization in combination with the above-mentioned calcogen sensitization. Specifically listed are gold sulfur sensitization, gold selenium sensitization, gold tellurium sensitization, gold sulfur selenium sensitization, gold sulfur tellurium sensitization, gold selenium tellurium sensitization, gold sulfur selenium tellurium sensitization.

In the invention, chemical sensitization may be conducted at any period providing it is after particle formation and before application, and the period can be after de-salting, (1) before spectral sensitization, (2) simultaneous with spectral sensitization, (3) after spectral sensitization, (4) directly before application, and the like.

The amount of a calcogen sensitizer used in the invention is from about $10^{-8}$ to $10^{-1}$ mol, preferably from about $10^{-7}$ to $10^{-2}$ mol per mol of a silver halide though it varies depending on the silver halide particle used, chemical aging conditions and the like.

Likewise, the amount of a gold sensitizer used in the invention is from about $10^{-7}$ to $10^{-2}$ mol, more preferably from about $10^{-6}$ to $5\times10^{-3}$ mol per mol of a silver halide, as approximate criteria, though it varies depending on various conditions. Any conditions can be selected as conditions of environments for chemical sensitization of an emulsion, and pAg is 8 or less, preferably 7.0 or less, more preferably 6.5 or less, particularly 6.0 or less, and pAg is 1.5 or more, preferably 2.0 or more, particularly preferably 2.5 or more, and pH is from 3 to 10, preferably from 4 to 9, temperature is from 20 to 95° C., preferably from about 25 to 80° C.

In the invention, a reduction sensitizer can also be used together, in addition to calcogen sensitizers and gold sensitizers.

As the specific compound in a reduction sensitization method, ascorbic acid, thio dioxide urea, dimethylamineborane are preferable, and additionally, it is preferable to use stannous chloride, aminoiminomethanesulfinic acid, hydrazine derivatives, borane compounds, silane compounds, polyamide compounds and the like. Addition of a reduction sensitizer may be conducted at any stages in a photosensitive emulsion production process from crystal growth to preparation process of coating solution directly before application. It is also preferable to effect reduction sensitization by aging while maintaining pH at 8 or more and pAg at 4 or less of the emulsion, and it is also preferable to effect reduction sensitization by introducing a single addition portion of a silver ion during particle formation.

The amount of a reduction sensitizer is from about $10^{-7}$ to $10^{-1}$ mol, more preferably from about $10^{-6}$ to $5\times10^{-2}$ mol per mol of a silver halide, as approximate criteria, though it varies likewise depending on various conditions.

Into the silver halide emulsion in the invention, a thiosulfonic acid compound may be added according to a method shown in EP-A No. 293,917.

The photosensitive silver halide particle in the invention may be not chemically sensitized, however, it is preferable that the photosensitive silver halide particle is chemically sensitized by at least one method from gold sensitization and calcogen sensitization methods from the standpoint of designing a photothermographic material of high sensitivity.

9) Spectral Sensitizing Dye

The photothermographic material of the invention is preferable sensitized by a spectral sensitizing dye. It is preferably sensitized spectrally at 700 nm to 1400 nm. Particularly, the photothermographic material is spectrally sensitized so that the sensitization maximum is present in the near infrared region from 750 nm to 900 nm.

The spectral sensitizing dye which can be used in the photothermographic material in the invention may be any compound providing the spectral sensitization of maximum sensitive wavelength in this range, and particularly, it is preferably at least one spectral sensitizing dye selected from those of the general formulae (3a) to (3d).

Next, the details of spectral sensitizing dyes of the general formulae (3a) to (3d) (hereinafter, also described as infrared photosensitive coloring matter) will be illustrated.

General Formula (3a)

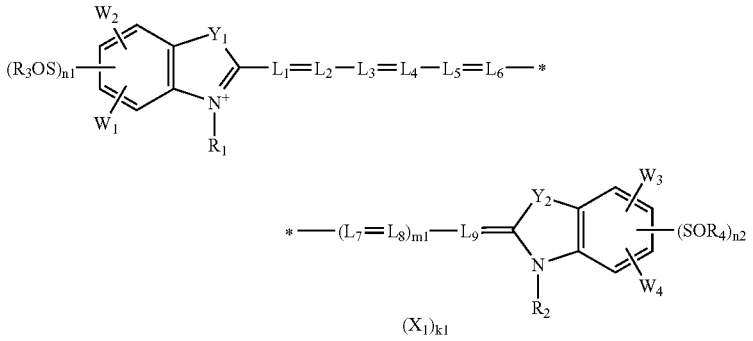

-continued

General formula (3b)

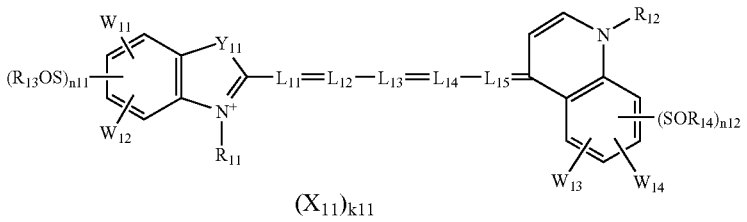

$(X_{11})_{k11}$

General formula (3c)

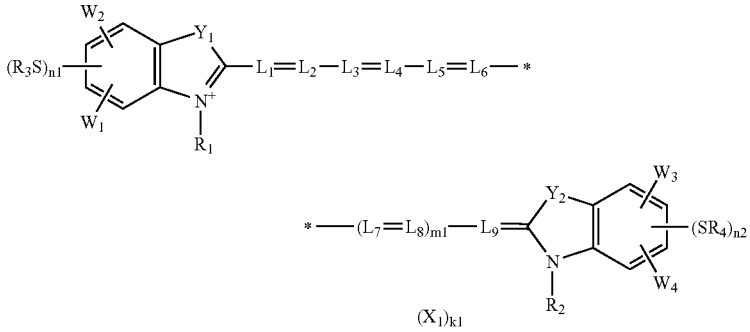

$(X_1)_{k1}$

General formula (3d)

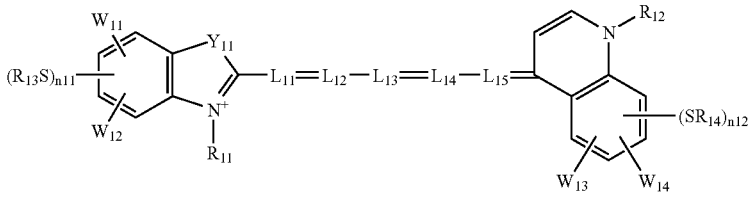

$(X_{11})_{k11}$

In the above-mentioned general formulae (3a) to (3d), listed as the aliphatic groups represented by $R_1$, $R_2$, $R_{11}$ and $R_{12}$ are, for example, branched or linear alkyl groups having 1 to 10 carbon atoms (for example, a methyl group, ethyl group, propyl group, butyl group, pentyl group, iso-pentyl group, 2-ethyl-hexyl group, octyl group, decyl group and the like), alkeyl groups having 3 to 10 carbon atoms (for example, a 2-propenyl group, 3-butenyl group, 1-methyl-3-propenyl group, 3-pentenyl group, 1-methyl-3-butenyl group, 4-hexenyl group and the like), aralkyl groups having 7 to 10 carbon atoms (for example, a benzyl group, phenetyl group and the like). The above-mentioned groups may further substituted by groups such as lower alkyl groups (for example, a methyl group, ethyl group, propyl group and the like), halogen atoms (for example, a fluorine atom, chlorine atom, bromine atom and the like), vinyl groups, aryl groups (for example, a phenyl group, p-tolyl group, p-bromophenyl group and the like), trifluoromethyl group, alkoxy groups (for example, a methoxy group, ethoxy group, methoxyethoxy group and the like), aryloxy groups (for example, a phenoxy group, p-tolyloxy group and the like), cyano group, sulfonyl groups (for example, a methanesulfonyl group, trifluoromethanesulfonyl group, p-toluenesulfonyl group and the like), alkoxycarbonyl groups (for example, an ethoxycarbonyl group, butoxycarbonyl group and the like), amino groups (for example, an amino group, biscarboxymethylamino group and the like), aryl groups (for example, a phenyl group, carboxyphenyl group and the like), heterocyclic groups (for example, a tetrahydrofurfuryl group, 2-pyrrolidinon-1-yl group and the like), acyl groups (for example, an acetyl group, benzoyl group and the like), ureide groups (for example, a ureide group, 3-methylureide group, 3-phenylureide and the like), thioureide groups (for example, a thioureide group, 3-methylthioureide group and the like), alkylthio groups (for example, a methylthio group, ethylthio group and the like), arylthio groups (for example, a 2-thienylthio group, 3-thienylthio group, 2-imidazolylthio group and the like), carbonyloxy groups (for example, an acetyloxy group, propanoyloxy group, benzoyloxy group and the like), acylamino groups (for example, an acetylamino group, benzoylamino group and the like), thioamide groups (for example, a thioacetamide group, thiobenzoylamide group and the like), or hydrophilic groups such as, for example, a sulfo group, carboxyl group, phosphono group, sulfate group, hydroxyl group, mercapto group, sulfino group, carbamoyl groups (for example, a carbamoyl group, N-methylcarbamoyl group, N,N-tetramethylenecarbamoyl group and the like), sulfamoyl groups (for example, a sulfamoyl group, N,N-3-oxapentamethylene aminosulfonyl group and the like), sulfoneamide groups (for example, a methanesulfoneamide group, butanesulfoneamide group and the like), sulfonylaminocarbonyl groups (for example, a methanesulfonylaminocarbonyl group, ethanesulfonylaminocarbonyl group and the like), acylaminosulfonyl groups (for example, an acetoamidesulfonyl group, methoxyacetoamidesulfonyl group and the like), acylaminocarbonyl groups (for example, an acetamidecarbonyl group, methoxyacetamidecarbonyl group and the like), sulfinylaminocarbonyl groups (for example, a methanesulfinylaminocarbonyl group, ethanesulfinylaminocarbonyl group and the like), and the like.

Specific examples of these aliphatic groups carrying a substituted hydrophilic group include carboxymethyl, carboxyethyl, carboxybutyl, carboxypentyl, 3-sulfate butyl, 3-sulfopropyl, 2-hydroxy-3-sulfopropyl group, 4-sulfobutyl, 5-sulfopentyl, 3-sulfopentyl, 3-sulfinobutyl, 3-phosphonopropyl, hydroxyethyl, N-methanesulfonylcarbamoylmethyl, 2-carboxy-2-propenyl, o-sulfobenzyl, p-sulfophenetyl, p-carboxybenzyl and the like.

The lower alkyl group represented by $R_3$, $R_4$, $R_{13}$ and $R_{14}$ is, for example, a linear or branched group having 5 or less carbon atoms, and specific examples thereof include a methyl group, ethyl group, propyl group, butyl group, pentyl group, isopropyl group and the like. As the cycloalkyl group, for example, a cyclopropyl group, cyclobutyl group, cyclopentyl group and the like are listed. As the alkenyl group, for example, 2-propenyl group, 3-butenyl group, 1-methyl-3-propenyl group, 3-pentenyl group, 1-methyl-3-butenyl group, 4-hexenyl group and the like. As the aralkyl group, for example, a benzyl group, phenetyl group, p-methoxyphenylmethyl group, o-acetylaminophenylethyl group and the like are listed, and the aryl group includes substituted or unsubstituted groups, and examples thereof include a phenyl group, 2-naphtyl group, 1-naphthyl group, o-tolyl group, o-methoxyphenyl group, m-chlorophenyl group, m-bromophenyl group, p-tolyl group, p-ethoxyphenyl group and the like, and the heterocyclic group includes substituted and unsubstituted groups, and examples thereof include a 2-furyl group, 5-methyl-2-furyl group, 2-thienyl group, 3-thienyl group, 2-imidazolyl group, 2-methyl-1-imidazolyl group, 4-phenyl-2-thiazolyl group, 5-hydroxy-2-benzothiazolyl group, 2-pyridyl group, 1-pyrrolyl group and the like.

These groups can be substituted by lower alkyl groups (for example, a methyl group, ethyl group and the like), lower alkoxy groups (for example, a methoxy group, ethoxy group and the like), hydroxyl group, halogen atoms (for example, a fluorine atom, chlorine, atom, bromine atom, iodine atom), aryl groups (for example, a phenyl group, tolyl group, chlorophenyl group and the like), mercapto group, lower alkylthio groups (for example, a methylthio group, ethylthio group and the like), and the like.

Specific examples of substituents represented by $W_1$ to $W_4$ and $W_{11}$ to $W_{14}$ include alkyl groups (for example, a methyl group, ethyl group, propyl group, isobutyl group and the like), aryl groups (including monocyclic and polycyclic, for example, a phenyl group, naphthyl group and the like), heterocyclic groups (for example, thienyl, furyl, pyridyl, carbazolyl, pyrrolyl and indolyl groups and the like), halogen atoms (for example, a fluorine atom, chlorine atom, bromine atom and the like), vinyl groups, aryl groups (for example, a phenyl group, p-tolyl group, p-bromophenyl group and the like), trifluoromethyl group, alkoxy groups (for example, a methoxy group, ethoxy group, methoxyethoxy group and the like), aryloxy groups (for example, a phenoxy group, p-tolyloxy group and the like), sulfonyl groups (for example, a methanesulfonyl group, p-toluenesulfonyl group and the like), alkoxycarbonyl groups (for example, an ethoxycarbonyl group, butoxycarbonyl group and the like), amino groups (for example, an amino group, biscarboxymethylamino group and the like), aryl groups (for example, a phenyl group, carboxyphenyl group and the like), heterocyclic groups (for example, a tetrahydrofurfuryl group, 2-pyrrolidinon-1-yl group and the like), acyl groups (for example, an acetyl group, benzoyl group and the like), ureide groups (for example, a ureide group, 3-methylureide group, 3-phenylureide and the like), thioureide groups (for example, a thioureide group, 3-methylthioureide group and the like), alkylthio groups (for example, a methylthio group, ethylthio group and the like), arylthio groups (for example, a phenylthio group and the like), hydroxyl group, styryl group and the like.

On these groups, substitution with groups listed in the explanation of the aliphatic group represented by $R_1$ and the like can be made, and specific examples of the alkyl group substituted include, for example, 2-methoxyethyl, 2-hydroxyethyl, 3-ethoxycarbonylpropyl, 2-carbamoylethyl, 2-methanesulfonylethyl, 3-methanesulfonylaminopropyl, benzyl, phenetyl, carboxymethyl, carboxyethyl, allyl, 2-furyl ethyl and the like, specific examples of the aryl group substituted include, for example, p-carboxyphenyl, p-N,N-dimethylaminophenyl, p-morpholinophenyl, p-methoxyphenyl, 3,4-dimethoxyphenyl, 3,4-methylenedioxyphenyl, 3-chlorophenyl, p-nitrophenyl and the like, and specific examples of the heterocyclic group substituted include, for example, 5-chloro-2-pyridyl, 5-ethoxycarbonyl-2-pyridyl, 5-carbamoyl-2-pyridyl and the like.

As condensed rings which can be formed by mutual connection of $W_1$ and $W_2$, $W_3$ and $W_4$, $W_{11}$ and $W_{12}$, $W_{13}$ and $W_{14}$, $R_3$ and $W_1$, $R_3$ and $W_2$, $R_{13}$ and $W_{11}$, $R_{13}$ and $W_{12}$, $R_4$ and $W_3$, $R_4$ and $W_4$, $R_{14}$ and $W_{13}$, $R_{14}$ and $W_{14}$, for example, 5-membered and 6-membered saturated or unsaturated condensed carbocycles are listed. Substitution can be made on any position of these condensed rings, and as these groups to be substituted, groups explained as the groups which can be substituted on the above-mentioned aliphatic group are listed.

In the above-mentioned general formulae (3a) to (3d), the methine group represented by $L_1$ to $L_9$ and $L_{11}$ to $L_{15}$ shows independently a substituted or unsubstituted methine group. Specific examples of the group substituted include substituted or unsubstituted lower alkyl groups (for example, a methyl group, ethyl group, iso-propyl group, benzyl group and the like), alkoxy groups (for example, a methoxy group, ethoxy group and the like), aryloxy groups (for example, a phenoxy group, naphthoxy group and the like), aryl groups (for example, a phenyl group, naphthyl group, p-tolyl group, o-carboxyphenyl group and the like), —N($V_1$, $V_2$), —SR or heterocyclic groups (for example, a 2-thienyl group, 2-furyl group, N,N'-bis(methoxyethyl) barbituric acid and the like). Here, R represents the lower alkyl group, aryl group or heterocyclic group as described above, and $V_1$ and $V_2$ represent a substituted or unsubstituted lower alkyl group or aryl group, and $V_1$ and $V_2$ can also be mutually connected to form a 5-membered and 6-membered nitrogen-containing heterocycle. Further, the methine groups can be connected with adjacent methine groups or with methine groups apart by one group, to form a 5-membered and 6-membered ring.

In compounds of the above-described general formulae (3a) to (3d), when a group having cation or anion charge is substituted, a counter ion is formed with an anion or cation of equivalent amount so as to offset charge in the molecule. For example, specific examples of the cation in ions necessary for offsetting charge in the molecule represented by $X_1$ and $X_{11}$ include proton, organic ammonium ions (for example, ions of triethylammonium, triethanolammonium and the like), inorganic cations (cations of lithium, sodium, potassium and the like), and specific examples of the acid anion include, for example, halogen ions (for example, a chlorine ion, bromine ion, iodine ion and the like), p-toluenesulfonate ion, perchlorate ion, boron tetrafluoride ion, sulfate ion, methylsulfate ion, ethylsulfate ion, methanesulfonate ion, trifluoromethanesulfonate ion and the like.

Specific examples of spectral sensitizing dyes of the above-mentioned general formulae (3a) to (3d) will be shown below, but the scope of the invention is not limited to them.

No.1
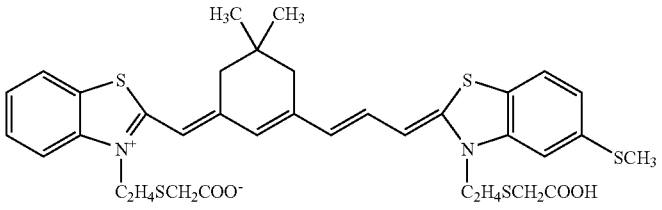
No. 2
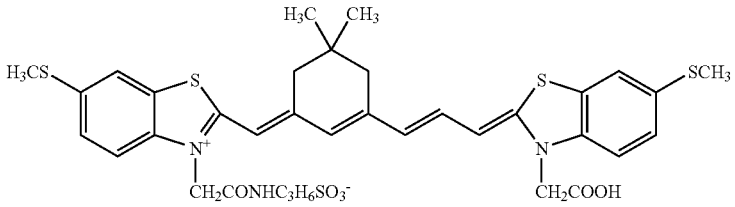
No. 3
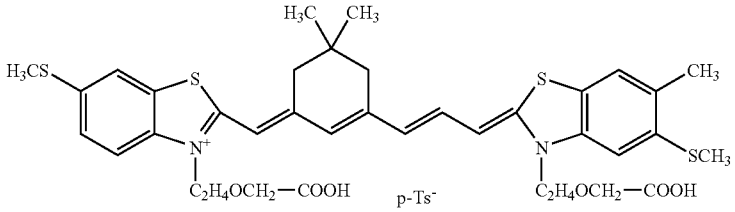
No. 4
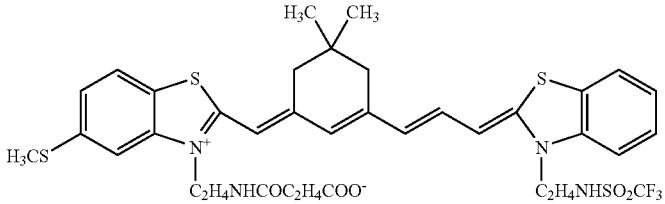
No. 5
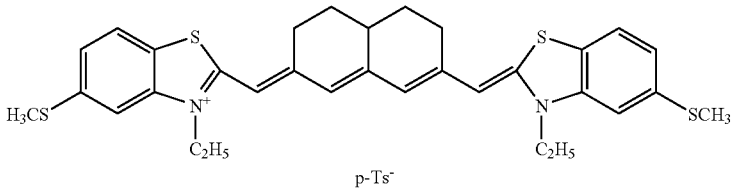
No. 6
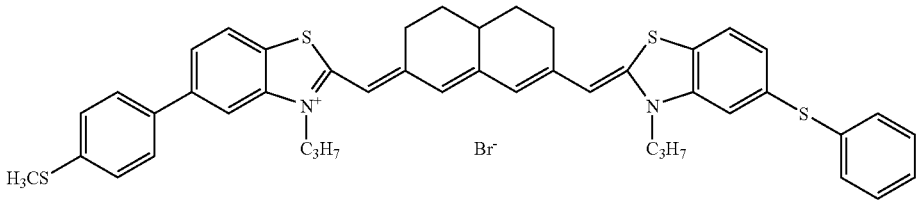
No. 7
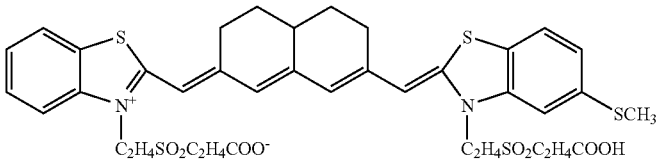
No. 8
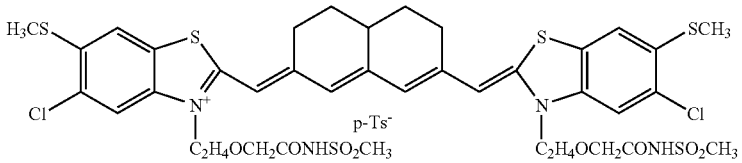

-continued
No. 9
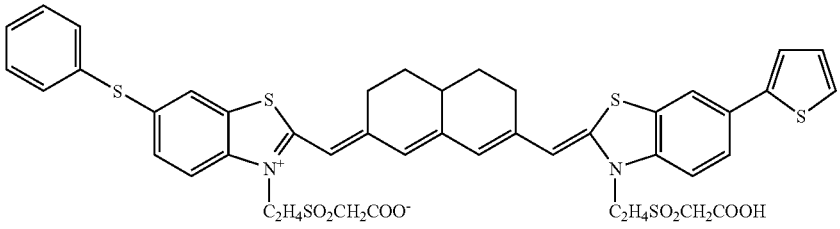
No. 10
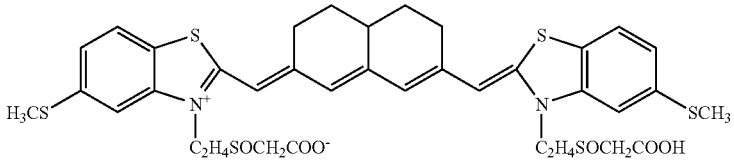
No. 11
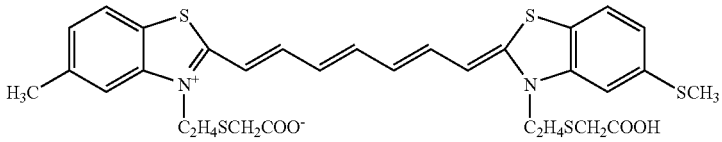
No. 12
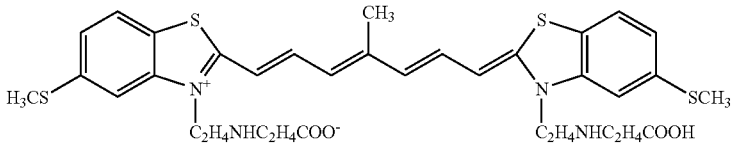
No. 13
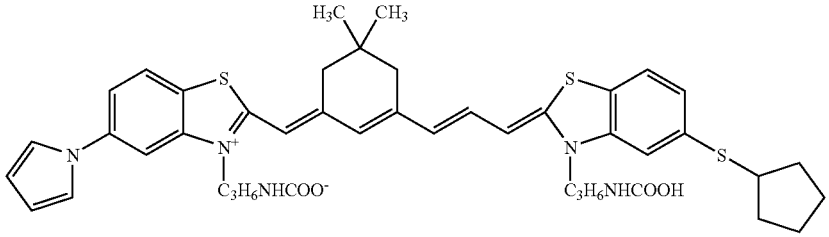
No. 14
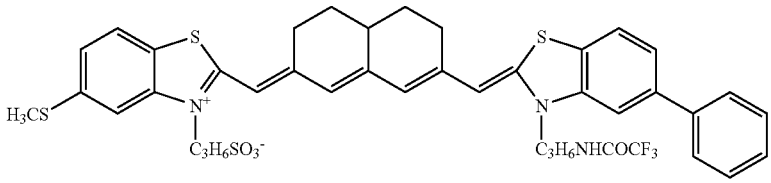
No. 15
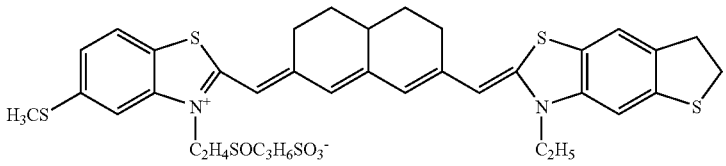
No. 16
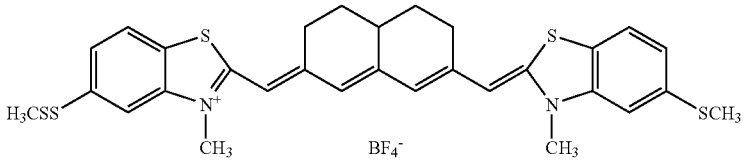

-continued
No. 17
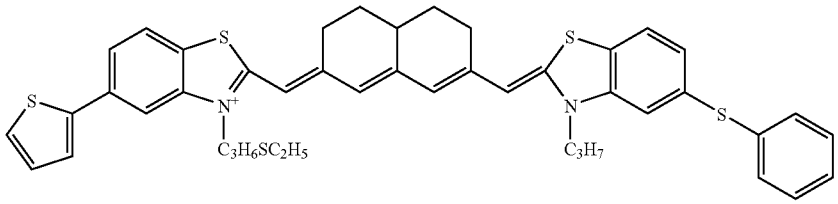
No. 18
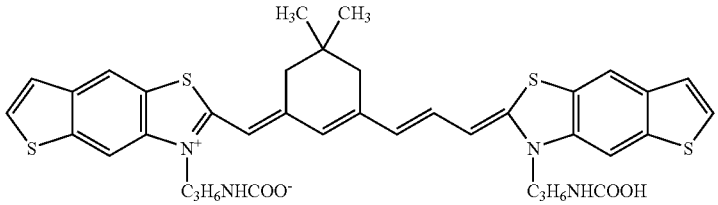
No. 19
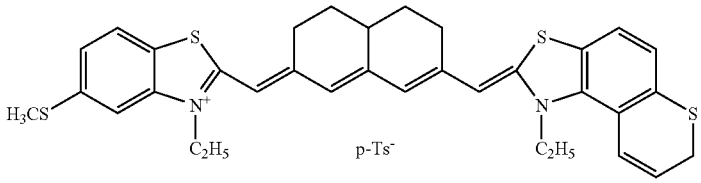
No. 20
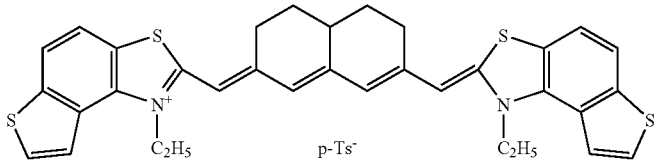
No. 21
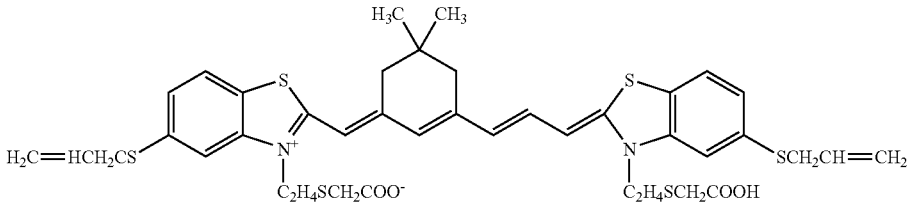
No. 22
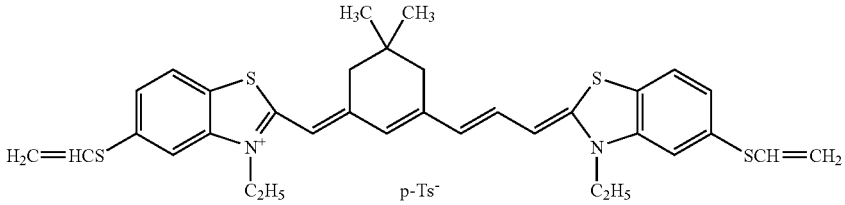
No. 23
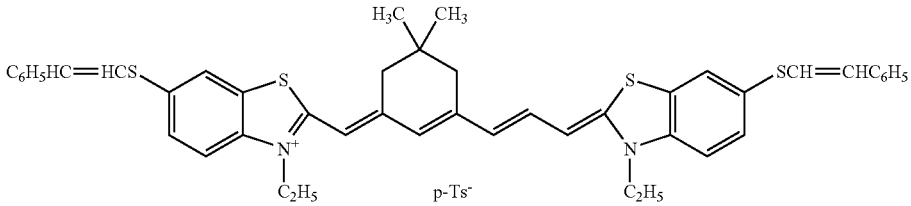

-continued
No. 24
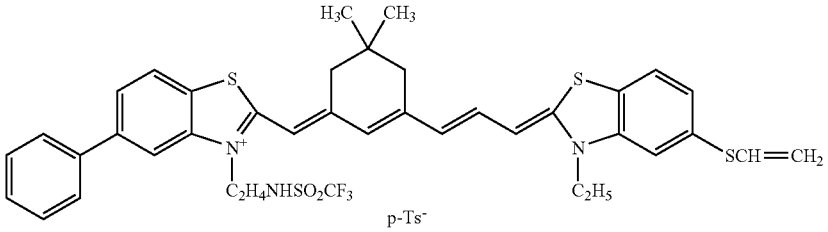
No. 25
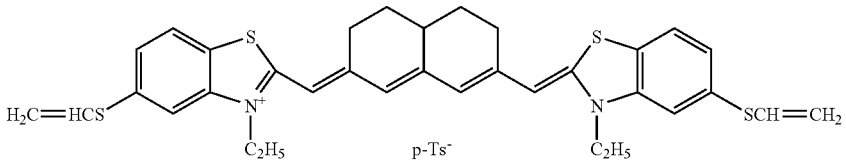
No. 26
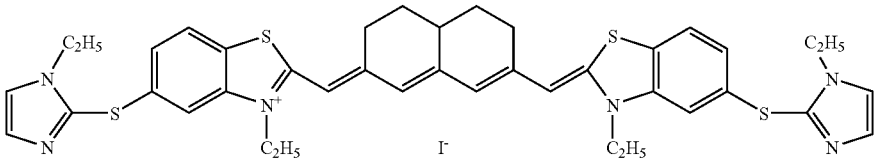
No. 27
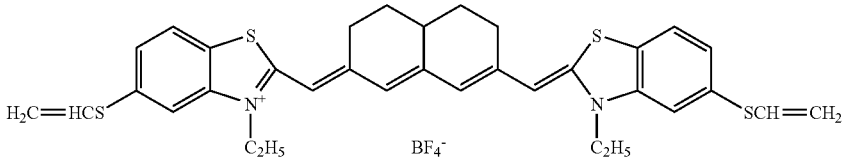
No. 28
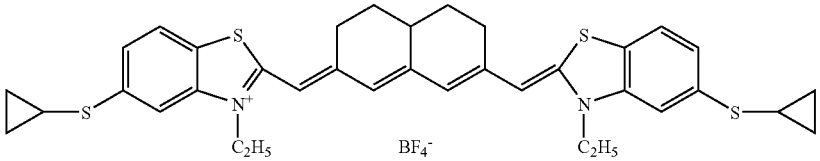
No. 29
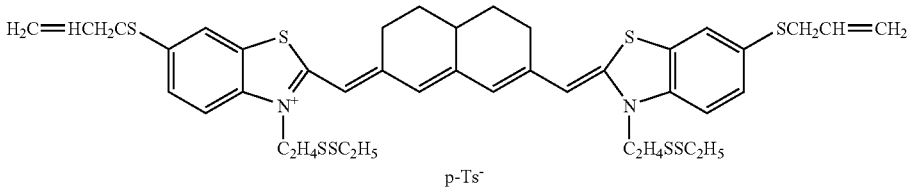
No. 30
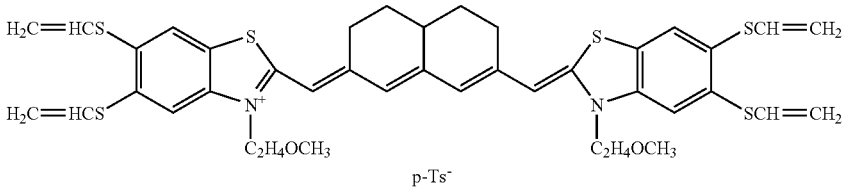
No. 31
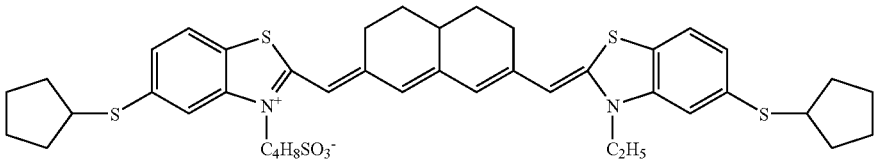

-continued
No. 32
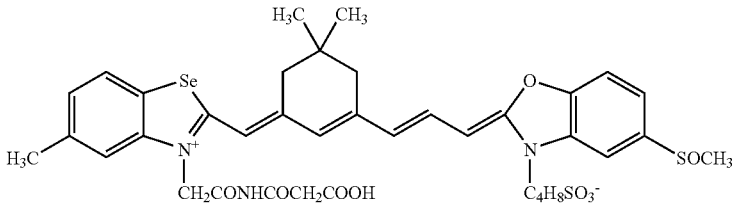
No. 33
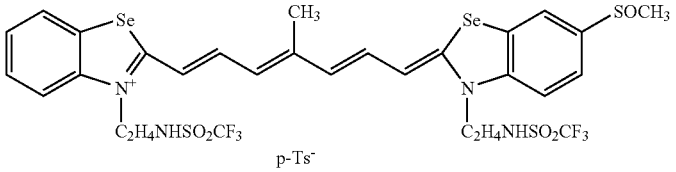
No. 34
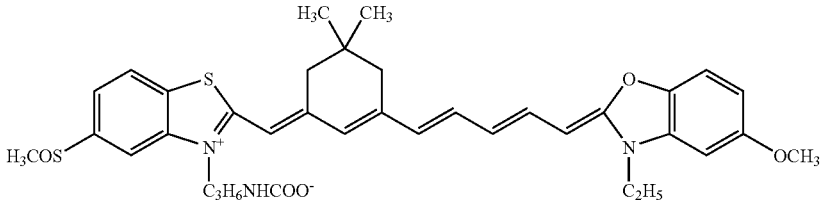
No. 35
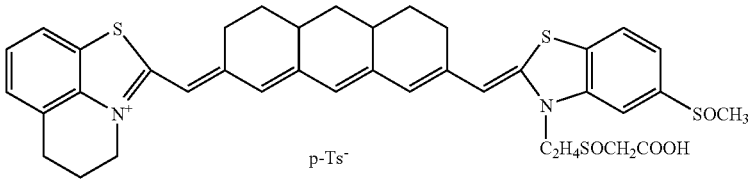
No. 36
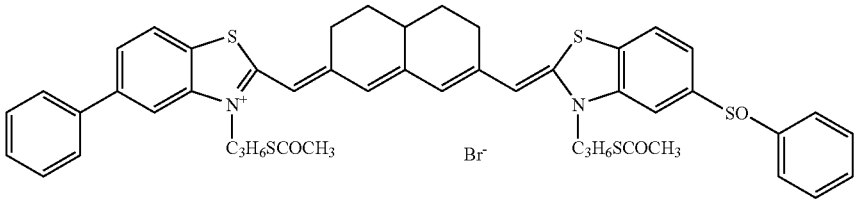
No. 37
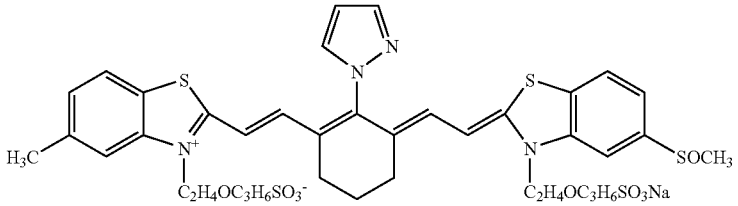
No. 38
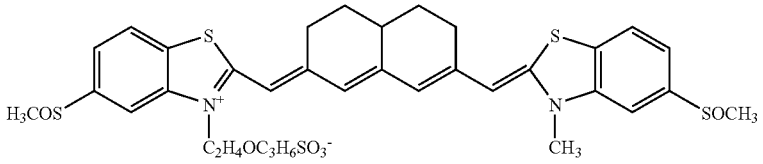
No. 39
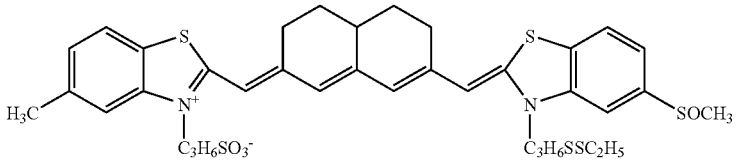

-continued
No. 40
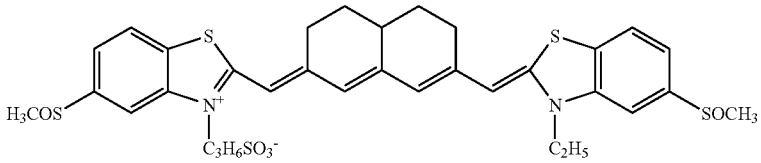
No. 41
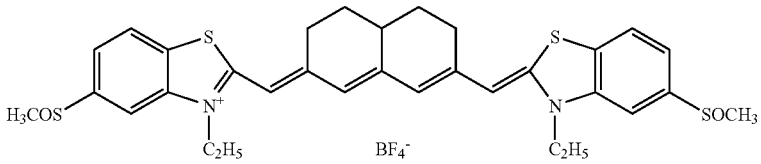
No. 42
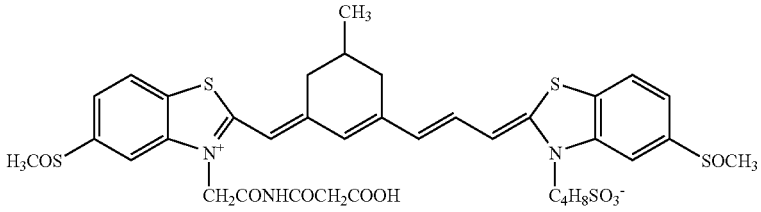
No. 43
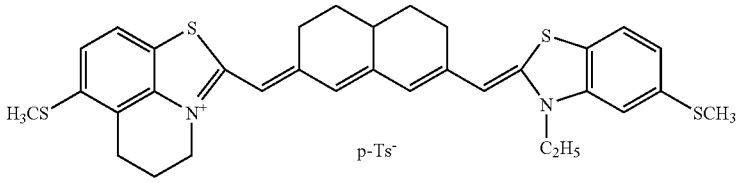
No. 44
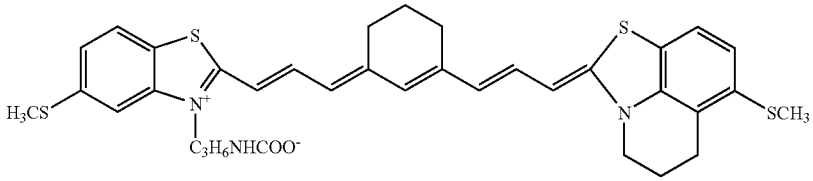
No. 45
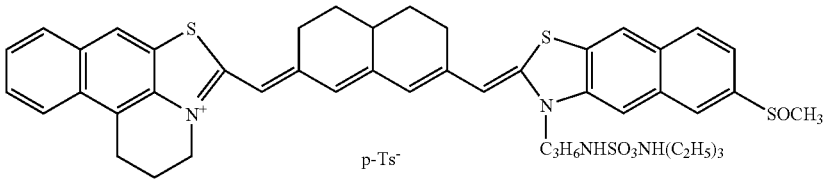
No. 46
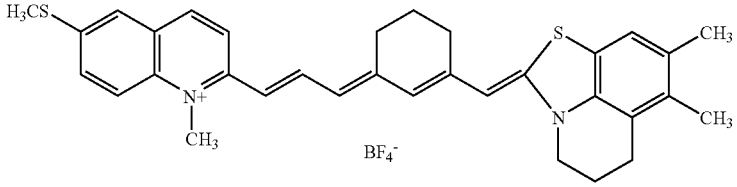
No. 47
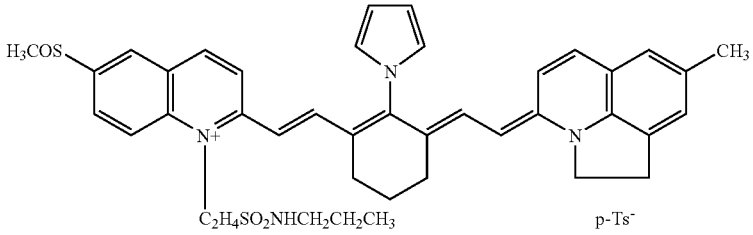

-continued

No. 48

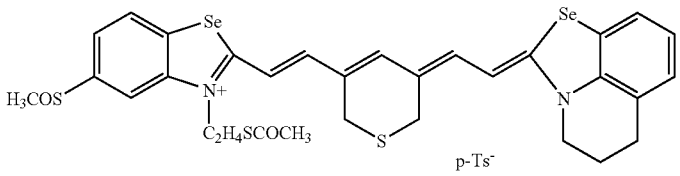

No. 49

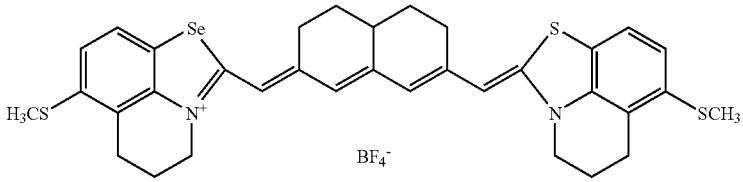

No. 50

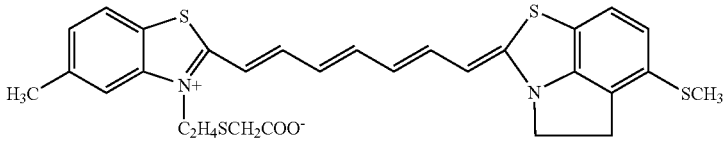

No. 51

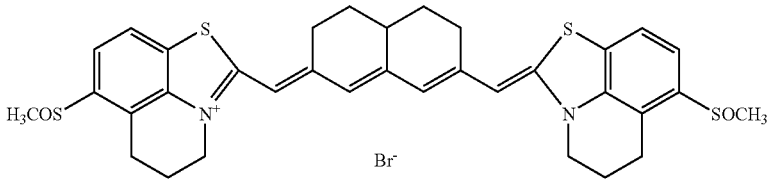

No. 52

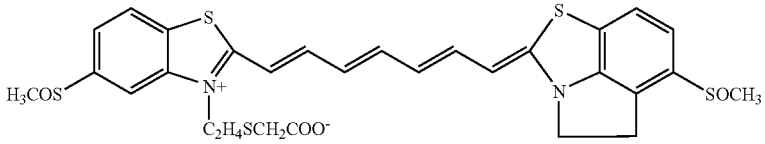

No. 53

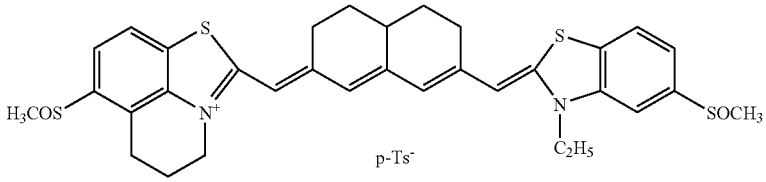

Infrared spectral sensitizing dyes of the general formulae (3a) to (3d) in the invention can be synthesized by methods described, for example, in F. M. Harmer, The Chemistry of Heterocyclic Compounds, vol. 18, The Cyanine Dyes and Related Compounds (A. Weissbergered. Interrscience, Nex York, 1964), JP-A Nos. 3-138638 and 10-73900, JP-W No. 9-510022, U.S. Pat. No. 2,734,900, GBP No. 774779, Japanese Patent Application Nos. 10-269843 and 11-58686.

In the invention, infrared spectral sensitizing dyes of the general formulae (3a) to (3d) may be used singly, however, two or more spectral sensitizing dyes can also be used in combination. When the above-mentioned infrared spectral sensitizing dyes are used singly or in combination, they are contained in a silver halide emulsion at a ratio of $1\times10^{-6}$ mol to $5\times10^{-3}$ mol, preferably of $1\times10^{-5}$ mol to $2.5\times10^{-3}$ mol, further preferably of $4\times10^{-5}$ mol to $1\times10^{-3}$ mol in total per mol of silver halide. In the invention, when spectral sensitizing dyes are used in combination of two or more, the spectral sensitizing dyes can be contained at any ratio in a silver halide emulsion.

Regarding spectral sensitizing dyes and their addition methods, there are descriptions in JP-A No. 11-65021, paragraph nos. 0103 to 0109 and JP-A No. 10-186572, compounds of the general formula (II) and paragraph no. 0106, U.S. Pat. Nos. 5,510,236 and 3,871,887, spectral sensitizing dyes described in Example 5, spectral sensitizing dyes disclosed in JP-A Nos. 2-96131 and 59-48753, and EP-A No. 0803764A1, p. 19, line 38 to p. 20, line 35, Japanese Patent Application Nos. 2000-86865, 2000-102560, 2000-205399, and the like. These spectral sensitizing dyes may be used singly or in combination of two or more. In the invention, the period for addition of a spectral sensitizing dye in a silver halide emulsion is preferably after a de-salting process before application, more preferably after de-salting until completion of chemical aging.

In the invention, a supersensitizer can be used for improving spectral sensitization efficiency. As the supersensitizer in the invention, compounds described in EP-A No. 587,338, U.S. Pat. Nos. 3,877,943 and 4,873,184, JP-A Nos. 5-341432, 11-109547, 10-111543, and the like, are listed.

10) Compound that can be One-electron-oxidized to Provide a One-electron Oxidation Product, Which Releases 1 or More Electrons in or After a Subsequent Reaction The photothermographic material of the invention preferably contains a compound that can be one-electron-oxidized to provide a one-electron oxidation product, which releases 1 or more electrons in or after a subsequent reaction.

As the compound that can be one-electron-oxidized to provide a one-electron oxidation product, which releases 1 or more electrons in or after a subsequent reaction is a compound selected from the following types 1 to 5 (hereinafter, simply described as type 1 to 5 compound).

(Type 1) a compound that can be one-electron-oxidized to provide a one-electron oxidation product which further releases at least two electrons, due to when subjected to a subsequent bond cleavage reaction;

(Type 2) a compound that has at least 2 groups adsorbable to the silver halide and can be one-electron-oxidized to provide a one-electron oxidation product which further releases one electron, due to when subjected to a subsequent bond cleavage reaction;

(Type 3) a compound that can be one-electron-oxidized to provide a one-electron oxidation product, which further releases at least one electron after being subjected to a subsequent bond formation;

(Type 4) a compound that can be one-electron-oxidized to provide a one-electron oxidation product which further releases at least one electron after a subsequent ring cleavage reaction in the molecule; and (Type 5) a compound represented by X—Y, in which X represents a reducing group and Y represents a leaving group, and convertable by one-electron-oxidizing the reducing group to a one-electron oxidation product which can be converted into an X radical by eliminating the leaving group in a subsequent X—Y bond cleavage reaction, one electron being released from the X radical.

Each compound of Types 1 to 5 preferably has a sensitizing dye moiety.

Each compound of Types 1 and 3 to 5 preferably has a group adsorbable to the silver halide.

It is more preferred that the compound has an adsorbable group to the silver halide.

In the compound of Type 1, the term "the bond cleavage reaction" specifically means a cleavage reaction of a bond of carbon-carbon, carbon-silicon, carbon-hydrogen, carbon-boron, carbon-tin or carbon-germanium. Cleavage of a carbon-hydrogen bond may be followed after the cleavage reaction.

The compound of Type 1 can be one-electron-oxidized to be converted into the one-electron oxidation product, and thereafter can release further 2 or more electrons, preferably 3 or more electrons with the bond cleavage reaction. In other words, the compound of Type 1 is such a compound that can be 2 or more-electron-oxidized, preferably 3 or more-electron-oxidized, after the one-electron oxidation.

The compound of Type 1 is preferably represented by any one of general formulae (A), (B), (1), (2) or (3).

General formula (A)

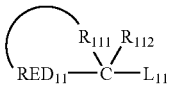

-continued

General formula (B)

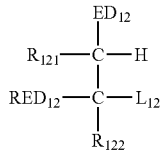

General formula (1)

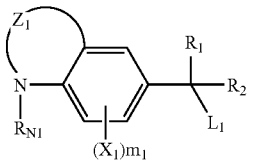

General formula (2)

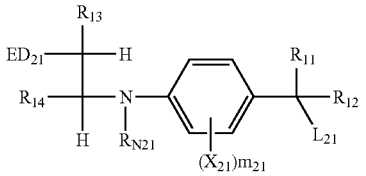

General formula (3)

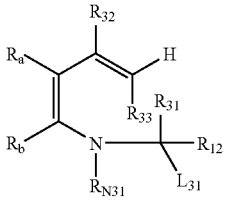

In the general formula (A) $RED_{11}$ represents a reducing group that can be one-electron-oxidized, and $L_{11}$ represents a leaving group.

$R_{112}$ represents a hydrogen atom or a substituent.

$R_{111}$ represents a nonmetallic atomic group forming a particular, 5- or 6-membered ring structure with a carbon atom C and $RED_{11}$.

The particular, 5- or 6-membered ring structure corresponds to a tetrahydro-, hexahydro- or octahydro-derivative of a 5- or 6-membered aromatic ring including aromatic heterocycles.

In the general formula (B), $RED_{12}$ represents a reducing group that can be one-electron-oxidized, and $L_{12}$ represents a leaving group.

$R_{121}$ and $R_{122}$ each represent a hydrogen atom or a substituent. $ED_{12}$ represents an electron-donating group.

In the general formula (B), $R_{121}$ and $RED_{12}$, $R_{121}$ and $R_{122}$, and $ED_{12}$ and $RED_{12}$ may bond together to form a ring structure, respectively.

In the compound represented by the general formula (A) or (B), the reducing group of $RED_{11}$ or $RED_{12}$ is one-electron-oxidized, and thereafter the leaving group of $L_{11}$ or $L_{12}$ is spontaneously eliminated, thus a C (carbon atom)-$L_{11}$ bond or a C (carbon atom)-$L_{12}$ bond is cleaved, in the bond cleavage reaction. Further 2 or more, preferably 3 or more electrons can be released with the bond cleavage reaction.

In the general formula (1), $Z_1$ represents an atomic group forming a 6-membered ring with a nitrogen atom and 2 carbon atoms in a benzene ring; $R_1$, $R_2$ and $R_{N1}$ each represent a hydrogen atom or a substituent; $X_1$ represents a substituent linkable to the benzene ring; $m_1$ represents an integer of 0 to 3; and $L_1$ represents a leaving group.

In the general formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$ represents a substituent linkable to a benzene ring; $m_{21}$ represents an integer of 0 to 3; and $L_{21}$ represents a leaving group.

$R_{N21}$, $R_{13}$, $R_{14}$, $X_{21}$ and $ED_{21}$ may bond to each other to form a ring structure.

In the general formula (3), $R_{32}$, $R_{33}$, $R_{31}$, $R_{N31}$, $R_a$ and $R_b$ each represent a hydrogen atom or a substituent; and $L_{31}$ represents a leaving group.

Incidentally, $R_a$ and $R_b$ bond together to form an aromatic ring when $R_{N31}$ is not an aryl group.

After the compound represented by the general formula (1), (2) or (3) is one-electron-oxidized, the leaving group of $L_1$, $L_{21}$ or $L_{31}$ is spontaneously eliminated, thus a C (carbon atom)-$L_1$ bond, a C (carbon atom)-$L_{21}$ bond or a C (carbon atom)-$L_{31}$ bond is cleaved, in the bond cleavage reaction. Further 2 or more, preferably 3 or more electrons can be released with the bond cleavage reaction.

First, the compound represented by the general formula (A) will be described in detail below.

In the general formula (A), the reducing group of $RED_{11}$ can be one-electron-oxidized and can bond to after-mentioned $R_{111}$ to form the particular ring structure. Specifically, the reducing group may be a divalent group provided by removing 1 hydrogen atom from the following monovalent group at a position suitable for ring formation.

The monovalent group may be an alkylamino group; an arylamino group such as an anilino group and a naphthylamino group; a heterocyclic amino group such as a benzthiazolylamino group and a pyrrolylamino group; an alkylthio group; an arylthio group such as a phenylthio group; a heterocyclic thio group; an alkoxy group; an aryloxy group such as a phenoxy group; a heterocyclic oxy group; an aryl group such as a phenyl group, a naphthyl group and an anthranil group; or an aromatic or nonaromatic heterocyclic group, containing at least one heteroatom selected from the group consisting of a nitrogen atom, a sulfur atom, an oxygen atom and a selenium atom, which has a 5- to 7-membered, monocyclic or condensed ring structure such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring. $RED_{11}$ is hereinafter described as the monovalent group for convenience. The monovalent groups may have a substituent.

Examples of the substituent include halogen atoms; alkyl groups including aralkyl groups, cycloalkyl groups, active methine groups, etc.; alkenyl groups; alkynyl groups; aryl groups; heterocyclic groups, which may bond at any position; heterocyclic groups containing a quaternary nitrogen atom such as a pyridinio group, an imidazolio group, a quinolinio group and an isoquinolinio group; acyl groups; alkoxycarbonyl groups; aryloxycarbonyl groups; carbamoyl groups; a carboxy group and salts thereof; sulfonylcarbamoyl groups; acylcarbamoyl groups; sulfamoylcarbamoyl groups; carbazoyl groups; oxalyl groups; oxamoyl groups; a cyano group; carbonimidoyl groups; thiocarbamoyl groups; a hydroxy group; alkoxy groups, which may contain a plurality of ethyleneoxy groups or propyleneoxy groups as a repetition unit; aryloxy groups; heterocyclic oxy groups; acyloxy groups; alkoxy or aryloxy carbonyloxy groups; carbamoyloxy groups; sulfonyloxy groups; amino groups; alkyl, aryl or heterocyclic amino groups; acylamino groups; sulfoneamide groups; ureide groups; thioureide groups; imide groups; alkoxy or aryloxy carbonylamino groups; sulfamoylamino groups; semicarbazide groups; thiosemicarbazide groups; hydrazino groups; ammonio groups; oxamoylamino groups; alkyl or aryl sulfonylureide groups; acylureide groups; acylsulfamoylamino groups; a nitro group; a mercapto group; alkyl, aryl or heterocyclic thio groups; alkyl or aryl sulfonyl groups; alkyl or aryl sulfinyl groups; a sulfo group and salts thereof; sulfamoyl groups; acylsulfamoyl groups; sulfonylsulfamoyl groups and salts thereof; groups containing a phosphoric amide or phosphate ester structure; etc.

The substituents may be further substituted by the substituent.

In the general formula (A), the leaving group of $L_{11}$ can be eliminated by the bond cleavage after the reducing group of $RED_{11}$ is one-electron-oxidized. Specific examples of the leaving group include a carboxy group and salts thereof, silyl groups, a hydrogen atom, triarylboron anions, trialkylstannyl groups, trialkylgermyl groups and a $—CR_{C1}R_{C2}R_{C3}$ group.

When $L_{11}$ represents a salt of a carboxy group, specific examples of a counter ion to form the salt include alkaline metal ions such as $Li^+$, $Na^+$, $K^+$ and $Cs^+$, alkaline earth metal ions such as $Mg^{2+}$, $Ca^{2+}$ and $Ba^{2+}$, heavy metal ions such as $Ag^+$ and $Fe^{2+/3+}$, ammonium ions, phosphonium ions, etc.

When $L_{11}$ represents a silyl group, the silyl group is specifically a trialkylsilyl group, an aryldialkylsilyl group, a triarylsilyl group, etc. The alkyl group may be a methyl group, an ethyl group, a benzyl group, a t-butyl group, etc. and the aryl group may be a phenyl group, etc. in the silyl group.

When $L_{11}$ represents a triarylboron anion, the aryl group is preferably a phenyl group, which may have a substituent with examples the same as those of the substituent on $RED_{11}$.

When $L_{11}$ represents a trialkylstannyl group or a trialkylgermyl group, each alkyl group thereof has 1 to 24 carbon atom and is normal, branched or cyclic. The alkyl group may have a substituent with examples the same as those of the substituent on $RED_{11}$.

When $L_{11}$ represents a $—CR_{C1}R_{C2}R_{C3}$ group, $R_{C1}$, $R_{C2}$ and $R_{C3}$ independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxy group. $R_{C1}$, $R_{C2}$ and $R_{C3}$ may bond to each other to form a ring structure, and may have a substituent.

Examples of the substituent on $R_{C1}$, $R_{C2}$ and $R_{C3}$ are the same as those of the substituent on $RED_{11}$.

Incidentally, when one of $R_{C1}$, $R_{C2}$ and $R_{C3}$ is a hydrogen atom or an alkyl group, there is no case where the other two of them are a hydrogen atom or an alkyl group.

$R_{C1}$, $R_{C2}$ and $R_{C3}$ are preferably an alkyl group, an aryl group (particularly a phenyl group), an alkylthio group, an arylthio group, an alkylamino group, an arylamino group, a heterocyclic group, an alkoxy group or a hydroxy group, respectively. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, a hydroxy group, etc.

Examples of the ring structure formed by $R_{C1}$, $R_{C2}$ and $R_{C3}$ include a 1,3-dithiolane-2-yl group, a 1,3-dithiane-2-yl group, an N-methyl-1,3-thiazolidine-2-yl group, an N-benzyl-benzothiazolidine-2-yl group, etc.

Preferred examples of the —$CR_{C1}R_{C2}R_{C3}$ group include a trityl group, a tri-(p-hydroxyphenyl)methyl group, a 1,1-diphenyl-1-(p-dimethylaminophenyl)methyl group, a 1,1-diphenyl-1-(methylthio)methyl group, a 1-phenyl-1,1-(dimethylthio)methyl group, a 1,3-dithiolane-2-yl group, a 2-phenyl-1,3-dithiolane-2-yl group, a 1,3-dithiane-2-yl group, a 2-phenyl-1,3-dithiane-2-yl group, a 2-methyl-1,3-dithiane-2-yl group, an N-methyl-1,3-thiazolidine-2-yl group, a 2-methyl-3-methyl-1,3-thiazolidine-2-yl group, an N-benzyl-benzothiazolidine-2-yl group, a 1,1-diphenyl-1-dimethylaminomethyl group, a 1,1-diphenyl-1-morpholinomethyl group, etc.

It is also preferred that the —$CR_{C1}R_{C2}R_{C3}$ group is the same as a residue provided by removing $L_{11}$ from the general formula (A) as a result of selecting each of $R_{C1}$, $R_{C2}$ and $R_{C3}$ as above.

In the general formula (A), $R_{112}$ represents a hydrogen atom or a substituent linkable to a carbon atom. When $R_{112}$ represents a substituent linkable to a carbon atom, examples of the substituent may be the same as those of the substituent on $RED_{11}$.

Incidentally, there is no case where $R_{112}$ represents the same group as $L_{11}$.

In the general formula (A), $R_{111}$ represents a nonmetallic atomic group to form a particular, 5- or 6-membered ring structure with a carbon atom (C) and $RED_{11}$. The particular, 5- or 6-membered ring structure formed by $R_{111}$ corresponds to a tetrahydro-, hexahydro- or octahydro-derivative of a 5- or 6-membered aromatic ring including aromatic heterocycles.

The tetrahydro-, hexahydro- or octahydro-derivative means a ring structure derived by partly hydrogenating carbon-carbon double bonds and/or carbon-nitrogen double bonds of an aromatic ring or an aromatic heterocycle. The tetrahydro-derivative means a ring structure derived by hydrogenating 2 double bonds of carbon-carbon or carbon-nitrogen. The hexahydro-derivative means a ring structure derived by hydrogenating 3 double bonds of carbon-carbon or carbon-nitrogen. The octahydro-derivative means a ring structure derived by hydrogenating 4 double bonds of carbon-carbon or carbon-nitrogen. The aromatic ring is hydrogenated to converted into a partly hydrogenated, nonaromatic ring structure.

Specifically, examples of a 5-membered, monocyclic ring include a pyrrolidine ring, an imidazolidine ring, a thiazolidine ring, a pyrazolidine ring, an oxazolidine ring, etc., corresponding to a tetrahydro-derivative of an aromatic ring of a pyrrole ring, an imidazole ring, a thiazole ring, a pyrazole ring, an oxazole ring, etc.

Examples of a 6-membered, monocyclic ring include a piperidine ring, a tetrahydropyridine ring, a tetrahydropyrimidine ring, a piperazine ring, etc., corresponding to a tetrahydro- or hexahydro-derivative of an aromatic ring of a pyridine ring, a pyridazine ring, a pyrimidine ring, a pyrazine ring, etc.

Examples of a 6-membered, condensed ring include a tetralin ring, a tetrahydroquinoline ring, a tetrahydroisoquinoline ring, a tetrahydroquinazoline ring, a tetrahydroquinoxaline ring, etc., corresponding to a tetrahydro-derivative of an aromatic ring of a naphthalene ring, a quinoline ring, an isoquinoline ring, a quinazoline ring, a quinoxaline ring, etc.

Examples of a tricyclic ring include a tetrahydrocarbazole ring corresponding to a tetrahydro-derivative of a carbazole ring, an octahydrophenanthridine ring corresponding to an octahydro-derivative of a phenanthridine ring, etc.

These ring structures may further have a substituent with examples the same as those of the substituent on $RED_{11}$.

The substituents on the ring structure may bond together to further form a ring, which is a nonaromatic, carbocyclic ring or a heterocycle.

Next, preferred embodiments of the compound represented by the general formula (A) will be described.

In the general formula (A), $L_{11}$ is preferably a carboxy group or a salt thereof, or a hydrogen atom, more preferably a carboxy group or a salt thereof.

A counter ion of the salt is preferably an alkaline metal ion or an ammonium ion, the most preferably an alkaline metal ion, preferably $Li^+$, $Na^+$ or $K^+$ ion.

When $L_{11}$ represents a hydrogen atom, the compound represented by the general formula (A) preferably has a base moiety.

After the compound represented by the general formula (A) is oxidized, the base moiety acts to eliminate the hydrogen atom of $L_{11}$ and to release an electron.

The base is specifically a conjugate base of an acid with a pKa value of approximately 1 to 10. For example, the base moiety may contain a structure of a nitrogen-containing heterocycle such as pyridine, imidazole, benzoimidazole and thiazole; aniline; trialkylamine; an amino group; a carbon acid such as an active methylene anion; a thioacetic acid anion; carboxylate (—$COO^-$); sulfate (—$SO_3^-$); amineoxide (>$N^+(O^-)$—); and derivatives thereof. The base is preferably a conjugate base of an acid with a pKa value of approximately 1 to 8, more preferably carboxylate, sulfate or amineoxide, particularly preferably carboxylate.

When these bases have an anion, the compound of the general formula (A) may have a counter cation. EXAMPLEs of the counter cation include alkaline metal ions, alkaline earth metal ions, heavy metal ions, ammonium ions, phosphonium ions, etc.

The base moiety may be at an optional position of the compound represented by the general formula (A). The base moiety may be connected to $RED_{11}$, $R_{111}$ or $R_{112}$ in the general formula (A), and to a substituent thereon.

When $L_{11}$ represents a hydrogen atom, the hydrogen atom is connected to the base moiety preferably through 8 or less linking atom, more preferably through 5 to 8 linking atoms.

The linking atoms mean atoms connecting the hydrogen atom to a main atom of the base moiety (an atom having an anion or a lone electron pair) by covalent bonds. For example, 2 atoms of —C—$O^-$ in carboxylate and 2 atoms of S—$O^-$ in sulfate are counted as the linking atoms.

Further, the carbon atom represented by C in the general formula (A) is also added to the number of the linking atoms.

In the general formula (A), when $L_{11}$ is a hydrogen atom, $RED_{11}$ is an anilino group or a derivative thereof, and the nitrogen atom of $RED_{11}$ forms a 6-membered monocyclic saturated ring structure with $R_{111}$, such as a piperidine ring, a piperazine ring, a morpholine ring, a thiomorpholine ring and a selenomorpholine ring, it is preferable that the compound of the general formula (A) has an adsorbable group to the silver halide, and it is more preferable that the compound further has a base moiety connected to the hydrogen atom through 8 or less linking atom.

In the general formula (A), $RED_{11}$ is preferably an alkylamino group, an arylamino group, a heterocyclic amino group, an aryl group, or an aromatic or nonaromatic, heterocyclic group. The heterocyclic group is preferably a tetrahydroquinolinyl group, a tetrahydroquinoxalinyl group, a tetrahydroquinazolinyl group, an indolyl group, an indolenyl group, a carbazolyl group, a phenoxadinyl group, a phenothiadinyl group, a benzothiazolinyl group, a pyrrolyl group, an imidazolyl group, a thiazolidinyl group, a benzoimidazolyl group, a benzoimidazolinyl group, a 3,4-methylenedioxyphenyl-1-yl group, etc.

$RED_{11}$ is more preferably an arylamino group, particularly an anilino group, or an aryl group, particularly a phenyl group.

When $RED_{11}$ is an aryl group, it is preferred that the aryl group has at least one electron-donating group. The number of the electron-donating group is preferably 4 or less, more preferably 1 to 3.

The electron-donating group is a hydroxy group; an alkoxy group; a mercapto group; a sulfoneamide group; an acylamino group; an alkylamino group; an arylamino group; a heterocyclic amino group; an active methine group; an electron-excess, aromatic, heterocyclic group such as an indolyl group, a pyrrolyl group, an imidazolyl group, a benzimidazolyl group, a thiazolyl group, a benzthiazolyl group and an indazolyl group; a nitrogen-containing, nonaromatic heterocyclic group that substitutes at the nitrogen atom, such as a pyrrolidinyl group, an indolinyl group, a piperidinyl group, a piperazinyl group and a morpholino group; etc.

The active methine group is a methine group having 2 electron-withdrawing groups, and the electron-withdrawing group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The 2 electron-withdrawing groups may bond together to form a ring structure.

When $RED_{11}$ is an aryl group, a substituent on the aryl group is more preferably an alkylamino group, a hydroxy group, an alkoxy group, a mercapto group, a sulfoneamide group, an active methine group or a nitrogen-containing, nonaromatic heterocyclic group that substitutes at the nitrogen atom, further preferably an alkylamino group, a hydroxy group, an active methine group or a nitrogen-containing, nonaromatic heterocyclic group that substitutes at the nitrogen atom, the most preferably an alkylamino group or a nitrogen-containing, nonaromatic heterocyclic group that substitutes at the nitrogen atom.

In the general formula (A), $R_{112}$ is preferably a hydrogen atom; an alkyl group; an aryl group such as a phenyl group; an alkoxy group such as a methoxy group, an ethoxy group and a benzyloxy group; a hydroxy group; an alkylthio group such as a methylthio group and a butylthio group; an amino group; an alkylamino group; an arylamino group; or a heterocyclic amino group. $R_{112}$ is more preferably a hydrogen atom, an alkyl group, an alkoxy group, a hydroxy group, a phenyl group or an alkylamino group.

In the general formula (A), $R_{111}$ is preferably a nonmetallic atomic group that forms, with a carbon atom (C) and $RED_{11}$, the following particular 5- or 6-membered ring structure: a tetrahydro-derivative of a 5-membered, monocyclic aromatic ring of a pyrrole ring, an imidazole ring, etc., such as a pyrrolidine ring and an imidazolidine ring; a tetrahydro- or hexahydro-derivative of a 6-membered, monocyclic aromatic ring of a pyridine ring, a pyridazine ring, a pyrimidine ring, a pyrazine ring, etc., such as a piperidine ring, a tetrahydropyridine ring, a tetrahydropyrimidine ring and a piperazine ring; a tetrahydro-derivative of a 6-membered, condensed aromatic ring of a naphthalene ring, a quinoline ring, an isoquinoline ring, a quinazoline ring, a quinoxaline ring, etc., such as a tetralin ring, a tetrahydroquinoline ring, a tetrahydroisoquinoline ring, a tetrahydroquinazoline ring and a tetrahydroquinoxaline ring; a tetrahydro-derivative of a tricyclic aromatic ring of a carbazole ring, etc., such as a tetrahydro carbazole ring; an octahydro-derivative of a tricyclic aromatic ring of a phenanthridine ring, etc., such as an octahydro phenanthridine ring; etc.

The ring structure formed by $R_{111}$ is more preferably a pyrrolidine ring, an imidazolidine ring, a piperidine ring, a tetrahydropyridine ring, a tetrahydropyrimidine ring, a piperazine ring, a tetrahydroquinoline ring, a tetrahydroquinazoline ring, a tetrahydroquinoxaline ring or a tetrahydrocarbazole ring, particularly preferably a pyrrolidine ring, a piperidine ring, a piperazine ring, a tetrahydroquinoline ring, a tetrahydroquinazoline ring, a tetrahydroquinoxaline ring or a tetrahydrocarbazole ring, the most preferably a pyrrolidine ring, a piperidine ring or a tetrahydroquinoline ring.

The general formula (B) will be described in detail below.

In the general formula (B), $RED_{12}$ and $L_{12}$ are the same as $RED_{11}$ and $L_{11}$ in the general formula (A) with respect to the meanings and preferred embodiments, respectively.

Incidentally, $RED_{12}$ is a monovalent group except for the case of forming a ring structure mentioned below. Specific examples of $RED_{12}$ are the same as above-mentioned examples of the monovalent group to provide $RED_{11}$.

$R_{121}$ and $R_{122}$ are the same as $R_{112}$ in the general formula (A) with respect to the meanings and preferred embodiments, respectively. $ED_{12}$ represents an electron-donating group.

Each combination of $R_{121}$ and $RED_{12}$, $R_{121}$ and $R_{122}$, and $ED_{12}$ and $RED_{12}$ may bond together to form a ring structure.

In the general formula (B), the electron-donating group represented by $ED_{12}$ is a hydroxy group; an alkoxy group; a mercapto group; an alkylthio group; an arylthio group; a heterocyclic thio group; a sulfoneamide group; an acylamino group; an alkylamino group; an arylamino group; a heterocyclic amino group; an active methine group; an electron-excess, aromatic heterocyclic group such as an indolyl group, a pyrrolyl group and an indazolyl group; a nitrogen-containing, nonaromatic heterocyclic group that substitutes at the nitrogen atom, such as a pyrrolidinyl group, a piperidinyl group, an indolinyl group, a piperazinyl group and a morpholino group; or an aryl group having a substituent composed thereof, such as a p-hydroxyphenyl group, a p-dialkylaminophenyl group, an o,p-dialkoxyphenyl group and a 4-hydroxynaphthyl group.

The active methine group is the same as above-mentioned active methine group that acts as a substituent on $RED_{11}$ when $RED_{11}$ is an aryl group.

$ED_{12}$ is preferably a hydroxy group; an alkoxy group; a mercapto group; a sulfoneamide group; an alkylamino group; an arylamino group; an active methine group; an electron-excess aromatic heterocyclic group; a nitrogen-containing, nonaromatic heterocyclic group that substitutes at the nitrogen atom; or a phenyl group having a substituent composed thereof. More preferred are a hydroxy group; a mercapto group; a sulfoneamide group; an alkylamino group; an arylamino group; an active methine group; a nitrogen-containing, nonaromatic heterocyclic group that substitutes at the nitrogen atom; and a phenyl group having a substituent composed thereof, such as a p-hydroxyphenyl group, a p-dialkylaminophenyl group and an o,p-dialkoxyphenyl group.

In the general formula (B), each combination of $R_{121}$ and $RED_{12}$, $R_{122}$ and $R_{121}$, and $ED_{12}$ or $RED_{12}$ may bond together to form a ring structure.

The ring structure is a 5- to 7-membered, monocyclic or condensed, substituted or unsubstituted, carbocyclic or heterocyclic, nonaromatic ring. Specific examples of a ring structure formed by $R_{121}$ and $RED_{12}$ include a pyrrolidine ring, a pyrroline ring, an imidazolidine ring, an imidazoline ring, a thiazolidine ring, a thiazoline ring, a pyrazolidine ring, a pyrazoline ring, an oxazolidine ring, an oxazoline ring, an indane ring, a piperidine ring, a piperazine ring, a morpholine ring, a tetrahydropyridine ring, a tetrahydropyrimidine ring, an indoline ring, a tetralin ring, a tetrahydroquinoline ring, a tetrahydroisoquinoline ring, a tetrahydroquinoxaline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazine ring, a 2,3-dihydrobenzofuran ring, 2,3-dihydrobenzothiophene ring, etc.

When $ED_{12}$ and $RED_{12}$ form a ring structure, $ED_{12}$ preferably represents an amino group, an alkylamino group or an arylamino group, and specific examples of the ring structure include a tetrahydropyrazine ring, a piperazine ring, a tetrahydroquinoxaline ring, a tetrahydroisoquinoline ring, etc.

Specific examples of the ring structure formed by $R_{122}$ and $R_{121}$ include a cyclohexane ring, a cyclopentane ring, etc.

The compound represented by the general formula (A) is more preferably represented by one of the following general formulae (10) to (12), and the compound represented by the general formula (B) is more preferably represented by one of the following general formulae (13) and (14).

General formula (10)

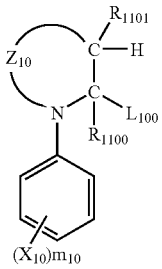

General formula (11)

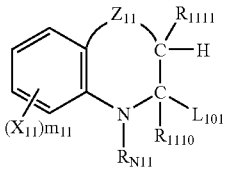

General formula (12)

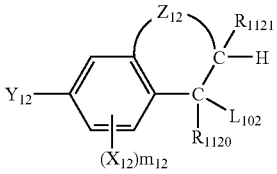

General formula (13)

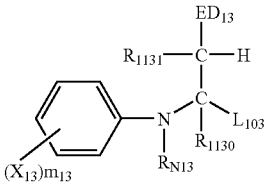

-continued

General formula (14)

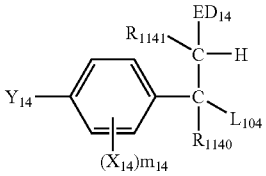

$L_{100}$, $L_{101}$, $L_{102}$, $L_{103}$ and $L_{104}$ in the general formulae (10) to (14) are the same as $L_{11}$ in the general formula (A) with respect to the meanings and preferred embodiments, respectively.

$R_{1100}$ and $R_{1101}$, $R_{1110}$ and $R_{1111}$, $R_{1120}$ and $R_{1121}$, $R_{1130}$ and $R_{1131}$, and $R_{1140}$ and $R_{1141}$ are the same as $R_{122}$ and $R_{121}$ in the general formula (B) with respect to the meanings and preferred embodiments, respectively.

$ED_{13}$ and $ED_{14}$ are the same as $ED_{12}$ in the general formula (B) with respect to the meanings and preferred embodiments, respectively.

$X_{10}$, $X_{11}$, $X_{12}$, $X_{13}$ and $X_{14}$ each represent a substituent connectable to a benzene ring. $m_{10}$, $m_{11}$, $m_{12}$, $m_{13}$ and $m_{14}$ each represent an integer of 0 to 3, and when they are 2 or 3, a plurality of $X_{10}$'s, $X_{11}$'s, $X_{12}$'s, $X_{13}$'s and $X_{14}$'s may be the same or different groups, respectively.

$Y_{12}$ and $Y_{14}$ each represent an amino group; an alkylamino group; an arylamino group; a nitrogen-containing, nonaromatic heterocyclic group that substitutes at the nitrogen atom, such as a pyrrolyl group, a piperidinyl group, an indolinyl group, a piperazino group and a morpholino group; a hydroxy group; or an alkoxy group.

$Z_{10}$, $Z_{11}$ and $Z_{12}$ each represent a nonmetallic atomic group forming a particular ring structure.

The particular ring structure formed by $Z_{10}$ corresponds to a tetrahydro- or hexahydro-derivative of a 5- or 6-membered, monocyclic or condensed, nitrogen-containing, aromatic heterocycle. Specific examples thereof include a pyrrolidine ring, an imidazolidine ring, a thiazolidine ring, a pyrazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring, etc.

The particular ring structure formed by $Z_{11}$ is a tetrahydroquinoline ring or a tetrahydroquinoxaline ring.

The particular ring structure formed by $Z_{12}$ is a tetralin ring, a tetrahydroquinoline ring or a tetrahydroisoquinoline ring.

$R_{N11}$ and $R_{N13}$ each represent a hydrogen atom or a substituent connectable to a nitrogen atom. The substituent is specifically an alkyl group, an alkenyl group, an alkynyl group, an aryl group, a heterocyclic group or an acyl group, preferably an alkyl group or an aryl group.

The substituent connectable to a benzene ring represented by $X_{10}$, $X_{11}$, $X_{12}$, $X_{13}$ and $X_{14}$ has the same examples as the substituent on $RED_{11}$ in the general formula (A).

The substituent is preferably a halogen atom; an alkyl group; an aryl group; a heterocyclic group; an acyl group; an alkoxy carbonyl group; an aryloxycarbonyl group; a carbamoyl group; a cyano group; an alkoxy group, which may contain a plurality of ethyleneoxy groups or propyleneoxy groups as a repetition unit; an alkyl, aryl, or heterocyclic amino group; an acylamino group; a sulfoneamide group; an ureide group; a thiouredide group; an imide group; an alkoxy or aryloxy carbonylamino group; a nitro group; an alkyl, aryl or heterocyclic thio group; an alkyl or aryl sulfonyl group; or a sulfamoyl group.

Each of $m_{10}$, $m_{11}$, $m_{12}$, $m_{13}$ and $m_{14}$ is preferably an integer of 0 to 2, more preferably 0 or 1.

Each of $Y_{12}$ and $Y_{14}$ is preferably an alkylamino group, an arylamino group, a nitrogen-containing nonaromatic heterocyclic group that substitutes at the nitrogen atom, a hydroxy group, or an alkoxy group, more preferably an alkylamino group, a 5 to 6-membered nitrogen-containing nonaromatic heterocyclic group that substitutes at the nitrogen atom, or a hydroxy group, the most preferably an alkylamino group (particularly a dialkylamino group), or a 5 to 6-membered nitrogen-containing nonaromatic heterocyclic group that substitutes at the nitrogen atom.

In the general formula (13), $R_{1131}$ and $X_{13}$, $R_{1131}$ and $R_{N13}$, $R_{1130}$ and $X_{13}$, or $R_{1130}$ and $R_{N13}$ may bond together to form a ring structure, respectively.

In the general formula (14), $R_{1141}$ and $X_{14}$, $R_{1141}$ and $R_{1140}$, $ED_{14}$ and $X_{14}$, or $R_{1140}$ and $X_{14}$ may bond together to form a ring structure, respectively.

The ring structure is a carbocyclic or heterocyclic, 5- to 7-membered, monocyclic or condensed, substituted or unsubstituted, nonaromatic ring structure. In the general formula (13), preferred are the case where $R_{1131}$ and $X_{13}$ bond together to form a ring structure, the case where $R_{1131}$ and $R_{N13}$ bond together to form a ring structure, and the case where no ring structure is formed.

Specific examples of the ring structure formed by $R_{1131}$ and $X_{13}$ in the general formula (13) include an indoline ring (in this case, $R_{1131}$ being a single bond), a tetrahydroquinoline ring, a tetrahydroquinoxaline ring, a 2,3-dihydrobenzo-1,4-oxazine ring, a 2,3-dihydrobenzo-1,4-thiazine ring, etc.

Particularly preferred are an indoline ring, a tetrahydroquinoline ring and a tetrahydroquinoxaline ring.

Specific examples of the ring structure formed by $R_{1131}$ and $R_{N13}$ in the general formula (13) include a pyrrolidine ring, a pyrroline ring, an imidazolidine ring, an imidazoline ring, a thiazolidine ring, a thiazoline ring, a pyrazolidine ring, a pyrazoline ring, an oxazolidine ring, an oxazoline ring, a piperidine ring, a piperadine ring, a morpholine ring, a tetrahydropyridine ring, a tetrahydropyrimidine ring, an indoline ring, a tetrahydroquinoline ring, a tetrahydroisoquinoline ring, a tetrahydroquinoxaline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazine ring, a 2,3-dihydrobenzofuran ring, a 2,3-dihydrobenzothiophene ring, etc.

Particularly preferred are a pyrrolidine ring, a piperidine ring, a tetrahydroquinoline ring and a tetrahydroquinoxaline ring.

In the general formula (14), preferred are the case where $R_{1141}$ and $X_{14}$ bond together to form a ring structure, the case where $ED_{14}$ and $X_{14}$ bond together to form a ring structure, and the case where no ring structure is formed.

Specific examples of the ring structure formed by $R_{1141}$ and $X_{14}$ in the general formula (14) include an indane ring, a tetralin ring, a tetrahydroquinoline ring, a tetrahydroisoquinoline ring, an indoline ring, etc.

Specific examples of the ring structure formed by $ED_{14}$ and $X_{14}$ in the general formula (14) include a tetrahydroisoquinoline ring, a tetrahydrocinnoline ring, etc.

Next, the general formulae (1) to (3) will be described below.

In the general formulae (1) to (3), $R_1$, $R_2$, $R_{11}$, $R_{12}$ and $R_{31}$ independently represent a hydrogen atom or a substituent, and they are the same as $R_{112}$ in the general formula (A) with respect to the meanings and preferred embodiments, respectively.

$L_1$, $L_{21}$ and $L_{31}$ independently represent a leaving group with examples the same as those of $L_{11}$ in the general formula (A).

$X_1$ and $X_{21}$ independently represent a substituent connectable to a benzene ring, with examples the same as those of the substituent on $RED_{11}$ in the general formula (A).

Each of $m_1$ and $m_{21}$ is an integer of 0 to 3, preferably an integer of 0 to 2, more preferably 0 or 1.

$R_{N1}$, $R_{N21}$ and $R_{N31}$ each represent a hydrogen atom or a substituent connectable to a nitrogen atom. The substituent is preferably an alkyl group, an aryl group or a heterocyclic group, and may further have a substituent with examples the same as those of the substituent on $RED_{11}$ in the general formula (A).

Each of $R_{N1}$, $R_{N21}$ and $R_{N31}$ is preferably a hydrogen atom, an alkyl group or an aryl group, more preferably a hydrogen atom or an alkyl group.

$R_{13}$, $R_{14}$, $R_{32}$, $R_{33}$, $R_a$ and $R_b$ independently represent a hydrogen atom or a substituent connectable to a carbon atom, with examples the same as those of the substituent on $RED_{11}$ in the general formula (A).

The substituent is preferably an alkyl group, an aryl group, an acyl group, an alkoxycarbonyl group, a carbamoyl group, a cyano group, an alkoxy group, an acylamino group, a sulfoneamide group, a ureide group, a thiouredide group, an alkylthio group, an arylthio group, an alkylsulfonyl group, an arylsulfonyl group, or a sulfamoyl group.

In the general formula (1), $Z_1$ represents an atomic group forming a 6-membered ring with a nitrogen atom and 2 carbon atoms in a benzene ring.

The 6-membered ring formed by $Z_1$ is a nonaromatic heterocycle condensed with the benzene ring in the general formula (1). The ring structure containing the nonaromatic heterocycle and the benzene ring to be condensed may be specifically a tetrahydroquinoline ring, a tetrahydroquinoxaline ring, or a tetrahydroquinazoline ring, which may have a substituent with examples and preferred embodiments the same as those of the substituent represented by $R_{112}$ in the general formula (A).

In the general formula (1), $Z_1$ is preferably an atomic group that forms a tetrahydroquinoline ring or a tetrahydroquinoxaline ring with a nitrogen atom and 2 carbon atoms in a benzene ring.

In the general formula (2), $ED_{21}$ is an electron-donating group, and the same as $ED_{12}$ in the general formula (B) with respect to the meanings and preferred embodiments.

In the general formula (2), any two of $R_{N21}$, $R_{13}$, $R_{14}$, $X_{21}$ and $ED_{21}$ may bond together to form a ring structure.

The ring structure formed by $R_{N21}$ and $X_{21}$ is preferably a 5- to 7-membered, carbocyclic or heterocyclic, nonaromatic ring structure condensed with a benzene ring, and specific examples thereof include a tetrahydroquinoline ring, a tetrahydroquinoxaline ring, an indoline ring, a 2,3-dihydro-5,6-benzo-1,4-thiazine ring, etc. Preferred are a tetrahydroquinoline ring, a tetrahydroquinoxaline ring and an indoline ring.

When $R_{N31}$ is a group other than an aryl group in the general formula (3), $R_a$ and $R_b$ bond together to form an aromatic ring.

The aromatic ring is an aryl group such as a phenyl group and a naphthyl group, or an aromatic heterocyclic group such as a pyridine ring group, a pyrrole ring group, a quinoline ring group and an indole ring group, preferably an aryl group.

The aromatic ring group may have a substituent, which is the same as the substituent represented by $X_1$ in the general formula (1) with respect to the examples and preferred embodiments.

In the general formula (3), $R_a$ and $R_b$ preferably bond together to form an aromatic ring, particularly a phenyl group.

In the general formula (3), $R_{32}$ is preferably a hydrogen atom, an alkyl group, an aryl group, a hydroxy group, an alkoxy group, a mercapto group or an amino group. When $R_{32}$ is a hydroxy group, $R_{33}$ is preferably an electron-withdrawing group.

The electron-withdrawing group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group, preferably an acyl group, an alkoxycarbonyl group, a carbamoyl group or a cyano group.

The compound of Type 2 will be described below.

The compound of Type 2 can be one-electron-oxidized to provide a one-electron oxidation product. The one-electron oxidation product can release further 1 electron in or after a bond cleavage reaction, in other words, can be further one-electron-oxidized.

The bond cleavage reaction is a cleavage reaction of a bond of carbon-carbon, carbon-silicon, carbon-hydrogen, carbon-boron, carbon-tin or carbon-germanium. Cleavage of a carbon-hydrogen bond may be caused with the cleavage reaction.

The compound of Type 2 has 2 or more, preferably 2 to 6, more preferably 2 to 4, adsorbent groups to the silver halide. The adsorbable group is further preferably a mercapto-substituted, nitrogen-containing, heterocyclic group.

The number of the adsorbent groups is preferably 2 to 6, more preferably 2 to 4. The adsorbable group will hereinafter be described.

The compound of Type 2 is preferably represented by the following general formula (C).

General formula (C)

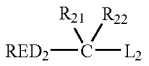

In the compound represented by the general formula (C), the reducing group of $RED_2$ is one-electron-oxidized, and thereafter the leaving group of $L_2$ is spontaneously eliminated, thus a C (carbon atom)-$L_2$ bond is cleaved, in the bond cleavage reaction. Further 1 electron can be released with the bond cleavage reaction.

In the general formula (C), $RED_2$ is the same as $RED_{12}$ in the general formula (B) with respect to the meanings and preferred embodiments.

$L_2$ is the same as $L_{11}$ in the general formula (A) with respect to the meanings and preferred embodiments.

Incidentally, when $L_2$ is a silyl group, the compound of the general formula (C) has 2 or more mercapto-substituted, nitrogen-containing, heterocyclic groups as the adsorbent groups.

$R_{21}$ and $R_{22}$ each represent a hydrogen atom or a substituent, and are the same as $R_{112}$ in the general formula (A) with respect to the meanings and preferred embodiments.

$RED_2$ and $R_{21}$ may bond together to form a ring structure.

The ring structure is a 5- to 7-membered, monocyclic or condensed, carbocyclic or heterocyclic, nonaromatic ring, and may have a substituent.

Incidentally, there is no case where the ring structure corresponds to a tetrahydro-, hexahydro- or octahydro-derivative of an aromatic ring or an aromatic heterocycle.

The substituent has the same examples as above-mentioned substituent on $RED_{11}$ in the general formula (A).

The ring structure is preferably such that corresponds to a dihydro-derivative of an aromatic ring or an aromatic heterocycle, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, a 1,2-dihydroquinoxaline ring, etc.

Preferred are a 2-imidazoline ring, a 2-thiazoline ring, an indoline ring, a benzoimidazoline ring, a benzothiazoline ring, a benzoxazoline ring, a 1,2-dihydro pyridine ring, a 1,2-dihydroquinoline ring, a 1,2-dihydroquinazoline ring and a 1,2-dihydroquinoxaline ring, more preferred are an indoline ring, a benzoimidazoline ring, a benzothiazoline ring and a 1,2-dihydroquinoline ring, particularly preferred is an indoline ring.

The compound of Type 3 will be described below.

The compound of Type 3 can be one-electron-oxidized to provide a one-electron oxidation product, which can release further 1 or more electron after a subsequent bond formation. In the bond formation, a bond of carbon-carbon, carbon-nitrogen, carbon-sulfur, carbon-oxygen, etc. is formed.

It is preferable that the one-electron oxidation product releases 1 or more electron after an intramolecular bond-forming reaction between the one-electron-oxidized portion and a reactive site in the same molecular such as a carbon-carbon double bond, a carbon-carbon triple bond, an aromatic group and a benzo-condensed, nonaromatic heterocyclic group.

Though the one-electron oxidation product derived from the compound of Type 3 by one-electron oxidation is generally a cation radical, it may be converted into a neutral radical by elimination of a proton.

This one-electron oxidation product of the cation radical or the neutral radical is subjected to the intramolecular reaction with the carbon-carbon double bond, the carbon-carbon triple bond, the aromatic group, or the benzo-condensed, nonaromatic heterocyclic group, whereby a bond of carbon-carbon, carbon-nitrogen, carbon-sulfur, carbon-oxygen, etc. is formed to provide another ring structure.

In the compound of Type 3, further 1 or more electron is released at the same time as or after the intramolecular reaction.

In more detail, the compound of Type 3 is one-electron-oxidized, then subjected to the bond formation to provide the radical having the ring structure, and oxidized such that further 1 electron is released directly from the radical or with elimination of a proton.

Thus-provided 2-electron oxidation product may be subjected to hyfrolysis reaction, or tautomerization reaction with proton shift, and then may be further oxidized and release further 1 or more, generally 2 or more electrons directly.

The 2-electron oxidation product may be further oxidized such that further 1 or more, generally 2 or more electrons is released directly therefrom without the tautomerization reaction.

The compound of Type 3 is preferably represented by the following general formula (D).

$$RED_3—L_3—Y_3 \qquad \text{Formula (D)}$$

In the general formula (D), $RED_3$ represents a reducing group that can be one-electron-oxidized, and $Y_3$ represents a reactive group that reacts with the one-electron-oxidized $RED_3$, specifically an organic group containing a carbon-carbon double bond, a carbon-carbon triple bond, an aromatic group or a benzo-condensed, nonaromatic heterocyclic group.

$L_3$ represents a linking group that connects $RED_3$ and $Y_3$.

In the general formula (D), $RED_3$ has the same meanings as $RED_{12}$ in the general formula (B).

In the general formula (D), $RED_3$ is preferably an arylamino group, a heterocyclic amino group, an aryloxy group, an arylthio group, an aryl group, or an aromatic or nonaromatic heterocyclic group that is preferably a nitrogen-containing heterocyclic group. $RED_3$ is more preferably an arylamino group, a heterocyclic amino group, an aryl group, or an aromatic or nonaromatic heterocyclic group. Preferred as the heterocyclic group are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzoimidazole ring group, a benzoimidazoline ring group, a benzothiazoline ring group, a 3,4-methylenedioxyphenyl-1-yl group, etc.

Particularly preferred as $RED_3$ are an arylamino group (particularly an anilino group), an aryl group (particularly a phenyl group), and an aromatic or nonaromatic heterocyclic group.

The aryl group represented by $RED_3$ preferably has at least one electron-donating group.

The electron-donating group is a hydroxy group; an alkoxy group; a mercapto group; an alkylthio group; a sulfoneamide group; an acylamino group; an alkylamino group; an arylamino group; a heterocyclic amino group; an active methine group; an electron-excess, aromatic heterocyclic group such as an indolyl group, a pyrrolyl group and an indazolyl group; a nitrogen-containing, nonaromatic heterocyclic group that substitutes at the nitrogen atom such as a pyrrolidinyl group, an indolinyl group, a piperidinyl group, a piperazinyl group, a morpholino group and a thiomorpholino group; etc.

The active methine group is a methine group having 2 electron-withdrawing groups, and the electron-withdrawing group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The 2 electron-withdrawing groups may bond together to form a ring structure.

When $RED_3$ is an aryl group, more preferred as a substituent on the aryl group are an alkylamino group, a hydroxy group, an alkoxy group, a mercapto group, a sulfoneamide group, an active methine group, and a nitrogen-containing, nonaromatic heterocyclic group that substitutes at the nitrogen atom, furthermore preferred are an alkylamino group, a hydroxy group, an active methine group, and a nitrogen-containing, nonaromatic heterocyclic group that substitutes at the nitrogen atom, and the most preferred are an alkylamino group, and a nitrogen-containing, nonaromatic heterocyclic group that substitutes at the nitrogen atom.

When the reactive group represented by $Y_3$ in the general formula (D) is an organic group containing a carbon-carbon double bond or a carbon-carbon triple bond having a substituent, preferred as the substituent are an alkyl group preferably having 1 to 8 carbon atom; an aryl group preferably having 6 to 12 carbon atoms; an alkoxycarbonyl group preferably having 2 to 8 carbon atoms; a carbamoyl group; an acyl group; an electron-donating group; etc.

The electron-donating group is an alkoxy group preferably having 1 to 8 carbon atom; a hydroxy group; an amino group; an alkylamino group preferably having 1 to 8 carbon atom; an arylamino group preferably having 6 to 12 carbon atoms; a heterocyclic amino group preferably having 2 to 6 carbon atoms; a sulfoneamide group; an acylamino group; an active methine group; a mercapto group; an alkylthio group preferably having 1 to 8 carbon atom; an arylthio group preferably having 6 to 12 carbon atoms; or an aryl group having a substituent composed thereof, in which the aryl moiety preferably has 6 to 12 carbon atoms.

The hydroxy group may be protected by a silyl group, and examples of the silyl-protected group include a trimethylsilyloxy group, a t-butyldimethylsilyloxy group, a triphenylsilyloxy group, a triethylsilyloxy group, a phenyldimethylsilyloxy group, etc. EXAMPLEs of the group containing carbon-carbon double bond or carbon-carbon triple bond include a vinyl group, an ethynyl group, etc.

When $Y_3$ is an organic group containing carbon-carbon double bond having a substituent, more preferred as the substituent are an alkyl group, a phenyl group, an acyl group, a cyano group, an alkoxycarbonyl group, a carbamoyl group and an electron-donating group. The electron-donating group is preferably an alkoxy group; a hydroxy group that may be protected by a silyl group; an amino group; an alkylamino group; an arylamino group; a sulfoneamide group; an active methine group; a mercapto group; an alkylthio group; or a phenyl group having the electron-donating group as a substituent.

Incidentally, when the organic group containing the carbon-carbon double bond has a hydroxy group as a substituent, $Y_3$ contains a moiety of $>C_1{=}C_2(—OH)—$, which may be tautomerized into a moiety of $>C_1H—C_2({=}O)—$.

In this case, it is preferred that a substituent on the $C_1$ carbon is an electron-withdrawing group, and as a result, $Y_3$ has a moiety of an active methylene group or an active methine group.

The electron-withdrawing group, which can provide such a moiety of an active methylene group or an active methine group, may be the same as above-mentioned electron-withdrawing group on the methine group of the active methine group.

When $Y_3$ is an organic group containing a carbon-carbon triple bond having a substituent, preferred as the substituent are an alkyl group, a phenyl group, an alkoxycarbonyl group, a carbamoyl group, an electron-donating group, etc. The electron-donating group is preferably an alkoxy group, an amino group, an alkylamino group, an arylamino group, a heterocyclic amino group, a sulfoneamide group, an acylamino group, an active methine group, a mercapto group, an alkylthio group, or a phenyl group having the electron-donating group as a substituent.

When $Y_3$ is an organic group containing an aromatic group, preferred as the aromatic group are an aryl group, particularly a phenyl group, having an electron-donating group as a substituent, and an indole ring group. The electron-donating group is preferably a hydroxy group, which may be protected by a silyl group; an alkoxy group; an amino group; an alkylamino group; an active methine group; a sulfoneamide group; or a mercapto group.

When $Y_3$ is an organic group containing a benzo-condensed, nonaromatic heterocyclic group, preferred as the benzo-condensed, nonaromatic heterocyclic group are groups having an aniline moiety, such as an indoline ring group, a 1,2,3,4-tetrahydroquinoline ring group, a 1,2,3,4-tetrahydroquinoxaline ring group and a 4-quinolone ring group.

In the general formula (D), the reactive group of $Y_3$ is more preferably an organic group containing a carbon-carbon double bond, an aromatic group, or a benzo-condensed, nonaromatic heterocyclic group.

Furthermore preferred are an organic group containing a carbon-carbon double bond; a phenyl group having an electron-donating group as a substituent; an indole ring group; and a benzo-condensed, nonaromatic heterocyclic group having an aniline moiety.

The carbon-carbon double bond more preferably has at least one electron-donating group as a substituent.

It is also preferred that the reactive group represented by $Y_3$ in the general formula (D) contains a moiety the same as the reducing group represented by $RED_3$ as a result of selecting the reactive group as above.

In the general formula (D), $L_3$ represents a linking group that connects $RED_3$ and $Y_3$, specifically a single bond, an alkylene group, an arylene group, a heterocyclic group, —O—, —S—, —$NR_N$—, —C(═O)—, —$SO_2$—, —SO—, —P(═O)—, or a combination thereof.

$R_N$ represents a hydrogen atom, an alkyl group, an aryl group or a heterocyclic group.

The linking group represented by $L_3$ may have a substituent with examples the same as those of the substituent on $RED_{11}$ in the general formula (A).

The linking group represented by $L_3$ may bond to each of $RED_3$ and $Y_3$ at an optional position such that the linking group substitutes optional 1 hydrogen atom of each $RED_3$ and $Y_3$.

In the general formula (D), when a cation radical ($X^+$.) provided by oxidizing $RED_3$ or a radical (X.) provided by eliminating a proton therefrom reacts with the reactive group represented by $Y_3$ to form a bond, it is preferable that they form a 3 to 7-membered ring structure containing the linking group represented by $L_3$.

Thus, the radical ($X^+$. or X.) and the reactive group of Y are preferably connected though 3 to 7 atoms.

Preferred examples of $L_3$ include a single bond; alkylene groups, particularly a methylene group, an ethylene group or a propylene group; arylene groups, particularly a phenylene group; a —C(═O)— group; a —O— group; a —NH— group; —N(alkyl)- groups; and divalent linking groups of combinations thereof.

The compound represented by the general formula (D) preferably represented by any one of the following general formulae (D-1) to (D-4).

General formula (D-1)

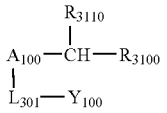

-continued

General formula (D-2)

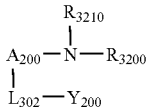

General formula (D-3)

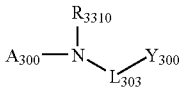

General formula (D-4)

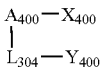

In the general formulae (D-1) to (D-4), $A_{100}$, $A_{200}$ and $A_{400}$ each represent an arylene group or a divalent heterocyclic group, and $A_{300}$ represents an aryl group or a heterocyclic group. These ring groups are the same as $RED_3$ in the general formula (D) with respect to the preferred embodiments.

$L_{301}$, $L_{302}$, $L_{303}$ and $L_{304}$ each represent a linking group, which is the same as $L_3$ in the general formula (D) with respect to the meanings and preferred embodiments.

$Y_{100}$, $Y_{200}$, $Y_{300}$ and $Y_{400}$ each represent a reactive group, which is the same as $Y_3$ in the general formula (D) with respect to the meanings and preferred embodiments.

$R_{3100}$, $R_{3110}$, $R_{3200}$, $R_{3210}$ and $R_{3310}$ each represent a hydrogen atom or a substituent.

$R_{3100}$ and $R_{3110}$ are preferably a hydrogen atom, an alkyl group or an aryl group, respectively.

$R_{3200}$ and $R_{3310}$ are preferably a hydrogen atom, respectively.

$R_{3210}$ is preferably a substituent, which is preferably an alkyl group or an aryl group.

$R_{3110}$ and $A_{100}$, $R_{3210}$ and $A_{200}$, and $R_{3310}$ and $A_{300}$ may bond together to form a ring structure, respectively.

The ring structure is preferably a tetralin ring, an indane ring, a tetrahydroquinoline ring, an indoline ring, etc.

$X_{400}$ represents a hydroxy group, a mercapto group or an alkylthio group, preferably a hydroxy group or a mercapto group, more preferably a mercapto group.

Among the compounds represented by any of the general formulae (D-1) to (D-4), more preferred are the compounds represented by the general formula (D-2), (D-3) or (D-4).

Furthermore preferred are the compound represented by the general formula (D-2) or (D-3).

Next, the compound of Type 4 will be described below.

The compound of Type 4 has a reducing group-substituted ring structure. After the reducing group is one-electron-oxidized, the compound can release further 1 or more electron with a ring structure cleavage reaction.

In the compound of Type 4, the ring structure is cleaved after the one-electron oxidation. The ring cleavage reaction proceeds as follows.

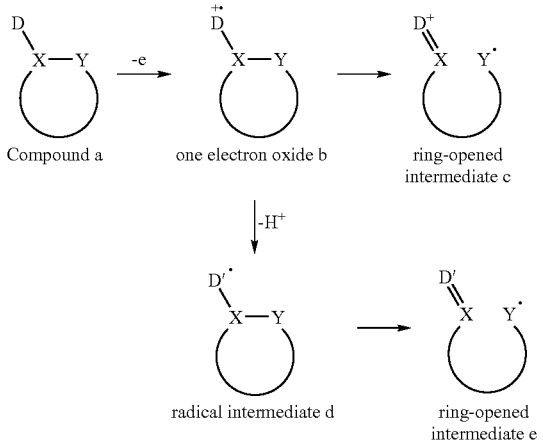

In the formula, compound a is the compound of Type 4.

In compound a, D represents a reducing group, and X and Y each represent an atom forming a bond in the ring structure, which is cleaved after the one-electron oxidation.

First, compound a is one-electron-oxidized to generate one-electron oxidation product b. Then, the X—Y bond is cleaved with conversion of the D-X single bond into a double bond, whereby ring-opened intermediate c is provided. Alternatively, there is a case where one-electron oxidation product b is converted into radical intermediate d with deprotonation, and ring-opened intermediate e is provided in the same manner.

Subsequently, further one or more electron is released form thus-provided Ring-opened intermediate c or e.

The ring structure in the compound of Type 4 is a 3 to 7-membered, carbocyclic or heterocyclic, monocyclic or condensed, saturated or unsaturated, nonaromatic ring.

The ring structure is preferably a saturated ring structure, more preferably 3- or 4-membered ring. Preferred examples of the ring structure include a cyclopropane ring, a cyclobutane ring, an oxirane ring, an oxetane ring, an aziridine ring, an azetidine ring, an episulphide ring and a thietane ring.

More preferred are a cyclopropane ring, a cyclobutane ring, an oxirane ring, an oxetane ring and an azetidine ring, particularly preferred are a cyclopropane ring, a cyclobutane ring and an azetidine ring.

The ring structure may have a substituent.

The compound of Type 4 is preferably represented by the following general formula (E) or (F).

General formula (E)

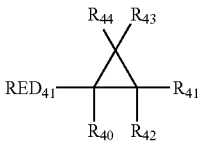

General formula (F)

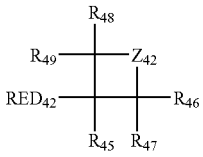

In the general formulae (E) and (F), $RED_{41}$ and $RED_{42}$ are the same as $RED_{12}$ in the general formula (B) with respect to the meanings and preferred embodiments, respectively. $R_{40}$ to $R_{44}$ and $R_{45}$ to $R_{49}$ each represent a hydrogen atom or a substituent with examples the same as those of the substituent on $RED_{12}$.

In the general formula (F), $Z_{42}$ represents —$CR_{420}R_{421}$—, —$NR_{423}$—, or —O—. $R_{420}$ and $R_{421}$ each represent a hydrogen atom or a substituent, and $R_{423}$ represents a hydrogen atom, an alkyl group, an aryl group or a heterocyclic group.

In the general formula (E), $R_{40}$ is preferably a hydrogen atom, an alkyl group, an alkenyl group, an alkynyl group, an aryl group, a heterocyclic group, an alkoxy group, an amino group, an alkylamino group, an arylamino group, a heterocyclic amino group, an alkoxycarbonyl group, an acyl group, a carbamoyl group, a cyano group or a sulfamoyl group, more preferably a hydrogen atom, an alkyl group, an aryl group, a heterocyclic group, an alkoxy group, an alkoxycarbonyl group, an acyl group or a carbamoyl group, most preferably a hydrogen atom, an alkyl group, an aryl group, a heterocyclic group, an alkoxycarbonyl group or a carbamoyl group.

It is preferred that at least one of $R_{41}$ to $R_{44}$ is a donor group, and it is also preferred that both of $R_{41}$ and $R_{42}$, or both of $R_{43}$ and $R_{44}$ are an electron-withdrawing group. It is more preferred that at least one of $R_{41}$ to $R_{44}$ is a donor group. It is furthermore preferred that at least one of $R_{41}$ to $R_{44}$ is a donor group and $R_{41}$ to $R_{44}$ other than the donor group are selected from a hydrogen atom and an alkyl group.

The donor group is a hydroxy group, an alkoxy group, an aryloxy group, a mercapto group, an acylamino group, a sulfonylamino group, an active methine group, or a group selected from the groups preferred for $RED_{41}$ and $RED_{42}$.

The donor group is preferably an alkylamino group; an arylamino group; a heterocyclic amino group; a 5-membered, monocyclic or condensed, aromatic heterocyclic group having one nitrogen atom in the ring; a nitrogen-containing, nonaromatic heterocyclic group that substitutes at the nitrogen atom; or a phenyl group having at least one electron-donating group as a substituent, wherein the electron-donating group is a hydroxy group, an alkoxy group, an aryloxy group, an amino group, an alkylamino group, an arylamino group, a heterocyclic amino group, or a nitrogen-containing, nonaromatic heterocyclic group that substitutes at the nitrogen atom.

The donor group is more preferably an alkylamino group; an arylamino group; 5-membered, aromatic heterocyclic group having one nitrogen atom in the ring, wherein the aromatic heterocycle is an indole ring, a pyrrole ring or a carbazole ring; or a phenyl group having an electron-donating group as a substituent, particularly a phenyl group having 3 or more alkoxy groups, a hydroxy group, an alkylamino group or an arylamino group.

The donor group is particularly preferably an arylamino group; 5-membered, aromatic heterocyclic group having one nitrogen atom in the ring, such as a 3-indolyl group; or a phenyl group having an electron-donating group as a substituent, particularly a phenyl group having a trialkoxyphenyl group, an alkylamino group or an arylamino group.

The electron-withdrawing group may be the same as above-mentioned electron-withdrawing group on the methine group of the active methine group.

In the general formula (F), $R_{45}$ is the same as $R_{40}$ in the general formula (E) with respect to the preferred embodiments.

Each of $R_{46}$ to $R_{49}$ is preferably a hydrogen atom, an alkyl group, an alkenyl group, an alkynyl group, an aryl group, a heterocyclic group, a hydroxy group, an alkoxy group, an amino group, an alkylamino group, an arylamino group, a heterocyclic amino group, a mercapto group, an arylthio group, an alkylthio group, an acylamino group or a sulfoneamino group, more preferably a hydrogen atom, an alkyl group, an aryl group, a heterocyclic group, an alkoxy group, an alkylamino group, an arylamino group or a heterocyclic amino group.

Each of $R_{46}$ to $R_{49}$ is particularly preferably a hydrogen atom, an alkyl group, an aryl group, a heterocyclic group, an alkylamino group or an arylamino group in the case where $Z_{42}$ is —$CR_{420}R_{421}$—, a hydrogen atom, an alkyl group, an aryl group or a heterocyclic group in the case where $Z_{42}$ is —$NR_{423}$—, a hydrogen atom, an alkyl group, an aryl group or a heterocyclic group in the case where $Z_{42}$ is —O—.

$Z_{42}$ is preferably —$CR_{420}R_{421}$— or —$NR_{423}$—, more preferably —$NR_{423}$—.

Each of $R_{420}$ and $R_{421}$ is preferably a hydrogen atom, an alkyl group, an alkenyl group, an alkynyl group, an aryl group, a heterocyclic group, a hydroxy group, an alkoxy group, an amino group, a mercapto group, an acylamino group or a sulfoneamino group, more preferably a hydrogen atom, an alkyl group, an aryl group, a heterocyclic group, an alkoxy group or an amino group.

$R_{423}$ is preferably a hydrogen atom, an alkyl group, an aryl group or an aromatic heterocyclic group, more preferably a methyl group, an ethyl group, an isopropyl group, a t-butyl group, a t-amyl group, a benzyl group, a diphenylmethyl group, an aryl group, a phenyl group, a naphthyl group, a 2-pyridyl group, a 4-pyridyl group or a 2-thiazolyl group.

The substituent represented by each of $R_{40}$ to $R_{49}$, $R_{420}$, $R_{421}$ and $R_{423}$ preferably has 40 or less carbon atoms, more preferably has 30 or less carbon atoms, particularly preferably 15 or less carbon atoms.

The substituents of $R_{40}$ to $R_{49}$, $R_{420}$, $R_{421}$ and $R_{423}$ may bond to each other or to the other portion such as $RED_{41}$, $RED_{42}$ and $Z_{42}$, to form a ring.

Each compound of Types 1, 3 and 4 used in the invention preferably has the adsorbable group to the silver halide, or a spectral sensitizing dye moiety, more preferably has the adsorbable group to the silver halide.

The compound of Type 2 has 2 or more adsorbable group to the silver halide.

Each compound of Types 1 to 4 further more preferably has 2 or more mercapto groups-substituted, nitrogen-containing, heterocyclic group as the adsorbent group.

In the compounds of Types 1 to 4 used in the invention, the adsorbable group to the silver halide is such a group that is directly adsorbed on the silver halide or promotes adsorption of the compound onto the silver halide. Specifically, the adsorbable group is a mercapto group or a salt thereof; a thione group (—C(═S)—); a heterocyclic group containing at least one atom selected from the group consisting of a nitrogen atom, a sulfur atom, a selenium atom and a tellurium atom; a sulfide group; a cationic group; or an ethynyl group.

Incidentally, the adsorbable group in the compound of Type 2 is not a sulfide group.

The mercapto group or a salt thereof used as the adsorbable group may be a mercapto group or a salt thereof itself, and is more preferably a heterocyclic group, an aryl group or an alkyl group having a mercapto group or a salt thereof as a substituent.

The heterocyclic group is a 5- to 7-membered, monocyclic or condensed, aromatic or nonaromatic, heterocyclic group. EXAMPLEs thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, etc.

The heterocyclic group may contain a quaternary nitrogen atom, and in this case, the mercapto group bonding to the heterocyclic group may be dissociated into a mesoion. Such heterocyclic group may be an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, etc. Preferred among them is a triazolium ring group such as a 1,2,4-triazolium-3-thiolate ring group.

Examples of the aryl group include a phenyl group and a naphthyl group.

Examples of the alkyl group include straight, branched or cyclic alkyl groups having 1 to 30 carbon atom.

When the mercapto group forms a salt, a counter ion of the salt may be a cation of an alkaline metal, an alkaline earth metal, a heavy metal, etc. such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; etc.

Further, the mercapto group used as the adsorbable group may be tautomerized into a thione group. Specific examples of the thione group include a thioamide group (herein a —C(═S)—NH— group); and groups containing a structure of the thioamide group, such as linear or cyclic thioamide groups, a thiouredide group, a thiourethane group and a dithiocarbamic acid ester group.

Examples of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, etc.

The thione group used as the adsorbent group, as well as the thione group derived from the mercapto group by tautomerization, may be a linear or cyclic, thioamide, thiouredide, thiourethane or dithiocarbamic acid ester group that cannot be tautomerized into the mercapto group or has no hydrogen atom at α-position of the thione group.

The heterocyclic group containing at least one atom selected from the group consisting of a nitrogen atom, a sulfur atom, a selenium atom and tellurium atom, which is used as the adsorbent group, is a nitrogen-containing heterocyclic group having a —NH— group that can form a silver imide (>NAg) as a moiety of the heterocycle; or a heterocyclic group having a —S— group, a —Se— group, a —Te— group or a ═N— group that can form a coordinate bond with a silver ion as a moiety of the heterocycle. EXAMPLEs of the former include a benzotriazole group, a triazole group, an indazole group, a pyrazole group, a tetrazole group, a benzimidazole group, an imidazole group, a purine group, etc. EXAMPLEs of the latter include a thiophene group, a thiazole group, an oxazole group, a benzothiazole group, a benzoxazole group, a thiadiazole group, an oxadiazole group, a triazine group, a selenazole group, a benzselenazole group, a tellurazole group, a benztellurazole group, etc. The former is preferable.

The sulfide group used as the adsorbable group may be any group with a —S— moiety, and preferably has a moiety of: alkyl or alkylene-S-alkyl or alkylene; aryl or arylene-S-alkyl or alkylene; or aryl or arylene-S-aryl or arylene.

The sulfide group may form a ring structure, and may be a —S—S— group.

Specific examples of the ring structure include groups with a thiolane ring, a 1,3-dithiolane ring, a 1,2-dithiolane ring, a thiane ring, a dithiane ring, a tetrahydro-1,4-thiazine ring (a thiomorpholine ring), etc.

Particularly preferred as the sulfide group are groups having a moiety of alkyl or alkylene-S-alkyl or alkylene.

The cationic group used as the adsorbable group is a quaternary nitrogen-containing group, specifically a group with an ammonio group or a quaternary nitrogen-containing heterocyclic group.

Incidentally, there is no case where the cationic group partly composes an atomic group forming a dye structure, such as a cyanine chromophoric group.

The ammonio group may be a trialkylammonio group, a dialkylarylammonio group, an alkyldiarylammonio group, etc., and examples thereof include a benzyldimethylammonio group, a trihexylammonio group, a phenyldiethylammonio group, etc.

Examples of the quaternary nitrogen-containing heterocyclic group include a pyridinio group, a quinolinio group, an isoquinolinio group, an imidazolio group, etc. Preferred are a pyridinio group and an imidazolio group, and particularly preferred is a pyridinio group.

The quaternary nitrogen-containing heterocyclic group may have an optional substituent. Preferred as the substituent in the case of the pyridinio group and the imidazolio group are alkyl groups, aryl groups, acylamino groups, a chlorine atom, alkoxycarbonyl groups and carbamoyl groups. Particularly preferred as the substituent in the case of the pyridinio group is a phenyl group.

The ethynyl group used as the adsorbable group means a —C≡CH group, in which the hydrogen atom may be substituted.

The adsorbable group may have an optional substituent.

Specific examples of the adsorbable group further include groups described in pages 4 to 7 of a specification of JP-A No. 11-95355.

Preferred as the adsorbable group used in the invention are mercapto-substituted, nitrogen-containing, heterocyclic groups such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimethyl-1,2,4-triazolium-3-thiolate group; and nitrogen-containing heterocyclic groups having a —NH— group that can form a silver imide (>NAg) as a moiety of the heterocycle, such as a benzotriazole group, a benzimidazole group and an indazole group.

Particularly preferred are a 5-mercaptotetrazole group, a 3-mercapto-1,2,4-triazole group and a benzotriazole group, and the most preferred are a 3-mercapto-1,2,4-triazole group and a 5-mercaptotetrazole group.

It is particularly preferred that the compound used in the invention has 2 or more mercapto group as a moiety.

The mercapto group (—SH) may be converted into a thione group in the case where it can be tautomerized.

The compound may have 2 or more adsorbent groups containing above-mentioned mercapto or thione group as a moiety, such as a cyclic thioamide group, an alkylmercapto group, an arylmercapto group and a heterocyclic mercapto group. Further, the compound may have 1 or more adsorbable group containing 2 or more mercapto or thione groups as a moiety, such as a dimercapto-substituted, nitrogen-containing, heterocyclic group.

Examples of the adsorbable group containing 2 or more mercapto group, such as a dimercapto-substituted, nitrogen-containing, heterocyclic group, include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolo pyrimidine group, a 2,5-dimercapto-imidazole group, etc. Particularly preferred are a 2,4-dimercaptopyrimidine group, a 2,4-dimercaptotriazine group, and a 3,5-dimercapto-1,2,4-triazole group.

The adsorbable group may be connected to any position of the compound represented by each of the general formulae (A) to (F) and (1) to (3). Preferred portions, which the adsorbable group bonds to, are $RED_{11}$, $RED_{12}$, $RED_2$ and $RED_3$ in the general formulae (A) to (D), $RED_{41}$, $R_{41}$, $RED_{42}$, and $R_{46}$ to $R_{48}$ in the general formulae (E) and (F), and optional portions other than $R_1$, $R_2$, $R_{11}$, $R_{12}$, $R_{31}$, $L_1$, $L_{21}$ and $L_{31}$ in the general formulae (1) to (3). Further, more preferred portions are $RED_{11}$ to $RED_{42}$ in the general formulae (A) to (F).

The spectral sensitizing dye moiety is a group containing a spectral sensitizing dye chromophore, a residual group provided by removing an optional hydrogen atom or substituent from a spectral sensitizing dye compound.

The spectral sensitizing dye moiety may be connected to any position of the compound represented by each of the general formulae (A) to (F) and (1) to (3). Preferred portion, which the spectral sensitizing dye moiety bonds to, are $RED_{11}$, $RED_{12}$, $RED_2$ and $RED_3$ in the general formulae (A) to (D), $RED_{41}$, $R_{41}$, $RED_{42}$, and $R_{46}$ to $R_{48}$ in the general formulae (E) and (F), and optional portions other than $R_1$, $R_2$, $R_{11}$, $R_{12}$, $R_{31}$, $L_1$, $L_{21}$ and $L_{31}$ in the general formulae (1) to (3). Further, more preferred portions are $RED_{11}$ to $RED_{42}$ in the general formulae (A) to (F).

The spectral sensitizing dye is preferably such that typically used in color sensitizing techniques. EXAMPLEs thereof include cyanine dyes, composite cyanine dyes, merocyanine dyes, composite merocyanine dyes, homopolar cyanine dyes, styryl dyes, and hemicyanine dyes.

Typical spectral sensitizing dyes are disclosed in Research Disclosure, Item 36544, September 1994.

The dyes can be synthesized by one skilled in the art according to procedures described in the above Research Disclosure and F. M. Hamer, *The Cyanine dyes and Related Compounds*, Interscience Publishers, New York, 1964.

Further, dyes described in pages 4 to 7 of a specification of JP-A No. 11-95355 (U.S. Pat. No. 6,054,260) may be used in the invention.

The total number of carbon atoms in the compounds of Types 1 to 4 used in the invention is preferably 10 to 60, more preferably 10 to 50, furthermore preferably 11 to 40, particularly preferably 12 to 30.

When a silver halide photosensitive material using the compounds of Types 1 to 4 is exposed, the compound is one-electron-oxidized. After the subsequent reaction, the compound is further oxidized while releasing 1 or more electron, or 2 or more electrons depending on Type. An oxidation potential in the first one-electron oxidation is preferably 1.4 V or less, more preferably 1.0 V or less.

This oxidation potential is preferably 0 V or more, more preferably 0.3 V or more. Thus, the oxidation potential is preferably approximately 0 to 1.4 V, more preferably approximately 0.3 to 1.0 V.

The oxidation potential may be measured by a cyclic voltammetry technique. Specifically, a sample is dissolved in a solution of acetonitrile/water containing 0.1 M lithium perchlorate=80/20 (volume %), nitrogen gas is passed through the resultant solution for 10 minutes, and then the oxidation potential is measured at 25° C. at a potential scanning rate of 0.1 V/second by using a glassy carbon disk as a working electrode, using a platinum wire as a counter electrode, and using a calomel electrode (SCE) as a reference electrode. The oxidation potential per SCE is obtained at peak potential of cyclic voltammetric curve.

In the case where the compound of Types 1 to 4 is one-electron-oxidized and release further 1 electron after the subsequent reaction, an oxidation potential in the subsequent oxidation is preferably −0.5 to −2 V, more preferably −0.7 to −2 V, furthermore preferably −0.9 to −1.6 V.

In the case where the compound of Types 1 to 4 is one-electron-oxidized and release further 2 or more electrons after the subsequent reaction, oxidation potentials in the subsequent oxidation are not particularly limited. The oxidation potentials in the subsequent oxidation often cannot be measured precisely, because an oxidation potential in releasing the second electron cannot be clearly differentiated from an oxidation potential in releasing the third electron.

Specific examples of the compounds of Types 1 to 4 used in the invention are illustrated below without intention of restricting the scope of the invention.

1

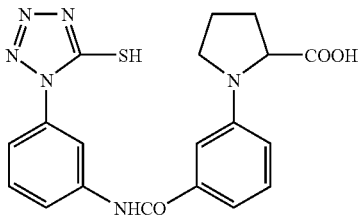

2

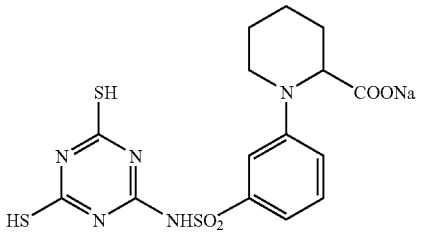

3

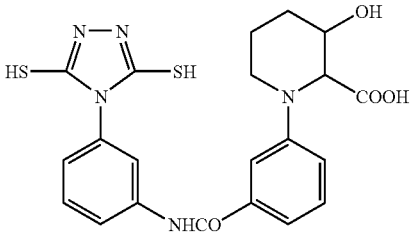

4

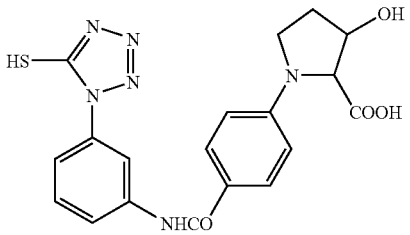

5

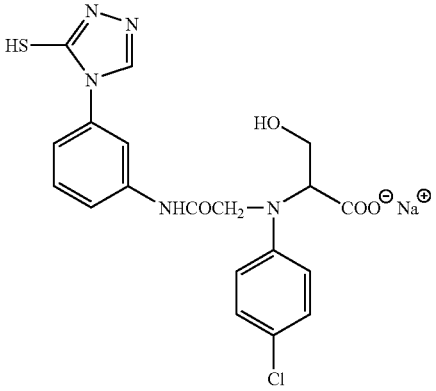

6

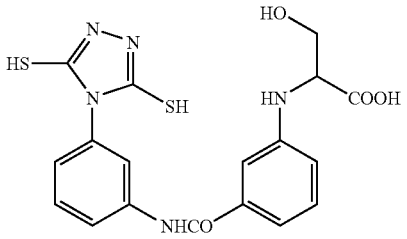

-continued
7
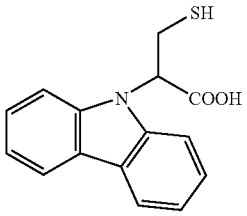
8
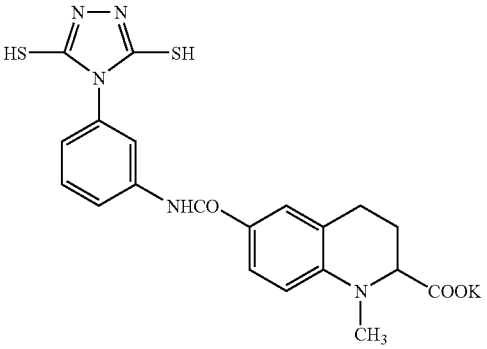
9
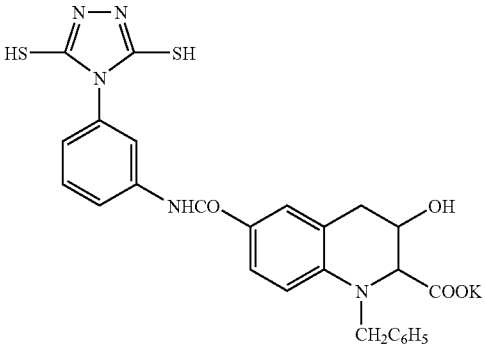
10
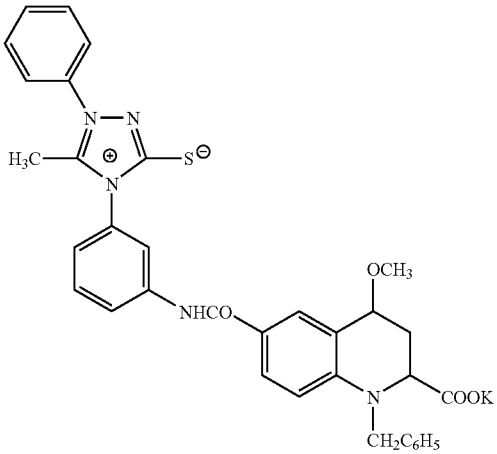
11
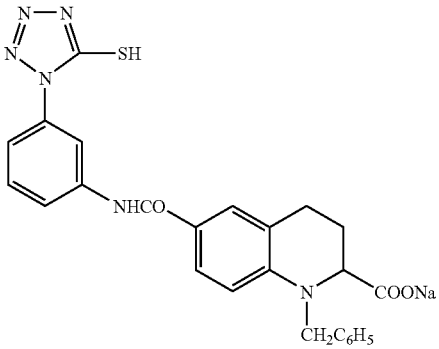
12
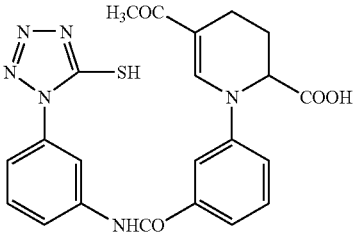
13
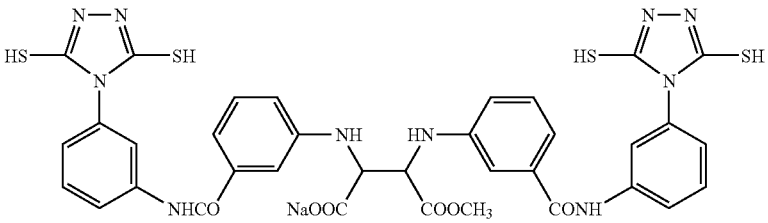

-continued
14
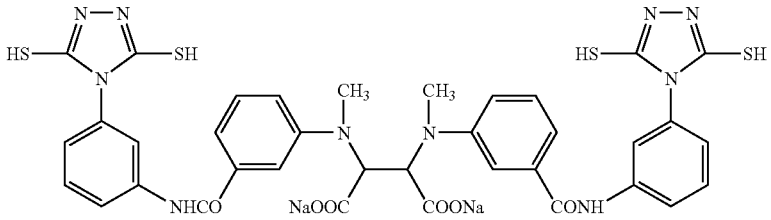
15
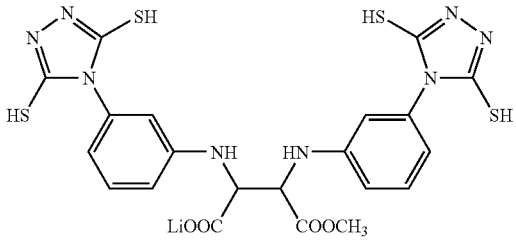
16
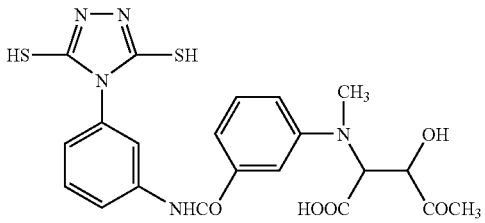
17
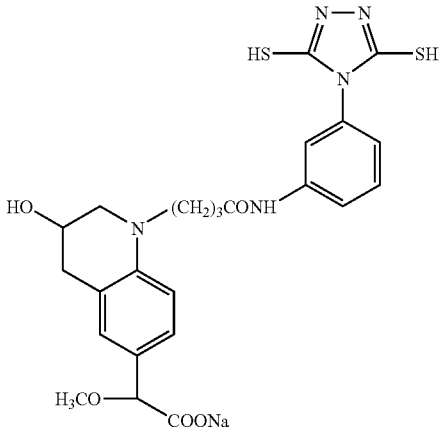
18
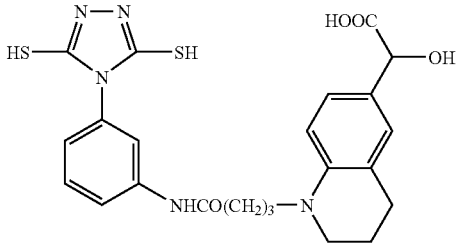
19
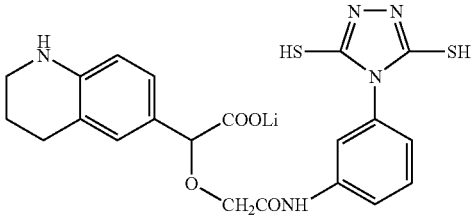
20
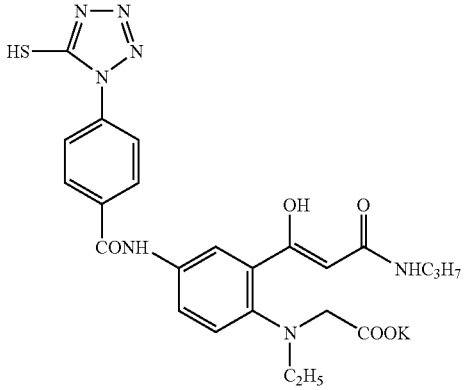
21
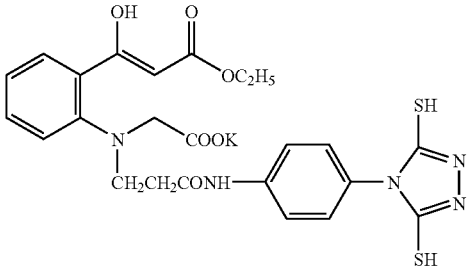
22
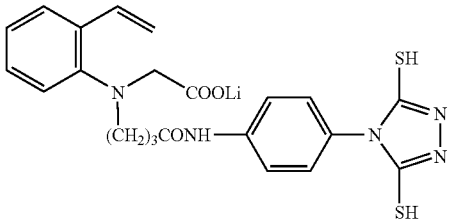

-continued
23
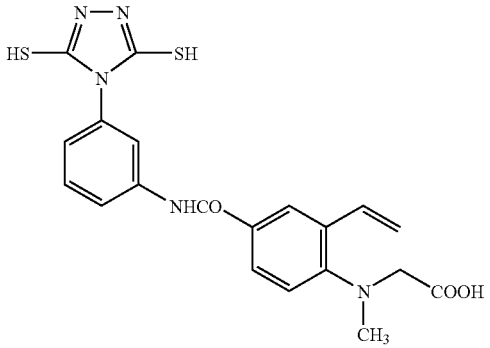
24
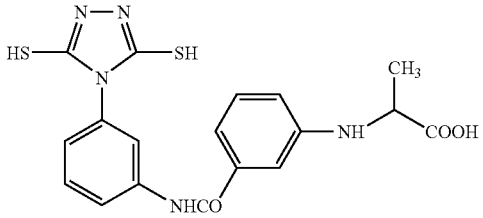
25
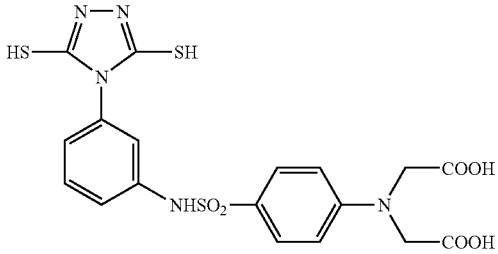
26
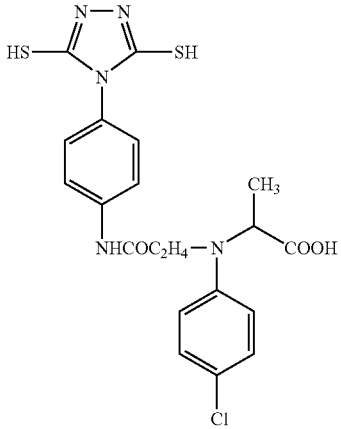
27
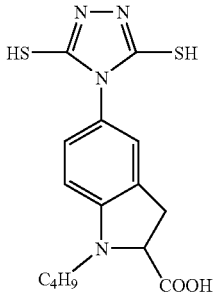
28
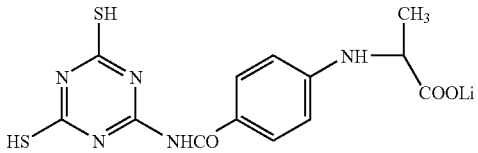
29
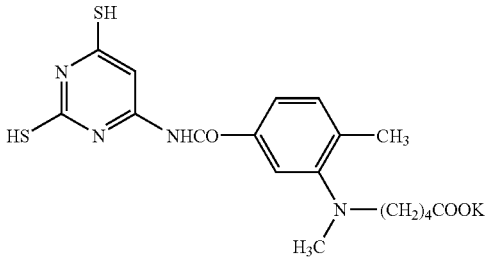
30
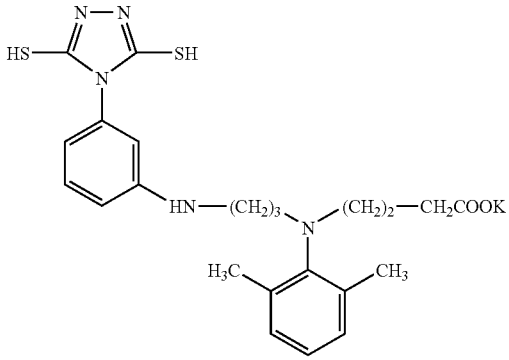

-continued
31
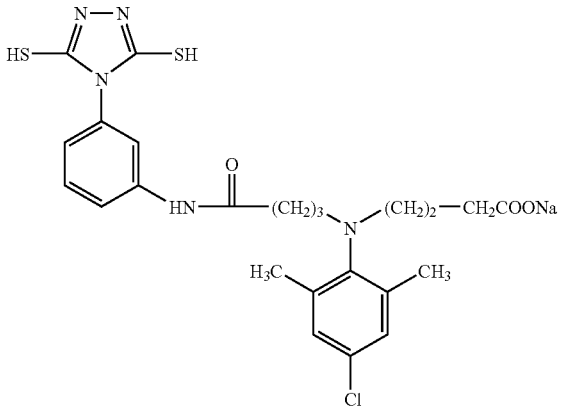
32
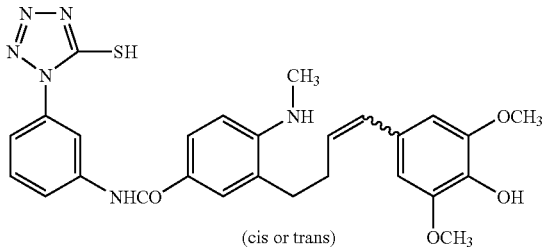
33
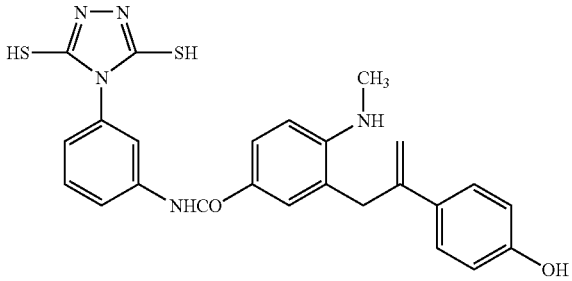
34
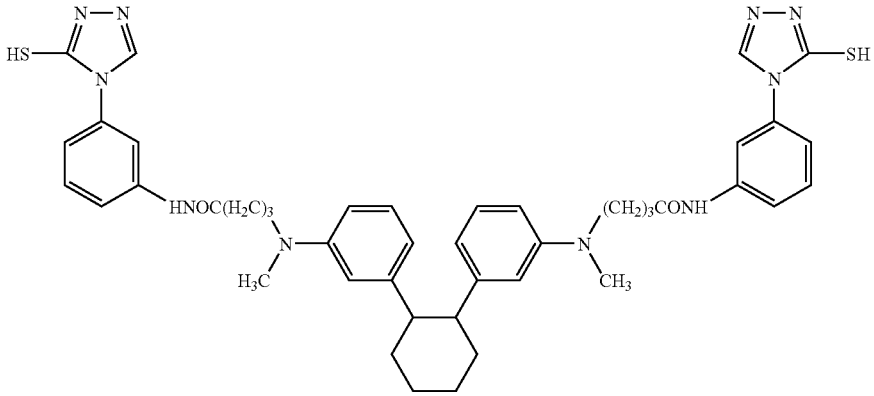
35
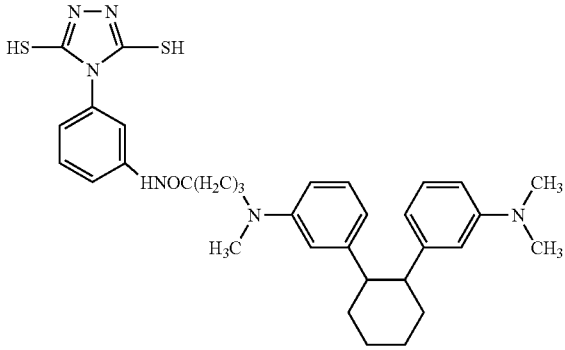
36
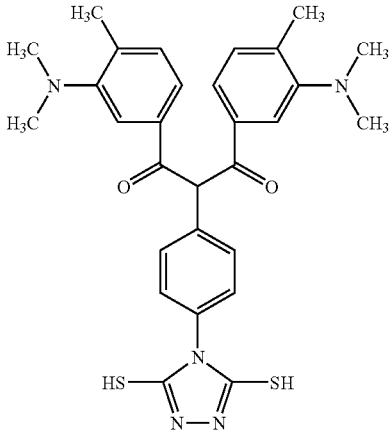

-continued
37
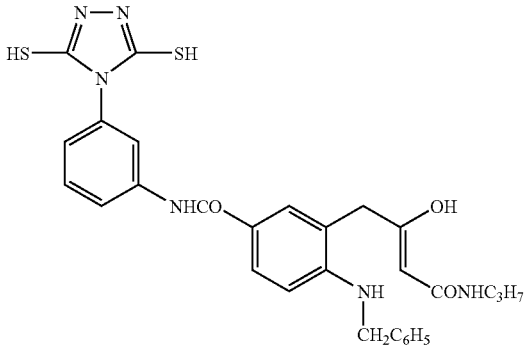
38
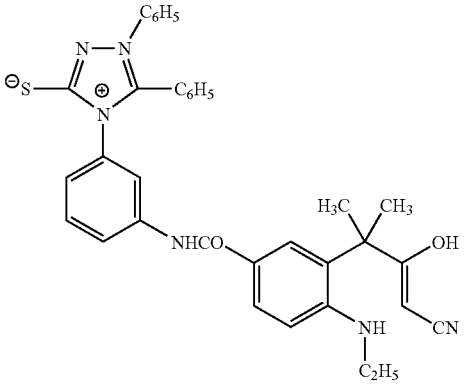
39
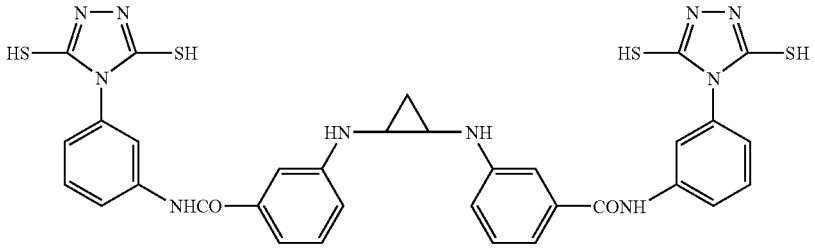
40
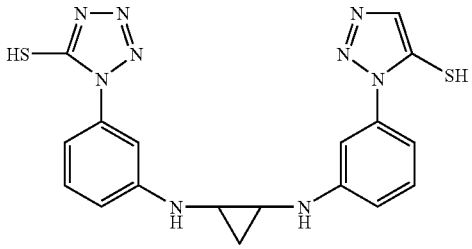
41
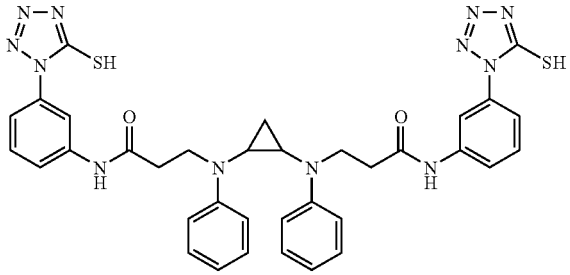
42
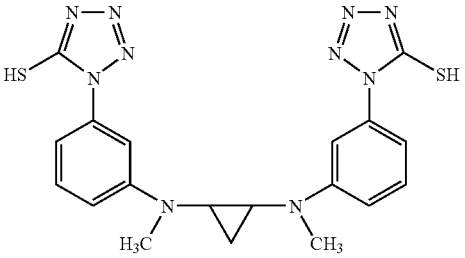
43
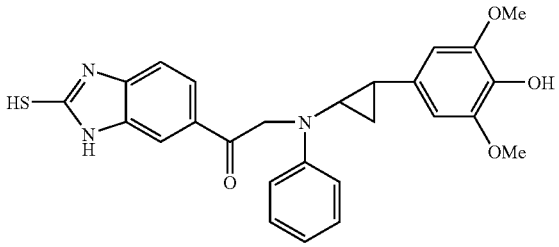
44
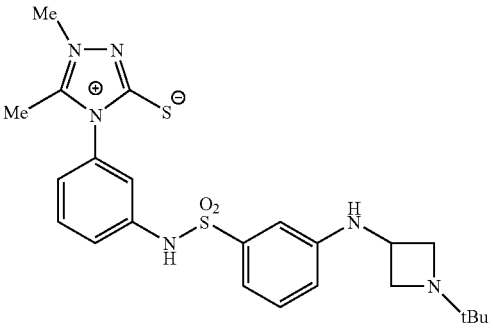

-continued
45
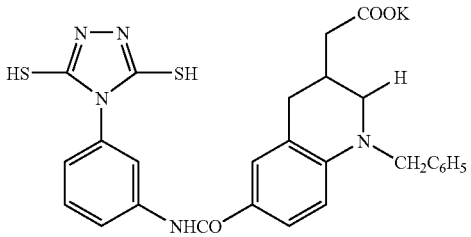
46
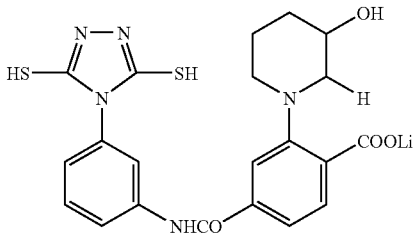
47
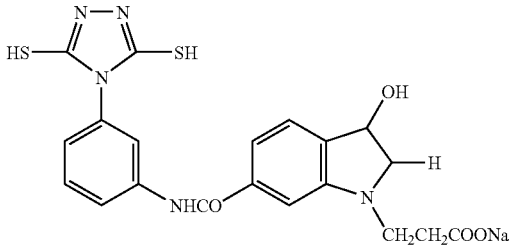
48
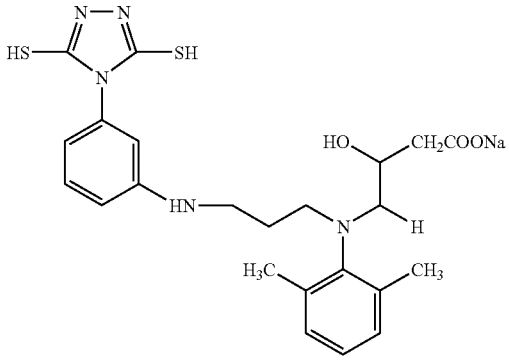
49
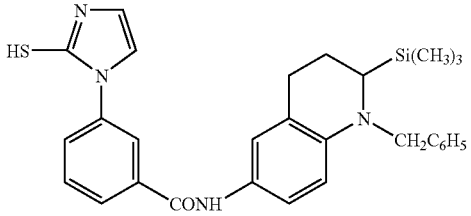
50
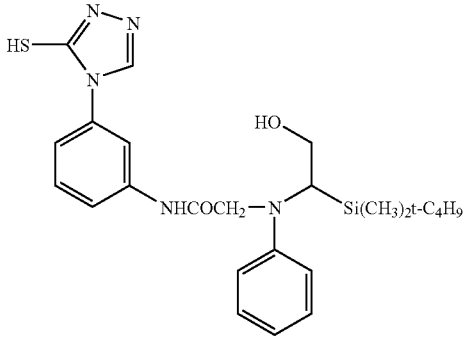
51
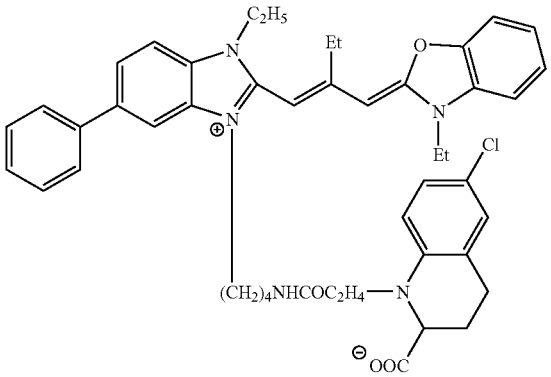
52
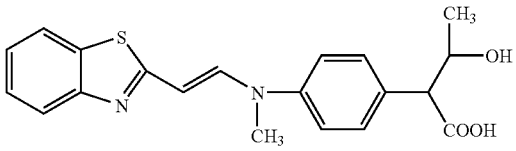
53
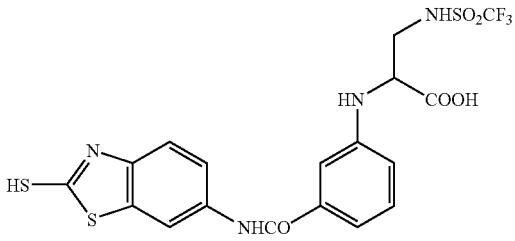
54
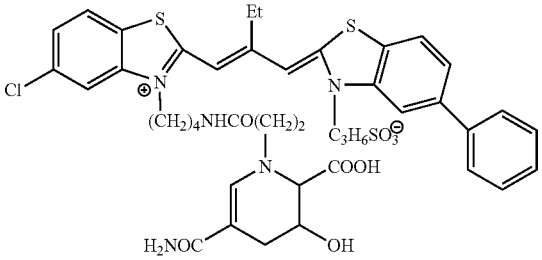

-continued

55

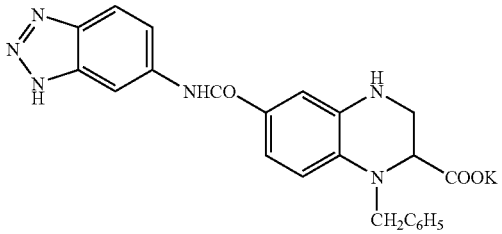

56

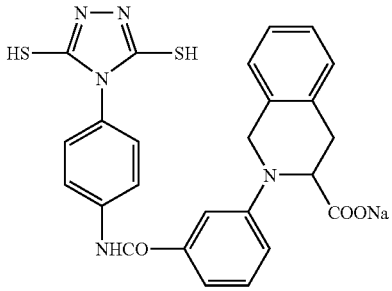

57

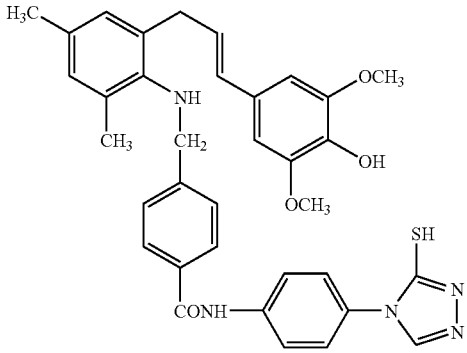

58

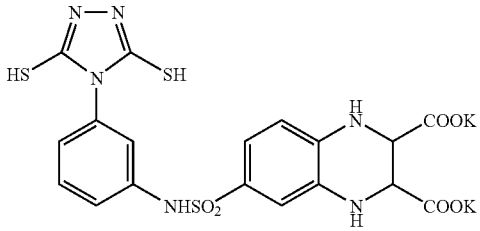

59

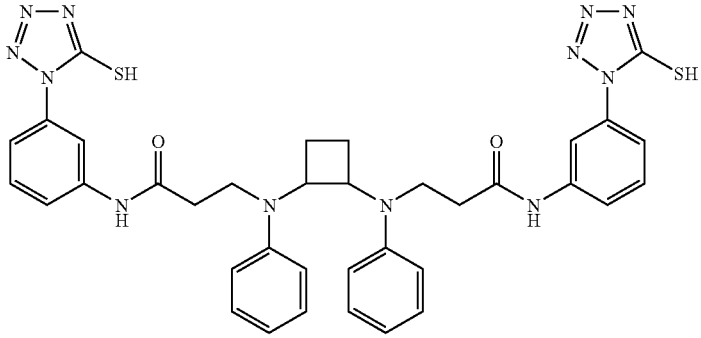

The compounds of Types 1 to 4 used in the invention are the same as compounds described in detail in Japanese Patent Application Nos. 2002-192373, 2002-188537, 2002-188536 and 2001-272137, respectively.

The specific examples of the compounds of Types 1 to 4 used in the invention further include compound examples disclosed in the specifications.

Synthesis examples of the compounds of Types 1 to 4 used in the invention may be the same as described in the specifications.

Next, the compound of Type 5 will be described.

The compound of Type 5 is represented by X—Y, in which X represents a reducing group and Y represents a leaving group. The reducing group represented by X can be one-electron-oxidized to provide a one-electron oxidation product, which can be converted into an X radical by eliminating the leaving group of Y with a subsequent X—Y bond cleavage reaction. The X radical can release further 1 electron.

The oxidation reaction of the compound of Type 5 may be represented by the following formula.

$$X—Y \xrightarrow[(-e^-)]{\text{oxidize}} (X—Y)^{+\bullet} \xrightarrow{\text{split}} X^+ + Y^+ \xrightarrow[(-e^-)]{\text{one electron release}} X^+$$

The compound of Type 5 exhibits an oxidation potential of preferably 0 to 1.4 V, more preferably 0.3 to 1.0 V.

The radical X. generated in the formula exhibits an oxidation potential of preferably −0.7 to −2.0 V, more preferably −0.9 to −1.6 V.

The compound of Type 5 is preferably represented by the following general formula (G).

General formula (G)

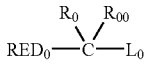

In the general formula (G), $RED_0$ represents a reducing group, $L_0$ represents a leaving group, and $R_0$ and $R_{00}$ each represent a hydrogen atom or a substituent.

$RED_0$ and $R_0$, and $R_0$ and $R_{00}$ may be bond together to form a ring structure, respectively.

$RED_0$ is the same as $RED_2$ in the general formula (C) with respect to the meanings and preferred embodiments.

$R_0$ and $R_{00}$ are the same as $R_{21}$ and $R_{22}$ in the general formula (C) with respect to the meanings and preferred embodiments, respectively. Incidentally, $R_0$ and $R_{00}$ are not the same as the leaving group of $L_0$ respectively, except for a hydrogen atom.

$RED_0$ and $R_0$ may bond together to form a ring structure with examples and preferred embodiments the same as those of the ring structure formed by bonding $RED_2$ and $R_{21}$ in the general formula (C).

Examples of the ring structure formed by bonding $R_0$ and $R_{00}$ each other include a cyclopentane ring, a tetrahydrofuran ring, etc.

In the general formula (G), $L_0$ is the same as $L_2$ in the general formula (C) with respect to the meanings and preferred embodiments.

The compound represented by the general formula (G) preferably has an adsorbable group to the silver halide or a spectrally sensitizing dye moiety. However, the compound does not have 2 or more adsorbable group when $L_0$ is a group other than a silyl group.

Incidentally, the compound may have 2 or more sulfide group as the adsorbent group, not depending on $L_0$.

The adsorbable group to the silver halide in the compound represented by the general formula (G) may be the same as those in the compounds of Types 1 to 4, and further may be a selenoxo group (—C═Se—), a telluroxo group (—C═Te—), a seleno group (—Se—), a telluro group (—Te—), or an active methine group.

The selenoxo group (—C═Se—) and the telluroxo group (—C═Te—) are an Se or Te derivative of a group containing a thione group (—C═S—), respectively. The selenoxo group and the telluroxo group may contain a selenoamide group (—C═Se—NH—) or a telluramide group (—C═Te—NH—), as well as the above-described thione group.

The seleno group (—Se—) and the telluro group (—Te—) are an Se or Te derivative of a group containing a sulfide group (—S—), respectively. EXAMPLEs thereof include Se or Te-substituted derivatives of groups containing a sulfide group.

The active methine group is a methine group having 2 electron-withdrawing groups as a substituent, and the electron-withdrawing group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The 2 electron-withdrawing groups may bond together to form a ring structure.

The adsorbable group in the compound represented by the general formula (G) is preferably a mercapto group or a salt thereof; a thione group (—C═S—); a heterocyclic group containing at least one atom selected from the group consisting of a nitrogen atom, a sulfur atom, a selenium atom and a tellurium atom; or a sulfide group. Further preferred are a mercapto-substituted, nitrogen-containing, heterocyclic group; and a nitrogen-containing heterocyclic group having a —NH— group that can form a silver imide (>NAg) as a moiety of the heterocycle. These groups are the same as those described with respect to the compounds of Types 1 to 4.

The adsorbable group may connect to any position in the compound represented by the general formula (G), and connects preferably to $RED_0$ or $R_0$, more preferably to $RED_0$.

The spectral sensitizing dye moiety in the compound represented by the general formula (G) is the same as in the compounds of Types 1 to 4.

Specific examples of the compound represented by the general formula (G) are illustrated below without intention of restricting the scope of the invention.

G-1

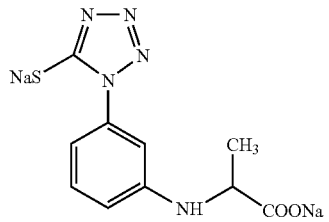

G-2

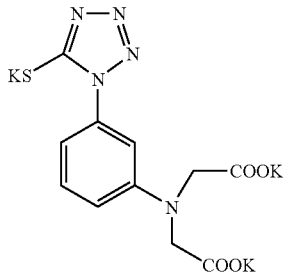

G-3

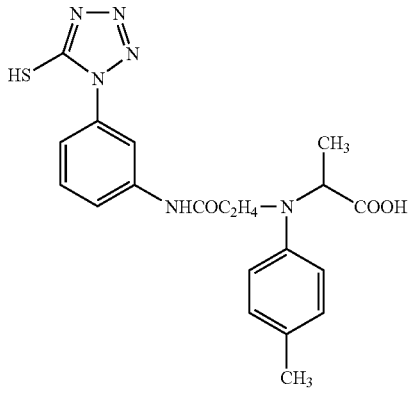

-continued
G-4
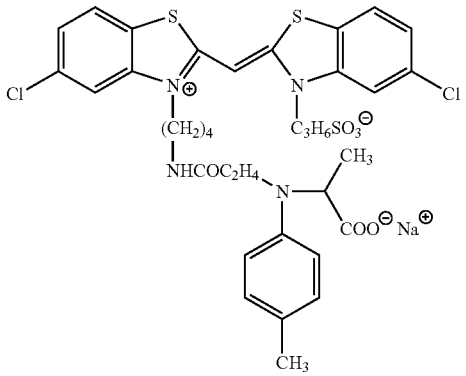
G-5
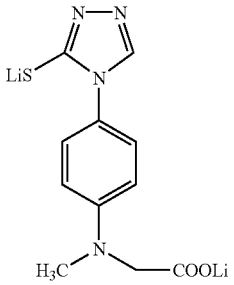
G-6
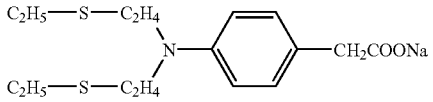
G-7
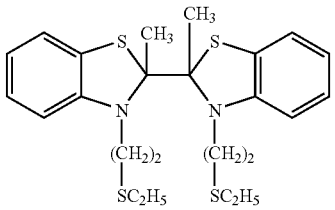
G-8
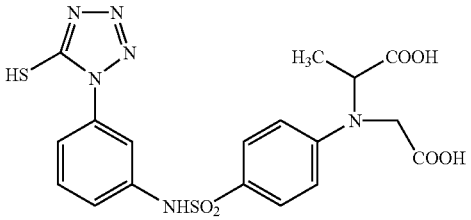
G-9
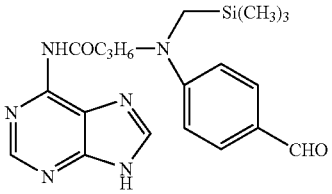
G-10
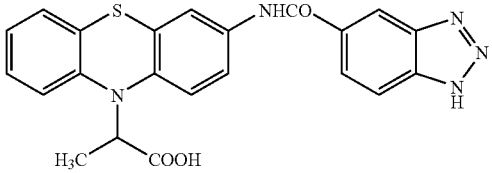
-continued
G-11
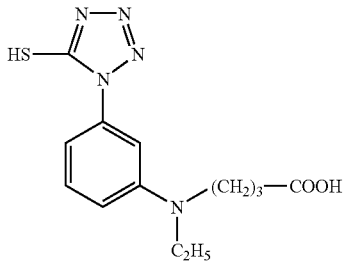
G-12
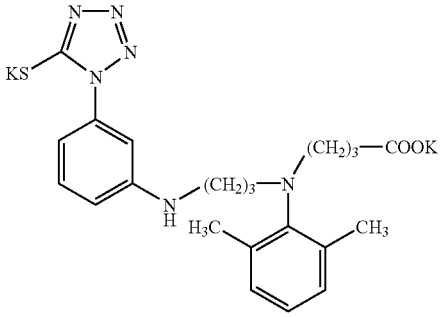
G-13
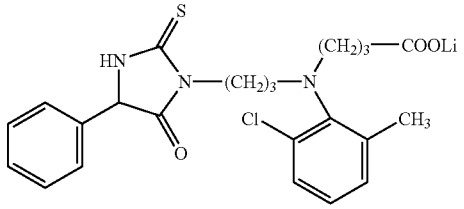
G-14
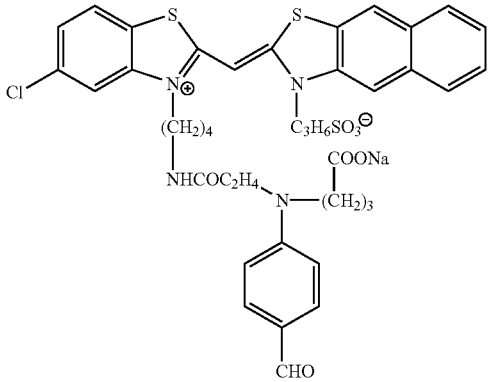
G-15
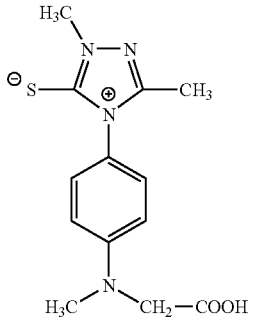

-continued

G-16

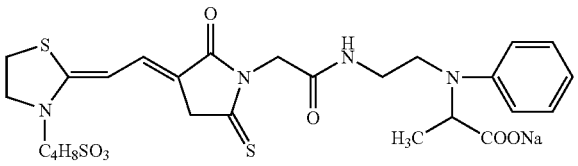

G-17

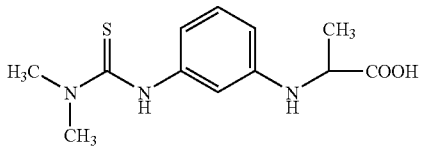

G-18

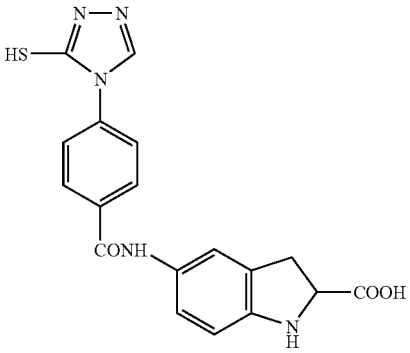

G-19

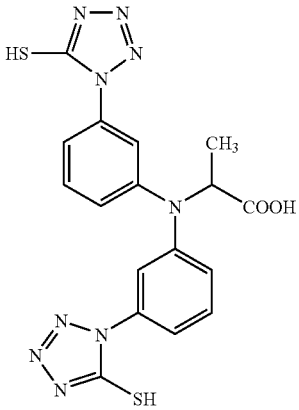

G-20

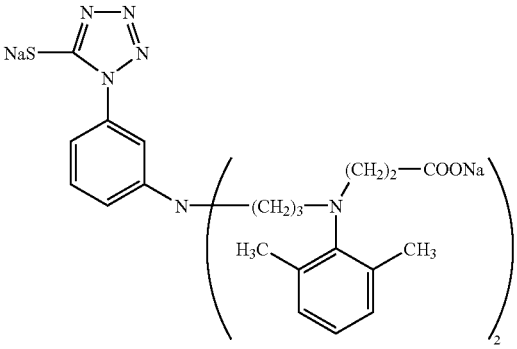

-continued

G-21

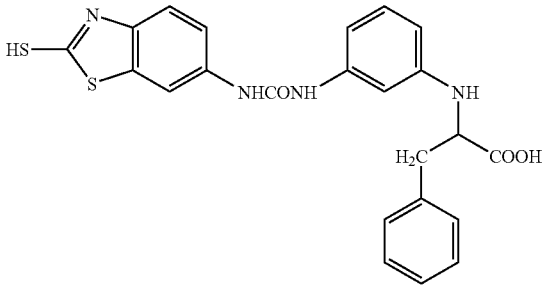

G-22

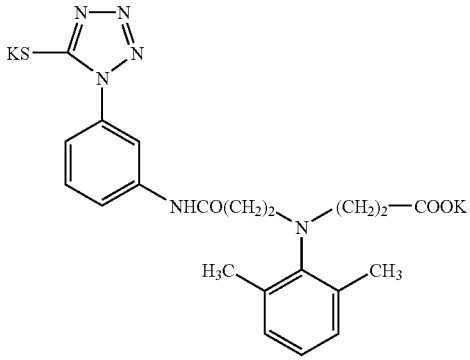

G-23

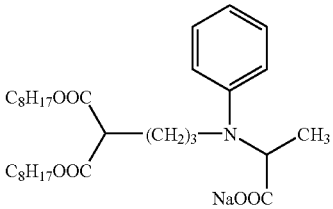

G-24

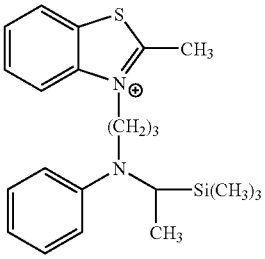

Specific examples of the compound represented by the general formula (G) further include examples of compound referred to as "1 photon 2 electron sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692 A1 (Compound INV 1 to 35); EP No. 893732 A1; U.S. Pat. Nos. 6,054,260 and 5,994,051; etc.

The compounds of Types 1 to 5 may be used at any time during preparation of the photosensitive silver halide emulsion and production of the photothermographic material. For example, the compound may be used, in a photosensitive silver halide grains-forming step, in a desalination step, in a chemical sensitization step, before application, etc. The compound may be added in numbers, in these steps. The compound is preferably added, after the photosensitive silver halide grains-forming step and before the desalination step; in the chemical sensitization step (just before the chemical sensitization to immediately after the chemical sensitization); or before the application. The compound is more preferably added, just before the chemical sensitization step to before mixing with the non-photosensitive organic silver salt.

It is preferred that the compound of Types 1 to 5 used in the invention is dissolved in water, a water-soluble solvent such as methanol and ethanol, or a mixed solvent thereof, to be added.

In the case where the compound is dissolved in water and solubility of the compound is increased by increasing or decreasing a pH value of the solvent, the pH value may be increased or decreased to dissolve and add the compound.

The compound of Types 1 to 5 used in the invention is preferably added to the image-forming layer comprising the photosensitive silver halide and the non-photosensitive organic silver salt. The compound may be added to a surface protective layer, an intermediate layer, etc. as well as the image-forming layer, to be diffused to the image-forming layer in the application step.

The compound may be added before or after addition of a sensitizing dye. A mol value of the compound per 1 mol of the silver halide is preferably $1\times10^{-9}$ to $5\times10^{-1}$ mol, more preferably $1\times10^{-8}$ to $5\times10^{-2}$ mol, in a layer comprising the photosensitive silver halide emulsion.

11) Combination of Different Kinds of Silver Halides

In the photothermographic material according to the invention, one kind of photosensitive silver halide emulsion may be used, or two or more kinds of silver halide emulsions (for example, those having different average grain sizes, halogen compositions, crystal habits or chemical sensitization conditions from one another) may be used in combination. Using plural types of photosensitive silver halides having different sensitivity from one another allows gradation to be adjusted. Related technologies are described, for example, in JP-A Nos. 57-119341, 53-106125, 47-3929, 48-55730, 46-5187, 50-73627 and 57-150841. Sensitivity difference among individual emulsions is preferably 0.2 log E or more.

12) Method of Preparing Organic Silver Salt and Method of Mixing with Light-sensitive Silver Halide It is preferred in particular that the present silver halide grains are formed in the absence of light-insensitive organic silver salts and then subjected to chemical sensitization. This is because there are cases where sufficient sensitivity cannot be attained with a method of forming silver halide by adding a halogenation agent to an organic silver salt, or the so-called conversion method.

Organic silver salts are prepared by adding alkali metal salts (e.g., sodium hydroxide, potassium hydroxide) to organic acids to convert at least a part of the organic acids into alkali metal soap of the organic acids, and then by adding thereto a water-soluble silver salt (e.g., silver nitrate). Light-sensitive silver halides may be added at any stage in the process of preparing the organic silver salts. As main mixing processes, there are (A) a process in which silver halides are added to organic acids in advance, admixed with alkali metal salts, and then admixed with a water-soluble silver salt; (B) a process in which alkali metal soap prepared from organic acids is mixed with silver halides, and thereto a water-soluble silver salt is added; (C) a process in which alkali metal soap is prepared from organic acids, apart thereof is converted into the silver salt, and then silver halides are added thereto, and further the remaining part is converted into the silver salt; and (D) a process in which organic silver salts are formed, and then mixed with silver halides. Of these processes, (B) and (C) are preferred over the others.

13) Mixing of Silver Halide into Application Liquid

The addition time of a silver halide of the invention into image forming layer application liquid is from 180 minutes before application to directly before application, preferably from 60 minutes to 10 seconds before application, however, the mixing method and mixing conditions are not particularly restricted providing the effect of the invention is manifested sufficiently. As the specific mixing method, there is a method of mixing in a tank so that the average residence time calculated from the addition flow rate and the liquid feeding amount to a coater is set at a desired length, a method using a static mixer described in N. Harnby, M. F. Edwards, A. W. Nienow, translated by K. Takahashi, Liquid Mixing Technology (Nikkan Kogyo Shinbunsha, 1989), chapter 8, and the like.

1-2. Reducing Agent

The present photothermographic material contains a reducing agent for organic silver salts. Any of substances capable of reducing silver ion, preferably organic substances having such capabilities, can be used as the reducing agent. Although reducing agents used in usual photographic development, such as phenidone, hydroquinone and catechol, are also effective, the hindered phenols represented by the following formula (R) are used to advantage in the invention. These compounds are illustrated below in detail.

General formula (R)

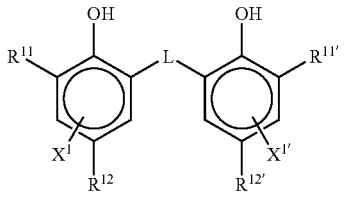

In formula (R), $R^{11}$ and $R^{11'}$ each represent a 1–20C alkyl group independently. $R^{12}$ and $R^{12'}$ independently represent a hydrogen atom or a group capable of substituting for a hydrogen on a benzene ring. L represents a linkage group —S— or —$CHR^{13}$—. $R^{13}$ represents a hydrogen atom or a 1–20C alkyl group. $X^1$ and $X^{1'}$ independently represent a hydrogen atom or a group capable of substituting for a hydrogen atom on a benzene ring.

Each of those substituents are illustrated below in detail.

1) $R^{11}$ and $R^{11'}$ $R^{11}$ and $R^{11'}$ are each independently a substituted or unsubstituted alkyl group containing 1 to 20 carbon atoms. The alkyl group is not particularly restricted as to its substituents, but it can preferably have as its substituent(s) an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group or/and a halogen atom.

2) $R^{12}$ and $R^{12'}$, $X^1$ and $X^{1'}$ $R^{12}$ and $R^{12'}$ each represent a hydrogen atom or a group capable of substituting for a hydrogen on a benzene ring independently. $X^1$ and $X^{1'}$ also independently represent a hydrogen atom or a group capable of substituting for a hydrogen atom on a benzene ring.

Suitable examples of groups capable of substituting for hydrogen atoms on the benzene rings respectively include an alkyl group, an aryl group, a halogen atom, an alkoxy group and an acylamino group.

3) L

L represents a linkage group —S— or —$CHR^{13}$—. $R_{13}$ represents a hydrogen atom or an alkyl group containing 1 to 20 carbon atoms. The alkyl group may have a substituent or substituents.

Examples of an unsubstituted alkyl group represented by $R^{13}$ include a methyl group, an ethyl group, a propyl group, a butyl group, a heptyl group, an undecyl group, an isopropyl group, a 1-ethylpentyl group and 2,4,4-trimethylpentyl group.

The substituent(s) the alkyl group can have are the same as in the case of $R^{11}$, and examples thereof include a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group and a sulfamoyl group.

4) Preferred Substituents

The substituents preferred as $R^{11}$ and $R^{11'}$ are secondary or tertiary alkyl groups containing 3 to 15 carbon atoms, with examples including an isopropyl group, an isobutyl group, a t-butyl group, a t-amyl group, a t-octyl group, a cyclohexyl group, a cyclopentyl group, a 1-methylcyclohexyl group and a 1-methylcyclopropyl group. Of these groups, tertiary alkyl groups containing 4 to 12 carbon atoms, especially a t-butyl group, a t-amyl group and a 1-methylcyclohexyl group, are preferred over the others. In particular, a t-butyl group is advantageous over the others.

The substituents preferred as $R^{12}$ and $R^{12'}$ are alkyl groups containing 1 to 20 carbon atoms, with examples including a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group and a methoxyethyl group. Of these groups, a methyl group, an ethyl group, a propyl group, an isopropyl group and a t-butyl group are preferred over the others.

The substituents preferred as $X^1$ and $X^{1'}$ include a hydrogen atom, a halogen atom and an alkyl group. In particular, it is advantageous that both $X^1$ and $X^{1'}$ are hydrogen atoms.

L is preferably a linkage group —$CHR^{13}$—.

$R^{13}$ is preferably a hydrogen atom or an alkyl group containing 1 to 15 carbon atoms. Suitable examples of such an alkyl group include a methyl group, an ethyl group, a propyl group, an isopropyl group and a 2,4,4-trimethylpentyl group. In particular, a hydrogen atom, a methyl group, a propyl group and an isopropyl group are preferred as $R^{13}$.

When $R^{13}$ is a hydrogen atom, $R^{12}$ and $R^{12'}$ are preferably alkyl groups containing 2 to 5 carbon atoms, far preferably ethyl and propyl groups, particularly preferably ethyl groups.

When $R^{13}$ is a primary or secondary alkyl group containing 1 to 8 carbon atoms, $R^{12}$ and $R^{12'}$ are preferably methyl groups. EXAMPLEs of a primary or secondary 1–8C alkyl group suitable for $R^{13}$ include a methyl group, an ethyl group, a propyl group and an isopropyl group. Of these groups, methyl, ethyl and propyl groups are preferred as $R^{13}$.

When all of $R^{11}$, $R^{11'}$, $R^{12}$ and $R^{12'}$ are methyl groups, $R^{13}$ is preferably a secondary alkyl group. In this case, the secondary alkyl group of $R^{13}$ is preferably an isopropyl group, an isobutyl group or a 1-ethylpentyl group, and far preferably an isopropyl group.

Thermal developing capabilities of the reducing agents represented by formula (R) vary with combinations of $R^{11}$, $R^{11'}$, $R^{12}$, $R^{12'}$ and $R^{13}$. As the thermal developing capability can be adjusted by using in combination with two or more of the reducing agents in various mixing ratios, the combined use of at least two reducing agents may be preferable depending on the intended purpose.

Examples of a compound represented by formula (R) according to the invention are illustrated below, but these examples should not be interpreted as limiting the scope of the invention.

(I-1)

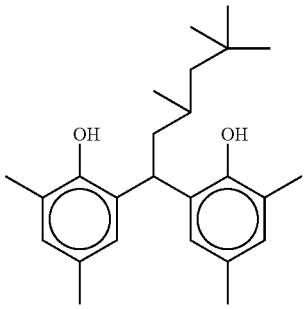

(I-2)

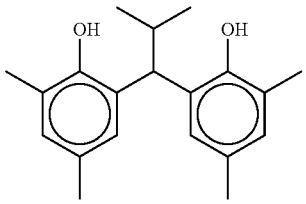

(I-3)

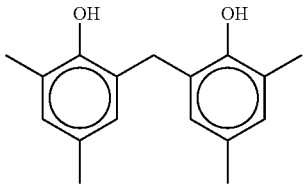

(I-4)

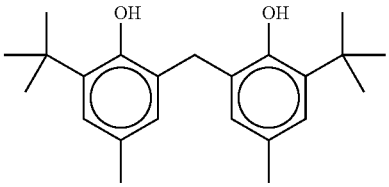

(I-5)

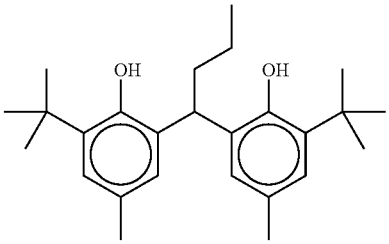

-continued
(I-6)
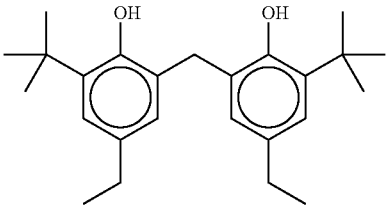
(I-7)
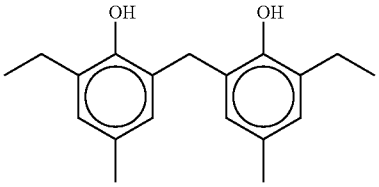
(I-8)
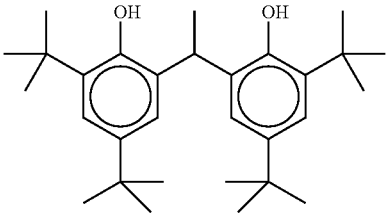
(I-9)
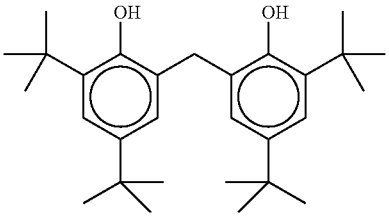
(I-10)
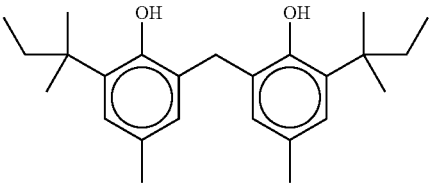
(I-11)
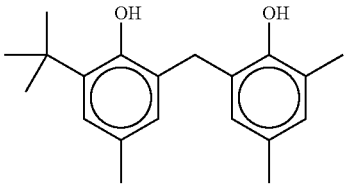
(I-12)
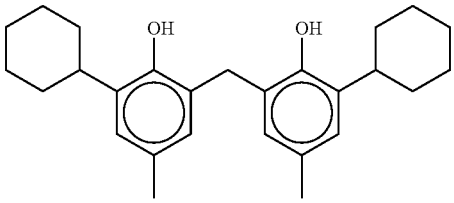
-continued
(I-13)
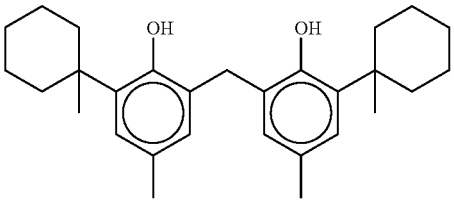
(I-14)
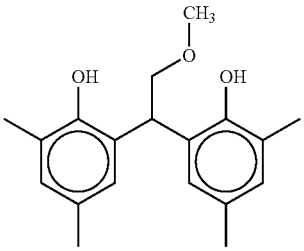
(I-15)
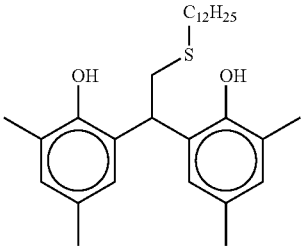
(I-16)
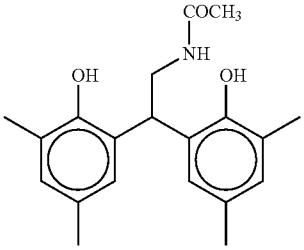
(I-17)
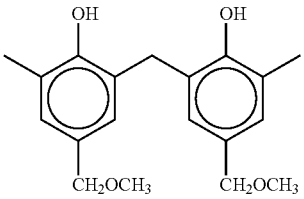
(I-18)
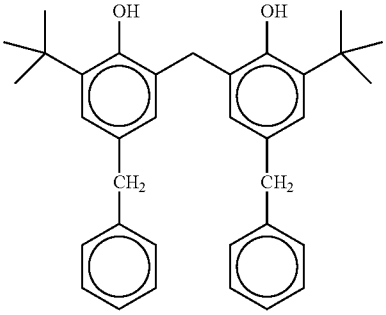

-continued (I-19)

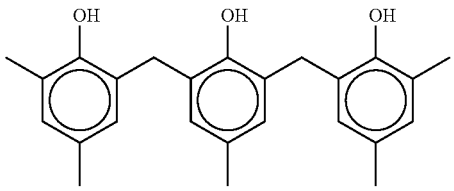

(I-20)

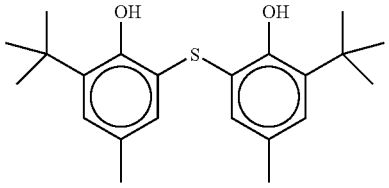

(I-21)

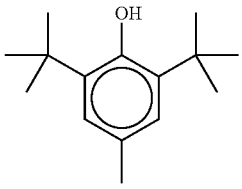

(I-22)

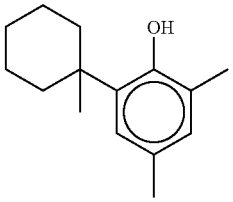

(I-23)

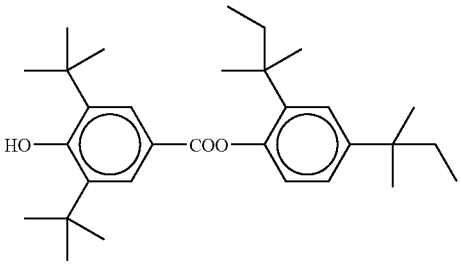

(I-24)

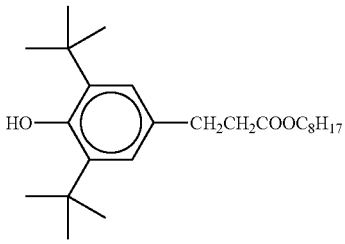

(I-25)

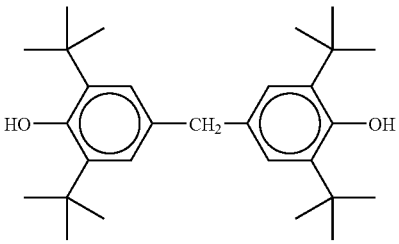

-continued (I-26)

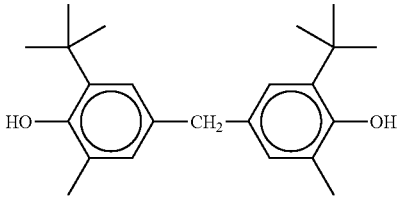

(I-27)

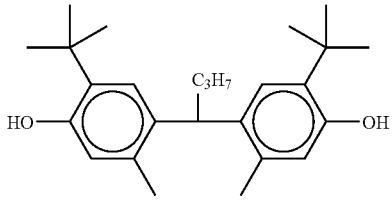

The suitable amount of reducing agent(s) added in the invention is from 0.01 to 5.0 g/m$^2$, preferably from 0.1 to 3.0 g/m$^2$. And it is appropriate that the reducing agent be contained in a proportion of 5 to 50 mole %, preferably 10 to 40 mole %, to one mole of silver on the side of the image-forming layer.

Although the present reducing agent(s) can be added to an image-forming layer containing organic silver salts and light-sensitive silver halide or the layers adjacent thereto, it is preferable to add them to the image-forming layer. The present reducing agents can be added to a coating composition in any manner. For instance, they may be added in the form of a solution, an emulsion dispersion or a dispersion of fine solid particles.

1-3. Compound of the General Formula (1)

The photothermographic material according to the invention comprises a compound as represented by the following general formula (1) as an antifoggant:

$$Q\text{-}(Y)_n\text{—}C(Z_1)(Z_2)X \qquad \text{General formula (1)}$$

wherein Q represents a heterocyclic group;

Y represents a divalent connecting group;

n represents 0 or 1;

$Z_1$ and $Z_2$ each represent a halogen atom; and

X represents a hydrogen atom or an electron-withdrawing group.

In the general formula (1), Q is preferably a nitrogen-containing heterocyclic group containing from 1 to 3 nitrogen atoms and, particularly preferably, a 2-pyridyl group or a 2-quinolyl group.

X is preferably an electron-withdrawing group, more preferably a member selected from the group consisting of: a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group and particularly preferably a halogen atom. Among such halogen atoms, a chlorine atom, a bromine atom and an iodine atom are preferable, a chlorine atom and a bromine atom are more preferable, and a bromine atom is most preferable.

Y is preferably a member selected from the group consisting of: —C(═O)—, —SO— and —$SO_2$—, more preferably —C(═O)— or —$SO_2$— and particularly preferably —$SO_2$—.

n represents 0 or 1 and is preferably 1.

Compounds which are represented by the general formula (1) are given below, but the invention is by no means limited thereto.

(1-1)

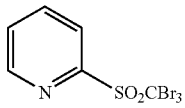

(1-2)

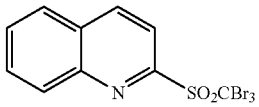

(1-3)

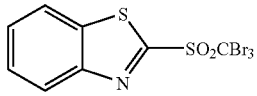

(1-4)

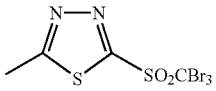

(1-5)

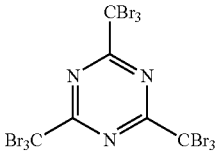

(1-6)

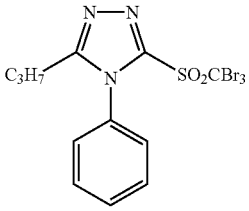

(1-7)

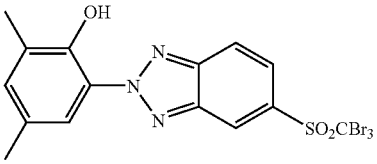

A compound of the general formula (1) of the invention is used in an amount of preferably $10^{-4}$ to 1 mol, more preferably $10^{-3}$ to 0.5 mol, further preferably $10^{-2}$ to 0.2 mol, per mol of a non-photosensitive silver salt in an image forming layer.

1-4. Compound of the General Formula (2)

A compound of the general formula (2) of the invention will be described.

General formula (2)

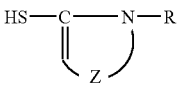

In the general formula (2), Z represents an atomic group for forming a 5-membered and 6-membered aromatic heterocycle containing an atom selected from carbon, oxygen, nitrogen, sulfur, selenium and tellurium. Z may also have a substituent. These substituents may be mutually bonded to form a cyclic structure which gives a condensed ring together with a cyclic structure formed of Z. Preferable specific examples of the aromatic heterocycle are imidazole, pyrazole, triazole, tetrazole, thiaziazole, thiazidine, pyridazine, pyrimidine, pyrazine, triazine and the like. Particularly preferable are imidazole, triazole and tetrazole. Most preferable is imidazole.

In the general formula (2), R represents a hydrogen atom, alkyl group, aralkyl group, alkoxy group or aryl group. The alkyl group, aralkyl group, alkoxy group and aryl group may have a substitutable group as a substituent.

Specific examples of the alkyl group R include methyl, ethyl, propyl and cyclohexyl groups, and the like. Specific examples of the aralkyl group R include a benzyl group, and the like. Specific examples of the alkoxy group R include a methoxy group, ethoxy group, and the like. Specific examples of the aryl group R include a phenyl group, naphthyl group, and the like. Specific examples of the substitutable substituent include amino groups, amide groups, sulfoneamide groups (a methylsulfoneamide group and the like), ureide groups, urethane groups (a metylurethane group, ethylurethane group and the like), aryloxy groups (a phenyl group, naphthoxy group and the like), sulfamoyl groups, carbamoyl groups (an ethylcarbamoyl group, phenylcarbamoyl group and the like), aryl groups (a phenyl group, naphtyl group and the like), alkylthio groups (a methylthio group, hexylthio group and the like), arylthio groups (a phenylthio group and the like), hydroxyl group, halogen atoms (fluorine, chlorine, bromine, iodine and the like), sulfonic groups, carboxylic groups, cyano groups, carboxyl groups or salts thereof, phosphoric amide groups), substituted alkyl groups: substituents (amino groups, amide groups, sulfoneamide groups, ureide groups, urethane groups, aryloxy groups, sulfamoyl groups, carbamoyl groups, aryl groups, alkylthio groups, arylthio groups, hydroxy groups, halogen atoms, sulfonic groups, carboxylic groups, cyano groups, carboxyl groups or salts thereof, or phosphoric amid groups. These substituents may further have a substituent, and as this substituent, those as listed for the above-mentioned R and substituents thereof are mentioned.

R represents preferably a hydrogen atom, substituted or unsubstituted phenyl groups, alkyl groups. The total carbon number of R is preferably from 0 to 20. Particularly preferable are a hydrogen atom, and substituted or unsubstituted phenyl groups.

Preferable compounds of the general formula (2) are 2-mercapto benzsoles, 1-phenyl-5-mercapto tetrazoles, particularly, 2-mercapto-6-methylbenzimidazole is preferable.

Specific examples of compounds of the general formula (2) are shown below, but the scope of the invention is not limited to them.

2-1

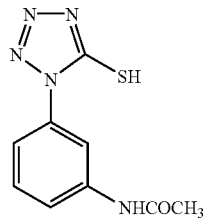

-continued
2-2
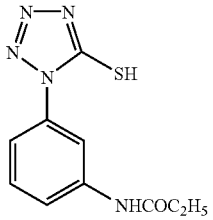
2-3
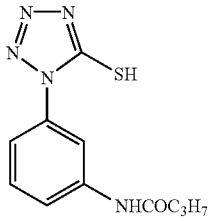
2-4
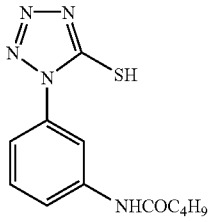
2-5
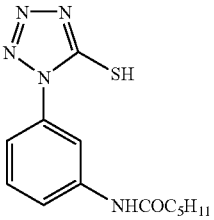
2-6
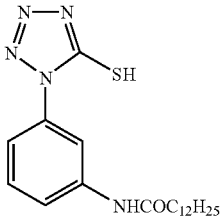
2-7
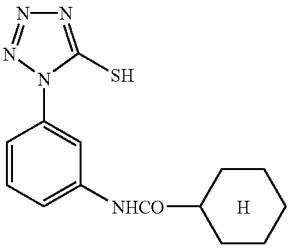
-continued
2-8
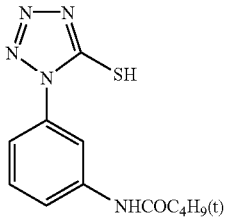
2-9
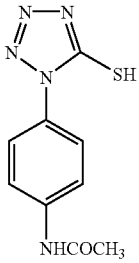
2-10
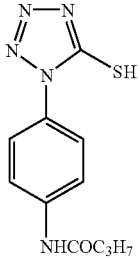
2-11
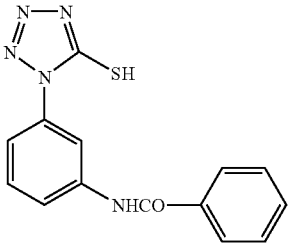
2-12
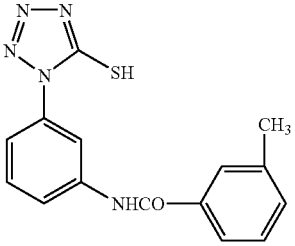
2-13
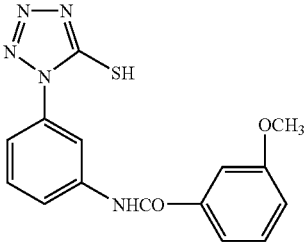

-continued
2-14
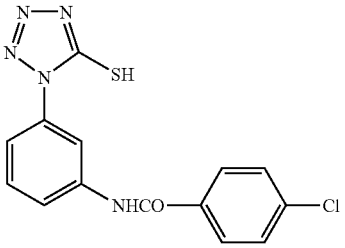
2-15
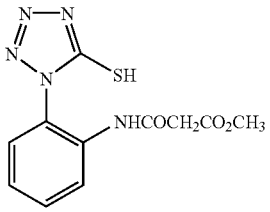
2-16
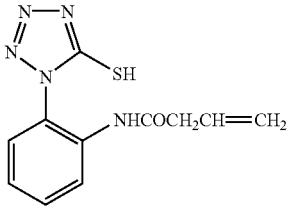
2-17
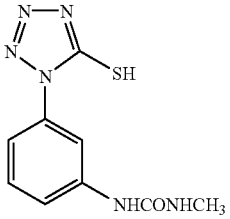
2-18
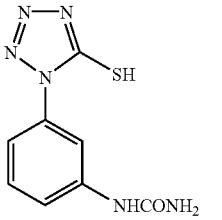
2-19
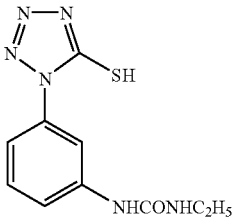
2-20
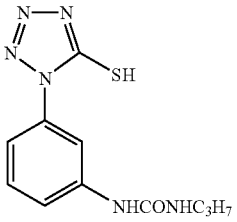
-continued
2-21
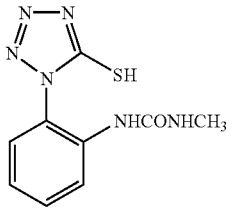
2-22
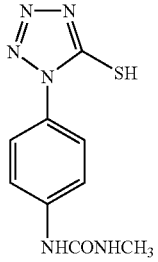
2-23
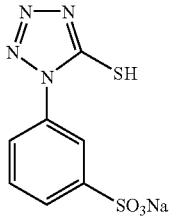
2-24
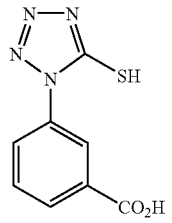
2-25
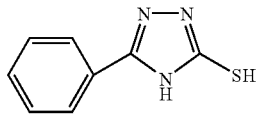
2-26
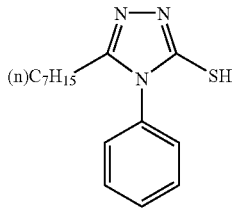
2-27
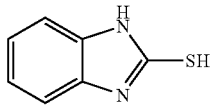
2-28
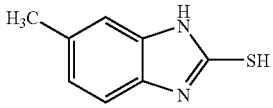

-continued
2-29
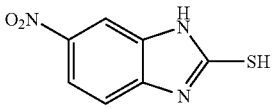
2-30
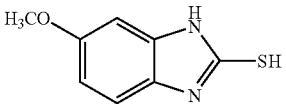
2-31
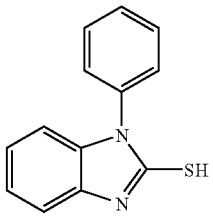
2-32
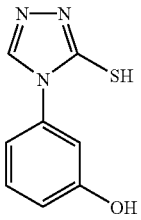
2-33
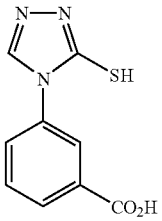
2-34
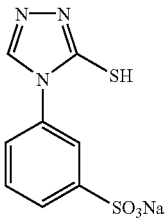
2-35
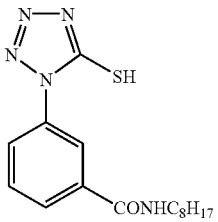
2-36
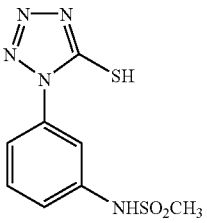
-continued
2-37
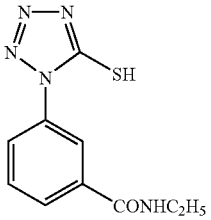
2-38
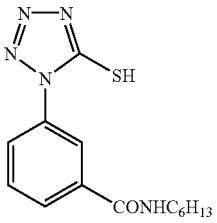
2-39
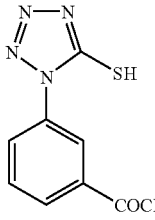
2-40
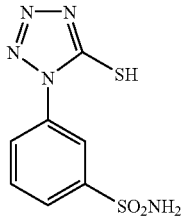
2-41
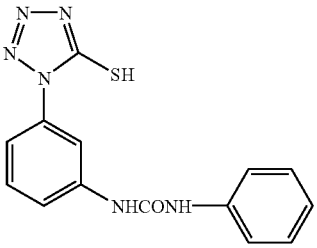
2-42
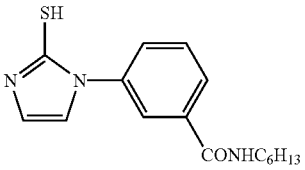
2-43
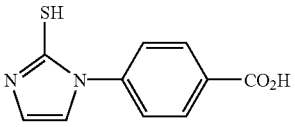

-continued
2-44
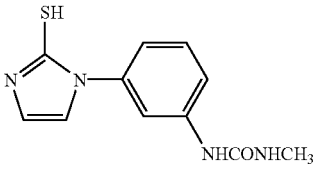
2-45
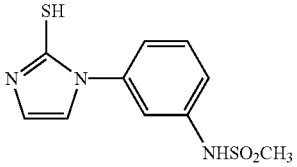
2-46
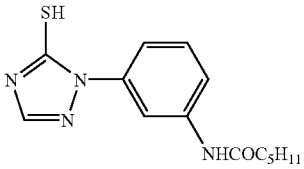
2-47
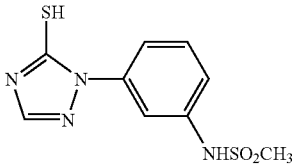
2-48
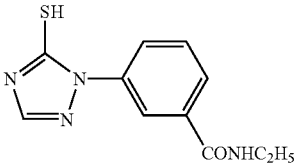
2-49
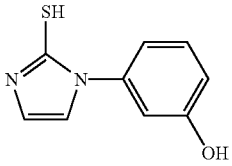
2-50
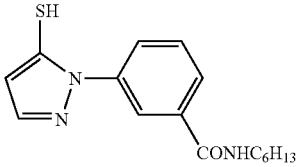
2-51
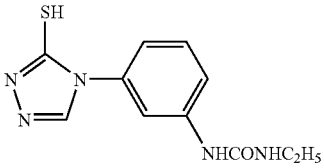
-continued
2-52
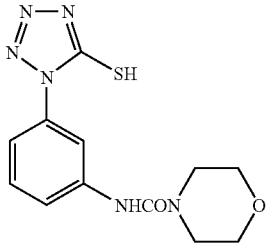
2-53
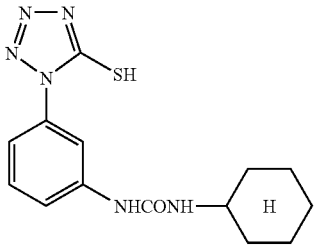
2-54
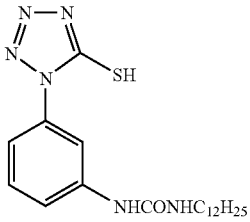
2-55
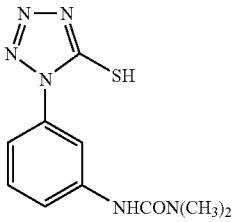
2-56
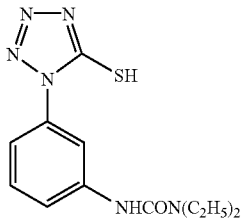
2-57
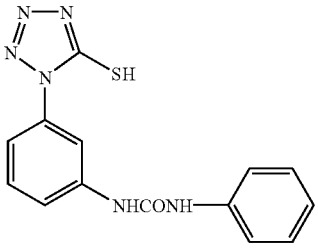

-continued
2-58
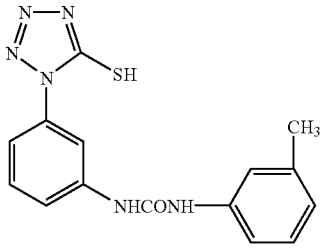
2-59
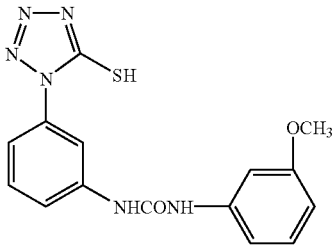
2-60
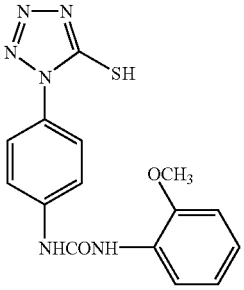
2-61
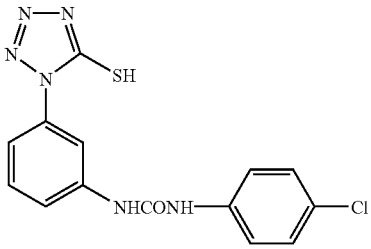
2-62
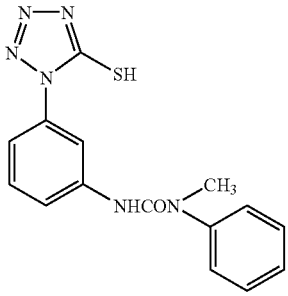
2-63
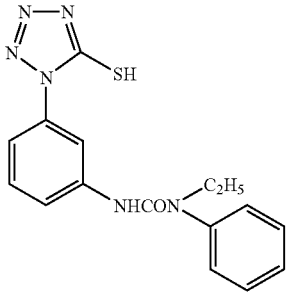
-continued
2-64
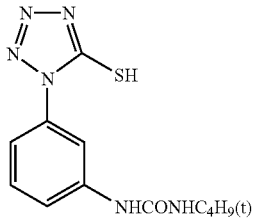
2-65
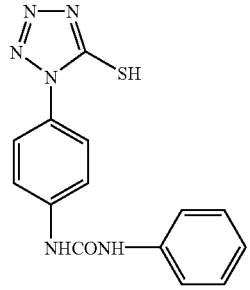
2-66
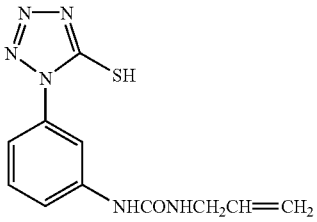
2-67
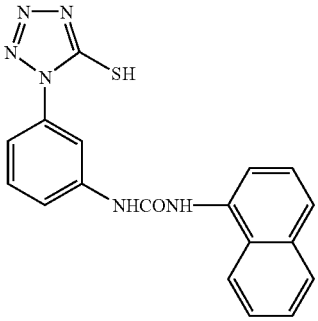
2-68
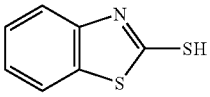
2-69
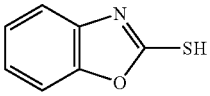
2-70
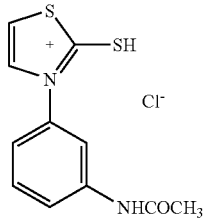
The compounds of the general formula (2) can be dissolved in water or suitable organic solvents, for example, alcohols (methanol, ethanol, propanol, fluorinated alcohol), ketones (acetone, methyl ethyl ketone), dimethylformamide, dimethylsulfoxide, methylcellosolve and the like, before use.

Further, the compounds of the general formula (2) can be dissolved, by an already well known emulsification dispersion method, using an oil such as dibutyl phthalate, tricresyl phosphate, glyceryl triacetate, diethyl phthalate and the like, or an auxiliary solvent such as ethyl acetate, cyclohexanone and the like, and an emulsified dispersion is mechanically produced, to be used. Further, a powder of a compound of the general formula (2) is dispersed in water in a ball mil, colloid mill, according to a method known as a solid dispersion method, or by ultrasonic wave, before use.

The compound of the general formula (2) can be contained in any layer providing it is a layer on the side of a layer containing a silver halide on a substrate, and it is preferable that the compound of the general formula (2) is contained in a layer containing a silver halide emulsion or its adjacent layer.

The addition amount of the general formula (2) is preferably $1\times10^{-4}$ to $5\times10^{-1}$ mol, more preferably $5\times10^{-4}$ to $5\times10^{-2}$ mol per mol of a silver halide.

1-5. Compound of the General Formula (T1)

Benzotriazole compounds of the following general formula (T1) will be described in detail below.

General formula (T1)

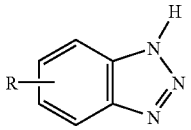

In the formula, R represents a hydrogen atom, alkyl group having 1 to 4 carbon atoms, aryl group, halogen atom, amino group, nitro group, alkoxycarbonyl group, substituted or unsubstituted carboxylic acid or salt thereof, or sulfonic acid or salt thereof.

Among groups represented by R, as the alkyl group having 1 to 4 carbon atoms, for example, a methyl group, ethyl group, butyl group and the like are listed, and as the aryl group, for example, a phenyl group and the like are listed, and as the halogen atom, for example, a chlorine atom, bromine atom and the like are listed. The salts of carboxylic acids or sulfonic acids are alkali metal salts, for example, sodium salts, potassium salts and the like are listed.

Specific examples of compounds of the general formula (T1) in the invention are shown below, but compounds which can be used in the invention are not limited only to these compounds.

1-1

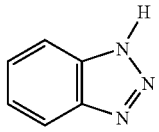

1-2

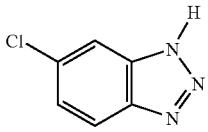

-continued 1-3

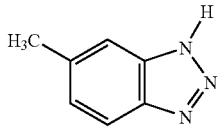

1-4

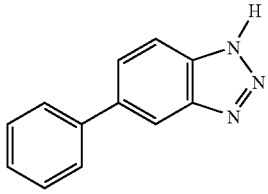

1-5

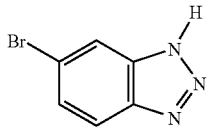

1-6

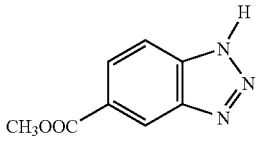

1-7

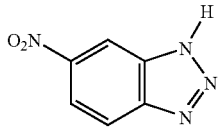

1-8

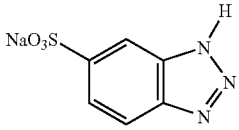

The compound of the general formula (T1) can be added to any layer providing it is a layer on the side of an image forming layer on a substrate, and it is particularly preferable that the compound of the general formula (T1) is added to a layer containing a photosensitive silver halide (hereinafter, described as image forming layer) or a layer adjacent to the image forming layer.

In corporating the compound of the general formula (T1) into these layers, the compound is added itself in application liquid, or dissolved in a solvent such as water, methyl ethyl ketone (MEK), alcohol and the like before addition.

The amount of the compound of the general formula (T1) in these layers is from $10^{-4}$ to 1 mol, preferably $10^{-3}$ to 0.1 mol per mol of total silver amount.

The compound of the general formula (T1) may be added singly or in combination of two or more.

1-6. Compound of the General Formula (T2)

General formula (T2)

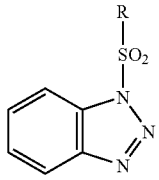

R represents an alkyl or alkenyl group having 20 or less carbon atoms, preferably an alkyl or alkenyl group having 10 or less carbon atoms, more preferably an alkyl or alkenyl group having 5 or less carbon atoms, an aryl, alkaryl or aralkyl group having 20 or less carbon atoms, preferably an aryl, alkaryl or aralkyl group having 10 or less carbon atoms, more preferably an aryl, alkaryl or aralkyl group having 6 or less carbon atoms, an aliphatic or aromatic heterocyclic group having 6 or less carbon atoms, or carbocyclic group having 6 or less carbon atoms.

R itself may have further substituents. For example, when R represents an alkyl, alkenyl, cycloalkyl, aryl, alkaryl, aralkyl, aliphatic or aromatic heterocyclic group or carbocyclic group, these groups may further be substituted. Non-limiting typical substituents include alkyl groups (for example, methyl, ethyl, propyl, iso-propyl and the like); halogen groups (for example, fluorine, chlorine, bromine, iodine); alkoxy or aryloxy groups (for example, methoxy, ethoxy, phenoxy and the like); nitro; cyano, alkylsulfonyl groups or arylsulfonyl groups. This kind of substituents and methods of producing them are known to those having ordinary knowledge in the field of organic chemistry, and when R represents an aryl group such as a phenyl group or the like, these substituents and methods are particularly general.

The benzotriazole group itself may have substituents. Non-limiting typical substituents include alkyl groups (for example, methyl, ethyl, propyl, iso-propyl and the like); halogen groups (for example, fluorine, chlorine, bromine, iodine); alkoxy or aryloxy groups (for example, methoxy, ethoxy, phenoxy and the like); nitro; cyano, alkylsulfonyl groups or arylsulfonyl groups. This kind of substituents and methods of producing them are known to those having ordinary knowledge in the field of organic chemistry.

The preferable compounds of the above-mentioned general formula (T2) are those in which R represents an aryl group such as a phenyl group, substituted phenyl group or the like.

Specific examples of compounds of the general formula (T2) in the invention are shown below, but compounds in the invention are not limited only to these compounds.

2-1

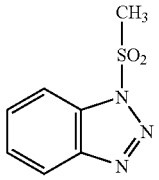

2-2

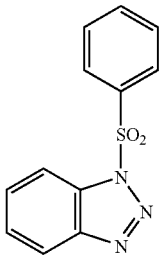

-continued 2-3

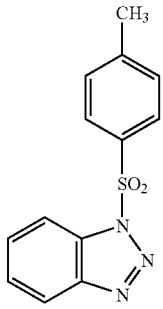

2-4

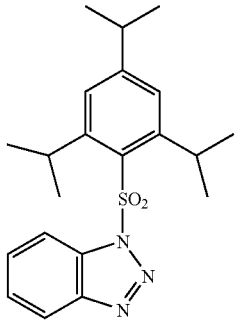

2-5

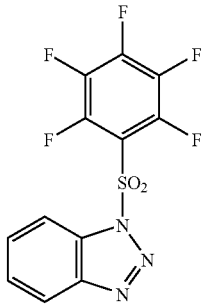

2-6

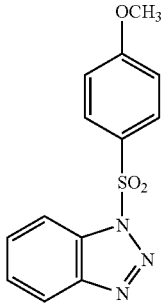

2-7

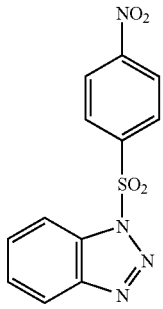

-continued 2-8

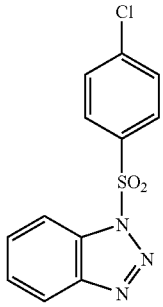

The compound of the general formula (T2) can be added to any layer providing it is a layer on the side of an image forming layer on a substrate, and it is particularly preferable that the compound of the general formula (T2) is incorporated in an image forming layer or a layer adjacent to the image forming layer.

In incorporating the compound of the general formula (T2) into these layers, it is possible that the compound is added itself, or dissolved in a solvent such as water, methyl ethyl ketone (MEK), alcohol and the like before addition in application liquid.

The addition amount of the compound of the general formula (T2) is from $10^{-4}$ to 1 mol, preferably $10^{-3}$ to 0.1 mol per mol of total silver.

The compound of the general formula (T2) may be added singly or in combination of two or more. Further, the compound of the general formula (T2) may be added alone or in combination with a compound of the general formula (T1). When the compound of the general formula (T2) is used in combination with a compound of the general formula (T1), it is preferable that the addition amount is within the above-mentioned range.

1-7. Antifoggant

As the antifoggant, stabilizer and stabilizer precursor which can be used in the invention, there are listed those described in JP-A No. 10-62899, paragraph no. 0070, EP-A No. 0803764A1, p. 20, line 57 to p. 21, line 7, compounds described in JP-A Nos. 9-281637 and 9-329864, and compounds described in U.S. Pat. Nos. 6,083,681 and 6,083,681, and EP No. 1048975. An antifoggant preferably used in the invention is an organic halogen compound, and as examples thereof, those disclosed in JP-A No. 11-65021, paragraph nos. 0111 to 0112 are listed. Particularly, organic halogen compounds represented by the formula (P) in JP-A No. 2000-284399, organic polyhalogen compounds represented by the general formula (II) in JP-A No. 10-339934, and organic polyhalogen compounds described in JP-A Nos. 2001-31644 and 2001-33911, are preferable.

1) Polyhalogen Compound

Hereinafter, in the present invention, other organic polyhalogen compounds may be used together with the above-mentioned compounds of the general formula (1). The preferably polyhalogen compounds which can be used in the invention are compounds of the following general formula (H).

$$Q\text{-}(Y)n\text{-}C(Z_1)(Z_2)X \qquad \text{General formula (H)}$$

In the general formula (H), Q represents an alkyl group, aryl group or heterocyclic group, Y represents a divalent connecting group, n represents 0 or 1, $Z_1$ and $Z_2$ represent a halogen atom, and X represents a hydrogen atom or an electron withdrawing group.

In the general formula (H), when Q represents an aryl group, Q preferably represents a phenyl group substituted with an electron withdrawing group showing a positive value of Hammett's substituent constant σp. Regarding the Hammett's substituent constant, Journal of Medicinal Chemistry, 1973, Vol. 16, No. 11, 1207 to 1216 and the like can be referred to. Such electron withdrawing groups include, for example, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54), cyano group (σp value: 0.66), nitro group (σp value: 0.78), aliphatic/aryl or heterocyclic sulfonyl group (for example, methanesulfonyl (σp value: 0.72)), aliphatic/aryl or heterocyclic acyl group (for example, acetyl (σp value: 0.50), benzoyl (σp value: 0.43), alkyl groups (for example, C≡CH (σp value: 0.23)), aliphatic/aryl or heterocyclic oxycarbonyl group (for example, methoxycarbonyl (σp value: 0.45), phenylcarbonyl (σp value: 0.44), carbamoyl group (σp value: 0.36), sulfamoyl group (σp value: 0.57), sulfoxide groups, heterocyclic groups, phosphoryl groups and the like. σp value is preferably in the range from 0.2 to 2.0, more preferably from 0.4 to 1.0. The electron withdrawing group is particularly preferably a carbamoyl group, alkoxycarbamoyl group, alkylsulfonyl group or alkylphosphoryl group, and of them, a carbamoyl group is most preferable.

X represents preferably an electron withdrawing group, more preferably a halogen atom, aliphatic,aryl or heterocyclic sulfonyl group, aliphatic,aryl or heterocyclic acyl group, aliphatic,aryl or heterocyclic oxycarbonyl group, carbamoyl group or sulfamoyl group, particularly preferably a halogen atom. Of halogen atoms, a chlorine atom, bromine atom and iodine atom are preferable, a chlorine atom and bromine atom are further preferable, and a bromine atom is particularly preferable.

Y represents preferably —C(═O)—, —SO— or —$SO_2$—, more preferably —C(═O)— or —$SO_2$—, particularly preferably —$SO_2$—. n represents 0 or 1, preferably 1.

Specific examples of a compound of the general formula (H) in the invention are shown below.

(H-1)

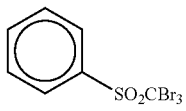

(H-2)

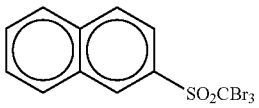

(H-3)

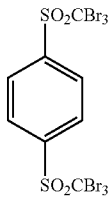

-continued (H-4)

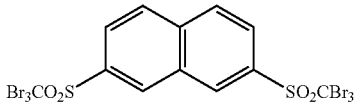

(H-5)

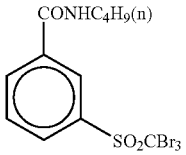

(H-6)

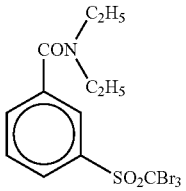

(H-7)

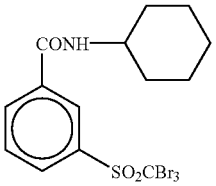

(H-8)

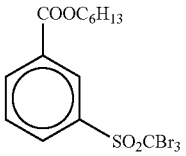

(H-9)

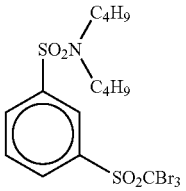

(H-10)

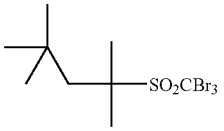

(H-11)

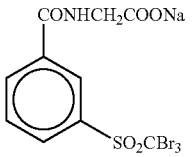

(H-12)

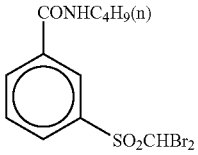

-continued (H-13)

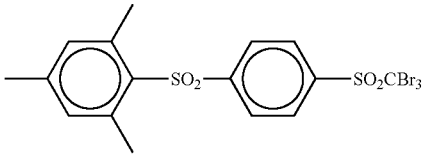

(H-14)

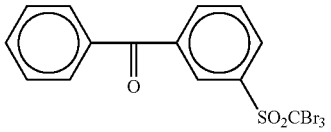

(H-15)

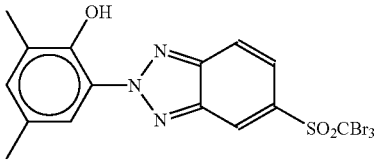

As preferable polyhalogen compounds in the invention other than the above-mentioned compounds, there are listed compounds described in JP-A Nos. 2001-31644, 2001-56526 and 2001-209145.

The compound the general formula (H) in the invention is incorporated at an amount of preferably from $10^{-4}$ to 1 mol, more preferably $10^{-3}$ to 0.5 mol, most preferably $1\times10^{-2}$ to 0.2 mol per mol of a non-photosensitive silver salt in an image forming layer.

In the invention, the method for incorporating an antifoggant in a photosensitive material is simular to a method described in the above-mentioned reducing agent. An organic polyhalogen compound is also preferably added in the form of solid fine particle dispersion.

2) Compound of the General Formula (PR)

It is preferable that the photothermographic material of the invention contains a propen nitrile compound of the following general formula (PR) as an antifoggant.

General formula (PR)

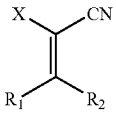

In the formula, $R_1$ represent a hydroxyl group or metal salt, $R_2$ represents an alkyl group or aryl group, X represents an electron withdrawing group or $R_1$ and X together form a ring containing an electron attractive group.

The electron withdrawing group represented by X will be described. The electron withdrawing group is defined by Hammett's constant $\sigma_p$. Hammett's constant $\sigma_p$ is defined by Hammett's Law: $\text{Log } K/K^0=\sigma_p\rho$. $K^0$ is the acid dissociation constant of a reference substance in an aqueous solution of 25° C., K is the analogous constant of an acid substituted at para-position. $\sigma_p$ value is determined for acid dissociation constant regarding p-substituted benzoic acid, where $\rho=1$. In the case of no substitution, $\sigma_p=0$, and a positive $\sigma_p$ value means that the group is an electron withdrawing group. When the $\sigma_p$ value is positive and larger, the electron withdrawing property is greater.

The electron withdrawing group X should have an electron withdrawing property at least equivalent to —COOR (here, R represents, for example, H, $CH_3$ or —$CH_2CH_3$). The Hammett's constant $\sigma_p$ is 0.43 for —COOH, 0.39 for —$COOCH_3$, and 0.45 for —$COOC_2H_5$. Namely, the electron donative group in the invention has to have a $\sigma_p$ of 0.39 or more. Non-limiting examples of such an electron withdrawing group include cyano groups, alkoxycarbonyl groups, methaloxycarbonyl groups, hydroxycarbonyl groups, nitro group, acetyl group, perfluoroalkyl groups, alkylsulfonyl groups, arylsulfonyl groups, and other groups listed in Lange, Handbook of Chemistry, vol. 14, McGraw-Hill, 1992, chapter 9, pp. 2 to 7.

$R_1$ may be a hydroxy group or a metal salt of a hydroxy group, for example, $OM^+$ (wherein, $M^+$ is a metal cation) Preferable $M^+$ is a monovalent cation such as $Li^+$, $Na^+$, $K^+$, $Fe^{+2}$, and may also be a divalent or trivalent cation.

$R_2$ represents an alkyl group or aryl group. When $R_2$ represents an alkyl group, the number of carbon atom is preferably from 1 to 20, more preferably from 1 to 10, most preferably from 1 to 4. Particularly preferably alkyl group is a methyl group. When $R_2$ is an aryl group, the number of carbon atom is preferably from 5 to 10, more preferably from 6 to 10. The most preferably aryl group is a phenyl group.

$R_1$ can also form a ring containing an electron withdrawing group, together with X. Preferably, the ring is 5-membered, 6-membered or 7-membered ring. Examples of such a ring include a lactone ring or cyclohexene ring shown in the following compound PR-08.

The propen-nitrile compound in the invention may be prepared by a method described later.

Propen-nitrile compounds useful in the invention are shown below. Most of them can present at both of the form of "enol" or "keto" tautomer, and the following chemical structure are shown only at the "enol" form. These are only typical examples, and the propen-nitrile compound is not limited to them.

PR-01

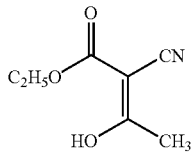

PR-02

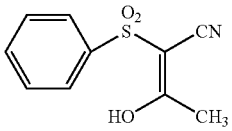

PR-03

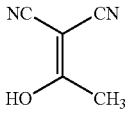

PR-04

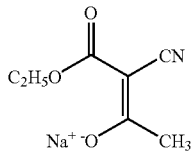

-continued

PR-05

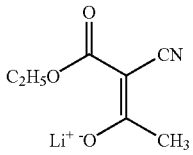

PR-06

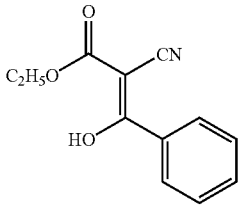

PR-07

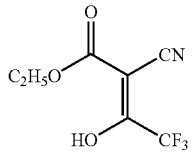

PR-08

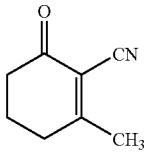

These compounds are different from those described in U.S. Pat. No. 5,545,515. In the compounds described in this publication, the end position of an acrylonitrile group (namely, position corresponding to $R_2$ of the general formula (PR) in the invention) is a hydrogen atom, for imparting a co-developer effect giving high contrast. The compound of the instant application does not have a hydrogen atom at the position of $R_2$, being different from the compound described in the above-mentioned publication. Owing to this difference, an effect is performed of reducing fogging without imparting ultra-high contrast.

The compound of the general formula (PR) in the invention can be added to an undercoating layer, intermediate layer, surface protective layer and the like in addition to an image forming layer, providing the layer is on the side of an image forming layer. Particularly preferably, the compound of the general formula (PR) is added to a layer adjacent to a layer containing a photosensitive silver halide.

The amount of the compound of the general formula (PR) in these layers is preferably $1\times10^{-7}$ mol/m$^2$~$1\times10^{-1}$ mol/m$^2$, more preferably $1\times10^{-6}$ mol/m$^2$~$1\times10^{-2}$ mol/m$^2$, particularly preferably $1\times10^{-5}$ mol/m$^2$~$5\times10^{-3}$ mol/m$^2$.

In the invention, at least one of compounds of the general formula (PR) may be advantageously added, and it is also possible to be aded in combination of two or more of them together.

The compound of the general formula (PR) can be dissolved in water or a suitable organic solvent, for example, alcohols (methanol, ethanol, propanol, fluorinated alcohol), ketones (acetone, methyl ethyl ketone), dimetylformamide, dimethylsulfoxide, methylcellosolve, and the like, before use.

Further, the compounds of the general formula (PR) can be dissolved in oil such as dibutyl phthalate, tricresyl phosphate, glyceryl triacetate, diethyl phthalate and the like, or an auxiliary solvent such as ethyl acetate, cyclohexanone and the like to be emulsified by an already well known emulsification dispersion method mechanically. Further, a powder of a compound of the general formula (PR) is dispersed in water, according to a method known as a solid dispersion method by a ball mil, colloid mill, or ultrasonic wave, before use.

3) Other Antifoggants

Other antifoggants include mercury (II) salts described in JP-A No. 11-65021, paragraph no. 0113, benzoic acids described in the same publication, paragraph no. 0114, salicylic acid derivatives described in Japanese Patent Application No. 2000-206642, formaldehyde scavenger compounds of the formula (S) described in Japanese Patent Application No. 2000-221634, triazine compounds according to claim 9 in JP-A No. 11-352624, compounds of the general formula (III) in JP-A No. 6-11791, 4-hydroxy-6-methyl-1,3,3a,7-tetrazaindene, and the like.

The photothermographic material in the invention may contain an azolium salt for the purpose of preventing fogging. Listed as the azolium salt are compounds of the general formula (XI) described in JP-A No. 59-193447, compounds described in JP-B No. 55-12581, and compounds of the general formula (II) described in JP-A No. 60-153039. The azolium salt may be added to any kayers of a photosensitive material, however, it is preferably added to a layer on the surface of an image forming layer, and further preferably added to an organic silver salt-containing layer. The azolium salt may be conducted at any process in application liquid preparation, and when added to an organic silver salt-containing layer, it may be added at any process from organic silver salt preparation to application liquid preparation, and preferably after organic silver salt preparation to directly before application. The azolinium salt may be added in any form such as powder, solution, finer particle dispersion and the like. Further, it may also be added in the form of solution mixed with other additives such as a sensitizing dye, reducing agent, toner and the like. In the invention, the amount of the azolinium salt in these layers is not particularly restricted, and preferably from $1\times10^{-6}$ mol or more and 2 mol or less, further preferably from $1\times10^{-3}$ mol or more and 0.5 mol or less per mol of silver.

1-8. Non-photosensitive Organic Silver

1) Composition

The non-photosensitive organic silver particle according to the invention (hereinafter, simply referred to as "organic silver salt" in some cases) is a silver salt which is relatively stable against light, however, forms a silver image when heated at 80° C. or higher in the presence of an exposed light catalyst (latent image of a photosensitive silver halide, and the like) and a reducing agent.

The organic silver salt may be any organic substance which can be a source capable of feeding a silver ion. Such non-photosensitive organic silver salts are described in JP-A Nos. 06-130543, 08-314078, 09-127643, 10-62899, paragraph nos. 0048?0049, JP-A Nos. 10-94074, 10-94075, EP-A No. 0803764A1, p. 18, line 24 to p. 19, line 37, EP-A Nos. 0962812A1, 1004930A2, JP-A Nos. 11-349591, 2000-7683, 2000-72711, 2000-112057, 2000-155383, and the like.

The non-photosensitive organic silver salt in the invention is preferably a silver salt of an organic acid, particularly a silver salt of a long chain aliphatic carboxylic acid (having 10 to 30 carbon atoms, preferably 15 to 28), and preferable examples of the organic silver salt include silver behenate, silver arachidate, silver stearate, silver oleate, silver laurate, silver capronate, silver myristate, silve palmitate, and mixtures thereof, and the like. Of these organic solver salts, it is preferable to use an organic acid silver having a silver behenate content of 30 mol % or more and 90 mol % or less. Particularly, the silver behenate content is preferably 40 mol % or more and 70 mol % or less. Remaining organic silver salts are silver salts of long chain aliphatic carboxylic acids, preferably, silver salts of long chain aliphatic carboxylic acids having 10 to 30 carbon atoms, particularly 15 to 28 carbon atoms.

2) Shape

The shape of an organic silver salt particle is not particularly restricted, and a needle crystal having short axis and long axis is preferable. In the filed of a silver halide photography photosensitive material, the inverse proportion between the size and covering power of a silver salt particle is well known. This relation is observed also in the photothermographic material of the invention, and it means that the larger the size of an organic silver particle in the image forming layer is, the lower the covering power decreases and image density lowers. Therefore, it is preferable to decrease the size of organic silver. In the present invention, it is preferable that the short axis is 0.01 μm~0.15 μm, the long axis is 0.10 μm~5.0 μm, it is more preferable that the short axis is 0.01 μm 0.15 μm, the long axis is 0.10 μm~4.0 μm, it is more preferable that the short axis is 0.01 μm~0.15 μm, the long axis is 0.10 μm~4.0 μm.

The particle size distribution of an organic silver salt is preferably in mono-dispersion. In mono-dispersion, percentage of value obtained by dividing standard deviation of the length of the short axis and the length of the long axis by the short axis and long axis is preferably 100% or less, more preferably 80% or less, further preferably 50% or less.

3) Preparation

The organic silver salt is produced by adding an alkali metal salt (for example, sodium hydroxide, potassium hydroxide and the like) to an organic acid to produced an alkali metal soap of the organic acid, then, mixing it with a water-soluble silver salt (for example, silver nitrate), and a photosensitive silver halide can be added at any stage.

These salt formation processes are all conducted with a water solvent, then, dehydration and drying are conducted, then, re-dispersion into a solvent such as MEK and the like is effected. Drying is conducted in a gas flow mode flash jet drier under an oxygen partial pressure of preferably 15 vol % or less, more preferably 15 vol % or less and 0.01 vol % or more, further preferably 10 vol % or less and 0.01 vol % or more.

Though an organic silver salt is used in given amount, the silver application amount is preferably from 0.1 to 5 g/m$^2$, further preferably from 1 to 3 g/m$^2$.

1-9. Development Accelerator

In the photothermographic material of the invention, a development accelerator is preferably contained. As the development accelerator, preferably used are sulfonamidephenol-based compounds of the general formula (A) described in JP-A Nos. 2000-267222 and 2000-330234, and the like, hindered phenol-based compounds of the general formula (II) described in JP-A No. 2001-92075, hydrazine-based compounds of the general formula (I) described in JP-A Nos. 10-62895 and 11-15116, and of the general formula (1) described in JP-A Nos. 2001-07478, phenol-based or naphthol-based compounds of the general formula (2) described in JP-A Nos. 2001-264929. These development accelerators are used in an amount of from 0.1 to 20 mol %, preferably from 0.5 to 10 mol %, more preferably from 1 to 5 mol %, based on a reducing agent. As the method of introducing accelerators into a sensitive material, the same method as for a reducing agent is mentioned, and in particular, addition in the form of solution is preferable.

In the invention, hydrazine-based compounds of the general formula (1) described in JP-A No. 2001-074278 and naphthol-based compounds of the general formula (2) described in JP-A No. 2001-264929 are particularly preferable, of the above-mentioned development accelerators.

Specific preferable examples of the development accelerators in the invention are listed below. The invention is not limited to them.

(A-1)

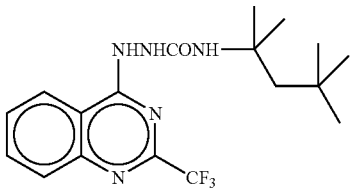

(A-2)

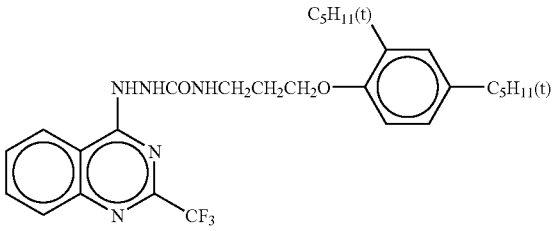

(A-3)

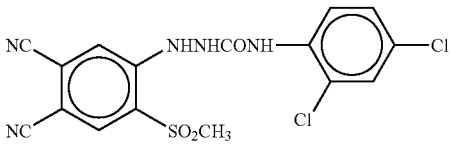

(A-4)

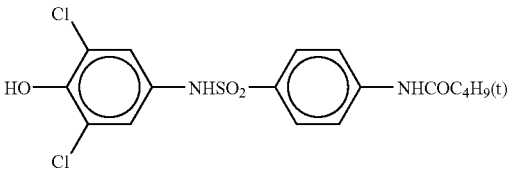

(A-5)

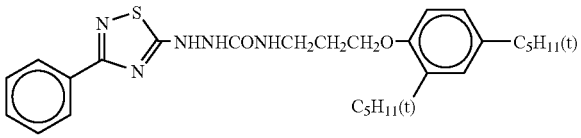

(A-6)

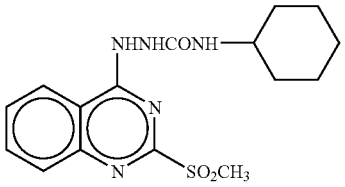

-continued (A-7)

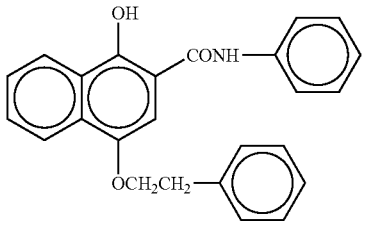

(A-8)

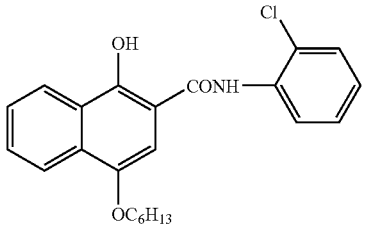

(A-9)

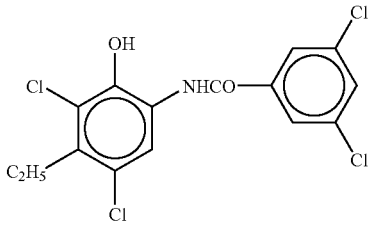

(A-10)

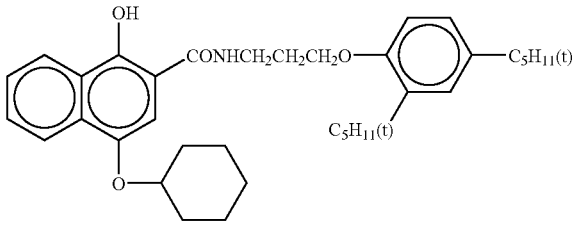

1-10. Binder

As the binder in an image forming layer in the photosensitive material of the invention, any polymer may be used, and a suitable binder is transparent or semitransparent, and generally colorless, and examples thereof include natural resins and polymers and copolymers, synthetic resins and polymers and copolymers, and other media forming films, for example, gelatins, rubbers, poly(vinyl alcohols), hydroxyethylcelluloses, cellulose acetates, cellulose acetate butyrates, poly(vinylpyrrolidones), casein, starch, poly (acrylic acid), poly(methyl methacryaltes), poly(vinyl chlorides), poly(methacrylic acids), styrene-maleic anhydride copolymers, styrene-acrylonitrile copolymers, styrene-butadiene copolymers, poly(vinyl acetals) (for example, poly (vinyl formal) and poly(vinyl butyral)), poly(esters), poly (urethanes), phenoxy resins, poly(vinylidene chlorides), poly(epoxydes), poly(carbonates), poly(vinyl acetates), poly (olefins), cellulose esters, poly(amides).

The binder may be used in combination of two or more. In this case, two or more polymers different in glass transition temperature (hereinafter, described as Tg) may be blended and used.

In this specification, Tg was calculated according to the following formula.

$$1/Tg=\Sigma(Xi/Tgi)$$

Here, a polymer is obtained by copolymerization of n monomers from i=1 to n. Xi is the weight fraction ($\Sigma Xi=1$) of i-th monomer, Tgi is the glass transition temperature (absolute temperature) of a homopolymer of i-th monomer. $\Sigma$ is sum of from i=1 to n. Regarding the glass transition temperature of a homopolymer of each monomer (Tgi), values according to Polymer Handbook (3rd Edition) (J. Brandrup, E. H. Immergut (Wiley-Interscience, 1989)) were adopted.

Since the binder is applied using an organic solvent described later, any compound can be used selected from polyvinyl acetal, polyvinyl chloride, polyvinyl acetate, cellulose acetate, polyolefin, polyester, polystyrene, polyacrylonitrile, polycarbonate, polyvinylbutyral, butyl ethyl cellulose, methacrylate copolymer, maleic anhydride ester copolymer, polystyrene and butadiene-styrene copolymer and the like. Particularly, in an image forming layer, polyvinylbutyral is preferably contained as a binder, and specifically, polyvinylbutyral is used as a binder in an amount of 50% by weight or more based on the binder total weight in an image forming layer. Of course, a copolymer and terpolymer are also contained. The preferable total amount of polyvinylbutyral is from 50% by weight or more and 100% by weigh or less, further preferably from 70% by weight or more and 100% by weigh or less based on the binder total weight in an image forming layer. Tg of a binder is preferably from 40 to 90° C., further preferably from 50 to 80° C. When two or more polymers different in Tg are blended and used, it is preferable that the weight-average Tg is in the above-mentioned range.

The-binder total amount is so sufficient as to keep components of an image forming layer in its layer. That is, binders are used in an amount within the range giving effective function as a binder. The effective range can be suitably determined by those skilled in the art. The ratio of a binder and an organic silver salt is from 15:1 to 1:3, preferably from 8:1 to 1:2 by weight, as approximate standard when at least an organic silver salt is kept.

1-11. Solvent for Application

Examples of a solvent are described in New Solvent Pocket Book (Shinban Yozai Pocket Book) (Ohm, 1994) and the like, but the scope of the invention is not limited to them. The boiling point of a solvent used in the invention is preferably 40° C. or more and 180° C. or less. Specific examples of a solvent include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisol, ethyelen glycol diethyl ether, N,N-dimethylformamide, morpholine, propanesultone, perfluorotributylamine, water and the like. Of them, methyl ethyl ketone is preferably used since it has suitable boiling point, gives uniform surface condition of the applied layers, easily in drying, and can decrease the solvent residue.

Regarding the solvent used for application, it is preferable that the amount thereof remaining in the layers after application and drying (solvent residue) is as low as possible. The solvent residue is, in general, evaporated into environment in exposure or thermal development of the photothermographic material, to cause uncomfortable feeling and also undesirable influence on human health.

In the invention, the solvent residue is, in the case of MEK, preferably from 0.1 mg/m$^2$ to 150 mg/m$^2$, more preferably from 0.1 mg/m$^2$ to 80 mg/m$^2$, further preferably from 0.1 mg/m$^2$ to 40 mg/m$^2$.

1-12. Tone Controlling Agent

In the photothermographic material of the invention, it is preferable that a phenol derivative of the following general formula (P) is contained as a tone controlling agent for developed silver.

General formula (P)

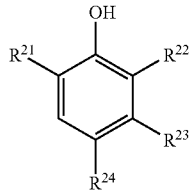

In the formula, $R^{21}$ and $R^{22}$ represent each independently a hydrogen atom, alkyl group or acylamino group. However, each of $R^{21}$ and $R^{22}$ does not represents 2-hydroxyphenylmethyl, and they do not simultaneously represent a hydrogen atom. $R^{23}$ represents a hydrogen atom or alkyl group. $R^{24}$ represents a substituent which can be substituted on a benzene ring.

$R^{21}$ represents, in the case of alkyl group, preferably an alkyl group having 1 to 30 carbon atoms, more preferably an alkyl group having 1 to 10 carbon atoms.

The alkyl group may have a substituent. Specific examples of unsubstituted alkyl groups include preferably methyl, ethyl, butyl, octyl, isopropyl, t-butyl, t-octyl, t-amyl, sec-butyl, cyclohexyl, 1-methyl-cyclohexyl and the like, and more preferably groups sterically larger than an isopropyl group (for example, an isopropyl group, isononyl group, t-butyl group, t-amyl group, t-octyl group, cyclohexyl group, 1-methyl-cyclohexl group, adamantly group and the like), and of them, particularly preferably tertiaryl alkyl groups: t-butyl, t-octyl, t-amyl and the like.

As the substituent when the above-mentioned alkyl group has a substituent, listed are halogen atoms, aryl groups, alkoxy groups, amino groups, acyl groups, acylamino groups, alkylthio groups, arylthio groups, sulfoneamide groups, acyloxy groups, oxycarbonyl groups, carbamoyl groups, sulfamoyl groups, sulfonyl groups, phosphoryl groups and the like.

$R^{22}$ represents, in the case of alkyl group, preferably an alkyl group having 1 to 30 carbon atoms, more preferably an unsubstituted alkyl group having 1 to 24 carbon atoms.

The alkyl group may have a substituent. Specific examples of unsubstituted alkyl groups include preferably methyl, ethyl, butyl, octyl, isopropyl, t-butyl, t-octyl, t-amyl, sec-butyl, cyclohexyl, 1-methyl-cyclohexyl and the like.

Examples of the substituent are the same as for $R^{21}$.

$R^{21}$ and $R^{22}$ represent, in the case of acylamino group, preferably an acylamino group having 1 to 30 carbon atoms, more preferably an acylamino group having 1 to 10 carbon atoms.

The acylamino group may be unsubstituted or have a substituent. Specifically listed are an acetylamino group, alkoxyacetylamino group, aryloxyacetylamino group and the like.

$R^{21}$ represents preferably an alkyl group, among a hydrogen atom, alkyl groups and acylamino groups.

On the other hand, $R^{22}$ represents preferably a hydrogen atom or an unsubstituted alkyl group having 1 to 24 carbon atoms, among a hydrogen atom, alkyl groups and acylamino groups, and specifically listed are a methyl group, isopropyl group and t-butyl group.

Here, each of $R^{21}$ and $R^{22}$ does not represents 2-hydroxyphenylmethyl group, and they do not simultaneously represent a hydrogen atom.

$R^{23}$ represents a hydrogen atom or alkyl group, and of them, preferably a hydrogen atom or alkyl group having 1 to 30 carbon atoms, more preferably a hydrogen atom or alkyl group having 1 to 24 carbon atoms. Explanation of the alkyl group is the same as for $R^{22}$. Specifically listed are a methyl group, isopropyl group and t-butyl group.

It is preferably either one of $R^{22}$ and $R^{23}$ is a hydrogen atom.

$R^{24}$ represents a group which can be substituted on a benzene ring, is a group having the same definition as for $R^{12}$ and $R^{12'}$ in a compound of the general formula (R). $R^{24}$ represents preferably a substituted or unsubstituted alkyl group having 1 to 30 carbon atoms or an oxycarbonyl group having 2 to 30 carbon atoms, more preferably an alkyl group having 1 to 24 carbon atoms. As the substituent on an alkyl group, listed are aryl groups, amino groups, alkoxy groups, oxycarbonyl groups, acylamino groups, acyloxy groups, imide groups, ureide groups and the like, and more preferable are aryl groups, amino groups, oxycarbonyl groups and alkoxy groups.

A further preferable structure of a compound of the general formula (P) is represented by the following general formula (P-2).

General formula (P-2)

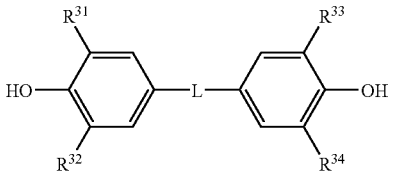

In the formula, $R^{31}$, $R^{32}$, $R^{33}$ and $R^{34}$ represent each independently a hydrogen atom, or a substituted or unsubstituted alkyl group having 1 to 20 carbon atoms. $R^{31}$ and $R^{32}$, or $R^{33}$ and $R^{34}$ do not represent simultaneously a hydrogen atom. $R^{31}$, $R^{32}$, $R^{33}$ and $R^{34}$ represent preferably an alkyl group having 1 to 10 carbon atoms. The substituent on an alkyl group is not particularly restricted, and preferably listed are aryl groups, hydroxy group, alkoxy groups, aryloxy groups, alkylthio groups, arylthio groups, acylamino groups, sulfoneamide groups, sulfonyl groups, phosphoryl groups, acyl groups, carbamoyl groups, ester groups, halogen atoms and the like. Of them, at least one of groups sterically larger than an isopropyl group (for example, an isononyl group, t-butyl group, t-amyl group, t-octyl group, cyclohexyl group, 1-methyl-cyclohexl group, adamantly group and the like) is preferably present, and two or more of them are more preferably present. Particularly preferable are tertiary alkyl groups sterically larger than an isopropyl group: t-butyl, t-octyl, t-amyl and the like. L has the same meaning as for L in a compound of the general gormula (R).

Specific examples of compounds of the general formula (P) and general formula (P-2) in the invention are shown below, but the scope of the invention is not limited to them.

P-1

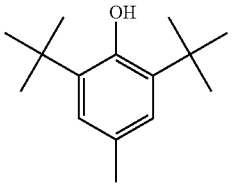

P-2

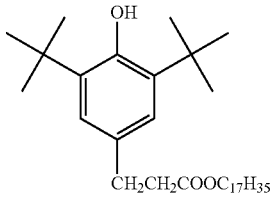

P-3

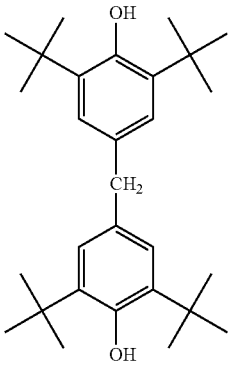

P-4

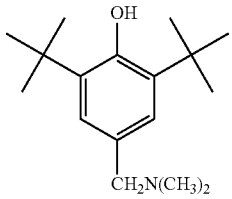

-continued
P-5
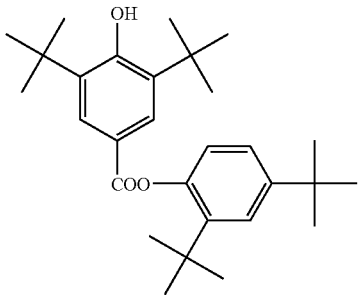
P-6
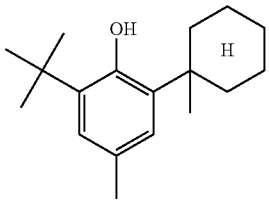
P-7
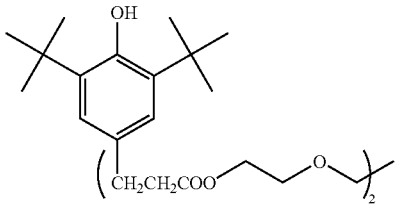
P-8
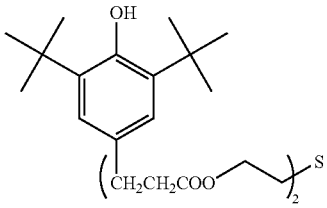
P-9
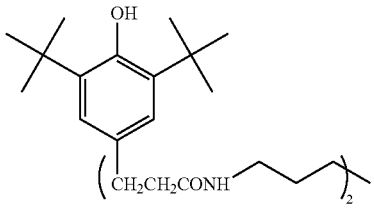
P-10
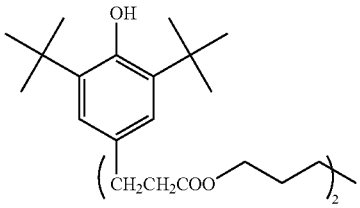
P-11
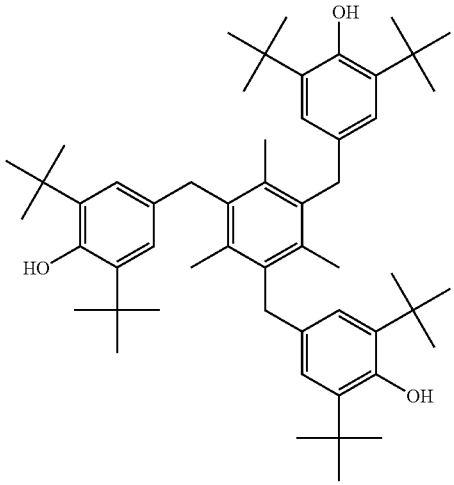
P-12
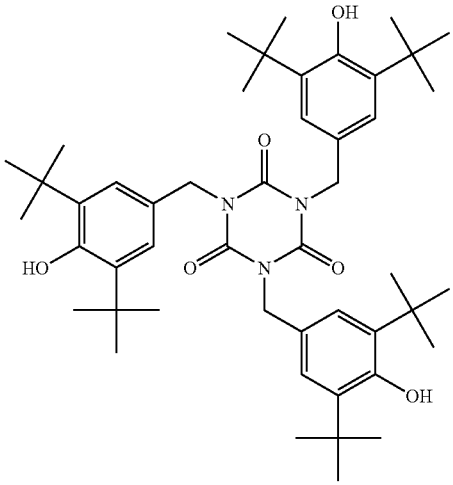
P-13
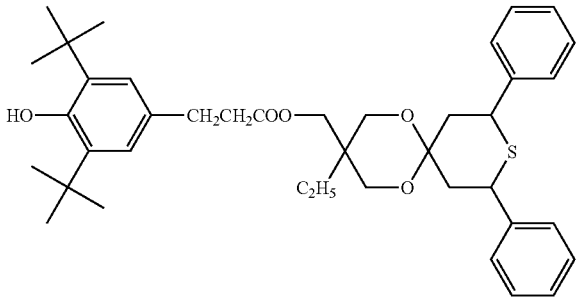

-continued
P-14
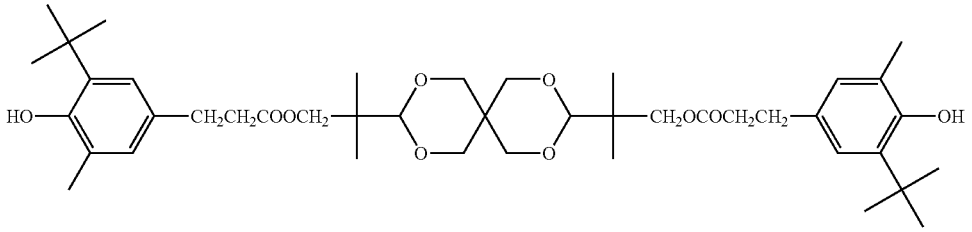
P-15
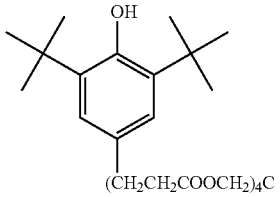
P-16
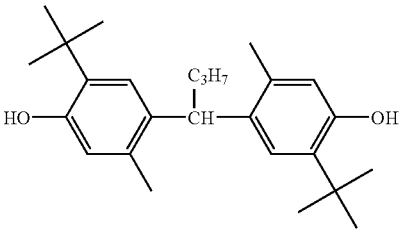
P-17
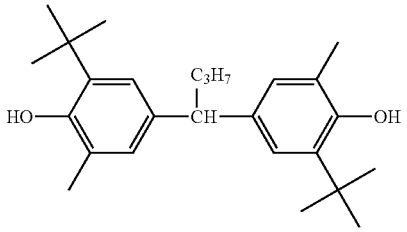
P-18
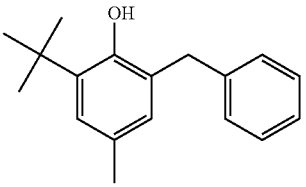
P-19
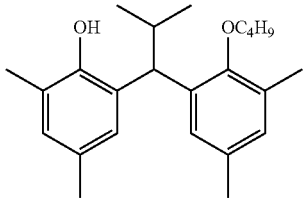
P-20
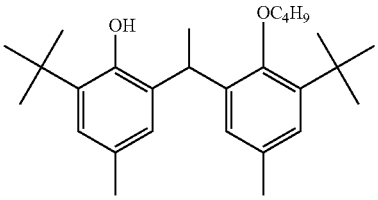
P-21
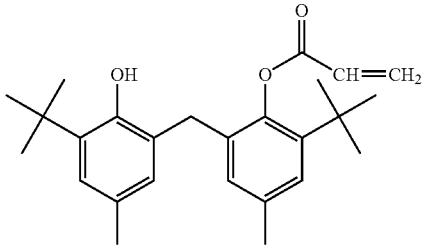
P-22
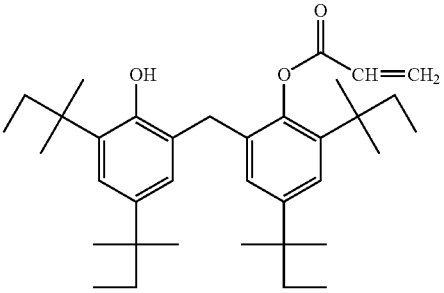
P-23
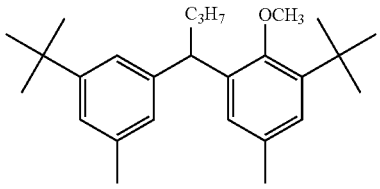
P-24
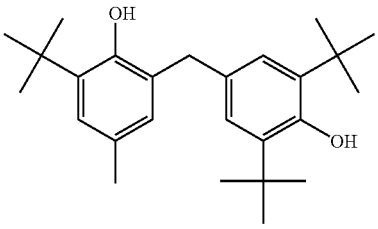

-continued
P-25
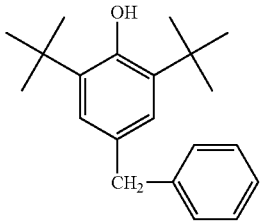
P-26
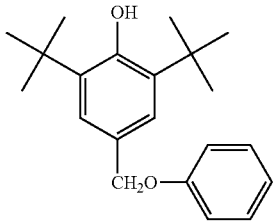
27
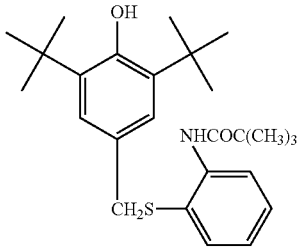
P-28
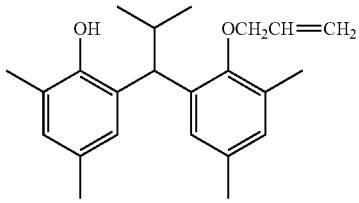
29
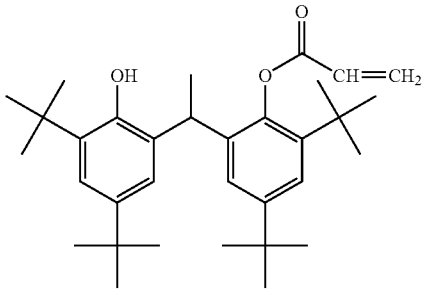
P-30
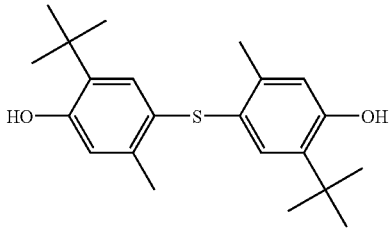
P-31
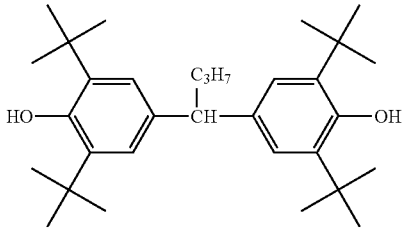
P-32
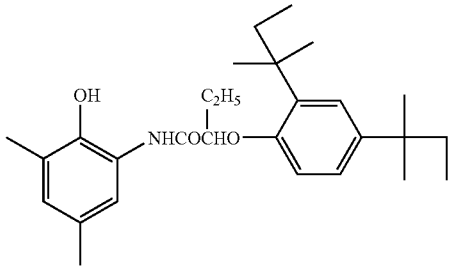
P-33
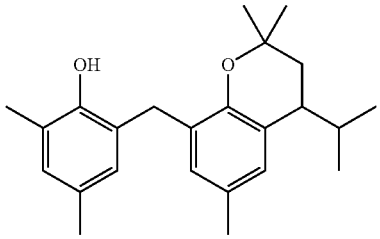
P-34
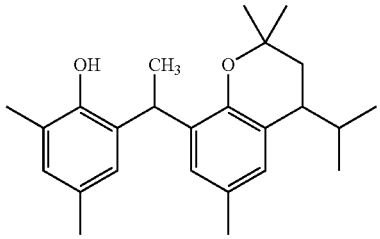
P-35
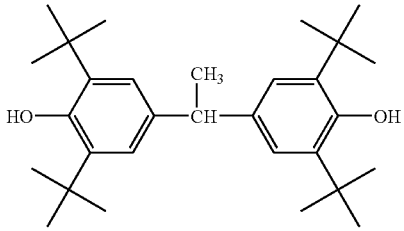
P-36
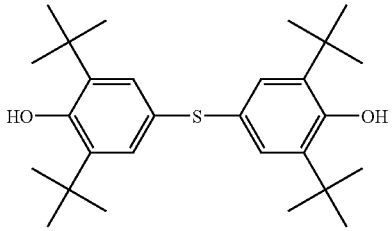

-continued

P-37

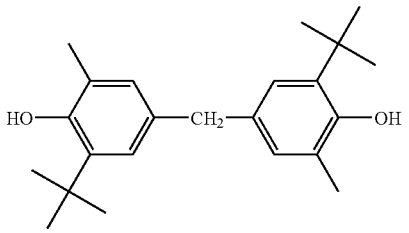

P-38

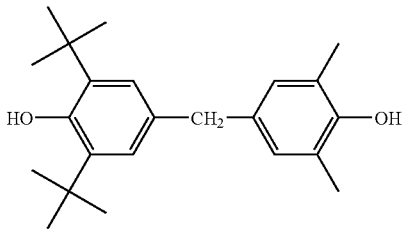

P-39

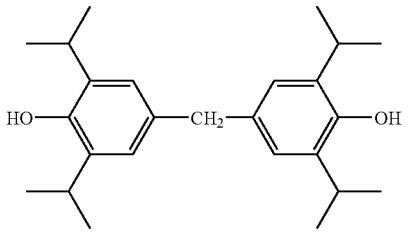

P-40

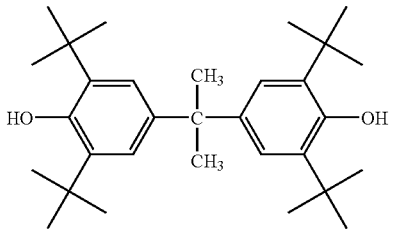

Compounds of the general formula (P) and general formula (P-2) may be contained in any form such as solution, emulsified dispersion, solid fine particle dispersion and the like in application liquid and contained in a photosensitive material.

As the emulsion dispersion method, a method is mentioned in which dissolution is effected using an oil such as dibutyl phthalate, tricresyl phosphate, glyceryl triacetate, diethyl phthalate and the like, or an auxiliary solvent such as ethyl acetate, cyclohexanone and the like, and an emulsified dispersion is mechanically produced.

As the solid fine particle dispersion method, a method is mentioned in which a powder of a compound is dispersed in a suitable solvent such as water and the like by a ball mill, colloid mill, vibration ball mill, sand mill, jet mill, roller mill or by ultrasonic wave, to produced a solid dispersion. In this operation, protective colloids (for example, polyvinyl alcohol), surfactants (for example, anionic surfactants such as sodium triisopropyl naphthalenesulfonate (mixture of three compounds different in substitution position by an isopropyl group) and the like) may be used. A water dispersion can contain a preservative (for example, benzoisothiazolinone sodium salt).

Compounds of the general formula (P) and general formula (P-2) are preferably contained in an image forming layer containing an organic silver salt, however, it may also permissible that one is contained in an image forming layer and other is contained in a adjacent non-image forming layer, or both are contained in a non-image forming layer. Further, when an image forming layer is constituted of a plurality of layers, they may also be contained respectively in separate layers.

The addition ratio (molar ratio) of a compound of the general formula (P) to a reducing agent of the general formula (R) is preferably in the range from 0.001 to 0.2, more preferably in the range from 0.005 to 0.1, further preferably in the range from 0.008 to 0.05. The addition molar ratio of a compound of the general formula (P-2) to a compound of the general formula (R) is also the same.

1-13. Phthalic Acid and Derivative Thereof

The photothermographic material of the invention preferably contains a compound selected from phthalic acid and derivatives thereof. As the phthalic acid and derivatives thereof used in the invention, compounds of the following general formula (PH) are preferable.

General formula (PH)

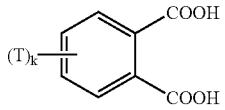

In the formula, T represents a halogen atom (fluorine, bromine, iodine), alkyl group, aryl group, alkoxy group or nitro group, and k represents an integer of 0 to 4. When k is 2 or more, a plurality of ks may be mutually the same or different. k is preferably from 0 to 2, and more preferably 0 or 1.

The compound of the general formula (PH) may be used as it is in the form of acid, or may be made into a suitable salt from the standpoints of easiness of adding into application liquid, control of PH, before use. As the salts, alkali metal salts, ammonium salt, alkaline earth metal salts, amine salts and the like can be used. Preferable are alkali metal salts (Li, Na, K salts and the like) and ammonium salt.

Specific examples of phthalic acid and derivatives thereof used in the invention are shown below, but the scope of the invention is not limited to them.

PH-1

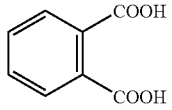

PH-2

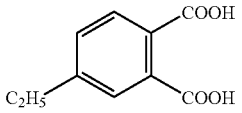

-continued

PH-3

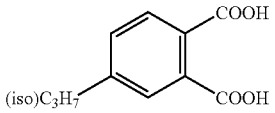

PH-4

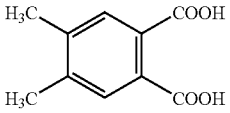

PH-5

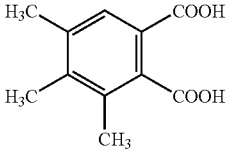

PH-6

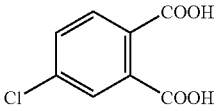

PH-7

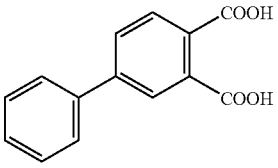

PH-8

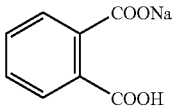

PH-9

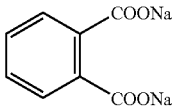

PH-10

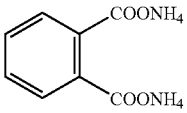

PH-11

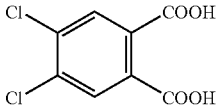

PH-12

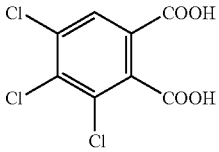

PH-13

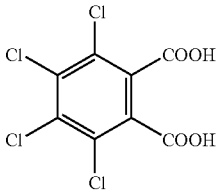

1-14. Hydrogen Bonding Compound

In the invention, it is preferable to simultaneously use a non-reducing compound having a group capable of forming a hydrogen bond with an aromatic hydroxyl group (—OH) of a reducing agent.

As the group capable of forming a hydrogen bond, listed are phosphoryl groups, sulfoxide groups, sulfonyl groups, carbonyl groups, amide groups, ester groups, urethane groups, ureide groups, tertiary amino groups, nitrogen-containing aromatic groups and the like. Of them, preferable are compounds having phosphoryl groups, sulfoxide groups, amide groups (here, >N—H group is not contained, and blocked like >N—Ra (Ra is a substituent other than H)), urethane groups (here, >N—H group is not contained, and blocked like >N—Ra (Ra is a substituent other than H)), ureide groups (here, >N—H group is not contained, and blocked like >N—Ra (Ra is a substituent other than H)).

In the invention, the particularly preferable hydrogen bonding compound is a compound of the following general formula (B).

General formula (B)

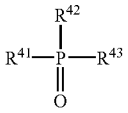

In the general formula (B), $R^{21}$ to $R^{23}$ represent each independently an alkyl group, aryl group, alkoxy group, aryloxy group, amino group or heterocyclic group, and these groups may be unsubstituted or may have a substituent.

As the substituent when $R^{21}$ to $R^{23}$ have substituents, listed are halogen atoms, alkyl groups, aryl groups, alkoxy groups, amino groups, acyl group, acylamino groups, alkylthio groups, arylthio groups, sulfoneamide groups, acyloxy groups, oxycarbonyl groups, carbamoyl groups, sulfamoyl groups, sulfonyl groups, phosphoryl groups and the like, and preferable as the substituent are alkyl groups or aryl groups, and examples thereof include a methyl group, ethyl group, isopropyl group, t-butyl group, t-octyl group, phenyl group, 4-alkoxyphenyl group, 4-acyloxyphenyl group and the like.

Specific examples of the alkyl group $R^{21}$ to $R^{23}$ include a methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group and the like.

Listed as the aryl group are a phenyl group, cresyl group, xylyl group, naphthyl group, 4-t-butylphenyl group, 4-t-octylphenyl group, 4-anisidyl group, 3,5-dichlorophenyl group and the like.

Listed as the alkoxy group are a methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group and the like.

Listed as the aryloxy group are a phenoxy group, cresyloxy group, isopropylphenoxy group, 4-t-butylphenoxy group, naphthoxy group, biphenyloxy group and the like.

Listed as the amino group are a dimethylamino group, diethylamino group, dibutylamino group, dioctylamino group, N-methyl-N-hexylamino group, dicyclohexylamino group, diphenylamino group, N-methyl-N-phenylamino group and the like.

$R^{21}$ to $R^{23}$ represent preferably an alkyl group, aryl group, alkoxy group, aryloxy group. From the standpoint of the effect of the invention, at least one of $R^{21}$ to $R^{23}$ represents an alkyl group or aryl group, and more preferably, two or more of them represent an alkyl group or aryl group. From the standpoint of availability at cheap cost, $R^{21}$ to $R^{23}$ represent the same group.

Specific examples of the hydrogen bonding compounds typically including compounds of the general formula (B) in the invention are shown below, but the scope of the invention is not limited to them.

B-1

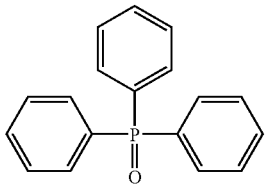

B-2

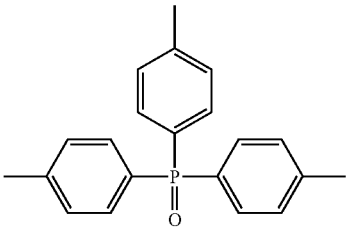

B-3

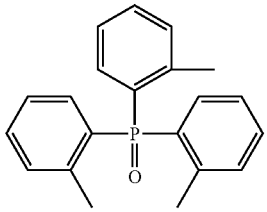

B-4

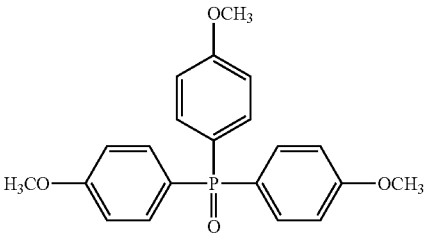

B-5

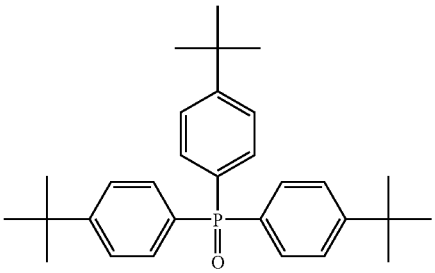

B-6

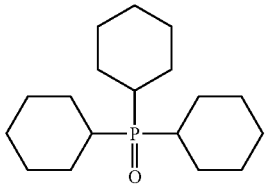

-continued

B-7

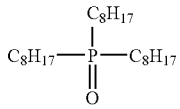

B-8

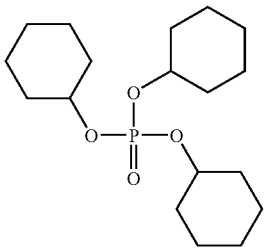

B-9

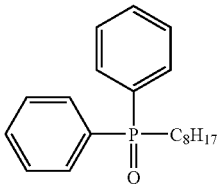

B-10

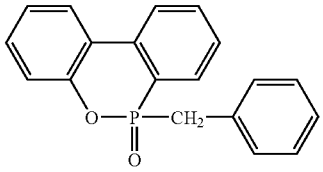

B-11

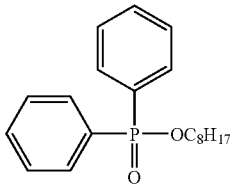

B-12

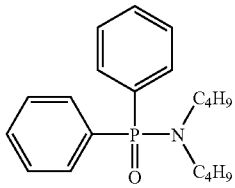

B-13

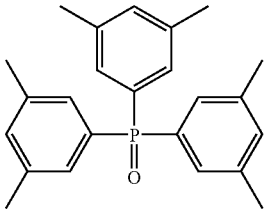

B-14

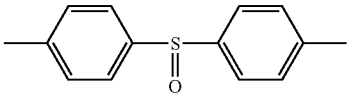

-continued

B-15

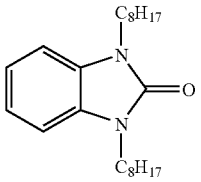

B-16

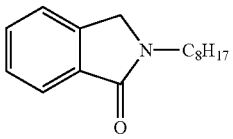

B-17

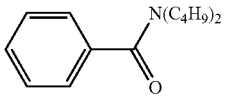

Specific examples of the hydrogen bonding compounds are described in Japanese Patent Application Nos. 2000-192191 and 2000-194811 in addition to the above-mentioned examples.

The hydrogen bonding compound of the invention can be contained in the form of solution, emulsified dispersion or solid dispersed fine particle dispersion in application liquid, and used in a photosensitive material, like the reducing agent. The compound of the invention forms a complex composed of a compound having a phenolic hydroxyl group in solution condition and a hydrogen bond, and can be isolated as a complex in the form of crystal, depending on a combination of a reducing agent with a compound of the general formula (A) in the invention.

Use of thus isolated crystal powder as a solid dispersed fine particle dispersion is particularly preferable for obtaining a stable ability. Further, a method can be also preferably use in which a reducing agent and a hydrogen bonding compound of the invention are mixed in the form of powder, and made into a complex, in dispersing by a sand grinder mill and the like using a suitable dispersing agent.

The hydrogen bonding compound of the invention is used in an amount of preferably from 1 to 200 mol %, more preferably from 10 to 150 mol %, further preferably from 30 to 100 mol % based on a reducing agent.

1-15. Other Additives

1) Disulfide Compound

In the invention, a disulfide compound represented by Ar—S—S—Ar is preferably contained, for suppressing or promoting development to control development, for improving spectral sensitization efficiency, for improving preservability before and after development, and the like. In the formula, Ar represents an aromatic or condensed aromatic ring having one or more nitrogen, sulfur, oxygen, selenium or tellurium groms.

For example, benzimidazole, naphthoimidazole, benzthiazole, naphthothiazole, benzoxazole, naphthooxazole, benzoselenazole, benzotellurazole, imidazole, oxazole, pyrazole, thiazole, thiadiazole, tetrazole, triazine, pyrimidine, pyridazine, pyrazine, pyridine, purine, quinoline and quinazoline are preferable, and benzimidazole, benzothizole and benzotellurazole are more preferable.

These aromatic rings may have substituents. As the substituents, preferable are, for example, halogen atoms (for example, Br, Cl), hydroxy group, amino groups, carboxy groups, alkyl groups (preferably having 1 to 4 carbon atoms), alkoxy groups (preferably having 1 to 4 carbon atoms), and aryl groups (may have substituents).

The amount of the disulfide compound incorporated in these layers is preferably from 0.001 to 1 mol, more preferably from 0.003 to 0.1 mol per mol of a silver halide in an image forming layer.

2) Toner

In the photothermographic material of the invention, addition of a toner is preferable, and such the toner is described in JP-A No. 10-62899, paragraph nos. 0054 to 0055, EP No. 0803764A1, p. 21, lines 23 to 48, JP-A No. 2000-356317 and Japanese Patent Application No. 2000-187298, and particularly preferable are phthalazines (phthalazinone, phthalazinone derivatives or metal salts; for example, 4-(1-naphthyl) phthalazinone, 6-chlorophthalazinone, 5,7-dimethoxyphthalazinone and 2,3-dihydro-1,4-phthalazinone); combination of phthalazinones with phthalic acids (for example, phthalic acid, 4-methylphthalic acid, 4-nitrophthalic acid, diammonium phthalate, sodium phthalate, potassium phthalate and tetrachlorophthalic anhydrice); phthalazines (phthalazine, phthalazine derivatives or metal salts; for example 4-(1-naphthyl)phthalazine, 6-isopropylphthalazine, 6-t-butylphthalazine, 6-chlorophthlazine, 5,7-dimethoxyphthalazine, and 2,3-dihydrophthalazine), and particularly, in combination with a silver halide having high silver iodide content, a combination of phthalazines with phthalic acids is preferable.

The amount of the toner incorporated in the material is preferably from 0.01 to 0.3 mol, more preferably from 0.02 to 0.2 mol, particularly preferably from 0.02 to 0.1 mol per mol of an organic silver salt. The amount of the toner is important for promotion of development, in a silver halide emulsion having a high silver iodide content in the invention, and sufficient development and low fogging can be satisfied simultaneously by selection of suitable addition amount.

3) Plasticizer, Lubricant

Plasticizers and lubricants which can be used in the photothermographic material of the invention are described JP-A No. 11-65021, paragraph no. 0117. Slipping agents are described in JP-A No. 11-84573, paragraph nos. 0061 to 0064 and Japanese Patent Application No. 11-106881, paragraph nos. 0049 to 0062.

4) Dye, Pigment

In an image forming layer in the invention, various dyes and pigments can be used from the standpoints of improvement in color tone, prevention of generation of interference fringe in exposure to laser, and prevention of irradiation.

Light absorption at an exposure wavelength of an image forming layer is preferably 0.1 or more and 0.6 or less, further preferably 0.2 or more and 0.5 or less. When absorption is large, Dmin increases, images cannot be discriminated easily, and when absorption is low, sharpness is lost, in some cases. Any methods can be used for imparting absorption to a photosensitive silver halide layer in the invention, and it is preferable to use a dye. As the dye, any compound can be used providing the above-mentioned absorption condition is satisfied, and listed are pyrazoloazole dyes, anthraquinone dyes, azo dyes, azomethine dyes, oxonol dyes, carbocyanine dyes, styryl dyes, triphenylmethane dyes, indoaniline dyes, indophenol dyes, squallirium dyes and the like. Preferable dyes used in the invention include anthraquinone dyes (for example, compounds 1 to 9 described in JP-A No. 5-341441, compounds 3-6 to 18 and 8-23 to 38 described in JP-A No. 5-165147, and the like), azomethine dyes (compounds 17 to 47, described in JP-A No. 5-341441, and the like), indoaniline dyes (compounds 11 to 19, described in JP-A No. 5-289227, compound 47, described in JP-A No. 5-341441, compounds 2-10 to 11, described in JP-A No. 5-165147, and the like), azo dyes (compounds 10 to 16, described in JP-A No. 5-341441, and the like) and squallirium dyes (compounds 1 to 20, described in JP-A No. 10-104779, compounds 1a to 3d, described in U.S. Pat. No. 5,380,635). These dyes may be added in any form such as solution, emulsion, solid fine particle dispersion, mordanting with a polymer mordant, and the like. The amount of these compounds to be added is determined by the intended absorption amount, and in general, these are preferably used in an amount of 1 μg or more and 1 g or less per 1 $m^2$.

Further, light absorption substances as described in U.S. Pat. Nos. 3,253,921; 2,274,782; 2,527,583 and 2,956,879 can be contained as a filter dye in a surface protective layer. Furthermore, a dye can be mordanted as described, for example, in U.S. Pat. 3,282,699. The use amount of a filter dye is preferably from 0.1 to 3, particularly preferably from 0.2 to 1.5 as absorbency at the exposure wavelength.

In the photothermographic material of the invention, any part other than a photosensitive silver halide silver particle-containing layer shows an absorption at the exposure wavelength of preferably 0.1 or more and 3.0 or less, further preferably 0.3 or more and 2.0 or less, from the standpoint of prevention of halation. As the part showing absorption at the exposure wavelength, in layers opposite, via a substrate, to a photosensitive silver halide silver particle-containing layer (back layer, back surface priming or undercoat layer, protective layer for back layer), and between a photosensitive silver halide silver particle-containing layer and a substrate (priming or undercoat layer) are preferable.

In the invention, photosensitive silver halide particles are spectrally sensitized in the infrared region, however, when absorption is imparted to parts other than a photosensitive silver halide silver particle-containing layer, any methods may be used, and it is preferable that the absorption maximum in the visible region is 0.3 or less. As the dye used, the same dye as the dye for imparting absorption to a photosensitive silver halide layer can be used, and may be the same as or different from the dye used in the photosensitive silver halide layer.

5) Ultra-high Contrast Promoting Agent

For forming an ultra-high contrast image suitable for graphic arts, it is preferable to add an ultra-high contrast promoting agent to an image forming layer. Ultra-high contrast promoting agents and their addition method and addition amount are described in JP-A Nos. 11-65021, paragraph no. 0118 and 11-223898, paragraph nos. 0136 to 193, Japanese Patent Application Nos. 11-87297, compounds of the formulae (H), (1) to (3), (A), (B), 11-91652, compounds of the general formulae (III) to (V) (specific compound: chemical formulae 21 to 24), and the accelerators for the contrast promoting agent are described in JP-A Nos. 11065021, paragraph no. 0102, 11-223898, paragraph nos. 0194 to 0195.

When formic acid and formates are used as a fogging substance, it is preferable that they are contained in an amount of 5 mmol or less, further, 1 mmol or less per mol of silver on the side carrying an image formaing layer containing a photosensitive silver halide.

When an ultra-high contrast promoting agent is used in the photothermographic material of the invention, it is preferable to simultaneously use an acid or its salt formed by hydration of phosphorus pentoxide. As the acid or its salt formed by hydration of phosphorus pentoxide, listed are metaphosphoric acid (salt), pyrophosphoric acid (salt), orthophosphoric acid (salt), triphosphoric acid (salt), tetraphosphoric acid (salt), hexametaphosphoric acid (salt) and the like. As the acid or its salt formed by hydration of phosphorus pentoxide preferably used, hexametaphosphoric acid (salt) can be listed. Specifically listed salts are sodium orthophosphate, sodium dihydrogen orthophosphate, sodium hexametaphosphate, ammonium hexametaphosphate and the like.

The amount of the acid or its salt formed by hydration of phosphorus pentoxide (application amount per $m^2$ of photosensitive material) may be determined as necessary depending on various properties such as sensitivity and fogging and the like, and preferably from 0.1 to 500 $mg/m^2$, more preferably from 0.5 to 100 $mg/m^2$.

1-16. Layer Construction, and Other Components Thereof

The photothermographic material of the invention can have a non-photosensitive layer in addition to the image forming layer. The non-photosensitive layer can be classified, based on layout, into (a) a surface protective layer mounted on an image forming layer (on the side remote from a substrate), (b) an intermediate layer provided between a plurality of image forming layers, or between an image forming layer and a surface protective layer, (c) a priming or undercoating layer provided between an image forming layer and a substrate, and (d) a back layer provided on the opposite side to an image forming layer.

A layer acting as an optical filter can be provided, and provided as a layer of (a) or (b). An anti-halation layer is provided on a photosensitive material as a layer of (c) or (d)

1) Surface Protective Layer

In the photothermographic material of the invention, a surface protective layer can be provided for the purpose of preventing adhesion of an image forming layer, and the like. The surface protective layer may be composed of a single layer or of several layers.

As the binder in the surface protective layer, any polymer may be used. Examples of this binder include polyesters, gelatins, polyvinyl alcohol, cellulose derivatives and the like, and cellulose derivatives are preferable. Examples of the cellulose derivative are shown below, but the invention is not limited to them. As the cellulose derivative, listed are, for example, cellulose acetate, cellulose acetate butyrate, cellulose propionate, hydroxypropylcellulose, hydroxypropylmethylcellulose, methylcellulose, hydroxyethylcellulose, carboxymethylcellulose and the like and mixtures thereof. The thickness of the surface protective layer is preferably from 0.1 to 10 μm, particularly preferably from 1 to 5 μm.

In the surface protective layer, any adhesion preventing material may be used. Examples of the adhesion preventing material include waxes, liquid paraffins, silica particle, styrene-containing elastomer-like block copolymers (for example, styrene-butadiene-styrene, styrene-isoprene-styrene), cellulose acetate, cellulose acetate butyrate, cellulose propionate and mixtures thereof.

2) Anti-halation Layer

An anti-halation layer can be provided on the side far from an exposure light source than a photosensitive layer. The anti-halation layer is described in JP-A Nos. 11-65021, paragraph nos. 0123?~124, 11-223898, 9-230531, 10-36695, 10-104779, 11-231457, 11-352625, 11-352626 and the like.

The anti-halation layer contains an anti-halation dye showing absorption at the exposure wavelength. For example, the photothermographic material of the invention have exposure wavelength in the infrared region, an infrared absorption dye may advantageously be used, and even in this case, a dye showing no sub-absorption in the visible region is preferable.

In the case of halation prevention using a dye showing sub-absorption in the visible region, it is preferable that visible color of the dye does not substantially remain after image formation, and it is preferable to use a means to decolor by heat in thermal development, and particularly, it is preferable that a heat decoloring dye and a base precursor are incorporated in a non-photosensitive layer to allow it to function as an anti-halation layer. These technologies are described in JP-A No. 11-231457, and the like.

The addition amount of the decoloring dye is determined by the purpose of the dye. In general, it is used in an amount of giving an optical density (absorbancy) over 0.1 when measured at the intended wavelength. The optical density is preferably from 0.2 to 2. The use amount of a dye for obtaining such optical density is, in general, from about 0.001 to 1 $g/m^2$.

When a dye is thus decolored, the optical density after thermal development can be decreased to 0.1 or less. Two or more decoloring dyes may be used together in conbination. Likewise, two or more base precursors may be used together in combination.

In such thermal decoloring by a decoloring dye and a base precursor, it is preferable to use substances (for example, diphenylsulfone, 4-chlorophenyl(phenyl)sulfone) which can decrease in melting point of the base precursor by 3° C. or more when mixed with the base precursor, as described in JP-A No. 11-352626, from the standpoint of a thermal decoloring property or the like.

3) Back Layer

The back layer which can be applied to the invention is described in JP-A No. 11-65021, paragraph nos. 0128 to 0130.

The binder in a back layer is transparent or translucent, and generally colorless. Examples thereof include natural polymer synthethic resin, polymer and copolymer, and other film forming medias, for example: gelatins, gum arabic, poly(vinyl alcohols), hydroxyethylcelluloses, cellulose acetates, cellulose acetate butyrates, poly(vinylpyrrolidones), casein, starch, poly(acrylic acid), poly(methyl methacryaltes), poly(vinyl chlorides), poly(methacrylic acids), copoly(styrene-maleic anhydride), copoly(styrene-acrylonitrile), copoly(styrene-butadiene), poly(vinyl acetals) (for example, poly(vinyl formal) and poly(vinyl butyral)), poly (esters), poly(urethanes), phenoxy resins, poly(vinylidene chlorides), poly(epoxydes), poly(carbonates), poly(vinyl acetates), poly(olefins), cellulose esters, poly(amides). A binder may be used with aqueous solution or an organic solvent soution or emulsion to form a coat solution.

In the invention, a coloring dyes showing an absorption maximum at 300 to 450 nm can be added for the purpose of improving silver tone and change by time of an image. Such coloring dyes are described in JP-A Nos. 62-210458, 63-104046, 63-103235, 63-208846, 63-306436, 63-314535, 01-61745, 11-276751, and the like. Such a coloring dye is added usually in an amount of 0.1 $mg/m^2$ to 1 $g/m^2$, and as the layer to which the coloring dye is added, a back layer mounted on the opposite side to a photosensitive layer is preferable.

4) Matting Agent

In the invention, it is preferable to add a matting agent to a surface protective layer and a back layer for improving a conveyance property.

The degree of matting on an image formed surface is not particularly restricted providing it does not cause so-called star dust failure in which small white spots are formed and light leaking occurs, and Beck smoothness is preferably 200 seconds or more and 1000 seconds or less, particularly preferably 300 seconds or more and 800 seconds or less. Beck smoothness is easily measured by Japan Industrial Standard (JIS) P8119 "Kami oyobi Itagami no Beck Shikenki niyoru Heikatsudo Shiken Houhou" and TAPPI standard method T479.

In the invention, regarding the degree of matting of a back layer, Beck smoothness if preferably 250 second or less and 10 second or more, and further preferably 180 second or less and 50 second or more.

In the invention, it is preferable that a matting agent is contained in an outermost surface layer or a layer functioning as an outermost surface layer of a photosensitive material or a layer near the outer surface, alternatively in a layer acting as a so-called protective layer.

The matting agent which can be used in the invention is an organic or inorganic fine particle insoluble in an application solvent. Those well known in the art can be used such, for example, organic matting agents described in U.S. Pat. Nos. 1,939,213; 2,701,245; 2,322,037; 3,262,782; 3,539,344; 3,767,448, inorganic matting agents described in U.S. Pat. Nos. 1,260,772; 2,192,241; 3,257,206; 3,370,951; 3,523,022; 3,769,020. Specific examples of organic compounds which can be preferably used as a matting agent include water-dispersible vinyl compounds such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate, polytetrafluoroethylene and the like, cellulose derivatives such as methylcllulose, cellulose acetate, cellulose acetate propionate, starch derivatives such as carboxy starch, carboxynitrophenyl starch, urea-formaldehyde-starch reaction product and the like, gelatin hardened with a known hardener and hardened gelatin in the form of fine capsule hollow particle obtained by coacervate-hardening, and the like. As examples of the inorganic compound, silicon dioxide, titanium dioxide, magnesium dioxide, aluminum oxide, barium sulfate, calcium carbonate, silver chloride de-sensitized by a known method as well as silver bromide, glass, diatomaceous earth, and the like can be preferably used. As the above-mentioned matting agent, different kinds of substances can be used in admixture, if necessary. The size and form of the matting agent are not particularly restricted, and those of any particle size can be used. In practice of the invention, it is preferable to use those having a particle size of 0.1 μm to 30 μm. The particle size distribution of the matting agent may be narrow or wide. On the other hand, since the matting agent exerts a significant influence on the haze and surface gloss of a photosensitive material, it is preferable the particle size, form and particle size distribution are made into necessary conditions in production of the matting agent or by mixing a plurality of matting agents.

5) Hardener

A hardener may be used in an image forming layer, protective layer, back layer and the like in the invention. As examples of the hardener, T. H James, THE THEORY OF THE PHOTOGRAPHIC PROCESS FOURTH EDITION (Macmillan Publishing Co., Inc, 1977), pp. 77 to 87 describe relevant methods, and chromium alum, 2,4-dichloro-6-hydroxy-2-triazine sodium salt, N,N-ethylenebis(vinylsulfoneacetamide), N,N-propylenebis(vinylsulfoneacetamide), and additionally, polyvalent metal ions described in p. 78 of the same literature, polyisocyanates described in U.S. Pat. No. 4,281,060, JP-A No. 6-208193 and the like, epoxy compounds described in U.S. Pat. No. 4,791,042 and the like, vinylsulfone-based compounds described in JP-A No. 62-89048, and the like, can be preferably used.

The hardener is added in the form of solution, and addition timing of this solution into application liquid is from 180 minutes before application to directly before application, preferably from 60 minutes to 10 seconds before application, and mixing methods and mixing conditions are not particularly restricted providing the effect of the invention is sufficiently manifested.

As the specific mixing method, there are a method in which mixing is effected in a tank so regulated that the average residence time calculated from addition flow rate and liquid feeding rate to a coater takes desired time, and a method of using a static mixer described in N. Harnby, M. F. Edwards, A. W. Nienow, translated by K. Takahashi, Liquid Mixing Technology (Nikkan Kogyo Shinbunsha, 1989), chapter 8, and the like.

6) Surfactant

In the photothermographic material of the invention, a surfactant may be used for the purpose of improving applicability and chargeability. As examples of the surfactant, any compounds such as nonionic, anionic, cationic and fluorine-based surfactants and the like can be appropriately used. Specifically listed are fluorine-based polymer surfactants described in JP-A No. 62-170950, U.S. Pat. No. 5,380,644 and the like, fluorine-based surfactants described in JP-A Nos. 62-244945, 63-188135 and the like, polysiloxane-based surfactants described in U.S. Pat. No. 3,885,965 and the like, polyalkylene oxides and anionic surfactants and the like described in JP-A No. 6-301140.

In the invention, fluorine-based surfactants are preferably used. As specific examples of the fluorine-based surfactant, compounds described in JP-A Nos. 10-197985, 2000-19680, 2000-214554 and the like are listed. Further, polymer fluorine-based surfactants described in JP-A No. 9-281636 are also preferably used. In the photothermographic material of the invention, use of fluorine-based surfactants described in JP-A No. 2002-82411, Japanese Patent Application Nos. 2001-242357 and 2001-264110 is preferable. Particularly, fluorine-based surfactants described in Japanese Patent Application Nos. 2001-242357 and 2001-264110 are preferable from the standpoints of a charge controlling ability, stability of applied surface condition and slipping property, in conducting application production with aqueous application liquid, and fluorine-based surfactants described in Japanese Patent Application No. 2001-264110 are most preferable since a charge controlling ability is high and the amount thereof to be required may be small.

In the invention, a fluorine-based surfactant can be used in any layer on an image forming layer surface and back surface, and it is preferable to use the surfactant in layers on both surfaces. It is particularly preferable to use it in combination with an electrically conductive layer containing the nexte-mentioned antistatic metal oxide. In this case, a sufficient ability is obtained even if the use amount of a fluorine-based surfactant on a surface having an electrically conductive layer is reduced or removed.

Preferable use amount of a fluorine-based surfactant is in the range of from 0.1 $mg/m^2$~100 $mg/m^2$, more preferably from 0.3 $mg/m^2$~30 $mg/m^2$, further preferably from 1 $mg/m^2$~10 $mg/m^2$. Particularly, fluorine-based surfactants described in Japanese Patent Application No. 2001-264110 show a large effect, and the use amount thereof is preferably in the range from 0.01~10 $mg/m^2$, more preferably from 0.1~5 $mg/m^2$.

7) Antistatic Agent

In the invention, an antistatic layer may be provided containing known various metal oxides, conductive polymers and the like. The antistatic layer may be provided as the above-mentioned primer layer, back layer, surface protective layer and the like, or may be provided separately. For the antistatic layer, technologies described in JP-A Nos. 11-65021, paragraph no. 0135, 56-143430, 56-143431, 58-62646, 56-120519, 11-84573, paragraph nos. 0040–0051, U.S. Pat. No. 5,575,957, JP-A No. 11-223898, paragraph nos. 0078–0084, can be applied.

8) Film Surface pH

In the photothermographic material of the invention, the filme surface pH before thermal development treatment is preferably 7.0 or less, further preferably 6.6 or less. Its low limit is not particularly restricted, and about 3. Most preferably pH range is from 4 to 6.2.

For control of film surface pH, it is preferable, from the standpoint of keeping of film surface pH at lower level, to use an organic acid such as a phthalic acid derivative and the like, an non-volatile acid such as sulfuric acid and the like, a volatile base such as ammonia and the like. Particularly, ammonia is preferable for attaining low film surface pH since it is easily volatilized and can be removed before an application process or thermal development.

Further, it is also preferable to use a non-volatile base such as sodium hydroxide, potassium hydroxide, lithium hydroxide and the like together with ammonia. A method of measuring film surface pH is described in Japanese Patent Application No. 11-87297, paragraph no. 0123.

9) Substrate

As the substrate, listed are polyester films, primed polyester films, poly(ethylene terephthalate) films, polyethylene naphthalate films, cellulose nitrate films, cellulose ester films, poly(vinyl acetal) films, polycarbonate films and relevant or resinous materials, and glass, paper, metals and the like. Further, it is also possible to use flexible substrates, particularly, a paper substrate coated with partially acetylated cellulose, or a paper substrate coated or laminated by baryta and/or α-olefin polymer, particularly, polyethylene, polypropylene (α-olefin/polymer having 2 to 10 carbon atoms such as ethylene-butene copolymer and the like). The substrate may be transparent or translucent, and preferably transparent.

As the substrate, polyesters, particularly, polyethylene terephthalate, heat-treated at temperatures from 130 to 185° C. for relaxing inner strain remaining in the film in biaxial drawing, is preferably used for deleting strain by heat contraction generating in thermal development treatment.

In the case of the photothermographic materials for medical use, a transparent substrate may be colored with a blue dye (for example, dye-1 described in JP-A No. 8-240877, examples), or may not be colored. Specific examples of the substrate are described in JP-A No. 11-65021, paragraph no. 0134.

On the substrate, priming technologies such as water-soluble polyesters described in JP-A No. 11-84574, styrene butadiene copolymers described in JP-A No. 10-186565, vinylidene chloride copolymers described in JP-A No. 2000-39684 and Japanese Patent Application No. 11-106881, paragraph nos. 0063 to 0080, and the like are preferably applied.

10) Other Additives

In the photothermographic material, antioxidants, stabilizers, plasticizers, ultraviolet absorbers or coating aids may be further added. Solvents described in JP-A No. 11-65021, paragraph no. 0133 may also be added. Various additives are added to either a photosensitive layer or a non-photosensitive layer. Regarding them, WO98/36322, EP803764A1, JP-A Nos. 10-186567, 10-18568, and the like can be referred to.

11) Application Method

The photothermographic material in the invention may be applied by any method. Specifically, extrusion coating, slide coating, curtain coating, immersion coating, knife coating, flow coating, or various coating operations including various hopper coatings described in U.S. Pat. No. 2,681,294, are used, and extrusion coating or slide coating described in Stephen F. Kistler, Petert M. Schweizer, "LIQUID FILM COATING" (CHAPMAN & HALL, 1997), pp. 399 to 536, is preferably used, and extrusion coating is particularly preferably used.

12) Wrapping Material

The photothermographic material of the invention is preferably closely wrapped with a wrapping material having low oxygen permeability and/or low vapor permeability for preventing degradation in photographic performances in preservation before use or preventing curling or winding habituation in the case of a product in the form of roll. The oxygen permeability is preferably 50 ml/atm/$m^2$/day or less, more preferably 10 ml/atm/$m^2$/day or less, further preferably 1.0 ml/atm/$m^2$/day or less. The vapor permeability is preferably 10 g/atm/$m^2$/day or less, more preferably 5 g/atm/$m^2$/day or less, further preferably 1 g/atm/$m^2$/day or less. Specific examples of wrapping materials having low oxygen permeability and/or low vapor permeability are those described, for example, in JP-A Nos. 8-254793 and 2000-206653.

13) Other Technologies Utilizable

As the technologies which can be used for the photothermographic material of the invention, EP Nos. 803764A1, 883022A1, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569–10-186572, 10-197974, 10-197982, 10-197983, 10-197985–10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536–11-133539, 11-133542, 11-133543, 11-223898, 11-352627, 11-305377, 11-305278, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064, 2000-171936 are also listed.

14) Color Image Formation

As a method of obtaining a color image using the photothermographic material of the invention, there is a method described in JP-A No. 7-13295, p. 10, left column line 48 to line 11, left column line 40. As stabilizers for color dye images, those exemplified in GBP No. 1,326,889, U.S. Pat. Nos. 3,432,300, 3,698,909, 3,574,627, 3,573,050, 3,764,337 and 4,042,394 can also be used.

In the case of a multi-color photothermographic material, in general, image forming layers are mutually discriminated and maintained by using a functional or non-functional barrier layer between the image forming layers as described in U.S. Pat. No. 4,460,681.

2. Image Formation Method 2-1. Exposure

The photosensitive material of the invention may be exposed by any method, however, laser beam is preferable as the exposure light source. It has been found that a silver halide emulsion having high silver iodide content as in the invention can record an image with lower energy by writing with light of high intensity of illumination such as laser beam. By writing with such strong light in short period of time, the intended sensitivity can be attained.

Particularly, so as to obtain maximum density (Dmax), preferably light value on the surface of a photosensitive material is from 0.1 W/$mm^2$ to 100 W/$mm^2$. It is more preferably from 0.5 W/$mm^2$ to 50 W/$mm^2$, most preferably from 1 W/$mm^2$ to 50 W/$mm^2$.

As the laser light source, gas lasers ($Ar^+$, He—Ne, He—Cd), YAG laser, dye laser, semiconductor laser and the like can be used. Further, semiconductor laser and second harmonic generation element and the like can also be used. Preferably used laser is determined, corresponding to light absorption peak wavelength of a spectral sensitizing dye in a photothermographic material, and preferably used are He-Ne laser emitting red ray, and infrared semiconductor laser. Of them, infrared semiconductor laser is cheap and gives stable light emission, and particularly compact and gives excellent operability, therefore, suitable for designing simply a laser image output system requiring no selection of setting position. The peak wavelength of laser light is from 700 nm to 1400 nm, preferably from 750 nm to 900 nm.

Recently, blue semiconductor laser has been developed, enabling image recording with high precision, and recording density has increased and stable output of long life has become possible, therefore, expansion of demand from now on is expected. The peak wavelength of laser light is from 300 nm to 550 nm, preferably from 400 nm to 500 nm.

Laser beam oscillating in longitudinal-multiplied by a high frequency superimpose method and the like is also preferably used.

2-2. Thermal Development

The photothermographic material of the invention may be developed by any method, however, a photothermographic material exposed imagewisely is heated for development, usually. Preferable development temperature is from 80 to 250° C., further preferably from 100 to 140° C. Development time is preferably from 1 to 180 seconds, further preferably from 10 to 90 seconds.

As the thermal development mode, a plate heater mode is preferable. As the thermal development mode according to a plate heater mode, a method described in JP-A No. 11-133572 is preferable, and used is a thermal development apparatus of obtaining a visible image by contacting a photothermographic material carrying formed latent images with a heating means at a thermal development part, in which the heating means is made of a plate heater, and a plurality of press rollers are placed mutually facing along one surface of the plate heater, and the above-mentioned photothermographic material is passed between the above-mentioned press rollers and the above-mentioned plate heater to effect thermal development. It is preferable that the plate heater is divided into 2 to 6 stages, and the temperature of the tip portion is lowered by about 1 to 10° C.

Such a method is described also in JP-A No. 54-30032, water and organic solvents contained in a photothermographic material can be removed out of the system, and variation of the dimension of a substrate of a photothermographic material due to steep heating of the photothermographic material can be suppressed.

As another heating method, it is also possible that a backside resistive heating layer as shown in U.S. Pat. Nos. 4,460,681 and 4,374,921 is provided, and energized to cause heat generation, to heat the layer.

2-3. System

As a medical laser imager equipped with an exposure part and thermal development part, FUJI MEDICAL DRY IMAGER-FM-DPL, and DRYPIX 7000 are listed. This system is described in Fuji Medical Review No. 8, page 39 to 55. Further, it is also applied as a photothermographic material for a laser imager in AD network suggested by Fuji Film Medical K.K. as a network system satisfying DICOM standard.

3. Application of the Invention

The photothermographic material comprising a high silver iodide photographic emulsion in the present invention can form a B/W image with developed silver and preferably used as photothermographic materials for medical imaging, photothermographic materials for industrial photographic imaging, photothermographic materials for garaphic arts, and photothermographic materials for COM.

EXAMPLES

The present invention will be specifically illustrated below by the following examples, but the scope of the invention is not limited thereto.

Example 1

1. Preparation and Undercoating of PET Substrate 1-1. Film Formation

PET having an intrinsic viscosity IV of 0.66 (measured at 25° C. in phenol/tetrachloroethane=6/4 (by weight)) was obtained in a usual manner using terephthalic acid and ethylene glycol. The resulting PET was pelletized, the obtained pellets were dried at 130° C. for 4 hours and melted at 300° C., and 0.04% by weight of Dye BB having a structure shown below was added thereto. Thereafter, the melt was extruded from a T-die and then cooled, and a non-stretched film having a thickness large enough to provide a thickness of 175 μm after heat setting was produced.

Dye BB:

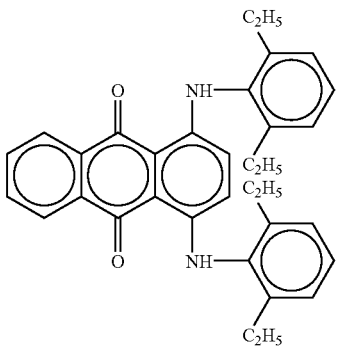

This film was stretched to 3.3 times in a machine direction using rolls having different peripheral speeds and then stretched to 4.5 times in a cross direction by a tenter. During stretching, temperatures were 110° C. and 130° C., respectively. Subsequently, the film was heat set at 240° C. for 20 seconds and relaxed by 4% in the cross direction at the same temperature. Thereafter, a chuck portion of the tenter was slit, both edge parts of the film were knurled, and the film was taken up at 4 kg/cm$^2$ to obtain a roll having a thickness of 175 μm.

1-2. Surface Corona Discharge Treatment

Both surfaces of the resulting substrate were treated at room temperature at 20 m/min using a solid state corona discharge treating machine "Model 6KVA" (manufactured by Pillar Technologies). From the current and voltage read at this time, it was known that a treatment of 0.375 kV·A·min/m$^2$ was applied to the support. A treatment frequency here was 9.6 kHz and a gap clearance between an electrode and the dielectric roll was 1.6 mm.

2. Preparation and Coating of Coating Solution for Back Layer

In 830 g of MEK, 84.2 g of cellulose acetate butyrate (CAB381-20, produced by Eastman Chemical Co.) and 4.5 g of polyester resin (Vitel PE2200B, produced by Bostic Co.) were added and dissolved while stirring was carried out. 0.30 g of Dye 2 was added to the dissolved solution, and 43.2 g of methanol having dissolved therein 4.5 g of a fluorine-containing surfactant (Surflon KH40, product by Asahi Glass Co., Ltd.) and 2.3 g of another fluorine-containing surfactant (Megafac F120K, product by Dainippon Ink & Chemicals Inc.) was further added. The resulting solution was thoroughly stirred until these were dissolved. Finally, 75 g of silica (Siloid 64×6000, product by W.R. Grace Co.) dispersed in methyl ethyl ketone to a concentration of 1 wt % using a dissolver-type homogenizer was added and the mixture was stirred to prepare a coating solution for a back surface.

The thus-prepared coating solution for the back layer was coated and dried by an extrusion coater, so as to provide a dry thickness of 3.5 μm. Drying was performed for 5 minutes using air having a temperature of 100° C. and a dew point of 10° C.

3. Image Forming Layer and Surface Protective Layer 3-1. Preparation of Coating Materials 1) Preparation of Silver Halide Emulsion 88.3 g of phthalated gelatin, 10 ml of a 10 wt % methanol aqueous solution of a PAO compound ($HO(CH_2CH_2O)n$—$(CH(CH_3)CH_2O)_{17}$—$(CH_2CH_2O)m$-H; m+n=5 to 7), and 0.32 g of potassium bromide were added to 5429 ml of water and dissolved, and 659 ml of a 0.67 mol/l silver nitrate aqueous solution and a liquid containing 0.703 mol of KBr and 0.013 mol of KI dissolved per liter was added to the resulting solution which was maintained at 40° C. according to a parallel mixing method, using a mixing stirrer shown in JP-B No. 58-58288, while controlling pAg at 8.09 over 4 minutes and 45 seconds, as a nucleation process. One minute thereafter, 20 ml of a 0.63 N potassium hydroxide solution was added. Six minutes thereafter, 1976 ml of a 0.67 mol/l silver nitrate aqueous solution and a liquid containing 0.657 mol of KBr, 0.013 mol of potassium iodide and 30 μmol of dipotassium iridiate hexachloride dissolved per liter were added according to a parallel mixing method at a temperature of 40° C., while controlling pAg at 8.09 over 14 minutes and 15 seconds. After stirring was carried out for 5 minutes, the temperature was lowered to 38° C.

Then, 18 ml of a 5 wt % acetic acid aqueous solution was added, to precipitate a silver halide emulsion. A supernatant was removed leaving 2 liters of the precipitated portion, and 10 liters of water was added thereto. The mixture was stirred, and then, a silver halide emulsion was precipitated again. Further, a supernatant was removed leaving 1.5 liter of the precipitated portion, 10 liter of water was further added, the mixture was stirred, and then, a silver halide emulsion was precipitated. A supernatant was removed leaving 1.5 liter of the precipitated portion. A liquid prepared by dissolving 1.72 g of anhydrous sodium carbonate in 151 ml of water was then added, and the mixture was heated to 55° C. The mixture was further stirred for 120 minutes. Finally, pH was adjusted to 5.0, and water was added so that an amount of the mixture was 1161 g per mol of silver.

This emulsion was monodispersed cubic silver iodobromide particles having an average particle size of 40 nm, a variation coefficient of particle size of 12%, a [100] surface ratio of 92% and a silver iodide content of 2 mol %. This emulsion is called emulsion 4.

According to the same method as used for preparation of emulsion 4 described above, emulsion 1, emulsion 2 and emulsion 3 were prepared having halogen compositions and particle sizes as shown below, by changing the concentrations of KBr and KI used and by controlling a charging temperature.

| | | | |
|---|---|---|---|
| Emulsion 1 | silver iodide 100 mol % | $AgI_{100}$ | Particle size: 80 nm |
| Emulsion 2 | silver iodide 100 mol % | $AgI_{100}$ | Particle size: 40 nm |
| Emulsion 3 | silver iodide 50 mol % | $AgBr_{50}I_{50}$ | Particle size: 40 nm |
| Emulsion 4 | silver iodide 2 mol % | $AgBr_{98}I_2$ | Particle size: 40 nm |

2) Preparation of Powder Organic Silver Salt 0.3776 mol of behenic acid, 0.2266 mol of arachidic acid, and 0.1550 mol of stearic acid was added to 4720 ml of pure water and dissolved at 80° C., then, 540.2 ml of a 1.5 N sodium hydroxide aqueous solution and 6.9 ml of concentrated nitric acid were added thereto, and then, the mixture was cooled to 55° C., to obtain a sodium salt of an organic acid. While maintaining a temperature of the above-mentioned solution of the sodium salt of an organic acid at 55° C., 45.3 g of each of the above-mentioned silver halide emulsions 1, 2, 3 and 4 and 450 ml of water were added, and the mixture was stirred for 5 minutes at 13200 rpm (mechanical vibration frequency: 21.1 KHz) by a homogenizer manufactured by IKA JAPAN (ULTRA-TURRAXT-25). Next, 702.6 ml of a 1 mol/l silver nitrate solution was added over 2 minutes, and the mixture was stirred for 10 minutes, to obtain an organic silver salt dispersion. Then, the resulting organic silver salt dispersion was transferred to a water washing vessel, de-ionized water was added thereto, the mixture was stirred and then allowed to stand still, to cause floatation and separation of the organic silver salt dispersion, and lower water-soluble salts were removed. Then, washing with de-ionized water and draing were repeated until a conductivity of the drainage water reached 2 μS/cm, centrifugal dehydration was performed, and then, drying was conducted in a circulation drier with warm air having an oxygen partial pressure of 10 vol % until no weight loss was shown at 40° C., to obtain a powdery organic silver salt containing photosensitive silver halide.

3) Preparation of Re-dispersion of Organic Silver Salt Containing Photosensitive Silver Halide 14.57 g of a polyvinyl butyral powder (Butvar B-79, manufactured by Monsant) was dissolved in 1457 g of methyl ethyl ketone (MEK), and 500 g of the above-mentioned powdery organic silver salt was gradually added while stirring was carried out by a DISPERMAT CA-40M type, a dissolver manufactured by VMA-GETZMANN, and sufficiently mixed to provide slurry.

The above-mentioned slurry was dispersed trough 2 paths by a GM-2 type pressure mode homogenizer manufactured by SMT, to prepare a photosensitive emulsion dispersion. In this procedure, the treatment pressure in the first pass was 280 kg/cm$^2$, and the treatment pressure in the second pass was 560 kg/cm$^2$.

4) Preparation of Application Liquids 1 to 36 for Image Forming Layer 15.1 g of MEK was added to a photosensitive emulsion dispersion (50 g) containing an organic silver salt containing emulsion 1, emulsion 2, emulsion 3 and emulsion 4 as shown in Table 1, the mixture was maintained at 21° C. while stirring was carried out by a dissolver type homogenizer at 1000 rpm, 390 μl of a 10 wt % methanol solution of a composite of two N,N-dimethylacetamide molecules, one hydrobromic acid molecule, and one bromine molecule was added thereto, and stirring was carried out for 2 hours. Further, 494 μl of a 10 wt % methanol solution of calcium bromide was added, and stirring was carried out for 20 minutes.

Subsequently, 167 mg of a methanol solution containing 15.9 wt % of dibenzo-18-crown-6 and 4.9 wt % of potassiumacetate was added, and stirring was carried out for 10 minutes. Then, 18.3 wt % of 2-chlorobenzoic acid, 34.2 wt % of salicylic-p-toluenesulfonate, 4.5 wt % of a compound 2-19 or 2-28 represented by general formula (2) and 0.24 wt % of a sensitizing dye of the general formulae (3a) to (3d) were added, 2.6 g of a MEK solution was added as shown in Table 1 and Table 2, the mixture was stirred for one hour. Then, the temperature was lowered to 13° C., and the mixture was further stirred for 30 minutes. While the temperature was maintained at 13° C., 13.31 g of polyvinyl butyral (Butvar B-79, manufactured by Monsant) was added, and the mixture was stirred for 30 minutes. Then, 1.08 g of a 9.4 wt % tetrachlorophthalic acid solution was added, and the mixture was stirred for 15 minutes. While stirring was continued, reducing agent-1 was added in an amount of 0.4 mol per mol of silver.

12.4 g of a MEK solution of 1.1 wt % of 4-methylphthalic acid and dye 1 was added, 1.5 g of 10 wt % Desmodur N3300 (aliphatic isocyanate manufactured by Mobay) was subsequently added, and further, 4.27 g of a MEK solution of 7.4 wt % of a comparative compound-A or compound 1-1 or 1-2 of general formula (1) shown in Table 1 and 7.2 wt % phthalazine was added, to prepare application liquids 1 to 36 for image forming layer.

5) Preparation of Application Liquid for Surface Protective Layer

To 865 g of MEK was added, while stirring was continued, 96 g of cellulose acetate butyrate (manufactured by Eastman Chemical, CAB 171-15), 4.5 g of polymethyl methacrylate (manufactured by Rohm & Haas, PARALOID A-21), 1.5 g of 1,3-di(vinylsulfonyl)-2-propanol, 1.0 g of benzotriazole and 1.0 g of a fluorine-based surfactant (manufactured by Asahi Glass Co., Ltd., SURFLON KH40), and dissolved, then, 30 g of a dispersion prepared by dispersing 13.6 wt % of cellulose acetate butyrate (manufactured by Eastman Chemical, CAB 171-15) and 9 wt % of calcium carbonate (manufactured by Speciality Minerals, Super-Pflex 200) in MEK by a dissolver type homogenizer at 8000 rpm for 30 minutes was added and stirring was carried out, to prepare an application liquid for surface protective layer.

3-2. Production of Photothermographic Material

As shown in Table 1, application liquids 1 to 36 for an image forming layer and an application liquid for a surface protective layer were simultaneously applied to form multiple layers on the opposite surface to a back layer of a substrate by an extrusion coater, to produce photothermographic materials 1 to 36. The image forming layer was coated so as to be an amount of silver coated as 1.9 g/m$^2$ and the surface protective layer to be a dry film thickness as 2.5 μm. Then, it was dried using hot air at a temperature of 75° C. and a due point of 10° C. over 10 minutes.

In thus obtained photothermographic material, the MEK content measured by the following condition was named as a solvent residue. A piece of film having an area of 46.3 cm$^2$ was excised, and this was cut into about 5 mm square and accommodated in a dedicated glass bottle, and sealed with a septum and an aluminum cap, then, set on a head space sampler HP7694 type of gas chromatography (GC) 5671 type manufactured by Hewlett Packard. As a GC detector, a flame ionization detector (FID) was used, and as a column, DB-624 manufactured by J & W was used. Regarding main measurement conditions, heating conditions of a head space sampler included 120° C. for 20 minutes, and the GC introduction temperature was 150° C., and the temperature was raised from 45° C. to 100° C. at a rate of 8° C./minute. The calibration curve was made as follows: a constant amount of MEK diluted by butanol was accommodated in a dedicated glass bottle, then, measurement was conducted in the same manner as described above to give chromatogram, and a calibration curve was made using the peak area. The solvent content of the photosensitive material was 40 mg/m$^2$.

100 cm$^2$ of the photosensitive material was excised, and the image forming layer was peeled in MEK. It was decomposed with sulfuric acid and nitric acid in MICRO DIGEST A300 type microwave mode wet decomposition apparatus manufactured by PROLABO, and analyzed by a calibration curve method by PQ-Ω type ICP-MS manufactured by VG Elemental (induction bonding plasma weight analyzer), to known that the Zr content in the photosensitive material was 10 μg or less per 1 mg of Ag.

Compounds used in examples are shown below.

Reducing agent-1

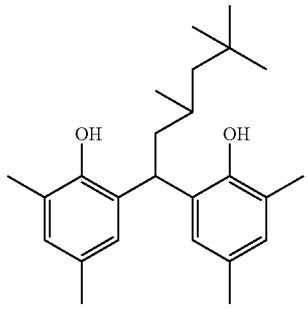

Dye-1

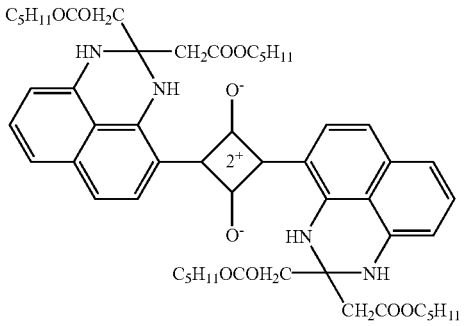

-continued

Comparative compound-A

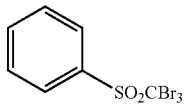

Dye-2

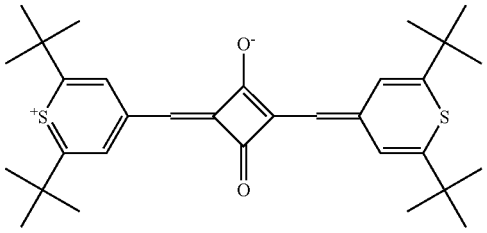

3-3. Exposure and Thermal Development

An exposure machine was trial-manufactured using, as an exposure source, semiconductor laser longitudinally multiple-moded, having a wavelength of 800 nm to 820 nm, at high frequency superposition, and exposure was effected by laser scanning by this exposing machine, on the image forming layer surfaces of the above produced samples No. 1 to No. 36. In this procedure, an image was recorded at an incident angle of scanning laser beam to the exposure surface of the photosensitive material of angle 75°. Then, development was conducted at 124° C. for 15 seconds using an automatic developing machine having a heat drum so that the protective layer of the photosensitive material and the drum surface came into contact, and evaluation of the resulted image was conducted with a densitometer. In this operation, the room for exposure and development had a temperature of 23° C. and a relative humidity of 50% RH.

An image had smaller deterioration ascribed to irregular interference, and an image having unexpected excellent sharpness and contrast was obtained, as compared with image recording at an incident angle of scanning laser to the exposure surface of the photothermographic material of 90° C.

(Sensitivity)

Sensitivity was represented by the inverse of the exposure amount giving optical density of fogging plus 1.0, and shown by relative value to the sensitivity of sample No. 9, which was taken as 100.

(Dmin)

The density of a non-image part was measured by Macbeth densitometer.

(Dmax)

It shows the maximum optical density when the exposure amount is being increased.

(Preservability)

Each sample were cut into half size (356 mm×432 mm), wrapped with the following wrapping material under environments of 35° C. and 60% RH, preserved for one week, then, the photographic performances were evaluated.

Wrapping Material

It is a laminate material of PET 10 μm/PE 20 μm/Aluminum foil 9 μm/Ny 15 μm/polyethylene 50 μm containing 3 wt % carbon, and has the following properties.

Oxygen permeability: 0.02 ml/atm/m$^2$/day 25° C.

Vapor permeability: 0.10 g/atm/m$^2$/day 25° C.

Decrease in Dmax (maximum density part) in preservation under the above-mentioned conditions was measured and used as preservability before thermal development. Smaller the decrease in density is, more excellent the preservability is.

(Image Preservability After Thermal Development)

Thermal development was conducted by laser exposure according to the above-mentioned method, then, the developed sample was irradiated sufficiently with light, moisture thereof was controlled for 3 hours at 70% RH, and the sample was enclosed in a bag capable of shielding light and left for 72 hours under environment of 60° C. In this operation, increase in Dmin was shown. Smaller the increase in Dmin is, more excellent the image preservability is.

The results are shown in Table 1 and Table 2. As shown by these results, photothermographic materials having high silver iodide content even if spectrally sensitized to infrared region and containing compounds of the general formula (1) and the general formula (2) of the invention showed excellent preservability before thermal development and showed excellent image preservability after thermal development.

TABLE 1

| Photo-thermo-graphic material | Silver halide emulsion: Emulsion No. | Silver halide emulsion: Halogen com-position | Silver halide emulsion: Particle size | Compound of the general formula (1) | Compound of the general formula (2) | Sensitizing dye of the general formulae (3a) to (3d) | Sensi-tivity | D min | D max | Pre-servability before thermal dev. (ΔDmax) | Image preserv-ability after thermal dev. (ΔDmin) | Remarks |
|---|---|---|---|---|---|---|---|---|---|---|---|---|
| 1 | Emulsion 1 | $AgI_{100}$ | 80 nm | Comparative compound-A | None | No. 41 | 80 | 0.23 | 3.20 | 0.30 | 0.04 | Com-parative example |
| 2 | " | " | " | Comparative compound-A | 2⁻ 19 | " | 95 | 0.23 | 3.40 | 0.25 | 0.04 | Com-parative example |
| 3 | " | " | " | Comparative compound-A | 2⁻ 28 | " | 98 | 0.23 | 3.60 | 0.20 | 0.04 | Com-parative example |
| 4 | " | " | " | 1-1 | None | " | 97 | 0.19 | 3.40 | 0.15 | 0.02 | Present invention |
| 5 | " | " | " | " | 2⁻ 19 | " | 98 | 0.19 | 3.50 | 0.12 | 0.02 | Present invention |
| 6 | " | " | " | " | 2⁻ 28 | " | 103 | 0.19 | 3.70 | 0.10 | 0.02 | Present invention |
| 7 | " | " | " | 1-2 | None | " | 98 | 0.18 | 3.40 | 0.14 | 0.02 | Present invention |
| 8 | " | " | " | " | 2⁻ 28 | " | 99 | 0.18 | 3.40 | 0.12 | 0.02 | Present invention |
| 9 | " | " | " | " | " | No. 5 | 100 | 0.18 | 3.60 | 0.11 | 0.02 | Present invention |
| 10 | Emulsion 2 | " | 40 nm | Comparative compound-A | None | No. 41 | 75 | 0.22 | 3.70 | 0.25 | 0.03 | Com-parative example |
| 11 | " | " | " | Comparative compound-A | 2⁻ 19 | " | 85 | 0.22 | 4.00 | 0.22 | 0.03 | Com-parative example |
| 12 | " | " | " | Comparative compound-A | 2⁻ 28 | " | 90 | 0.22 | 4.20 | 0.18 | 0.03 | Com-parative example |
| 13 | " | " | " | 1-1 | None | " | 90 | 0.19 | 3.90 | 0.15 | 0.01 | Present invention |
| 14 | " | " | " | " | 2⁻ 19 | " | 91 | 0.19 | 4.10 | 0.12 | 0.01 | Present invention |
| 15 | " | " | " | " | 2⁻ 28 | " | 93 | 0.19 | 4.30 | 0.10 | 0.01 | Present invention |
| 16 | " | " | " | 1-2 | None | " | 90 | 0.18 | 3.90 | 0.10 | 0.01 | Present invention |
| 17 | " | " | " | " | 2⁻ 28 | " | 89 | 0.18 | 4.10 | 0.08 | 0.01 | Present invention |
| 18 | " | " | " | " | " | No. 5 | 94 | 0.18 | 4.30 | 0.08 | 0.01 | Present invention |

TABLE 2

| | | | | | | | | | | | | |
|---|---|---|---|---|---|---|---|---|---|---|---|---|
| 19 | Emulsion 3 | $AgBr_{50}I_{50}$ | 40 nm | Comparative compound-A | None | No. 41 | 90 | 0.22 | 3.80 | 0.32 | 0.05 | Com-parative example |
| 20 | " | " | " | Comparative compound-A | 2⁻ 19 | " | 103 | 0.22 | 4.10 | 0.30 | 0.05 | Com-parative example |
| 21 | " | " | " | Comparative compound-A | 2⁻ 28 | " | 105 | 0.22 | 4.30 | 0.28 | 0.05 | Com-parative example |

TABLE 2-continued

| | | | | | | | | | | | | |
|---|---|---|---|---|---|---|---|---|---|---|---|---|
| 22 | " | " | " | 1-1 | None | " | 103 | 0.19 | 3.90 | 0.19 | 0.02 | Present invention |
| 23 | " | " | " | " | 2⁻ 19 | " | 108 | 0.19 | 4.20 | 0.12 | 0.02 | Present invention |
| 24 | " | " | " | " | 2⁻ 28 | " | 113 | 0.19 | 4.40 | 0.10 | 0.02 | Present invention |
| 25 | " | " | " | 1-2 | None | " | 105 | 0.18 | 3.90 | 0.18 | 0.02 | Present invention |
| 26 | " | " | " | " | 2⁻ 28 | " | 109 | 0.18 | 4.20 | 0.12 | 0.02 | Present invention |
| 27 | " | " | " | " | " | No. 5 | 114 | 0.18 | 4.40 | 0.10 | 0.02 | Present invention |
| 28 | Emulsion 4 | $AgBr_{98}I_2$ | " | Comparative compound-A | None | No. 41 | 110 | 0.35 | 3.90 | 0.50 | 0.18 | Comparative example |
| 29 | " | " | " | Comparative compound-A | 2⁻ 19 | " | 130 | 0.35 | 4.20 | 0.45 | 0.18 | Comparative example |
| 30 | " | " | " | Comparative compound-A | 2⁻ 28 | " | 135 | 0.35 | 4.40 | 0.40 | 0.18 | Comparative example |
| 31 | " | " | " | 1-1 | None | " | 108 | 0.30 | 4.00 | 0.40 | 0.12 | Comparative example |
| 32 | " | " | " | " | 2⁻ 19 | " | 128 | 0.30 | 4.30 | 0.30 | 0.12 | Comparative example |
| 33 | " | " | " | " | 2⁻ 28 | " | 133 | 0.30 | 4.50 | 0.25 | 0.12 | Comparative example |
| 34 | " | " | " | 1-2 | None | " | 109 | 0.27 | 4.00 | 0.38 | 0.12 | Comparative example |
| 35 | " | " | " | " | 2⁻ 28 | " | 129 | 0.27 | 4.30 | 0.28 | 0.12 | Comparative example |
| 36 | " | " | " | " | " | No. 5 | 134 | 0.27 | 4.50 | 0.23 | 0.12 | Comparative example |

Example 2

1) Preparation of Silver Halide Emulsion

Emulsions 5 to 7 having halogen compositions and average particle sizes shown below were prepared in the same manner as for emulsion 4 in Example 1 but changing the concentration of KBr and KI and controlling the charging temperature.

| | | | |
|---|---|---|---|
| Emulsion 5 | silver iodide 40 mol % | $AgBr_{60}I_{40}$ | Particle size: 40 nm |
| Emulsion 6 | silver iodide 70 mol % | $AgBr_{30}I_{70}$ | Particle size: 40 nm |
| Emulsion 7 | silver iodide 90 mol % | $AgBr_{10}I_{90}$ | Particle size: 40 nm |

2) Preparation of Dispersion of Organic Silver Salt Containing Silver Halide

Organic silver salt dispersions containing respective silver halides were prepared using the above-mentioned emulsions 5 to 7 in the same manner as in Example 1.

3) Preparation of Application Liquids 37 to 72 for Image Forming Layer 100 g of MEK was added to each 500 g of dispersions containing the above-mentioned emulsions 5 to 7 and emulsions 2 in Example 1 while stirring under nitrogen flow, and the mixtures were kept at 24° C. 2.5 ml of a 10 wt % methanol solution of the following antifoggant 1 was added to each solution and the mixture was stirred for 15 minutes. 1.8 ml of a solution of the following crown ether compound-1 and potassium acetate of 1:5 weight ratio in which the amount of the crown ether compound-1 was 20 wt % was added and the mixture was stirred for 15 minute. Next, 7 ml of a mixed solution of 4-chloro-2-benzoylbenzoic acid and 5-methyl-2-mercaptobenzimidazole (mixing ratio=25:2 by weight, 3.0 wt % in total, methanol solution) and compounds of the general formula (1) and their comparative compounds shown in Tables 3 and 4 were added in an amount of $3.5\times10^{-3}$ mol, and compounds of the general formula (2) were added as shown in Tables 3 and 4 in an amount of $5\times10^{-3}$ mol per mol of a silver halide, further, a mixture of type 1 to 5 compounds: No. 19, No. 46 and No. 53 (1:1:1) was added in an amount of $6\times10^{-3}$ mol per mol of a silver halide, and the mixture was stirred for 1 hour, then, the temperature was lowered to 13° C., and the mixture was further stirred for 30 minutes. 48 g of polyvinylbutyral was added and dissolved sufficiently while keeping at 13° C., then, the following additives were added. These operations were all conducted under nitrogen flow.

| | |
|---|---|
| Phthalazine | 1.5 g |
| Tetrachlorophthalic acid | 0.5 g |
| 4-methylphthalic acid | 0.5 g |
| Dye 2 | 2.0 g |
| Reducing agent (1,1-bis(2-hydroxy-3,5-dimethylphenyl)-2-methylpropane) | 15 g |
| Desmodur N3300 (manufactured by Mobay, aliphatic isocyanate) | 1.10 g |

Crown ether compound-1

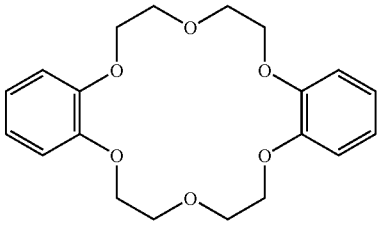

Antifoggant 1

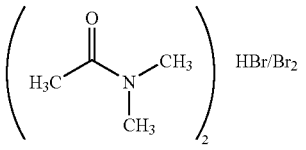

Dye 2

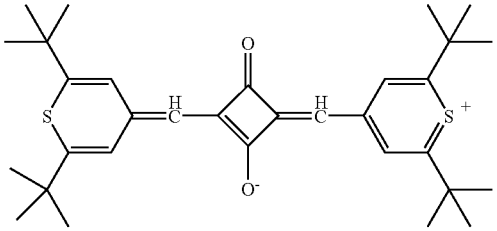

Antifoggant 2

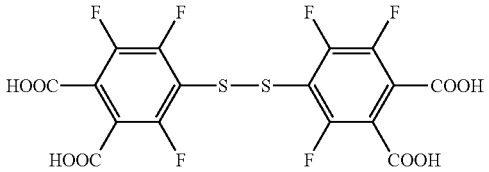

4) Application

Image forming layer: The above-mentioned application liquids for image forming layer was applied on the opposite surface to a back layer of a substrate on which the same back layer had been applied as in Example 1 so that the applied silver amount was 1.8 g/m$^2$ and the amount of polyvinyl butyral, binder, was 8.5 g/m$^2$.

Surface protective layer: The following application liquid was applied so that the applied thickness was 100 μm.

| | |
|---|---|
| Acetone | 175 ml |
| 2-propanol | 40 ml |
| Methanol | 15 ml |
| Cellulose acetate | 8 g |
| Phthalazine | 1.5 g |
| 4-methylphthalic acid | 0.72 g |
| Tetrachlorophthalic acid | 0.22 g |
| Tetrachlorophthalic anhydride | 0.5 g |
| Monodispersed silica having an average particle size of 4 μm (variation factor: 20%) based on binder | 1 wt % |
| Fluorine-based polymer surfactant (manufactured by Asahi Glass Co., Ltd., SURFLON KH40) | 0.5 g |

5) Exposure, and Thermal Development

The resulted sample was exposed to xenon flash light for an emission time of $10^{-6}$ seconds via a light interference filter showing a peak at 410 nm through a step wedge. This exposure condition is a simulating condition under which performances corresponding to blue semiconductor laser can be evaluated.

Thermal development was conducted in the same manner as in Example 1.

The results evaluated in the same manner as in Example 1 are shown in Tables 3 and 4. Sensitivity was shown as relative ratio based on sample 45.

The samples of the invention showed sufficient sensitivity enabling blue laser exposure, and had excellent preservability and image preservability.

TABLE 3

| Photo-thermo-graphic material | Silver halide emulsion: Emulsion No. | Silver halide emulsion: Halogen composition | Silver halide emulsion: Particle size | Compound of the general formula (1) | Compound of the general formula (2) | Sensi-tivity | D min | D max | Image: Preservability (ΔDmax) | Image: preservability (ΔDmin) | Remarks |
|---|---|---|---|---|---|---|---|---|---|---|---|
| 37 | Emulsion 2 | $AgI_{100}$ | 40 nm | Comparative compound-A | None | 102 | 0.2 | 3.2 | 0.32 | 0.06 | Comparative example |
| 38 | " | " | " | Comparative compound-A | 2- 19 | 122 | 0.19 | 3.4 | 0.27 | 0.06 | Comparative example |
| 39 | " | " | " | Comparative compound-A | 2- 28 | 123 | 0.19 | 3.5 | 0.22 | 0.06 | Comparative example |
| 40 | " | " | " | 1-1 | None | 104 | 0.17 | 3.9 | 0.16 | 0.03 | Present invention |
| 41 | " | " | " | " | 2- 19 | 122 | 0.16 | 4.2 | 0.13 | 0.02 | Present invention |
| 42 | " | " | " | " | 2- 28 | 123 | 0.16 | 4.3 | 0.11 | 0.02 | Present invention |
| 43 | " | " | " | 1-2 | None | 105 | 0.16 | 4.1 | 0.15 | 0.03 | Present invention |
| 44 | " | " | " | " | 2- 28 | 122 | 0.16 | 4.2 | 0.13 | 0.02 | Present invention |
| 45 | " | " | " | " | " | 121 | 0.16 | 4.2 | 0.12 | 0.02 | Present invention |
| 46 | Emulsion 5 | $AgBr_{60}I_{40}$ | 40 nm | Comparative compound-A | None | 106 | 0.2 | 3.7 | 0.27 | 0.06 | Comparative example |
| 47 | " | " | " | Comparative compound-A | 2- 19 | 120 | 0.2 | 4.1 | 0.24 | 0.06 | Comparative example |
| 48 | " | " | " | Comparative compound-A | 2- 28 | 125 | 0.2 | 4.2 | 0.2 | 0.06 | Comparative example |

TABLE 3-continued

| Photo-thermo-graphic material | Silver halide emulsion Emulsion No. | Halogen composition | Particle size | Compound of the general formula (1) | Compound of the general formula (2) | Sensi-tivity | D min | D max | Image Preservability (ΔDmax) | preservability (ΔDmin) | Remarks |
|---|---|---|---|---|---|---|---|---|---|---|---|
| 49 | " | " | " | 1-1 | None | 105 | 0.17 | 3.9 | 0.16 | 0.03 | Present invention |
| 50 | " | " | " | " | 2⁻ 19 | 122 | 0.17 | 4.1 | 0.13 | 0.02 | Present invention |
| 51 | " | " | " | " | 2⁻ 28 | 126 | 0.17 | 4.2 | 0.11 | 0.02 | Present invention |
| 52 | " | " | " | 1-2 | None | 105 | 0.16 | 3.9 | 0.11 | 0.03 | Present invention |
| 53 | " | " | " | " | 2⁻ 28 | 121 | 0.16 | 4.1 | 0.09 | 0.02 | Present invention |
| 54 | " | " | " | " | " | 126 | 0.16 | 4.2 | 0.1 | 0.02 | Present invention |

TABLE 4

| | | | | | | | | | | | |
|---|---|---|---|---|---|---|---|---|---|---|---|
| 56 | " | " | " | " | 2⁻ 19 | 125 | 0.2 | 4.1 | 0.29 | 0.06 | Present invention |
| 57 | " | " | " | " | 2⁻ 28 | 123 | 0.2 | 4.3 | 0.26 | 0.06 | Present invention |
| 58 | " | " | " | 1-1 | None | 108 | 0.17 | 4.0 | 0.15 | 0.03 | Present invention |
| 59 | " | " | " | " | 2⁻ 19 | 127 | 0.17 | 4.3 | 0.09 | 0.02 | Present invention |
| 60 | " | " | " | " | 2⁻ 28 | 129 | 0.17 | 4.4 | 0.10 | 0.02 | Present invention |
| 61 | " | " | " | 1-2 | None | 108 | 0.16 | 4.0 | 0.12 | 0.03 | Present invention |
| 62 | " | " | " | " | 2⁻ 28 | 126 | 0.16 | 4.3 | 0.09 | 0.02 | Present invention |
| 63 | " | " | " | " | " | 125 | 0.16 | 4.4 | 0.08 | 0.02 | Present invention |
| 64 | Emulsion 7 | $AgBr_{10}I_{90}$ | " | Comparative compound-A | None | 107 | 0.18 | 3.8 | 0.33 | 0.05 | Comparative example |
| 65 | " | " | " | Comparative compound-A | 2⁻ 19 | 126 | 0.18 | 4.2 | 0.28 | 0.05 | Comparative example |
| 66 | " | " | " | Comparative compound-A | 2⁻ 28 | 130 | 0.18 | 4.3 | 0.37 | 0.05 | Comparative example |
| 67 | " | " | " | 1-1 | None | 106 | 0.16 | 4.2 | 0.15 | 0.02 | Present invention |
| 68 | " | " | " | " | 2⁻ 19 | 126 | 0.16 | 4.5 | 0.09 | 0.02 | Present invention |
| 69 | " | " | " | " | 2⁻ 28 | 129 | 0.16 | 4.6 | 0.11 | 0.02 | Present invention |
| 70 | " | " | " | 1-2 | None | 109 | 0.16 | 4.1 | 0.14 | 0.02 | Present invention |
| 71 | " | " | " | " | 2⁻ 28 | 129 | 0.16 | 4.4 | 0.10 | 0.02 | Present invention |
| 72 | " | " | " | " | " | 125 | 0.16 | 4.3 | 0.08 | 0.02 | Present invention |

Example 3

1) Preparation of Application Liquid for Image Forming Layer 507 g of an organic acid silver dispersion using silver halide emulsion 2 in Example 1 was stirred at 13° C. for 15 minutes, and 3.9 ml of a 10 wt % pyridinium bromide perbromide (PHP) methanol solution was added. After stirred for 2 hours, 5.2 ml of 72 wt % methanol solution of calcium bromide was added. Stirring was continued for 30 minutes, then, 117 g of Butvar B-79 was added. Stirring was further continued for 30 minutes, then, 27.3 g of 1.1-bis(2-hydroxy-3,5-dimethylphenyl)-2-methylpropane as a reducing agent was added, and stirred further for 15 minutes. Then, sensitizing dye-1 was added in an amount of $1\times10^{-3}$ mol per mol of silver halide, and the mixture was stirred for 15 minutes. Subsequently, a solution prepared by dissolving 1.39 g of Desmodur N3300 (manufactured by Mobay, aliphatic isocyanate) in 12.3 g of MEK was added, the mixture was further stirred for 15 minutes, then, the mixture was aged at 21° C. for 15 minutes.

To 100 g of this dispersion was added compound No. 1-2 of the general formula (1) or comparative compound-A in an amount of 0.03 mol per mol of applied silver amount, hydrogen bonding compound-1 in equimolar to the reducing agent, development accelerator-1 in an amount of $5.0\times10^{-3}$ mol per mol of applied silver amount, a compound of the general formula (2) of the invention (described in Table 3), further, a mixture of type 1 to 5 compound No. 19, No 46 and No. 53 (1:1:1) in an amount of $6\times10^{-3}$ mol per mol of applied silver, and 2.2 g of 4-chlorobenzophenone-2-carboxylic acid, 0.47 g of 2-chlorobenzoic acid and 0.47 g of 5-methyl-2-mercaptobenzimidazole, and the mixture was stirred at 21° C. for 1 hour. Then, 0.368 g of phthalazine, 0.123 g of tetrachlorophthalic acid and 2 g of dye-1 were added, to complete application liquid for image forming layer.

2) Preparation of Application Liquid for Surface Protective Layer

To 865 g of MEK was added, while stirring, 96 g of cellulose acetate butyrate (manufactured by Eastman Chemical, CAB 171-15), 4.5 g of polymethyl methacrylate (manufactured by Rohm & Haas, PARALOID A-21), 1.5 g of 1,3-di(vinylsulfonyl)-2-propanol, 1.0 g of benzotriazole and 1.0 g of a fluorine-based surfactant C, and dissolved, then, 30 g of a dispersion prepared by dispersing 13.6 wt % of cellulose acetate butyrate (manufactured by Eastman Chemical, CAB 171-15) and 9 wt % of calcium carbonate (manufactured by Speciality Minerals, Super-Pflex 200) in MEK by a dissolver type homogenizer at 8000 rpm for 30 minutes was added and stirred, to prepare application liquid for surface protective layer.

3). Production of Photothermographic Material

Application liquids for image forming layer and application liquid for surface protective layer were simultaneously applied to form multiple layer on the opposite surface to a back layer of the same substrate as in Example 1 by an extrusion coater, to produce photothermographic material (shown in Table 5). Application was so conducted that the image forming layer was made with an application silver amount of 1.9 g/m$^2$ and the surface protective layer had a dry thickness of 2.5 μm. Then, it was dried using hot air at a temperature of 75° C. and a due point of 10° C. over 10 minutes.

Compounds used in the example are shown below.

Fluorine-based polymer surfactant C

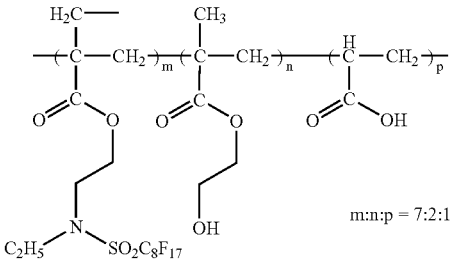

-continued

Sensitizing dye-1

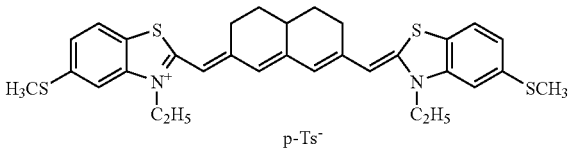

Development accelerator-1

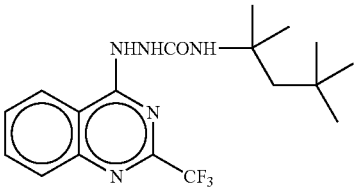

Hydrogen bonding compound-1

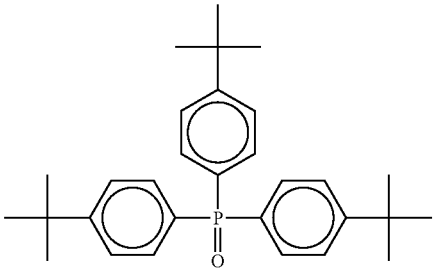

5) Exposure and Thermal Development

The resulted samples 3-1 to 3-6 were exposed in the same manner as in Example 1, then, thermally developed at 124° C. for 15 seconds. The results are shown in Table 5. The samples of the invention showed high laser sensitivity and excellent preservability.

TABLE 5

| Sample No. | Compound of the general formula (1) | Compound of the general formula (2) | Sensitivity | Dmin | Dmax | Preservability (ΔDmax) | Remarks |
|---|---|---|---|---|---|---|---|
| 3-1 | Comparative compound-A | None | 90 | 0.25 | 3.8 | 0.5 | Comparative example |
| 3-2 | " | 2-19 | 93 | 0.23 | 4.1 | 0.3 | " |
| 3-3 | " | 2-28 | 100 | 0.24 | 4.3 | 0.3 | " |
| 3-4 | 1-2 | None | 98 | 0.15 | 3.7 | 0.3 | " |
| 3-5 | " | 2-19 | 103 | 0.15 | 4.1 | 0.1 | Present invention |
| 3-6 | " | 2-28 | 108 | 0.15 | 4.2 | 0.1 | " |

Example 4

Samples 4-1 to 4-6 were produced in the same manner as in Example 5 except that sensitizing dye-1 was removed in Example 3. The resulted samples were exposed to xenon flash light for an emission time of $10^{-6}$ seconds via a light interference filter showing a peak at 410 nm through a step wedge. The results are shown in Table 6.

The samples of the invention showed sufficient sensitivity enabling blue laser exposure, and had excellent preservability and image preservability.

TABLE 6

| Sample No. | Compound of the general formula (1) | Compound of the general formula (2) | Sensitivity | Dmin | Dmax | Preservability (ΔDmax) | Remarks |
|---|---|---|---|---|---|---|---|
| 4-1 | Comparative compound-A | None | 92 | 0.23 | 3.8 | 0.5 | Comparative example |
| 4-2 | " | 2-19 | 93 | 0.21 | 4.1 | 0.3 | " |
| 4-3 | " | 2-28 | 100 | 0.22 | 4.3 | 0.3 | " |
| 4-4 | 1-2 | None | 95 | 0.13 | 3.7 | 0.3 | " |
| 4-5 | " | 2-19 | 100 | 0.13 | 4.1 | 0.1 | Present invention |
| 4-6 | " | 2-28 | 102 | 0.13 | 4.2 | 0.1 | " |

Example 5

1. Production of Primed PET Substrate

A primed substrate was made in the same manner as in Example 1.

2. Application of Back Layer

A back layer was made in the same manner as in Example 1.

3. Image Forming Layer and Surface Protective Layer 3-1. Preparation of Application Materials 1) Silver Halide Emulsion (Preparation of Silver Halide Emulsion-11)

To 1420 ml of distilled water was added 4.3 ml of a 1 wt % potassium iodide solution, further, added 3.5 ml of 0.5 mol/L sulfuric acid and 36.7 g of phthalated gelatin, and the resulted solution was kept at 42° C., while stirring in a stainless reaction bottle, and solution A prepared by diluting 22.22 g of silver nitrate in distilled water to give a volume of 195.6 ml and solution B prepared by diluting 21.8 g of potassium iodide in distilled water to give a volume of 218 ml, were added in their entireties to the solution, over 9 minutes. Then, 10 ml of a 3.5 wt % hydrogen peroxide aqueous solution was added, further, 10.8 ml of a 10 wt % benzimidazole aqueous solution was added. Further, solution C prepared by adding distilled water to 51.86 g of silver nitrate for dilution to 317.5 ml was added at constant flow rate in its entirety over 120 minutes and solution D prepared by diluting 60 g of potassium iodide with distilled water to give a volume of 600 ml was added by a controlled double jet method while maintaining pAg at 8.1.

A potassium iridiate (III) hexachloride was added in its entirety 10 minutes after initiation of addition of solution C and solution D so as to give a concentration of $1\times10^{-4}$ per mol of silver. Further, a potassium iron (II) hexacyanide aqueous solution was added in its entirety at a concentration of $3\times10^{-4}$ mol per mol of silver 5 seconds after completion of addition of solution C. PH was controlled to 3.8 using 0.5 mol/L sulfuric acid, and stirring was stopped, and precipitation/de-salting/water-washing process were conducted. PH was controlled to 5.9 using 1 mol/L sodium hydroxide, to produce a silver halide dispersion having pAg of 8.0.

The above-mentioned silver halide dispersion was maintained at 38° C. while stirring, and to this was added 5 ml of a 0.34 wt % methanol solution of 1,2-benzoisothiazolin-3-one, and the mixture was heated up to 47° C. 20 minutes after heating, sodium benzenethiosulfonate was added as a methanol solution in a proportion of $7.6\times10^{-5}$ mol per mol of silver, then, pAg was controlled to 5.5, and 5 minutes after, tellurium sensitizer C was added as a methanol solution in a proportion of $2.9\times10^{-4}$ mol per mol of silver and the mixture was aged for 91 minutes. The emulsion was adjusted to pAg 7.5, then, 1.3 ml of a 0.8 wt % methanol solution of N,N'-dihydroxyl-N",N"-diethylmelamine was added, further 4 minutes after, 5-methyl-2-mercaptobenzimidazole was added as a methanol solution in a proportion of $4.8\times10^{-3}$ mol per mol of silver and 1-phenyl-2-heptyl-5-mercapto-1,3,4-triazole was added in a proportion of $5.4\times10^{-3}$ mol per mol of silver, to produced a silver halide emulsion.

(Preparation of Silver Halide Emulsion-12)

Silver halide emulsion 12 having a silver iodide content in silver halide of 3.5 mol % was prepared in the same manner as the preparation of silver halide emulsion-11 except that the addition amount of potassium iodide was changed in preparation of the silver halide dispersion and temperature was controlled in particle growth for size controlling, in the preparation of silver halide emulsion-11.

The average particle size of silver halide was 0.040 μm.

2) Preparation of Powdery Silver Salt of Fatty Acid (Preparation of Powdery Silver Salt of Fatty Acid-11)

688 g of a fatty acid having a composition of 42 mol % of behenic acid, 34 mol % of arachidic acid and 24 mol % of stearic acid was dissolved in 13 L of water and mixed for 15 minutes, then, liquid prepared by dissolving 89.18 g of NaOH in 1.5 L of water of 80° C. was added, and mixed for 5 minutes to form a dispersion. At 80° C., to this dispersion was added liquid prepared by diluting 19 ml of concentrated nitric acid with 50 ml of water, and the dispersion was cooled to 55° C. and stirred for 25 minutes, then, kept at 55° C., and a dilute emulsion prepared by dissolving 700 g of the above-mentioned iridium-doped silver halide emulsion-11 (containing 1 mol of silver halide) in 1.25 L of water at 42° C. was added in an amount corresponding to 0.10 mol of silver halide, and stirred for 5 minutes. Further, 336.5 g of silver nitrate was dissolved in 2.5 L of water, and the resulted solution was added at 55° C. over 10 minutes. Then, the resulted organic silver salt dispersion was transferred into a water-washing vessel, and de-ionized water was added to this and the mixture was stirred, then, allowed to stand still to allow the organic silver salt dispersion to float and separate, and the lower water-soluble salts were removed. Then, washing with de-ionized water and drainage were repeated until the conductivity of the drain reached 2 μS/cm, and centrifugal dehydration was performed, then, drying was conducted in a circulation drier with warm air having an oxygen partial pressure of 10 vol % until no weight loss was shown at 45° C.

Powdery silver salt of fatty acid-12 was prepared in the same manner except that powdery silver salt of fatty acid-12 was used instead of silver halide emulsion-11, in the preparation of silver salt of fatty acid-11.

3) Re-dispersion of Organic Silver Salt in Organic Solvent (Preparation of Re-dispersion-11 of Organic Silver Salt)

209 g of the above-mentioned powdery silver salt of fatty acid-11 and 11 g of a polyvinyl butyral powder (Butvar B-79, manufactured by Monsant) were dissolved in 780 g of methyl ethyl ketone (MEK), and stirred by DISPERMAT CA-40M type, a dissolver manufactured by VMA-GETZMANN, and left at 7° C. over night, to obtain slurry.

The above-mentioned slurry was dispersed trough 2 pass by GM-2 type pressure mode homogenizer manufactured by SMT, to prepare a re-dispersion-11 of an organic silver salt.

(Preparation of Re-dispersion-12 of Organic Silver Salt)

Re-dispersion-12 of an organic silver salt was prepared in the same manner except that powdery silver salt of fatty acid-12 was used instead of powdery silver salt of fatty acid-11, in the above-mentioned preparation of re-dispersion-11 of an organic silver salt.

4) Preparation of Image Forming Layer Application Liquids-101 to 111 and -119 to 124

507 g of re-dispersion-11 of the above-mentioned was stirred at 13° C. for 15 minutes, and 3.9 ml of a 10 wt % pyridinium hydrobromide perbromide (PHP) methanol solution was added. After stirring for 2 hours, 5.2 ml of a 1.1 wt % methanol solution of potassium bromide was added. Stirring was continued for 30 minutes, then, 117 g of Butvar B-79 was added. After further stirring for 30 minutes, 27.3 g of reducing agent-1 (the above-mentioned specifically exemplified compound I-1) was added, and stirring was continued for further 15 minutes. Then, sensitizing dye-1 was added in an amount of $1\times10^{-3}$ mol per mol of silver halide, and stirred for 15 minutes. Subsequently, liquid prepared by dissolving 1.39 g of Desmodur N3300 (manufactured by Mobay, aliphatic isocyanurate) in 12.3 g of MEK was added, and stirred for further 15 minutes, then, aged at 21° C. for 15 minutes.

To 100 g of this dispersion was added compound polyhalogen compound-1 (the above-mentioned specifically exemplified compound H-2) in an amount of 0.03 mol per mol of applied silver amount, type 1-5 compound-1 (the above-mentioned specifically exemplified compound 24) in an amount of $5\times10^{-3}$ mol per mol of silver halide, hydrogen bonding compound-1 (the above-mentioned specifically exemplified compound B-7) in equimolar to the reducing agent-1, development accelerator-1 (the above-mentioned specifically exemplified compound A-1) and development accelerator-2 (the above-mentioned specifically exemplified compound A-8) each in an amount of $5.0\times10^{-3}$ mol per mol of silver salt of fatty acid, and 0.47 g of 4-chlorobenzophenone-2-carboxylic acid, 0.47 g of 2-chlorobenzoic acid and 0.043 g of 5-methyl-2-mercaptobenzimidazole, and the mixture was stirred at 21° C. for 1 hour. Then, 0.368 g of phthalazine, 0.123 g of tetrachlorophthalic acid and 2 g of dye-1 were added, to complete application liquid for image forming layer.

5) Preparation of Application Liquids-112 to 118 for Image Forming Layer

Application liquids-112 to 118 for image forming layer were prepared in the same manner except that re-dispersion-12 of an organic silver salt was used instead of re-dispersion-11 of an organic silver salt in preparation of application liquids-101 to 104, and 107 to 109 for image forming layer.

6) Preparation of Application Liquid for Surface Protective Layer 1.44 g of ACRYLOID (manufactured by Rohm and Haas [Pennsylvania Philadelphia]) polymethyl methacrylate and 37.29 g of CAB 171-15S (Eastman Kodak Co.) cellulose acetate butyrate were mixed in 459 g of MEK until dissolution. Then, to this premix was added 0.76 g of vinylsulfone VS-1 (described in EP-A No. 0600589A2, having the following structural formula), 0.57 g of a compound of the general formula (T1) shown in Tables 7 and 8 (not added to photothermographic materials-101, 107 to 112, 116 to 118), 0.45 g of dye 1, 0.50 g of a compound of the general formula (PR) (PR-01) and 0.047 mol of a compound of the general formula (T2) shown in Tables 7 and 8 (not added to photothermographic materials-101 to 106, 112 to 115), and 4.8 g of fluorine-based surfactant C, to prepare application liquid for surface protective layer.

Vinylphosphone VS-1

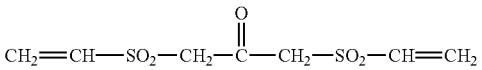

3-2. Preparation of Photothermographic Material

The application liquid for image forming layer and application liquid for surface protective layer prepared as described above were simultaneously applied to form multiple layer, by a dual knife coater, on the opposite surface to a back layer of a substrate on which the back layer had been applied, to produced photothermographic materials 101 to 124. Application was so conducted that the image forming layer had a thickness after drying of 18.3 μm and the surface protective layer had a thickness of 3.4 μm. This application apparatus was composed of arranged two knife coating blades. The substrate was cut into length matching the volume of the solution used, then, a knife with a hinge was lifted and placed at a position on the coater floor. Next, the knife was lowered and fixed to given position. The height of the knife was controlled using a wedge measured by an ammeter controlled by a screw knob. Knife No. 1 was raised to a gap corresponding to thickness matched to the total thickness of the thickness of the substrate and the desired wet thickness of the image forming layer (layer No. 1). Knife No. 2 was raised to height equivalent to the total thickness of the wet thickness of the substrate plus image forming ayer (layer No. 1) and the desired thickness of the surface protective layer (layer No. 2). Then, the material was dried for 15 minutes using air at a temperature of 75° C. and a due point of 10° C.

The chemical structures of compounds used in the examples of the invention are shown below.

Tellurium sensitizer C

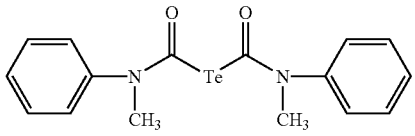

3-4. Measurement of Solvent Residue

In thus obtained photothermographic material, the MEK content measured by the following condition was used as a solvent content. A piece of film having an area of 46.3 $cm^2$ was excised, and this was cut into about 5 mm square and accommodated in a dedicated glass bottle, and sealed with a septum and an aluminum cap, then, set on a head space sampler HP7694 type of gas chromatography (GC) 5671 type manufactured by Hewlett Packard. As the GC detector, a flame ionization detector (FID) was used, and as the column, DB-624 manufactured by J & W was used. Regarding main measurement conditions, head space sampler heating conditions included 120° C. for 20 minutes, and the GC introduction temperature was 150° C., and the temperature was raised from 45° C. to 100° C. at a rate of 8° C./minute. The calibration curve was made as follows: a constant amount of a butanol diluted solution of MEK was accommodated in a dedicated glass bottle, then, measurement was conducted in the same manner as described above to give chromatogram, and a calibration curve was made using the peak area. There was no significant difference between the samples produced, and the solvent content was in the range from 10 to 12 $mg/m^2$.

4. Evaluation of Photographic Performances (Preparation)

The produced sample was cut into half size, wrapped with the following wrapping material under environments of 25° C. and 50% RH, and preserved for two weeks under normal temperature.

(Wrapping Material)

PET 10 μm/PE 12 μm/Aluminum foil 9 μm/Ny 15 μm/polyethylene 50 μm containing 3 wt % carbon, oxygen permeability: 0.02 $ml/atm/m^2/25°$ C./day, vapor permeability: 0.10 $g/atm/m^2/25°$ C./day The above-mentioned photosensitive materials were evaluated as follows.

(Exposure/Development of Photosensitive Material)

An exposure machine was trial-manufactured using, as an exposure source, semiconductor laser longitudinally multiple-moded, having a wavelength of 800 nm to 820 nm, at high frequency superomposed, and exposure was effected by laser scanning by this exposing machine, from the side of the image forming layer surfaces of the above produced samples No. 101 to No. 124. In this procedure, an image was recorded at an incident angle of scanning laser light to the exposure surface of the photosensitive material of 75° C. Then, development was conducted at 124° C. for 15 seconds using an automatic developing machine having a heat drum so that the protective layer of the photosensitive material and the drum surface came into contact, and evaluation of the resulted image was conducted with a densitometer.

(Evaluation of Photographic Performances)

1) Evaluation of Fogging

Evaluation of the resulted image was conducted using a Macbeth TD 904 densitometer (visible density). The fogging were evaluated by the minimum density (Dmin).

2) Evaluation of Sensitivity

Sensitivity was represented by the inverse of the exposure amount giving density of fogging plus 1.0. When the silver iodide content was 3.5 mol %, evaluation was conducted by the relative sensitivity (ΔS) of each sample against the photothermographic material-112, which sensitivity was taken as 100.

When the silver iodide content was 100 mol %, evaluation was conducted by the relative sensitivity (ΔS) of each sample against the photothermographic material-101, which sensitivity was taken as 100.

3) Evaluation of Printout After the Thermal Development

Photothermographic materials-101 to 124 of the invention were thermally developed to obtain image samples which were exposed under fluorescent lamp of 1000 lux for 3 days, then, the optical density of Dmin portion was measured. The optical density in this operation was represented by $Dmin_2$, and a difference (ΔDmin) from Dmin before exposure under fluorescent lamp was calculated.

$$\Delta Dmin = Dmin_2 - Dmin$$

TABLE 7

| Sample No. | Silver halide (AgI content) | General formula (T1) | General formula (T2) | Sensitizing coloring matter | Fogging Dmin | Sensitivity | Print out ΔDmin | Remarks |
|---|---|---|---|---|---|---|---|---|
| 101 | 100 mol % | None | None | −1 | 0.23 | 100 | 0.02 | Comparative example |
| 102 | 100 mol % | 1-1 | None | −1 | 0.17 | 99 | 0.00 | Present invention |
| 103 | 100 mol % | 1-2 | None | −1 | 0.19 | 95 | 0.00 | Present invention |
| 104 | 100 mol % | 1-3 | None | −1 | 0.18 | 97 | 0.00 | Present invention |
| 105 | 100 mol % | 1-4 | None | −1 | 0.19 | 95 | 0.00 | Present invention |
| 106 | 100 mol % | 1-5 | None | −1 | 0.18 | 96 | 0.00 | Present invention |
| 107 | 100 mol % | None | 2-1 | −1 | 0.18 | 98 | 0.00 | Present invention |
| 108 | 100 mol % | None | 2-2 | −1 | 0.19 | 99 | 0.00 | Present invention |
| 109 | 100 mol % | None | 2-3 | −1 | 0.16 | 100 | 0.00 | Present invention |
| 110 | 100 mol % | None | 2-4 | −1 | 0.17 | 99 | 0.00 | Present invention |
| 111 | 100 mol % | None | 2-5 | −1 | 0.19 | 97 | 0.00 | Present invention |
| 112 | 3.5 mol % | None | None | −1 | 0.25 | 100 | 0.08 | Comparative example |
| 113 | 3.5 mol % | 1-1 | None | −1 | 0.21 | 75 | 0.05 | Comparative example |

TABLE 7-continued

| Sample No. | Silver halide (AgI content) | General formula (T1) | General formula (T2) | Sensitizing coloring matter | Fogging Dmin | Sensitivity | Print out ΔDmin | Remarks |
|---|---|---|---|---|---|---|---|---|
| 114 | 3.5 mol % | 1-2 | None | −1 | 0.22 | 70 | 0.06 | Comparative example |
| 115 | 3.5 mol % | 1-3 | None | −1 | 0.23 | 72 | 0.06 | Comparative example |
| 116 | 3.5 mol % | None | 2-1 | −1 | 0.22 | 65 | 0.05 | Comparative example |
| 117 | 3.5 mol % | None | 2-2 | −1 | 0.23 | 68 | 0.06 | Comparative example |
| 118 | 3.5 mol % | None | 2-3 | −1 | 0.21 | 75 | 0.04 | Comparative example |

TABLE 8

| Sample No. | Silver halide (AgI content) | General formula (T1) | General formula (T2) | Sensitizing coloring matter | Fogging Dmin | Sensitivity | Print out ΔDmin | Remarks |
|---|---|---|---|---|---|---|---|---|
| 119 | 100 mol % | 1-1 | 2-3 | −1 | 0.15 | 99 | 0.00 | Present invention |
| 120 | 100 mol % | 1-2 | 2-3 | −1 | 0.16 | 95 | 0.00 | Present invention |
| 121 | 100 mol % | 1-3 | 2-3 | −1 | 0.16 | 97 | 0.00 | Present invention |
| 122 | 100 mol % | 1-1 | 2-4 | −1 | 0.16 | 98 | 0.00 | Present invention |
| 123 | 100 mol % | 1-2 | 2-4 | −1 | 0.17 | 94 | 0.00 | Present invention |
| 124 | 100 mol % | 1-3 | 2-4 | −1 | 0.17 | 96 | 0.00 | Present invention |

As shown in Tables 7 and 8, when the silver iodide content was 3.5 mol %, sensitivity decreased remarkably by addition of a compound of the general formula (T1) or (T2). In contrast, when the silver iodide content was 100 mol %, decrease in sensitivity was extremely small even by addition of a compound of the general formula (T1) or (T2).

In all samples of the invention using a compound of the general formula (T1) or (T2) and silver halide having a silver iodide content of 40 mol % or more and 100 mol % or less, photothermographic materials were obtained showing small fogging (low Dmin value), and extremely little printout.

Particularly when the compound of the general formula (T1) is 1-1 and the compound of the general formula (T1) is 2-3 and these were used in combination, the evaluation results of sensitivity, fogging and printout were excellent.

Example 6

Photothermographic materials-125 to 134 were produced in the same manner as for photothermographic material-119 in Example 5 except that type 1 to 5 compound-1 was changed as shown in Table 9.

TABLE 9

| Sample No. | Silver halide (AgI content) | General formula (T1) | General formula (T2) | Sensitizing coloring matter | Type 1 to 5 compounds Kind | Addition amount (mol/mol of silver halide) | Fogging Dmin | Sensitivity | Print out ΔDmin | Remarks |
|---|---|---|---|---|---|---|---|---|---|---|
| 102 | 100 mol % | 1-1 | 2-3 | −1 | 24 | $5 \times 10^{-3}$ | 0.15 | 99 | 0.00 | Present invention |
| 125 | 100 mol % | 1-1 | 2-3 | −1 | 6 | $5 \times 10^{-3}$ | 0.18 | 95 | 0.00 | Present invention |
| 126 | 100 mol % | 1-1 | 2-3 | −1 | 60 | $5 \times 10^{-3}$ | 0.16 | 94 | 0.00 | Present invention |
| 127 | 100 mol % | 1-1 | 2-3 | −1 | 61 | $5 \times 10^{-3}$ | 0.17 | 97 | 0.00 | Present invention |
| 128 | 100 mol % | 1-1 | 2-3 | −1 | G-1 | $5 \times 10^{-3}$ | 0.16 | 94 | 0.00 | Present invention |
| 129 | 100 mol % | 1-1 | 2-3 | −1 | 8 | $5 \times 10^{-3}$ | 0.16 | 105 | 0.00 | Present invention |
| 130 | 100 mol % | 1-1 | 2-3 | −1 | 34 | $5 \times 10^{-3}$ | 0.17 | 103 | 0.00 | Present invention |
| 131 | 100 mol % | 1-1 | 2-3 | −1 | 41 | $5 \times 10^{-3}$ | 0.18 | 110 | 0.00 | Present invention |
| 132 | 100 mol % | 1-1 | 2-3 | −1 | 8 | $2 \times 10^{-3}$ | 0.16 | 110 | 0.00 | Present invention |
| | | | | | 34 | $2 \times 10^{-3}$ | | | | |
| | | | | | 41 | $2 \times 10^{-3}$ | | | | |
| 133 | 100 mol % | 1-1 | 2-3 | −1 | 8 | $2 \times 10^{-3}$ | 0.17 | 104 | 0.00 | Present invention |
| | | | | | 24 | $2 \times 10^{-3}$ | | | | |
| | | | | | G-1 | $2 \times 10^{-3}$ | | | | |
| 134 | 100 mol % | 1-1 | 2-3 | −1 | 34 | $2 \times 10^{-3}$ | 0.17 | 109 | 0.00 | Present invention |
| | | | | | 41 | $2 \times 10^{-3}$ | | | | |
| | | | | | G-1 | $2 \times 10^{-3}$ | | | | |

Exposure and development were conducted, and performances were evaluated, in the same manner as in Example 5. As a result, all of the photothermographic materials in present invention were obtained showing little fogging (low Dmin value) and extremely little print out, even if the kind of type 1 to 5 compound was changed.

Example 7

Photothermographic materials-135 to 145 were produced in the same manner as for photothermographic materials-101 to 111 in Example 5 except that sensitizing dye-1 was changed to sensitizing dye-2.

(Sensitizing dye-2)

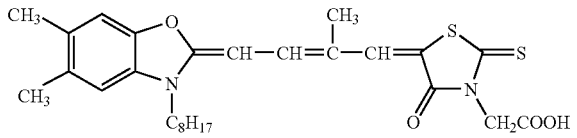

(Exposure/Development of Photosensitive Material)

The above obtained photothermographic materials were exposed and thermally developed in FUJI MEDICAL DRY IMAGER-FM-DPL (provided with 660 nm semiconductor laser showing 60 mW (IIIB) output at maximum, four panel heaters set at 112° C.-119° C.-121° C.-121° C., 24 seconds in total).

(Evaluation of Photographic Performances)

Evaluation was conducted in the same manner as in Example 5. The results are shown in Table 10.

TABLE 10

| Sample No. | Silver halide (AgI content) | General formula (T1) | General formula (T2) | Sensitizing coloring matter | Fogging Dmin | Sensitivity | Print out ΔDmin | Remarks |
|---|---|---|---|---|---|---|---|---|
| 135 | 100 mol % | None | None | −2 | 0.23 | 100 | 0.02 | Comparative example |
| 136 | 100 mol % | 1-1 | None | −2 | 0.17 | 99 | 0.00 | Present invention |
| 137 | 100 mol % | 1-2 | None | −2 | 0.19 | 95 | 0.00 | Present invention |
| 138 | 100 mol % | 1-3 | None | −2 | 0.18 | 97 | 0.00 | Present invention |
| 139 | 100 mol % | 1-4 | None | −2 | 0.19 | 95 | 0.00 | Present invention |
| 140 | 100 mol % | 1-5 | None | −2 | 0.18 | 96 | 0.00 | Present invention |
| 141 | 100 mol % | None | 2-1 | −2 | 0.18 | 98 | 0.00 | Present invention |
| 142 | 100 mol % | None | 2-2 | −2 | 0.19 | 99 | 0.00 | Present invention |
| 143 | 100 mol % | None | 2-3 | −2 | 0.16 | 100 | 0.00 | Present invention |
| 144 | 100 mol % | None | 2-4 | −2 | 0.17 | 99 | 0.00 | Present invention |
| 145 | 100 mol % | None | 2-5 | −2 | 0.19 | 97 | 0.00 | Present invention |

As a result of evaluation in the same manner as in Example 5, also when the sensitizing dye was changed to sensitizing dye-2 for red laser and exposure was effected with red laser, decrease in sensitivity was extremely small even by addition of a compound of the general formula (T1) or (T2), as in Example 5, and with all samples of the invention, were obtained small fogging (low Dmin value) and extremely small printout, as shown in Table 10.

Example 8

1) Re-dispersion of Organic Silver Salt into Organic Solvent

In re-dispersion-11 of an organic silver salt into an organic solvent in Example 5, wherein a slurry was dispersed trough 2 pass in GM-2 type pressure mode homogenizer manufactured by SMT, and the slurry was dispersed by a media dispersing machine filled 80% by volume with 1 mm Zr beads (manufactured by Toray Co., Ltd.) at a circumferential speed of 13 mm at a retensuion time of 0.5 minutes in mill, to obtain organic silver salt dispersion-13 containing a photosensitive silver halide.

2) Preparation of Application Liquid for Image Forming Layer

To 500 g of the above-mentioned organic silver salt dispersion-13 containing a photosensitive silver halide was added 100 g of MEK under nitrogen flow while stirring and the mixture was kept at 24° C. 2.5 ml of a 10 wt % methanol solution of the antifoggant-1 was added and the mixture was stirred for 15 minutes. 1.8 ml of a solution of a crown ether compound-1 and potassium acetate of 1:5 weight ratio in which the amount of the crown ether compound-1 was 20 wt % was added and the mixture was stirred for 15 minute. Next, sensitizing dye-3 was added in an amount of $1\times10^{-3}$ mol per mol of silver halide, and 4-chloro-2-benzoylbenzoic acid in a weight of 250 times of that of the sensitizing dye-3, and a supersensitizer, 5-methyl-2-mercaptobenzimidazole in a weight of 20 times of that of the sensitizing dye-3, compound-2 of the general formula (1) (the above-mentioned specifically exemplified compound 1-1) in an amount of 0.03 mol per mol of applied silver amount, and type 1-5 compound-1 (the above-mentioned specifically exemplified compound No. 24) in an amount of $3.5\times10^{-3}$ mol per mol of silver halide, hydrogen bonding compound-1 (the above-mentioned specifically exemplified compound B-7) of equimolar to reducing agent-2, and development accelerator-1 (the above-mentioned specifically exemplified compound A-1) and development accelerator-2 (the above-mentioned specifically exemplified compound A-8) each in an amount of $5\times10^{-3}$ mol per mol of silver of a fatty acid silver were added, and the mixture was stirred for 1 hour, then, the temperature was lowered to 13° C. and the mixture was further stirred for 30 minutes. While keeping at 13° C., 48 g of polyvinyl butyral was added and dissolved sufficiently, then, the following additives were added. These operations were all conducted under nitrogen flow.

| | |
|---|---|
| Phthalazine | 1.5 g |
| Tetrachlorophthalic acid | 0.5 g |
| 4-methylphthalic acid | 0.5 g |
| Dye-2 | 2.0 g |
| Reducing agent-2 (the above-mentioned specifically exemplified compound I-1) | 15 g |
| Desmodur N3300 (manufactured by Mobay, aliphatic isocyanate) | 1.10 g |
| Fogging preventing agent-2 | 0.9 g |

(Sensitizing dye-3)

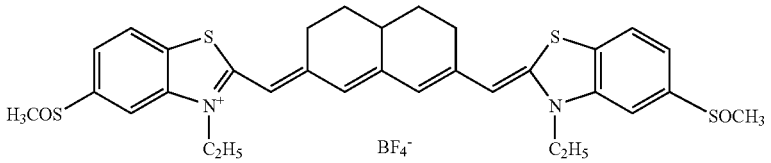

3) Surface Protective Layer Application Liquid

Surface protective layer application liquid was prepared in the same manner as in Example 5.

4) Production of Photothermographic Materials-146 to 163

Image forming layer: the above-mentioned image forming layer application liquid was applied on the opposite surface to a back layer of the substrate on which the same back layer as the substrate in Example 5 had been applied, so that the applied silver amount was 1.8 g/m$^2$ and the amount of polyvinyl butyral, binder, was 8.5 g/m$^2$.

Surface protective layer: It was applied so that the wet applied thickness was 100 μm.

5) Ability Evaluation

Results of evaluation conducted in the same manner as in Example 5 are shown in Table 11.

In all samples of the invention using a compound of the general formula (T1) or (T2) and silver halide having a silver iodide content of 40 mol % or more and 100 mol % or less, photothermographic materials were obtained showing small fogging (low Dmin value), and extremely little printout.

Particularly when the compound of the general formula (T1) is 1-1 and the compound of the general formula (T1) is 2-3 and these were used together in combination, the evaluation results of sensitivity, fogging and printout were excellent.

Example 9

Photothermographic materials-164 to 174 were produced in the same manner as in Example 5 except that preparation

TABLE 11

| Sample No. | Silver halide (AgI content) | General formula (T1) | General formula (T2) | Sensitizing coloring matter | Fogging Dmin | Sensitivity | Print out ΔDmin | Remarks |
|---|---|---|---|---|---|---|---|---|
| 146 | 100 mol % | None | None | −3 | 0.25 | 100 | 0.02 | Comparative example |
| 147 | 100 mol % | 1-1 | None | −3 | 0.19 | 97 | 0.00 | Present invention |
| 148 | 100 mol % | 1-2 | None | −3 | 0.21 | 93 | 0.00 | Present invention |
| 149 | 100 mol % | 1-3 | None | −3 | 0.20 | 95 | 0.00 | Present invention |
| 150 | 100 mol % | 1-4 | None | −3 | 0.21 | 93 | 0.00 | Present invention |
| 151 | 100 mol % | 1-5 | None | −3 | 0.20 | 94 | 0.00 | Present invention |
| 152 | 100 mol % | None | 2-1 | −3 | 0.20 | 96 | 0.00 | Present invention |
| 153 | 100 mol % | None | 2-2 | −3 | 0.21 | 97 | 0.00 | Present invention |
| 154 | 100 mol % | None | 2-3 | −3 | 0.18 | 98 | 0.00 | Present invention |
| 155 | 100 mol % | None | 2-4 | −3 | 0.19 | 97 | 0.00 | Present invention |
| 156 | 100 mol % | None | 2-5 | −3 | 0.21 | 95 | 0.00 | Present invention |
| 157 | 3.5 mol % | None | None | −3 | 0.22 | 100 | 0.10 | Comparative example |
| 158 | 3.5 mol % | 1-1 | None | −3 | 0.23 | 65 | 0.07 | Comparative example |
| 159 | 3.5 mol % | 1-2 | None | −3 | 0.24 | 60 | 0.08 | Comparative example |
| 160 | 3.5 mol % | 1-3 | None | −3 | 0.25 | 62 | 0.08 | Comparative example |
| 161 | 3.5 mol % | None | 2-1 | −3 | 0.24 | 55 | 0.07 | Comparative example |
| 162 | 3.5 mol % | None | 2-2 | −3 | 0.25 | 58 | 0.08 | Comparative example |
| 163 | 3.5 mol % | None | 2-3 | −3 | 0.22 | 65 | 0.06 | Comparative example |

Like in Example 5, when the silver iodide content was 3.5 mol %, sensitivity decreased remarkably by addition of a compound of the general formula (T1) or (T2). In contrast, when the silver iodide content was 100 mol %, decrease in sensitivity was extremely small even by addition of a compound of the general formula (T1) or (T2).

was effected without adding sensitizing dye-1 for preparation of photothermographic materials-101 to 111 in Example 5. Then, the same treatment was conducted as in Example 5 except that 405 nm blue laser was used, to obtain results shown in Table 12.

TABLE 12

| Sample No. | Silver halide (AgI content) | General formula (T1) | General formula (T2) | Sensitizing coloring matter | Fogging Dmin | Sensitivity | Print out ΔDmin | Remarks |
|---|---|---|---|---|---|---|---|---|
| 164 | 100 mol % | None | None | None | 0.23 | 100 | 0.02 | Comparative example |
| 165 | 100 mol % | 1-1 | None | None | 0.17 | 99 | 0.00 | Present invention |
| 166 | 100 mol % | 1-2 | None | None | 0.19 | 95 | 0.00 | Present invention |
| 167 | 100 mol % | 1-3 | None | None | 0.18 | 97 | 0.00 | Present invention |

TABLE 12-continued

| Sample No. | Silver halide (AgI content) | General formula (T1) | General formula (T2) | Sensitizing coloring matter | Fogging Dmin | Sensitivity | Print out ΔDmin | Remarks |
|---|---|---|---|---|---|---|---|---|
| 168 | 100 mol % | 1-4 | None | None | 0.19 | 95 | 0.00 | Present invention |
| 169 | 100 mol % | 1-5 | None | None | 0.18 | 96 | 0.00 | Present invention |
| 170 | 100 mol % | None | 2-1 | None | 0.18 | 98 | 0.00 | Present invention |
| 171 | 100 mol % | None | 2-2 | None | 0.19 | 99 | 0.00 | Present invention |
| 172 | 100 mol % | None | 2-3 | None | 0.16 | 100 | 0.00 | Present invention |
| 173 | 100 mol % | None | 2-4 | None | 0.17 | 99 | 0.00 | Present invention |
| 174 | 100 mol % | None | 2-5 | None | 0.19 | 97 | 0.00 | Present invention |

As shown in Table 12, also when a sensitizing dye was not added and exposure was conducted by bluer laser, decrease in sensitivity was extremely small even by addition of a compound of the general formula (T1) or (T2) like in Example 5, and with all sample of the invention, were obtained small fogging (low Dmin value) and extremely small printout.

Example 10

Photothermographic materials-175 to 185 were produced in the same manner as in Example 5 except that preparation was effected without adding sensitizing dye-3 for preparation of photothermographic materials-146 to 156 in Example 8. Then, the same treatment was conducted as in Example 5 except that 405 nm blue laser was used, to obtain results shown in Table 13.

TABLE 13

| Sample No. | Silver halide (AgI content) | General formula (T1) | General formula (T2) | Sensitizing coloring matter | Fogging Dmin | Sensitivity | Print out ΔDmin | Remarks |
|---|---|---|---|---|---|---|---|---|
| 175 | 100 mol % | None | None | None | 0.25 | 100 | 0.02 | Comparative example |
| 176 | 100 mol % | 1-1 | None | None | 0.19 | 97 | 0.00 | Present invention |
| 177 | 100 mol % | 1-2 | None | None | 0.21 | 93 | 0.00 | Present invention |
| 178 | 100 mol % | 1-3 | None | None | 0.20 | 95 | 0.00 | Present invention |
| 179 | 100 mol % | 1-4 | None | None | 0.21 | 93 | 0.00 | Present invention |
| 180 | 100 mol % | 1-5 | None | None | 0.20 | 94 | 0.00 | Present invention |
| 181 | 100 mol % | None | 2-1 | None | 0.20 | 96 | 0.00 | Present invention |
| 182 | 100 mol % | None | 2-2 | None | 0.21 | 97 | 0.00 | Present invention |
| 183 | 100 mol % | None | 2-3 | None | 0.18 | 98 | 0.00 | Present invention |
| 184 | 100 mol % | None | 2-4 | None | 0.19 | 97 | 0.00 | Present invention |
| 185 | 100 mol % | None | 2-5 | None | 0.21 | 95 | 0.00 | Present invention |

As shown in Table 13, also when a sensitizing dye was not added and exposure was conducted by bluer laser, decrease in sensitivity was extremely small even by addition of a compound of the general formula (T1) or (T2) like in Example 5, and with all sample of the invention, photothermographic materials were obtained showing small fogging (low Dmin value) and extremely small printout.

Example 11

1. Production of Primed PET Substrate

A primed substrate was made in the same manner as in Example 1.

2. Application of Back Layer

A back layer was made in the same manner as in Example 1.

3. Image Forming Layer and Surface Protective Layer 3-1. Preparation of Application Materials 1) Silver Halide Emulsion (Preparation of Silver Halide Emulsion-21)

To 1420 ml of distilled water was added 4.3 ml of a 1 wt % potassium iodide solution, further, added 3.5 ml of 0.5 mol/L sulfuric acid and 36.7 g of phthalated gelatin, and the resulted solution was kept at 42° C. while stirring in a stainless reaction bottle, and solution A prepared by diluting 22.22 g of silver nitrate in distilled water to give a volume of 195.6 ml and solution B prepared by diluting 21.8 g of potassium iodide in distilled water to give a volume of 218 ml, were added in their entireties to the solution, over 9 minutes. Then, 10 ml of a 3.5 wt % hydrogen peroxide aqueous solution was added, further, 10.8 ml of a 10 wt % benzimidazole aqueous solution was added. Further, solution C prepared by adding distilled water to 51.86 g of silver nitrate for dilution to 317.5 ml was added at constant flow rate in its entirety over 120 minutes and solution D prepared by diluting 60 g of potassium iodide with distilled water to give a volume of 600 ml was added by a controlled double jet method while maintaining pAg at 8.1.

A potassium iridiate (III) hexachloride was added in its entirety 10 minutes after starting of addition of solution C and solution D so as to give a concentration of $1\times10^{-4}$ per mol of silver. Further, a potassium iron (II) hexacyanide aqueous solution was added in its entirety at a concentration of $3\times10^{-4}$ mol per mol of silver, 5 seconds after completion of addition of solution C. PH was controlled to 3.8 using 0.5 mol/L sulfuric acid, and stirring was stopped, and precipitation/de-salting/water-washing process were conducted. PH was controlled to 5.9 using 1 mol/L sodium hydroxide, to produce a silver halide dispersion having pAg of 8.0. Particles in the prepared silver halide emulsions were pure silver iodide particles having an average sphere-reduced diameter of 0.040 μm and a variation coefficient of the sphere-reduced diameter of 17%. The particle size and the like were measured from the average of 1000 particles using an electron microscope.

The above-mentioned silver halide dispersion was maintained at 38° C. while stirring, and to this was added 5 ml of a 0.34 wt % methanol solution of 1,2-benzoisothiazolin-3-one, and the mixture was heated up to 47° C. 20 minutes after heating, sodium benzenethiosulfonate was added as a methanol solution in a proportion of $7.6\times10^{-5}$ mol per mol of silver, then, pAg was controlled to 5.5, and 5 minutes after, tellurium sensitizer C was added as a methanol solution in a proportion of $2.9\times10^{-4}$ mol per mol of silver and the mixture was aged for 91 minutes. The emulsion was adjusted to pAg 7.5, then, 1.3 ml of a 0.8 wt % methanol solution of N,N'-dihydroxy-N",N"-diethylmelamine was added, further 4 minutes after, 5-methyl-2-mercaptobenzimidazole was added as a methanol solution in a proportion of $4.8\times10^{-3}$ mol per mol of silver and 1-phenyl-2-heptyl-5-mercapto-1,3,4-triazole was added in a proportion of $5.4\times10^{-3}$ mol per mol of silver, to produce a silver halide emulsion.

(Preparation of Silver Halide Emulsion-22)

Silver halide emulsion 22 having a silver iodide content in silver halide of 3.5 mol % was prepared in the same manner as the preparation of silver halide emulsion-21 except that the addition amount of potassium iodide was changed to the mixture of potassium iodide and potassium bromide and temperature was controlled in particle growth for size controlling, in the preparation of silver halide emulsion-21.

The average particle size of silver halide was 0.040 μm.

2) Preparation of Silver Salt of Fatty Acid (Preparation of Silver Salt of Fatty Acid-21)

688 g of a fatty acid having a composition of 42 mol % of behenic acid, 34 mol % of arachidic acid and 24 mol % of stearic acid was dissolved in 13 L of water and mixed for 15 minutes, then, liquid prepared by dissolving 89.18 g of NaOH in 1.5 L of water of 80° C. was added, and mixed for 5 minutes to form a dispersion. At 80° C., to this dispersion was added liquid prepared by diluting 19 ml of concentrated nitric acid with 50 ml of water, and the dispersion was cooled to 55° C. and stirred for 25 minutes, then, kept at 55° C., and a dilute emulsion prepared by dissolving 700 g of the above-mentioned iridium-doped silver halide emulsion-21 (containing 1 mol of silver halide) in 1.25 L of water at 42° C. was added in an amount corresponding to 0.10 mol of silver halide, and mixed for 5 minutes. Further, 336.5 g of silver nitrate was dissolved in 2.5 L of water, and the resulted solution was added at 55° C. over 10 minutes. Then, the resulted organic silver salt dispersion was transferred into a water-washing vessel, and de-ionized water was added to this and the mixture was stirred, then, allowed to stand still to allow the organic silver salt dispersion to float and separate, and the lower water-soluble salts were removed. Then, washing with de-ionized water and drainage were repeated until the conductivity of the drain reached 2 μS/cm, and centrifugal dehydration was performed, then, drying was conducted in a circulation drier with warm air having an oxygen partial pressure of 10 vol % until no weight loss was shown at 45° C.

(Preparation of Silver Salt of Fatty Acid-22)

Silver salt of fatty acid-22 was prepared in the same manner except that silver halide emulsion-22 was used instead of silver halide emulsion-21 in preparation of silver salt of fatty acid-21.

3) Re-dispersion of Organic Silver Salt in Organic Solvent (Preparation of Re-dispersion-21 of Organic Silver Salt)

209 g of the above-mentioned powder silver salt of fatty acid-21 and 11 g of a polyvinyl butyral powder (Butvar B-79, manufactured by Monsant) were dissolved in 780 g of methyl ethyl ketone (MEK), and stirred by DISPERMAT CA-40M type, a dissolver manufactured by VMA-GETZMANN, and left at 7° C. over night, to obtain slurry.

The above-mentioned slurry was dispersed trough 2 pass by GM-2 type pressure mode homogenizer manufactured by SMT, to prepare a re-dispersed substance-21 of an organic silver salt.

(Preparation of Re-dispersion-22 of Organic Silver Salt)

Re-dispersion-22 of organic silver salt was prepared in the same manner except that silver salt of fatty acid-22 was used instead of silver salt of fatty acid-21 in the above-mentioned preparation of re-dispersion-21 of organic silver salt.

4) Preparation of Application Liquid-A for Image Forming Layer 507 g of re-dispersion-21 of the above-mentioned organic silver salt containing a photosensitive silver halide in an organic solvent was stirred at 13° C. for 15 minutes, and 3.9 ml of a 10 wt % pyridinium hydrobromide perbromide (PHP) methanol solution was added. After stirring for 2 hours, 5.2 ml of a 1.1 wt % methanol solution of potassium bromide was added. Stirring was continued for 30 minutes, then, 117 g of Butvar B-79 was added. After further stirring for 30 minutes, 27.3 g of reducing agent-1 (the above-mentioned specifically exemplified compound I-2) was added, and stirring was continued for further 15 minutes. Then, sensitizing dye-1 was added in an amount of $1\times10^{-3}$ mol per mol of silver halide, and stirred for 15 minutes. Subsequently, liquid prepared by dissolving 1.39 g of Desmodur N3300 (manufactured by Mobay, aliphatic isocyanurate) in 12.3 g of MEK was added, and stirred for further 15 minutes, then, aged at 21° C. for 15 minutes.

To 100 g of this dispersion was added compound polyhalogen compound-1 (the above-mentioned specifically exemplified compound PO-2) in an amount of 0.03 mol per mol of applied silver amount, type 1-5 compound-1 (the above-mentioned specifically exemplified compound 24) in an amount of $5\times10^{-3}$ mol per mol of silver halide, hydrogen bonding compound-1 (the above-mentioned specifically exemplified compound D-7) in equimolar to the reducing agent-1, development accelerator-1 (the above-mentioned specifically exemplified compound A-1) and development accelerator-2 (the above-mentioned specifically exemplified compound A-8) each in an amount of $5.0\times10^{-3}$ mol per mol of silver salt of fatty acid, and 0.47 g of 4-chlorobenzophenone-2-carboxylic acid, 0.043 g of 5-methyl-2-mercaptobenzimidazole, and the mixture was stirred at 21° C. for 1 hour. Then, 0.368 g of phthalazine, 0.123 g of tetrachlorophthalic acid and 2 g of dye-1 were added, to complete image forming layer application liquids-201 to 206.

5) Preparation of Image Forming Layer Application Liquid-B

Image formimg layer application liquid-B was prepared in the same manner except that re-dispersion-22 of an organic silver salt was used instead of re-dispersion-21 of an organic silver salt in preparation of image forming layer application liquid-A.

6) Preparation of Surface Protective Layer Application Liquid

To 512 g of MEK was added 61 g of methanol, 48 g of cellulose acetate butyrate (manufactured by Eastman Chemical, CAB171-15), and a compound of the general formula (PR) shown in Table 14 or 15 (not added to samples-201 to -207) so that the concentration was $5\times10^{-4}$ mol/m$^2$, and 2.08 g of 4-methylphthalic acid, 3.3 g of a 16 wt % MEK solution of fluorine-based polymer surfactant C, 1.9 g of polymethyl methacrylate (manufactured by Rohm and Haas [Pennsylvania Philadelphia]), 1.9 g of Acryloid A-21 and 0. 5 g of vinylsulfone VS-1 (described in EP-A No. 0600589A2) were mixed at room temperature, to prepare surface protective layer application liquid.

thickness of the wet thickness of the substrate+image forming layer (layer No. 1) and the desired thickness of the surface protective layer (layer No. 2). Then, the material was dried for 15 minutes using dry air at temperature of 75° C. and a due point of 10° C.

3-4. Measurement of Solvent Residue

Measurement was conducted on each sample in the same manner as in Example 5. As a result, the solvent content was in the range from 10 to 12 mg/m$^2$.

4. Evaluation of Photographic Performences

Results of evaluation in the same manner as in Example 5 are shown in Tables 14 and 15.

TABLE 14

| Sample No. | Silver halide (AgI content) | General formula (PR) | Sensitizing coloring matter | Fogging Dmin | Sensitivity | Print out ΔDmin | Remarks |
|---|---|---|---|---|---|---|---|
| 201 | 100 mol % | None | −1 | 0.21 | 100 | 0.02 | Comparative example |
| 202 | 100 mol % | PR-01 | −1 | 0.16 | 102 | 0.00 | Present invention |
| 203 | 100 mol % | PR-02 | −1 | 0.18 | 97 | 0.00 | Present invention |
| 204 | 100 mol % | PR-03 | −1 | 0.18 | 98 | 0.00 | Present invention |
| 205 | 100 mol % | PR-04 | −1 | 0.17 | 101 | 0.00 | Present invention |
| 206 | 100 mol % | PR-05 | −1 | 0.18 | 97 | 0.00 | Present invention |

TABLE 15

| Sample No. | Silver halide (AgI content) | General formula (PR) | Sensitizing coloring matter | Fogging Dmin | Sensitivity | Print out ΔDmin | Remarks |
|---|---|---|---|---|---|---|---|
| 207 | 3.5 mol % | None | −1 | 0.24 | 100 | 0.08 | Comparative example |
| 208 | 3.5 mol % | PR-01 | −1 | 0.19 | 75 | 0.05 | Comparative example |
| 209 | 3.5 mol % | PR-02 | −1 | 0.21 | 70 | 0.06 | Comparative example |
| 210 | 3.5 mol % | PR-03 | −1 | 0.20 | 65 | 0.05 | Comparative example |
| 211 | 3.5 mol % | PR-04 | −1 | 0.19 | 72 | 0.06 | Comparative example |
| 212 | 3.5 mol % | PR-05 | −1 | 0.20 | 71 | 0.07 | Comparative example |

3-2. Preparation of Photothermographic Material

The image formimg layer application liquids-A and -B and surface protective layer application liquid prepared as described above were simultaneously applied to form multiple layer, by a dual knife coater, on the opposite surface to a back layer of a substrate on which the back layer had been applied, to produced photothermographic materials 201 to 212. The photothermographic materials 201 to 206 used image forming layer application liquid-A and the photothermographic materials 207 to 212 used image forming layer application liquid-B.

Application was so conducted that the image forming layer had a thickness after drying of 18.3 μm and the surface protective layer had a thickness of 3.4 μm. This application apparatus was composed of arranged two knife coating blades. The substrate was cut into length matching the volume of the solution used, then, a knife with a hinge was lifted and placed at a position on the coater floor. Next, the knife was lowered and fixed to given position. The height of the knife was controlled using a wedge measured by an ammeter controlled by a screw knob. Knife No. 1 was raised to a gap corresponding to thickness matched to the total thickness of the thickness of the substrate and the desired wet thickness of the image forming layer (layer No. 1). Knife No. 2 was raised to height equivalent to the total As shown in Table 15, when the silver iodide content was 3.5 mol %, sensitivity decreased remarkably by addition of a compound of the general formula (PR). In contrast, when the silver iodide content was 100 mol %, decrease in sensitivity was extremely small even by addition of a compound of the general formula (PR).

Further, with all sample of the invention using a compound of the general formula (PR) and silver halide having a silver iodide content of 40 mol % or more and 100 mol % or less, photothermographic materials were obtained showing small fogging (low Dmin value) and extremely small printout.

Particularly when the compound of the general formula (PR) is PR-01, the evaluation results of sensitivity, fogging and printout were excellent.

Example 12

Photothermographic materials 213 to 222 were produced in the same manner except that type 1 to 5 compound-1 was changed as shown in Table 16, in preparation of photothermographic material 202. Further, exposure and development were conducted and photographic performances were evaluated in the same manner as in Example 11.

TABLE 16

| Sample No. | Silver halide (AgI content) | General formula (PR) | Sensitizing coloring matter | Type 1 to 5 compounds Kind | Addition amount (mol/mol of silver halide) | Fogging Dmin | Sensitivity | Print out ΔDmin | Remarks |
|---|---|---|---|---|---|---|---|---|---|
| 202 | 100 mol % | PR-01 | −1 | 24 | $5 \times 10^{-3}$ | 0.16 | 102 | 0.00 | Present invention |
| 213 | 100 mol % | PR-01 | −1 | 6 | $5 \times 10^{-3}$ | 0.17 | 97 | 0.00 | Present invention |
| 214 | 100 mol % | PR-01 | −1 | 60 | $5 \times 10^{-3}$ | 0.15 | 98 | 0.00 | Present invention |
| 215 | 100 mol % | PR-01 | −1 | 61 | $5 \times 10^{-3}$ | 0.17 | 101 | 0.00 | Present invention |
| 216 | 100 mol % | PR-01 | −1 | G-1 | $5 \times 10^{-3}$ | 0.16 | 96 | 0.00 | Present invention |
| 217 | 100 mol % | PR-01 | −1 | 8 | $5 \times 10^{-3}$ | 0.15 | 110 | 0.00 | Present invention |
| 218 | 100 mol % | PR-01 | −1 | 34 | $5 \times 10^{-3}$ | 0.16 | 108 | 0.00 | Present invention |
| 219 | 100 mol % | PR-01 | −1 | 41 | $5 \times 10^{-3}$ | 0.17 | 115 | 0.00 | Present invention |
| 220 | 100 mol % | PR-01 | −1 | 8 | $2 \times 10^{-3}$ | 0.15 | 115 | 0.00 | Present invention |
| | | | | 34 | $2 \times 10^{-3}$ | | | | |
| | | | | 41 | $2 \times 10^{-3}$ | | | | |
| 221 | 100 mol % | PR-01 | −1 | 8 | $2 \times 10^{-3}$ | 0.16 | 112 | 0.00 | Present invention |
| | | | | 24 | $2 \times 10^{-3}$ | | | | |
| | | | | G-1 | $2 \times 10^{-3}$ | | | | |
| 222 | 100 mol % | PR-01 | −1 | 34 | $2 \times 10^{-3}$ | 0.16 | 114 | 0.00 | Present invention |
| | | | | 41 | $2 \times 10^{-3}$ | | | | |
| | | | | G-1 | $2 \times 10^{-3}$ | | | | |

As shown in Table 16, photothermographic materials were obtained showing small fogging (low Dmin value) and extremely small printout, even if the kind of type 1 to 5 compound was changed.

Example 13

Photothermographic materials 223 to 228 were produced in the same manner except that sensitizing dye-1 was changed to sensitizing dye-2 in preparation of photothermographic materials 201 to 206.

(Exposure/Development of Photosensitive Material)

The above obtained photothermographic materials were exposed and thermally developed (four panel heaters set at 112° C.-119° C.-121° C.-121° C., 24 seconds in total) in FUJI MEDICAL DRY IMAGER-FM-DPL (provided with 660 nm semiconductor laser showing 60 mW (IIIB) output at maximum).

(Evaluation of Photographic Performances)

Evaluation of photographic performances was conducted in the same manner as in Example 11. The results are shown in Table 17.

As shown in Table 17, also when a sensitizing dye was changed to sensitizing dye-2 for red laser, and exposure was conducted with red laser, decrease in sensitivity was extremely small even by addition of a compound of the general formula (PR) like in Example 11, and with all sample of the invention, photothermographic materials were obtained showing small fogging (low Dmin value) and extremely small printout.

Example 14

1) Re-dispersion of Organic Silver Salt into Organic Solvent

In re-dispersion-21 of an organic silver salt into an organic solvent in Example 11, instead of dispersing a slurry trough 2 in GM-2 type pressure mode homogenizer, the slurry was dispersed by a media dispersing machine filled 80% by volume with 1 mm Zr beads (manufactured by Toray Co., Ltd.) at a circumferential speed of 13 mm at a retension time of 0.5 minutes in mill, to obtain organic silver salt dispersion-23 containing a photosensitive silver halide.

TABLE 17

| Sample No. | Silver halide (AgI content) | General formula (PR) | Sensitizing dye | Fogging Dmin | Sensitivity | Print out ΔDmin | Remarks |
|---|---|---|---|---|---|---|---|
| 223 | 100 mol % | None | −2 | 0.22 | 100 | 0.02 | Comparative example |
| 224 | 100 mol % | PR-01 | −2 | 0.15 | 105 | 0.00 | Present invention |
| 225 | 100 mol % | PR-02 | −2 | 0.17 | 99 | 0.00 | Present invention |
| 226 | 100 mol % | PR-03 | −2 | 0.17 | 96 | 0.00 | Present invention |
| 227 | 100 mol % | PR-04 | −2 | 0.18 | 102 | 0.00 | Present invention |
| 228 | 100 mol % | PR-05 | −2 | 0.17 | 98 | 0.00 | Present invention |

2) Preparation of Image Forming Layer Application Liquid

To 500 g of the above-mentioned organic silver salt dispersion-23 containing a photosensitive silver halide was added 100 g of MEK under nitrogen flow while stirring and the mixture was kept at 24° C. 2.5 ml of a 10 wt % methanol solution of the antifoggant-1 was added and the mixture was stirred for 15 minutes. 1.8 ml of a solution of the the dye adsorption promotor and potassium acetate of 1:5 weight ratio in which the amount of the dye adsorption promotor was 20 wt % was added and the mixture was stirred for 15 minute. Next, sensitizing dye-3 was added in an amount of $1\times10^{-3}$ mol per mol of silver halide, and 4-chloro-2-benzoylbenzoic acid in a weight of 250 times of that of the sensitizing dye-3, and a supersensitizer, 5-methyl-2-mercaptobenzimidazole in a weight of 20 times of that of the sensitizing dye-3, compound-2 of the general formula (1) (the above-mentioned specifically exemplified compound 1-1) in an amount of 0.03 mol per mol of applied silver amount, and type 1-5 compound-1 in an amount of $5\times10^{-3}$ mol per mol of silver halide, hydrogen bonding compound-1 of equimolar to reducing agent-2, and development accelerators-1 and -2 each in an amount of $5\times10^{-3}$ mol per mol of silver of a silver salt of fatty acid were added, and the mixture was stirred for 1 hour, then, the temperature was lowered to 13° C. and the mixture was further stirred for 30 minutes. While keeping at 13° C., 48 g of polyvinyl butyral was added and dissolved sufficiently, then, the following additives were added. These operations were all conducted under nitrogen flow.

| | |
|---|---|
| Phthalazine | 1.5 g |
| Tetrachlorophthalic acid | 0.5 g |
| 4-methylphthalic acid | 0.5 g |
| Dye-2 | 2.0 g |
| Reducing agent-2 (the above-mentioned specifically exemplified compound I-1) | 15 g |
| Desmodur N3300 (manufactured by Mobay, aliphatic isocyanate) | 1.10 g |
| Antifoggant-2 | 0.9 g |

3) Surface Protective Layer Application Liquid

Surface protective layer application liquid was prepared in the same manner as in Example 11.

4) Production of Photothermographic Materials 229 to 240

Image forming layer: The above-mentioned image forming layer application liquid was applied on the opposite surface to a back layer of the substrate on which the same back layer as the substrate in Example 11 had been applied, so that the applied silver amount was 1.8 g/m$^2$ and the amount of polyvinyl butyral, binder, was 8.5 g/m$^2$.

Surface protective layer: It was applied so that the wet applied thickness was 100 μm.

5) Evaluation of Photographic Performances

Results of evaluation conducted in the same manner as in Example 11 are shown in Tables 18 and 19.

TABLE 18

| Sample No. | Silver halide (AgI content) | General formula (PR) | Sensitizing dye | Fogging Dmin | Sensitivity | Print out ΔDmin | Remarks |
|---|---|---|---|---|---|---|---|
| 229 | 100 mol % | None | −3 | 0.23 | 100 | 0.02 | Comparative example |
| 230 | 100 mol % | PR-01 | −3 | 0.18 | 98 | 0.00 | Present invention |
| 231 | 100 mol % | PR-02 | −3 | 0.20 | 93 | 0.00 | Present invention |
| 232 | 100 mol % | PR-03 | −3 | 0.20 | 94 | 0.00 | Present invention |
| 233 | 100 mol % | PR-04 | −3 | 0.19 | 97 | 0.00 | Present invention |
| 234 | 100 mol % | PR-05 | −3 | 0.20 | 93 | 0.00 | Present invention |

TABLE 19

| Sample No. | Silver halide (AgI content) | General formula (PR) | Sensitizing dye | Fogging Dmin | Sensitivity | Print out ΔDmin | Remarks |
|---|---|---|---|---|---|---|---|
| 235 | 3.5 mol % | None | −3 | 0.25 | 100 | 0.10 | Comparative example |
| 236 | 3.5 mol % | PR-01 | −3 | 0.20 | 65 | 0.07 | Comparative example |
| 237 | 3.5 mol % | PR-02 | −3 | 0.22 | 60 | 0.08 | Comparative example |
| 238 | 3.5 mol % | PR-03 | −3 | 0.21 | 55 | 0.07 | Comparative example |
| 239 | 3.5 mol % | PR-04 | −3 | 0.20 | 62 | 0.08 | Comparative example |
| 240 | 3.5 mol % | PR-05 | −3 | 0.21 | 61 | 0.09 | Comparative example |

Like in Example 11, when the silver iodide content was 3.5 mol %, sensitivity decreased remarkably by addition of a compound of the general formula (PR). In contrast, when the silver iodide content was 100 mol % as shown in Table 18, decrease in sensitivity was extremely small even by addition of a compound of the general formula (PR).

In all samples in Table 18 using a compound of the general formula (PR) and silver halide having a silver iodide content of 100 mol %, photothermographic materials were obtained showing small fogging (low Dmin value), and extremely little printout.

Particularly when the compound of the general formula (PR) is PR-01, the evaluation results of sensitivity, fogging and printout were excellent.

Example 15

Photothermographic materials 241 to 252 were produced in the same manner as in Example 11 except that preparation was effected without adding sensitizing dye-1 added for preparation of photothermographic materials 201 to 212 in Example 11. Then, the same treatment was conducted as in Example 11 except that 405 nm blue laser was used, to obtain results shown in Tables 20 and 21.

TABLE 20

| Sample No. | Silver halide (AgI content) | General formula (PR) | Sensitizing dye | Fogging Dmin | Sensitivity | Print out ΔDmin | Remarks |
|---|---|---|---|---|---|---|---|
| 241 | 100 mol % | None | None | 0.21 | 100 | 0.02 | Comparative example |
| 242 | 100 mol % | PR-01 | None | 0.16 | 102 | 0.00 | Present invention |
| 243 | 100 mol % | PR-02 | None | 0.18 | 97 | 0.00 | Present invention |
| 244 | 100 mol % | PR-03 | None | 0.18 | 98 | 0.00 | Present invention |
| 245 | 100 mol % | PR-04 | None | 0.17 | 101 | 0.00 | Present invention |
| 246 | 100 mol % | PR-05 | None | 0.18 | 97 | 0.00 | Present invention |

TABLE 21

| Sample No. | Silver halide (AgI content) | General formula (PR) | Sensitizing dye | Fogging Dmin | Sensitivity | Print out ΔDmin | Remarks |
|---|---|---|---|---|---|---|---|
| 247 | 3.5 mol % | None | None | 0.24 | 100 | 0.08 | Comparative example |
| 248 | 3.5 mol % | PR-01 | None | 0.19 | 75 | 0.05 | Comparative example |
| 249 | 3.5 mol % | PR-02 | None | 0.21 | 70 | 0.06 | Comparative example |
| 250 | 3.5 mol % | PR-03 | None | 0.20 | 65 | 0.05 | Comparative example |
| 251 | 3.5 mol % | PR-04 | None | 0.19 | 72 | 0.06 | Comparative example |
| 252 | 3.5 mol % | PR-05 | None | 0.20 | 71 | 0.07 | Comparative example |

As shown in Table 20, also when a sensitizing dye was not added and exposure was conducted by blue laser, decrease in sensitivity was extremely small even by addition of a compound of the general formula (PR) like in Example 11, and with all sample of the invention, photothermographic materials were obtained showing small fogging (low Dmin value) and extremely small printout.

Example 16

Photothermographic materials 253 to 264 were produced in the same manner as in production of photothermographic materials 229 to 240 in Example 14 except that sensitizing dye-3 was removed. Then, the same treatment was conducted as in Example 11 except that 405 nm blue laser was used, to obtain results shown in Tables 22 and 23.

TABLE 22

| Sample No. | Silver halide (AgI content) | General formula (PR) | Sensitizing dye | Fogging Dmin | Sensitivity | Print out ΔDmin | Remarks |
|---|---|---|---|---|---|---|---|
| 253 | 100 mol % | None | None | 0.23 | 100 | 0.02 | Comparative example |
| 254 | 100 mol % | PR-01 | None | 0.18 | 98 | 0.00 | Present invention |
| 255 | 100 mol % | PR-02 | None | 0.20 | 93 | 0.00 | Present invention |
| 256 | 100 mol % | PR-03 | None | 0.20 | 94 | 0.00 | Present invention |
| 257 | 100 mol % | PR-04 | None | 0.19 | 97 | 0.00 | Present invention |
| 258 | 100 mol % | PR-05 | None | 0.20 | 93 | 0.00 | Present invention |

TABLE 23

| Sample No. | Silver halide (AgI content) | General formula (PR) | Sensitizing dye | Fogging Dmin | Sensitivity | Print out ΔDmin | Remarks |
|---|---|---|---|---|---|---|---|
| 259 | 3.5 mol % | None | None | 0.25 | 100 | 0.10 | Comparative example |
| 260 | 3.5 mol % | PR-01 | None | 0.20 | 65 | 0.07 | Comparative example |
| 261 | 3.5 mol % | PR-02 | None | 0.22 | 60 | 0.08 | Comparative example |
| 262 | 3.5 mol % | PR-03 | None | 0.21 | 55 | 0.07 | Comparative example |
| 263 | 3.5 mol % | PR-04 | None | 0.20 | 62 | 0.08 | Comparative example |
| 264 | 3.5 mol % | PR-05 | None | 0.21 | 61 | 0.09 | Comparative example |

As shown in Table 22, also when a sensitizing dye was not added and exposure was conducted by blue laser, decrease in sensitivity was extremely small even by addition of a compound of the general formula (PR) like in Example 11, and with all sample of the invention, photothermographic materials were obtained showing small fogging (low Dmin value) and extremely small printout.

Example 17

Surface protective layer application liquid was prepared without adding a compound of the general formula (PR) added in preparation of surface protective layer application liquid in Example 11. Further, a compound of the general formula (PR) was added in the same amount ($5\times10^{-4}$ mol/m$^2$) as in the case of addition to a surface protective layer, in preparation of image forming layer application liquid 202, to produce image forming layer application liquid 265.

TABLE 24

| Sample No. | Silver halide (AgI content) | General formula (PR) | Addition amount | Sensitizing dye | Fogging Dmin | Sensitivity | Print out ΔDmin | Remarks |
|---|---|---|---|---|---|---|---|---|
| 202 | 100 mol % | PR-01 | Surface protective layer | −1 | 0.16 | 102 | 0.00 | Present invention |
| 265 | 100 mol % | PR-01 | Image forming layer | −1 | 0.15 | 91 | 0.00 | Present invention |

Photographic perforemances were evaluated as in example 11.

As shown in Table 24, excellent results were obtained in fogging and printout when a compound of the general formula (PR) was added to any layer. However, there is a tendency that sensitivity slightly lowers when added to an image forming layer, teaching that addition to a surface protective layer adjacent to the image forming layer is preferable.

What is claimed is:

1. A photothermographic material comprising:

a substrate; and an image forming layer disposed on one surface of the substrate, and containing at least a photosensitive silver halide, a non-photosensitive organic silver salt, a reducing agent for a silver ion, and a binder, wherein, the photosensitive silver halide has a silver iodide content of 40 to 100 mol %, and an average particle size of 5 to 80 nm, and the photothermographic material contains a compound represented by formula (1);

$$Q\text{-}(Y)_n\text{—}C(Z_1)(Z_2)X \qquad \text{formula (1)}$$

wherein Q represents a heterocycle, Y represents a divalent connecting group, n represents 0 or 1, $Z_1$ and $Z_2$ each represent a halogen atom, and X represents a hydrogen atom or an electron withdrawing group;

and at least one compound represented by the following formula (T1);

formula (T1)

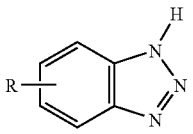

wherein R represents a hydrogen atom, an alkyl group having 1 to 4 carbon atoms, an aryl group, a halogen atom, an amino group, a nitro group, an alkoxycarbonyl group, a substituted or non-substituted carboxyl group or salt thereof, or a sulfonic group or salt thereof.

2. The photothermographic material according to claim 1, wherein said photothermographic material contains a phthalic acid or a derivative thereof.

3. The photothermographic material according to claim 1, wherein said photothermographic material contains a compound represented by the following formula (2):

formula (2)

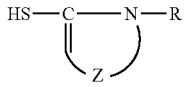

wherein Z represents an atomic group for forming a 5-membered or 6-membered aromatic heterocycle; and R represents a hydrogen atom, an alkyl group, an aralkyl group, an alkoxy group, or an aryl group.

4. The photothermographic material according to claim 1, wherein said photosensitive silver halide has an average particle size of 5 to 50 nm.

5. The photothermographic material according to claim 1, wherein said photosensitive silver halide has a silver iodide content of 90 to 100 mol %.

6. The photothermographic material according to claim 1, wherein said binder comprises polyvinyl butyral in an amount of 50 to 100 % by weight.

7. The photothermographic material according to claim 1, wherein said photosensitive silver halide is spectrally sensitized to a wavelength range of 700 nm to 1400 nm by a spectral sensitizing dye.

8. The photothermographic material according to claim 7, wherein said spectral sensitizing dye is at least one spectral sensitizing dye selected from the group represented by formulae (3a), (3b), (3c) and (3d):

formula (3a)

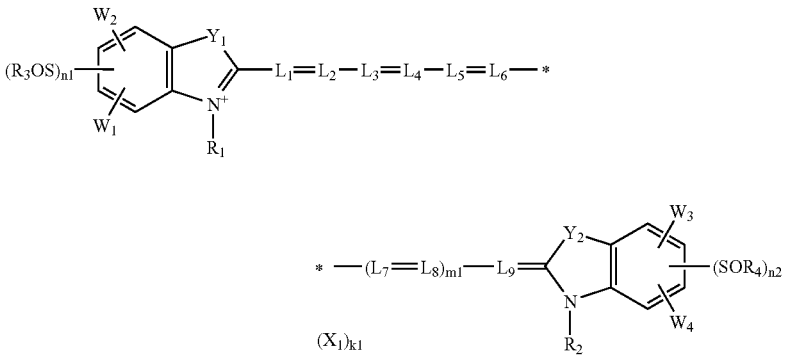

-continued formula (3b)

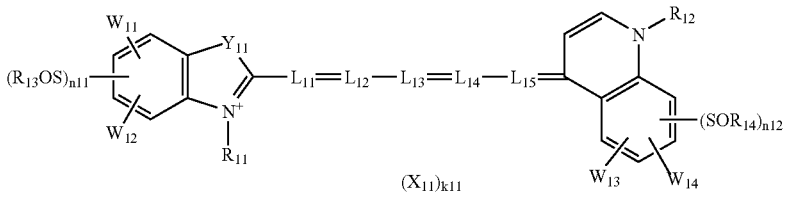

formula (3c)

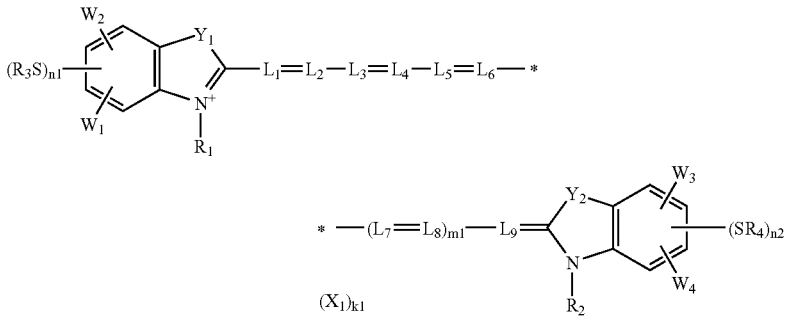

formula (3d)

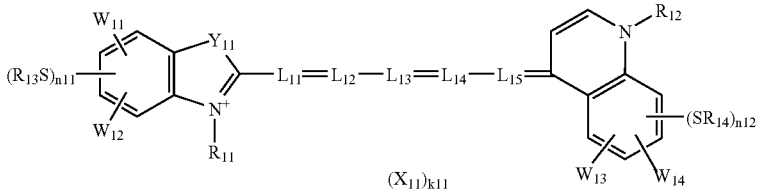

wherein $Y_1$, $Y_2$ and $Y_{11}$ each independently represent an oxygen atom, a sulfur atom, a selenium atom or a —CH═CH— group; $L_1$ to $L_9$ and $L_{11}$ to $L_{15}$ each independently represent a methine group; $R_1$, $R_2$, $R_{11}$ and $R_{12}$ each independently represent an aliphatic group; $R_3$, $R_4$, $R_{13}$ and $R_{14}$ each independently represent a lower alkyl group, a lower cycloalkyl group, a lower alkenyl group, a lower aralkyl group, a lower aryl group or a lower heterocyclic group; $W_1$, $W_2$, $W_3$, $W_4$, $W_{11}$, $W_{12}$, $W_{13}$ and $W_{14}$ each independently represent a hydrogen atom, a substituent, a non-metal atomic group necessary for bonding between $W_1$ and $W_2$, $W_3$ and $W_4$, $W_{11}$ and $W_{12}$, $W_{13}$ and $W_{14}$ to form a condensed ring, or a non-metal atomic group necessary for bonding between $R_3$ and $W_1$, $R_3$ and $W_2$, $R_{13}$ and $W_{11}$, $R_{13}$ and $W_{12}$, $R_4$ and $W_3$, $R_4$ and $W_4$, $R_{14}$ and $W_{13}$, and $R_{14}$ and $W_{14}$ to form a 5-membered or 6-membered ring; $X_1$ and $X_{11}$ each represent an ion necessary for neutralizing charge in the molecule, $k_1$ and $k_{11}$ each represent a number of ions necessary for neutralizing charge in the molecule; $m_1$ represents 0 or 1; $n_1$, $n_2$, $n_{11}$ and $n_{12}$ each represent 0, 1, or 2; and $n_1$ and $n_2$ do not simultaneously represent 0; and $n_{11}$ and $n_{12}$ do not simultaneously represent 0.

9. A photothermographic material comprising:

a substrate; and an image forming layer disposed on one surface of the substrate, and containing at least a photosensitive silver halide, a non-photosensitive organic silver salt, a reducing agent for a silver ion, and a binder, wherein, the photosensitive silver halide has a silver iodide content of 40 to 100 mol %, and an average particle size of 5 to 80 nm, and the photothermographic material contains a compound represented by formula (1);

$$Q\text{-}(Y)_n\text{—}C(Z_1)(Z_2)X \qquad \text{formula (1)}$$

wherein Q represents a heterocycle, Y represents a divalent connecting group, n represents 0 or 1, $Z_1$ and $Z_2$ each represent a halogen atom, and X represents a hydrogen atom or an electron withdrawing group;

and at least one compound represented by the following formula (T1);

formula (T1)

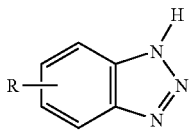

wherein R represents a hydrogen atom, an alkyl group having 1 to 4 carbon atoms, an aryl group, a halogen atom, an amino group, a nitro group, an alkoxycarbonyl group, a substituted or non-substituted carboxyl group or salt thereof, or a sulfonic group or salt thereof;

and wherein methyl ethyl ketone is used as an application solvent, and a residual amount of the methyl ethyl ketone is 0.1 to 150 mg/m$^2$.

10. The photothermographic material according to claim 1, further comprising a compound represented by formula (PR):

formula (PR)

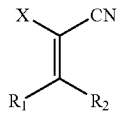

wherein $R_1$ represents a hydroxyl group or a metal salt of a hydroxyl group; $R_2$ represents an alkyl group or an aryl group; and X represents an electron withdrawing group, or $R_1$ and X together form a ring containing an electron withdrawing group.

11. The photothermographic material according to claim 1, further comprising at least one compound selected from the group consisting of compounds 1 to 5:

(1) a compound that can be one-electron-oxidized to provide a one-electron oxidation product which further releases at least two electrons, due to when subjected to a subsequent bond cleavage reaction;

(2) a compound that has at least 2 groups adsorbable to the silver halide and can be one-electron-oxidized to provide a one-electron oxidation product which further releases one electron, due to when subjected to a subsequent bond cleavage reaction;

(3) a compound that can be one-electron-oxidized to provide a one-electron oxidation product, which further releases at least one electron after being subjected to a subsequent bond formation;

(4) a compound that can be one-electron-oxidized to provide a one-electron oxidation product which further releases at least one electron after a subsequent ring cleavage reaction in the molecule; and (5) a compound represented by X—Y, in which X represents a reducing group and Y represents a leaving group, and convertable by one-electron-oxidizing the reducing group to a one-electron oxidation product which can be converted into an X radical by eliminating the leaving group in a subsequent X—Y bond cleavage reaction, one electron being released from the X radical.

* * * * *